US007315703B2

(12) United States Patent
Aruga

(10) Patent No.: US 7,315,703 B2
(45) Date of Patent: Jan. 1, 2008

(54) IMAGE FORMING APPARATUS, IMAGE FORMING SYSTEM, AND IMAGE FORMING METHOD

(75) Inventor: Tomohiro Aruga, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 173 days.

(21) Appl. No.: 11/200,541

(22) Filed: Aug. 8, 2005

(65) Prior Publication Data

US 2006/0029409 A1 Feb. 9, 2006

(30) Foreign Application Priority Data

Aug. 9, 2004 (JP) ..... 2004-232462
Aug. 9, 2004 (JP) ..... 2004-232463
Aug. 9, 2004 (JP) ..... 2004-232464
Aug. 9, 2004 (JP) ..... 2004-232465

(51) Int. Cl.
*G03G 15/06* (2006.01)

(52) U.S. Cl. ..... 399/55; 399/399; 399/270; 399/285; 430/120.1

(58) Field of Classification Search ..... 399/55, 399/53, 49, 285, 270; 358/406, 504; 347/19; 430/120, 120.1
See application file for complete search history.

(56) References Cited

U.S. PATENT DOCUMENTS 6,167,212 A * 12/2000 Satoh et al. ..... 399/55
6,304,738 B1 * 10/2001 Kobayashi et al. ..... 399/270 X
6,393,242 B2 * 5/2002 Miyashita et al. ..... 399/276
6,829,447 B2 * 12/2004 Okano ..... 399/55
6,947,676 B2 * 9/2005 Hayakawa ..... 399/53 X
2002/0009304 A1 * 1/2002 Kin et al. ..... 399/55
2003/0081960 A1 * 5/2003 Osawa et al. ..... 399/55
2003/0161666 A1 * 8/2003 Nishizawa et al. ..... 399/270
2004/0005160 A1 * 1/2004 Kawamura et al. ..... 399/55
2004/0189556 A1 * 9/2004 Tsujino et al. ..... 345/82
2006/0165426 A1 * 7/2006 Shimura et al. ..... 399/49

FOREIGN PATENT DOCUMENTS

JP 05-040392 2/1993
JP 05-072880 3/1993
JP 05-158316 6/1993
JP 05-333685 12/1993
JP 08-137222 5/1996
JP 08-190258 7/1996
JP 2801198 7/1998
JP 10-268635 A * 10/1998
JP 11-084833 3/1999
JP 2000-098710 4/2000
JP 2000-122398 4/2000
JP 2000-338770 12/2000
JP 2001-117425 4/2001
JP 2001-117468 4/2001
JP 2002-091098 3/2002
JP 2002-182457 6/2002
JP 2003-186354 7/2003

* cited by examiner

*Primary Examiner*—Sophia S. Chen
(74) *Attorney, Agent, or Firm*—Hogan & Hartson LLP

(57) ABSTRACT

An image forming apparatus includes an image bearing body and a developer bearing body. A transferring section transfers, onto a medium, a developer image formed on the image bearing body by development of the latent image. A voltage applying section alternately applies, to the developer bearing body, a first voltage for making the developer move from the developer bearing body toward the image bearing body in order to develop the latent image, and a second voltage for making the developer move from the image bearing body toward the developer bearing body. An image darkness adjusting section adjusts a darkness of the image to be formed on the medium by changing only the second voltage.

11 Claims, 63 Drawing Sheets

| total dot-count number / total drive time (S) | 0～30000 | 30001～60000 | 60001～90000 |
|---|---|---|---|
| 0～3000 | (initial) Vmax=-1250(V) | (mid-stage) Vmax=-1300(V) | (terminal) Vmax=-1350(V) |
| 3001～6000 | (mid-stage) Vmax=-1300(V) | (mid-stage) Vmax=-1350(V) | (terminal) Vmax=-1350(V) |
| 6001～9000 | (terminal) Vmax=-1350(V) | (terminal) Vmax=-1350(V) | (terminal) Vmax=-1350(V) |

Fig. 10

| size of development gap (μm) | Vmax | Vo | Vg |
|---|---|---|---|
| 116～130 | −1250(V) | −530(V) | −550(V) |
| 131～145 | −1300(V) | −580(V) | −600(V) |
| 146～160 | −1350(V) | −630(V) | −650(V) |

Fig. 31

| fogging darkness | Vmax |
|---|---|
| 0. 00~0. 05 | −1350(V) |
| 0. 06~0. 10 | −1300(V) |
| 0. 11~0. 15 | −1250(V) |

Fig. 44

| protrusion amount of restriction blade (mm) / surface roughness Rz of developing roller (μm) | 1.1 | 1.0 | 0.9 |
|---|---|---|---|
| 5.5 | Vmax=-1250(V) | Vmax=-1250(V) | Vmax=-1300(V) |
| 5.0 | Vmax=-1250(V) | Vmax=-1300(V) | Vmax=-1350(V) |
| 4.5 | Vmax=-1300(V) | Vmax=-1350(V) | Vmax=-1350(V) |

Fig. 59

IMAGE FORMING APPARATUS, IMAGE FORMING SYSTEM, AND IMAGE FORMING METHOD

CROSS-REFERENCE TO RELATED APPLICATIONS

The present application claims priority upon Japanese Patent Application No. 2004-232462 filed on Aug. 9, 2004, Japanese Patent Application No. 2004-232463 filed on Aug. 9, 2004, Japanese Patent Application No. 2004-232464 filed on Aug. 9, 2004, and Japanese Patent Application No. 2004-232465 filed on Aug. 9, 2004, which are herein incorporated by reference.

BACKGROUND OF THE INVENTION

1. Field of the Invention

The present invention relates to image forming apparatuses, image forming system, and image forming methods.

2. Description of the Related Art

Printers including, for example, an image bearing body for bearing a latent image, a developer bearing body that bears a developer and that is for developing the latent image borne on the image bearing body with the developer, and a transferring section that transfers, onto a medium to form an image thereon, a developer image formed on the image bearing body by the development of the latent image, are known as one type of image forming apparatus. Such a printer also has a voltage applying section that alternately applies, to the developer bearing body, a first voltage for making the developer move from the developer bearing body toward the image bearing body in order to develop the latent image, and a second voltage for making the developer move from the image bearing body toward the developer bearing body. It should be noted that developers having different charge amounts are borne on the developer bearing body by means of, for example, image force. (See, for example, JP 2002-182457A.)

(1) Further, the printer of the above-mentioned type has an image darkness adjusting section for adjusting the darkness of an image to be formed on the medium. The image darkness adjusting section of the conventional type adjusts the darkness of an image to be formed on a medium by changing the first voltage (also referred to as "Vmax") and the second voltage (also referred to as "Vmin"). In doing so, there are cases in which the absolute value of the first voltage becomes small.

If the absolute value of the first voltage is too small, then the force for making the developer move from the developer bearing body toward the image bearing body would be insufficient, and thus, it may not be possible to move some of the highly-charged developer from the developer bearing body toward the image bearing body (this is a phenomenon called "selective development"). Furthermore, in such a case, the highly-charged developer, which has not moved toward the image bearing body, remains borne on the developer bearing body; thus, it becomes difficult for the developer bearing body to bear some new developer.

(2) Further, in the printer of the above-mentioned type, the developer bearing body is arranged in opposition to the image bearing body with a gap therebetween, and the printer further includes an image darkness adjusting section for adjusting the darkness of an image to be formed on the medium. In consideration of preventing the above-mentioned phenomenon (the so-called "selective development") in which a portion of the developer borne on the developer bearing body does not move toward the image bearing body, it is effective to adjust the darkness of an image by fixing the first voltage ("Vmax") at a large absolute value, and changing only the second voltage ("Vmin").

However, if the darkness of an image is to be adjusted simply by changing only the second voltage, then the second voltage could take a wide variety of values. If the absolute value of the second voltage is too large, then the difference between the electric potential of the developer bearing body caused by the second voltage and the electric potential of the image bearing body will be too large, which may give rise to electric discharge. On the other hand, if the absolute value of the first voltage is too large, then the difference between the electric potential of the developer bearing body caused by the first voltage and the electric potential of the image bearing body will be too large, which may also give rise to electric discharge.

(3) Further, as described above, the printer of the above-mentioned type has an image darkness adjusting section for adjusting the darkness of an image to be formed on the medium. In consideration of preventing the above-mentioned phenomenon (the so-called "selective development") in which a portion of the developer borne on the developer bearing body does not move toward the image bearing body, it is effective to set the absolute value of the first voltage to a large value.

However, if the absolute value of the first voltage is too large, then the amount of developer that flies from the developer bearing body toward the image bearing body will increase. This increase may give rise to an increase in fogging or scattering of developer.

(4) Further, in the printer of the above-mentioned type, the developer bearing body bears the developer, carries the developer to a position that is in opposition to the image bearing body, and develops the latent image borne on the image bearing body with the developer that has been carried up to that position, and the printer further includes an image darkness adjusting section for adjusting the darkness of an image to be formed on the medium. In consideration of preventing the above-mentioned phenomenon (the so-called "selective development") in which a portion of the developer borne on the developer bearing body does not move toward the image bearing body, it is effective to adjust the darkness of an image by changing only the second voltage ("Vmin"), among the first voltage ("Vmax") and the second voltage.

However, if the darkness of an image is to be adjusted simply by changing only the second voltage, then the second voltage could take a wide variety of values; in that case, depending on the value of the second voltage, darkness non-uniformities may appear in the image. On the other hand, if the absolute value of the first voltage is too large, then this may give rise to an increase in fogging or scattering of developer.

SUMMARY OF THE INVENTION

The present invention has been made in view of the above and other issues.

(1) An object of the present invention is to prevent so-called selective development from occurring.

(2) Another object of the present invention is to prevent selective development from occurring, as well as suppress occurrence of electric discharge between a developer bearing body and an image bearing body.

(3) Another object of the present invention is to prevent selective development from occurring, as well as prevent an increase in fogging or scattering of developer.

(4) Another object of the present invention is to prevent darkness non-uniformities in an image, as well as prevent an increase in fogging or scattering of developer.

(1) An aspect of the present invention is an image forming apparatus comprising: an image bearing body for bearing a latent image; a developer bearing body that bears a developer and that is for developing the latent image borne on the image bearing body with the developer; a transferring section that transfers, onto a medium, a developer image formed on the image bearing body by the development of the latent image, to form an image; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; and an image darkness adjusting section for adjusting a darkness of the image to be formed on the medium by changing only the second voltage, among the first voltage and the second voltage.

(2) Another aspect of the present invention is an image forming apparatus comprising: an image bearing body for bearing a latent image; a developer bearing body that is arranged in opposition to the image bearing body with a gap therebetween, that bears a developer, and that is for developing the latent image borne on the image bearing body with the developer; a transferring section that transfers, onto a medium, a developer image formed on the image bearing body by the development of the latent image, to form an image; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; a first voltage setting section for setting the first voltage in accordance with information about a size of the gap; and an image darkness adjusting section for adjusting a darkness of the image to be formed on the medium by maintaining the first voltage that has been set by the first voltage setting section, and changing the second voltage.

Another aspect of the present invention is an image forming apparatus comprising: an image bearing body for bearing a latent image; a charging section for charging the image bearing body; a latent image forming section for forming the latent image on the image bearing body that has been charged by the charging section; a developer bearing body that is arranged in opposition to the image bearing body with a gap therebetween, that bears a developer, and that is for developing, with the developer, the latent image that has been formed on the image bearing body by the latent image forming section; a transferring section that transfers, onto a medium, a developer image formed on the image bearing body by the development of the latent image, to form an image; a charge voltage applying section that applies a charge voltage to the charging section for charging the image bearing body; a charge voltage setting section for setting the charge voltage in accordance with information about a size of the gap; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; and an image darkness adjusting section for adjusting a darkness of the image to be formed on the medium by changing only the second voltage, among the first voltage and the second voltage.

(3) Another aspect of the present invention is an image forming apparatus comprising: an image bearing body for bearing a latent image; a developer bearing body that bears a developer and that is for developing the latent image borne on the image bearing body with the developer; a transferring section that transfers, onto a medium, a developer image formed on the image bearing body by the development of the latent image, to form an image; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; a first voltage setting section for setting the first voltage in accordance with developer information which is information about the developer; and an image darkness adjusting section for adjusting a darkness of the image to be formed on the medium by maintaining the first voltage that has been set by the first voltage setting section, and changing the second voltage.

(4) Another aspect of the present invention is an image forming apparatus comprising: an image bearing body for bearing a latent image; a developer bearing body that bears a developer, that carries the developer to a position that is in opposition to the image bearing body, and that is for developing the latent image borne on the image bearing body with the developer that has been carried up to that position; a transferring section that transfers, onto a medium, a developer image formed on the image bearing body by the development of the latent image, to form an image; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; a first voltage setting section for setting the first voltage in accordance with carry-amount information which is information about a carry amount of the developer carried by the developer bearing body; and an image darkness adjusting section for adjusting a darkness of the image to be formed on the medium by maintaining the first voltage that has been set by the first voltage setting section, and changing the second voltage.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 10 is a diagram showing a Vmax setting table according to the first embodiment;

FIG. 31 is a diagram showing the Vmax-Vg setting table according to the second embodiment;

FIG. 44 is a diagram showing the Vmax setting table according to the third embodiment;

FIG. 59 is a diagram showing the Vmax setting table according to the fourth embodiment;

DETAILED DESCRIPTION OF THE INVENTION

Figure 1:
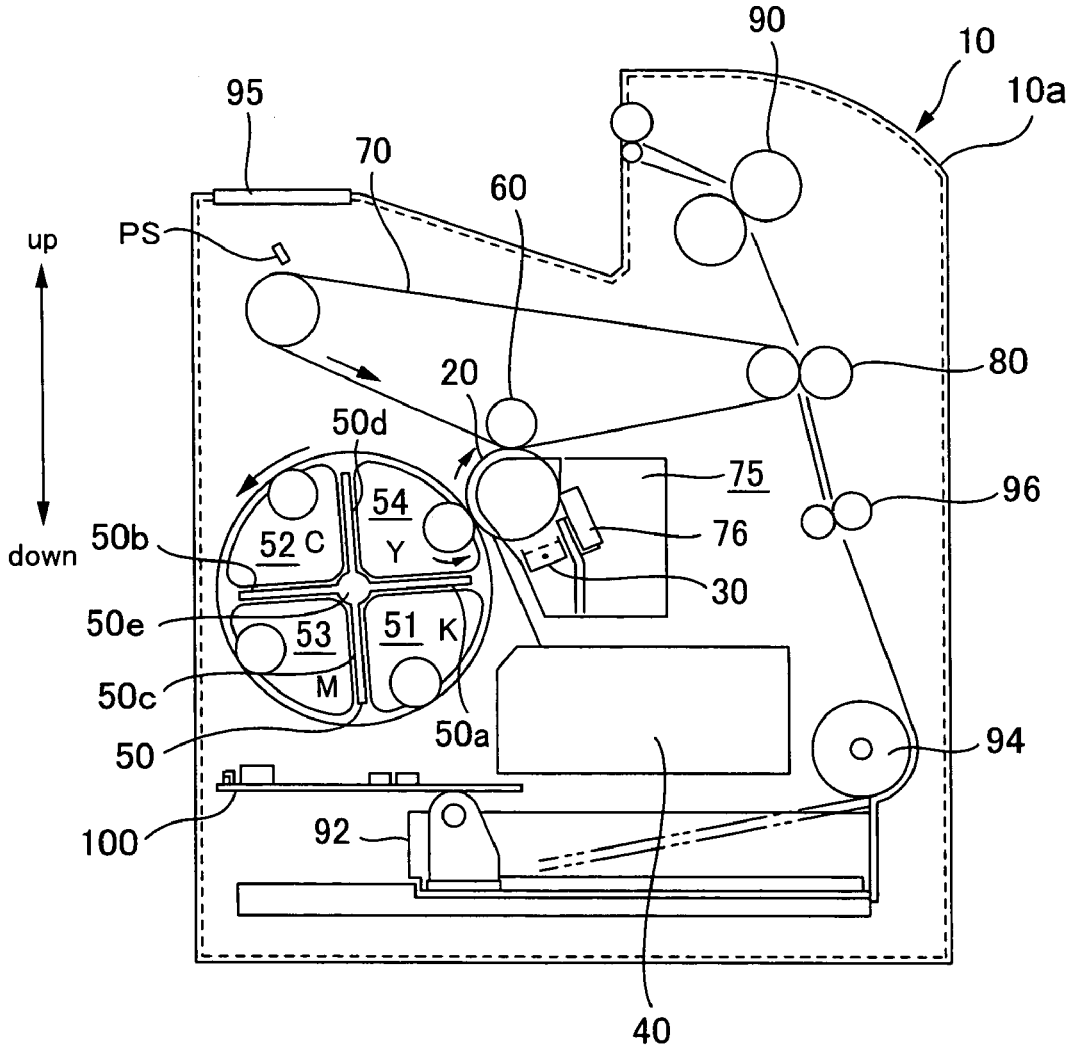
FIG. 1 is a diagram showing main structural components constructing a printer 10.

At least the following matters will be made clear by the description below with reference to the accompanying drawings.

(1) An image forming apparatus comprises: an image bearing body for bearing a latent image; a developer bearing body that bears a developer and that is for developing the latent image borne on the image bearing body with the developer; a transferring section that transfers, onto a medium, a developer image formed on the image bearing body by the development of the latent image, to form an image; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; and an image darkness adjusting section for adjusting a darkness of the image to be formed on the medium by changing only the second voltage, among the first voltage and the second voltage.

With this image forming apparatus, it is possible to make the highly-charged developer move toward the image bearing body appropriately by fixing the absolute value of the first voltage at a high value, and therefore, it becomes possible to prevent so-called selective development from occurring.

In the above-mentioned image forming apparatus, the image forming apparatus may further comprise a developing device that is provided with the developer bearing body and that is for containing the developer to be borne by the developer bearing body, and a first voltage setting section for setting the first voltage in accordance with an amount of usage of the developing device; and the image darkness adjusting section may adjust the darkness of the image to be formed on the medium by maintaining the first voltage that has been set by the first voltage setting section, and changing the second voltage.

If an excessive amount of developer adheres to the image bearing body, then there is a possibility that the quality of images, such as narrow lines, may deteriorate. On the other hand, the amount of developer that adheres to the image bearing body is larger the smaller the amount of usage of the developing device is. Therefore, in a case where the first voltage setting section sets the first voltage in accordance with the amount of usage of the developing device, it is possible to prevent the amount of developer adhering to the image bearing body from becoming excessive by making the absolute value of the first voltage larger in a stepwise manner according to the amount of usage of the developing device. Therefore, it becomes possible to prevent selective development and also prevent deterioration in the quality of images, such as narrow lines.

In the above-mentioned image forming apparatus, the amount of usage of the developing device may be a time for which the developer bearing body in the developing device has been driven.

The developer bearing body is driven when the developing device is used. Therefore, it becomes possible to get hold of the amount of usage of the developing device accurately by adopting the drive time of the developer bearing body (i.e., the time for which the developer bearing body has been driven) as the amount of usage of the developing device.

In the above-mentioned image forming apparatus, the amount of usage of the developing device may be a consumption amount of the developer contained in the developing device.

The developer is consumed when the developing device is used. Therefore, it becomes possible to get hold of the amount of usage of the developing device more accurately by adopting the consumption amount of developer as the amount of usage of the developing device.

In the above-mentioned image forming apparatus, the transferring section may include a transferring medium member through which the developer image formed on the image bearing body is transferred onto the medium; the transferring section may transfer the developer image formed on the image bearing body onto the transferring medium member, and transfer the developer image transferred on the transferring medium member onto the medium, to form the image; the image forming apparatus may further comprise a darkness detection member that detects a darkness of a test pattern formed on the transferring medium member for adjustment of the darkness of the image to be formed on the medium; and the image darkness adjusting section may change the second voltage based on a result of detection of the darkness of the test pattern by the darkness detection member.

In this way, it becomes possible to adjust the image darkness in a simple manner.

In the above-mentioned image forming apparatus, the developer bearing body may be made of metal.

In such a structure, the image force between the developer and the developer bearing body is strong. Therefore, selective development is likely to occur in cases where the absolute value of the first voltage is small. Therefore, the effect that it is possible to prevent selective development is attained more effectively in cases where the developer bearing body is made of metal.

In the above-mentioned image forming apparatus, the developer may be manufactured using a grinding method.

A developer made through the grinding method has a wide charge distribution, and thus, selective development is likely to occur. Therefore, the effect that it is possible to prevent selective development is attained more effectively in cases where the developer is manufactured through the grinding method.

In the above-mentioned image forming apparatus, the developer borne by the developer bearing body does not have to be in contact with the image bearing body before the voltage applying section applies the first voltage and the second voltage to the developer bearing body; when the voltage applying section applies the first voltage to the developer bearing body, the developer borne on the developer bearing body may fly toward the image bearing body and adhere thereto; and when the voltage applying section applies the second voltage to the developer bearing body, the developer adhering to the image bearing body may fly toward the developer bearing body and return thereto.

In the above-mentioned image forming apparatus, the developing device may be provided with a developing-device storage section in which information about the amount of usage of the developing device is stored; and the first voltage setting section may set the first voltage based on the information about the amount of usage of the developing device that has been read out from the developing-device storage section.

Further, an image forming apparatus may comprise: an image bearing body for bearing a latent image; a developer bearing body that bears a developer and that is for developing the latent image borne on the image bearing body with the developer; a transferring section that transfers, onto a medium, a developer image formed on the image bearing body by the development of the latent image, to form an image; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; an image darkness adjusting section for adjusting a darkness of the image to be formed on the medium by changing only the second voltage, among the first voltage and the second voltage; a developing device that is provided with the developer bearing body and that is for containing the developer to be borne by the developer bearing body; and a first voltage setting section for setting the first voltage in accordance with an amount of usage of the developing device; wherein: the image darkness adjusting section adjusts the darkness of the image to be formed on the medium by maintaining the first voltage that has been set by the first voltage setting section, and changing the second voltage; the amount of usage of the developing device is a time for which the developer bearing body in the developing device has been driven; the amount of usage of the developing device is a consumption amount of the developer contained in the developing device; the transferring section includes a transferring medium member through which the developer image formed on the image bearing body is transferred onto the medium; the transferring section transfers the developer image formed on the image bearing body onto the transferring medium member, and transfers the developer image transferred on the transferring medium member onto the medium, to form the image; the image forming apparatus further comprises a darkness detection member that detects a darkness of a test pattern formed on the transferring medium member for adjustment of the darkness of the image to be formed on the medium; the image darkness adjusting section changes the second voltage based on a result of detection of the darkness of the test pattern by the darkness detection member; the developer bearing body is made of metal; the developer is manufactured using a grinding method; the developer borne by the developer bearing body is not in contact with the image bearing body before the voltage applying section applies the first voltage and the second voltage to the developer bearing body; when the voltage applying section applies the first voltage to the developer bearing body, the developer borne on the developer bearing body flies toward the image bearing body and adheres thereto; when the voltage applying section applies the second voltage to the developer bearing body, the developer adhering to the image bearing body flies toward the developer bearing body and returns thereto; the developing device is provided with a developing-device storage section in which information about the amount of usage of the developing device is stored; and the first voltage setting section sets the first voltage based on the information about the amount of usage of the developing device that has been read out from the developing-device storage section.

With this image forming apparatus, the effect that it becomes possible to prevent selective development from occurring is achieved most effectively.

It is also possible to achieve an image forming system comprising: a computer; and an image forming apparatus that is connectable to the computer and that includes: an image bearing body for bearing a latent image; a developer bearing body that bears a developer and that is for developing the latent image borne on the image bearing body with the developer; a transferring section that transfers, onto a medium, a developer image formed on the image bearing body by the development of the latent image, to form an image; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; and an image darkness adjusting section for adjusting a darkness of the image to be formed on the medium by changing only the second voltage, among the first voltage and the second voltage.

Since this image forming system includes an image forming apparatus with which selective development can be prevented, it is possible to achieve an image forming system that is superior to conventional systems.

It is also possible to achieve an image forming method comprising the steps of: among a first voltage for making a developer move from a developer bearing body that bears the developer toward an image bearing body that bears a latent image, and a second voltage for making the developer move from the image bearing body toward the developer bearing body, changing only the second voltage in order to adjust a darkness of an image to be formed on a medium; developing the latent image by alternately applying, to the developer bearing body, the first voltage and the second voltage that has been changed; and forming an image by transferring, onto the medium, a developer image formed on the image bearing body by the development of the latent image.

With this image forming method, it becomes possible to prevent selective development from occurring.

(2-1) In the above-mentioned image forming apparatus, the developer bearing body may be arranged in opposition to the image bearing body with a gap therebetween; the image forming apparatus may further comprise a first voltage setting section for setting the first voltage in accordance with information about a size of the gap; and the image darkness adjusting section may adjust the darkness of the image to be formed on the medium by maintaining the first voltage that has been set by the first voltage setting section, and changing the second voltage.

That is, another aspect of an image forming apparatus comprises: an image bearing body for bearing a latent image; a developer bearing body that is arranged in opposition to the image bearing body with a gap therebetween, that bears a developer, and that is for developing the latent image borne on the image bearing body with the developer; a transferring section that transfers, onto a medium, a developer image formed on the image bearing body by the development of the latent image, to form an image; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; a first voltage setting section for setting the first voltage in accordance with information about a size of the gap; and an image darkness adjusting section for adjusting a darkness of the image to be formed on the medium by maintaining the first voltage that has been set by the first voltage setting section, and changing the second voltage.

With this image forming apparatus, it is possible to set a first voltage by which electric discharge is less prone to occur, based on the gap information. Therefore, it becomes possible to prevent selective development from occurring, as well as suppress occurrence of electric discharge between the developer bearing body and the image bearing body.

In the above-mentioned image forming apparatus, the image forming apparatus may further comprise a space keeping member that is arranged at both ends of the developer bearing body in a longitudinal direction thereof and that is for keeping a space between the image bearing body and the developer bearing body by abutting against the image bearing body, such that the developer bearing body is arranged in opposition to the image bearing body with the gap therebetween.

By keeping a space between the image bearing body and the developer bearing body using a space keeping member, it is possible to adjust the size of the gap with high precision. With such a structure, it is possible to set an appropriate first voltage, and thus, it becomes possible to effectively suppress the occurrence of electric discharge between the developer bearing body and the image bearing body.

In the above-mentioned image forming apparatus, the developer bearing body may be supported at both ends in the longitudinal direction thereof; the image forming apparatus may further comprise a pressing member that abuts against the developer bearing body along the longitudinal direction thereof and that presses the developer bearing body toward the image bearing body; and the information about the size of the gap may be information about a size of the gap at a central section in the longitudinal direction of the developer bearing body.

In a structure where the developer bearing body is supported at both ends in the longitudinal direction thereof and the pressing member presses the developer bearing body toward the image bearing body, the size of the gap at the central section in the longitudinal direction of the developer bearing body is smaller than the size of the gap at the ends in the longitudinal direction. Therefore, electric discharge tends to occur at the central section in the longitudinal direction. By setting the first voltage with the first voltage setting section based on the information about the size of the gap at the central section in the longitudinal direction of the developer bearing body, it becomes possible to suppress the occurrence of electric discharge between the developer bearing body and the image bearing body more effectively.

In the above-mentioned image forming apparatus, the information about the size of the gap may be information about a size of the space keeping member.

Depending on the structure of the image forming apparatus, there may be cases where it is not possible to measure the gap between the image bearing body and the developer bearing body. On the other hand, the size of the gap is dependent on the size of the space keeping member. Therefore, by adopting the information about the size of the space keeping member as the information about the size of the gap, it becomes possible to set the first voltage easily.

In the above-mentioned image forming apparatus, the image forming apparatus may further comprise a developing device that is attachable to and detachable from the image forming apparatus, that is provided with the developer bearing body, and that is for containing the developer to be borne by the developer bearing body; the developing device may be provided with a developing-device storage section in which the information about the size of the gap is stored; and the first voltage setting section may set the first voltage based on the information about the size of the gap that has been read out from the developing-device storage section.

In the above-mentioned image forming apparatus, the transferring section may include a transferring medium member through which the developer image formed on the image bearing body is transferred onto the medium; the transferring section may transfer the developer image formed on the image bearing body onto the transferring medium member, and transfer the developer image transferred on the transferring medium member onto the medium, to form the image; the image forming apparatus may further comprise a darkness detection member that detects a darkness of a test pattern formed on the transferring medium member for adjustment of the darkness of the image to be formed on the medium; and the image darkness adjusting section may change the second voltage based on a result of detection of the darkness of the test pattern by the darkness detection member.

In this way, it becomes possible to adjust the image darkness in a simple manner.

In the above-mentioned image forming apparatus, the developer bearing body may be made of metal.

In cases where the developer bearing body is made of metal, the image force between the developer and the developer bearing body is strong. Therefore, selective development is likely to occur. Therefore, in cases where the developer bearing body is made of metal, it is likely that the first voltage will be set to a large value from the viewpoint of preventing selective development. As a result, electric discharge is prone to occur. Therefore, the effect that it is possible to prevent selective development and suppress the occurrence of electric discharge between the developer bearing body and the image bearing body, is attained more effectively in cases where the developer bearing body is made of metal.

In the above-mentioned image forming apparatus, the developer may be manufactured using a grinding method.

In cases where the developer is made through the grinding method, the charge distribution of the developer becomes wide, and thus, selective development is likely to occur. Therefore, in cases where the developer is made through the grinding method, it is likely that the first voltage will be set to a large value from the viewpoint of preventing selective development. As a result, electric discharge is prone to occur. Therefore, the effect that it is possible to prevent selective development and suppress the occurrence of electric discharge between the developer bearing body and the image bearing body, is attained more effectively in cases where the developer is made through the grinding method.

In the above-mentioned image forming apparatus, the developer borne by the developer bearing body does not have to be in contact with the image bearing body before the voltage applying section applies the first voltage and the second voltage to the developer bearing body; when the voltage applying section applies the first voltage to the developer bearing body, the developer borne on the developer bearing body may fly toward the image bearing body and adhere thereto; and when the voltage applying section applies the second voltage to the developer bearing body, the developer adhering to the image bearing body may fly toward the developer bearing body and return thereto.

Further, an image forming apparatus may comprise: an image bearing body for bearing a latent image; a developer bearing body that is arranged in opposition to the image bearing body with a gap therebetween, that bears a developer, and that is for developing the latent image borne on the image bearing body with the developer; a transferring section that transfers, onto a medium, a developer image formed on the image bearing body by the development of the latent image, to form an image; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; a first voltage setting section for setting the first voltage in accordance with information about a size of the gap; an image darkness adjusting section for adjusting a darkness of the image to be formed on the medium by maintaining the first voltage that has been set by the first voltage setting section, and changing the second voltage; and a space keeping member that is arranged at both ends of the developer bearing body in a longitudinal direction thereof and that is for keeping a space between the image bearing body and the developer bearing body by abutting against the image bearing body, such that the developer bearing body is arranged in opposition to the image bearing body with the gap therebetween; wherein: the developer bearing body is supported at both ends in the longitudinal direction thereof; the image forming apparatus further comprises a pressing member that abuts against the developer bearing body along the longitudinal direction thereof and that presses the developer bearing body toward the image bearing body; the information about the size of the gap is information about a size of the gap at a central section in the longitudinal direction of the developer bearing body; the image forming apparatus further comprises a developing device that is attachable to and detachable from the image forming apparatus, that is provided with the developer bearing body, and that is for containing the developer to be borne by the developer bearing body; the developing device is provided with a developing-device storage section in which the information about the size of the gap is stored; the first voltage setting section sets the first voltage based on the information about the size of the gap that has been read out from the developing-device storage section; the transferring section includes a transferring medium member through which the developer image formed on the image bearing body is transferred onto the medium; the transferring section transfers the developer image formed on the image bearing body onto the transferring medium member, and transfers the developer image transferred on the transferring medium member onto the medium, to form the image; the image forming apparatus further comprises a darkness detection member that detects a darkness of a test pattern formed on the transferring medium member for adjustment of the darkness of the image to be formed on the medium; the image darkness adjusting section changes the second voltage based on a result of detection of the darkness of the test pattern by the darkness detection member; the developer bearing body is made of metal; the developer is manufactured using a grinding method; the developer borne by the developer bearing body is not in contact with the image bearing body before the voltage applying section applies the first voltage and the second voltage to the developer bearing body; when the voltage applying section applies the first voltage to the developer bearing body, the developer borne on the developer bearing body flies toward the image bearing body and adheres thereto; and when the voltage applying section applies the second voltage to the developer bearing body, the developer adhering to the image bearing body flies toward the developer bearing body and returns thereto.

With this image forming apparatus, the effect that it becomes possible to prevent selective development from occurring and suppress the occurrence of electric discharge between the developer bearing body and the image bearing body, is achieved most effectively.

(2-2) Further, in the above-mentioned image forming apparatus, the image forming apparatus may further comprise a charging section for charging the image bearing body, and a latent image forming section for forming the latent image on the image bearing body that has been charged by the charging section; the developer bearing body may be arranged in opposition to the image bearing body with a gap therebetween, and develops, with the developer, the latent image that has been formed on the image bearing body by the latent image forming section; and the image forming apparatus may further comprise a charge voltage applying section that applies a charge voltage to the charging section for charging the image bearing body, and a charge voltage setting section for setting the charge voltage in accordance with information about a size of the gap.

That is, another aspect of an image forming apparatus comprises: an image bearing body for bearing a latent image; a charging section for charging the image bearing body; a latent image forming section for forming the latent image on the image bearing body that has been charged by the charging section; a developer bearing body that is arranged in opposition to the image bearing body with a gap therebetween, that bears a developer, and that is for developing, with the developer, the latent image that has been formed on the image bearing body by the latent image forming section; a transferring section that transfers, onto a medium, a developer image formed on the image bearing body by the development of the latent image, to form an image; a charge voltage applying section that applies a charge voltage to the charging section for charging the image bearing body; a charge voltage setting section for setting the charge voltage in accordance with information about a size of the gap; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; and an image darkness adjusting section for adjusting a darkness of the image to be formed on the medium by changing only the second voltage, among the first voltage and the second voltage.

With this image forming apparatus, it is possible to set a charge voltage by which electric discharge is less prone to occur, based on the gap information. Therefore, it becomes possible to prevent selective development from occurring, as well as suppress occurrence of electric discharge between the developer bearing body and the image bearing body.

In the above-mentioned image forming apparatus, the image forming apparatus may further comprise a space keeping member that is arranged at both ends of the developer bearing body in a longitudinal direction thereof and that is for keeping a space between the image bearing body and the developer bearing body by abutting against the image bearing body, such that the developer bearing body is arranged in opposition to the image bearing body with the gap therebetween.

By keeping a space between the image bearing body and the developer bearing body using a space keeping member, it is possible to adjust the size of the gap with high precision. With such a structure, it is possible to set an appropriate charge voltage, and thus, it becomes possible to effectively suppress the occurrence of electric discharge between the developer bearing body and the image bearing body.

In the above-mentioned image forming apparatus, the developer bearing body may be supported at both ends in the longitudinal direction thereof; the image forming apparatus may further comprise a pressing member that abuts against the developer bearing body along the longitudinal direction thereof and that presses the developer bearing body toward the image bearing body; and the information about the size of the gap may be information about a size of the gap at a central section in the longitudinal direction of the developer bearing body.

In a structure where the developer bearing body is supported at both ends in the longitudinal direction thereof and the pressing member presses the developer bearing body toward the image bearing body, the size of the gap at the central section in the longitudinal direction of the developer bearing body is smaller than the size of the gap at the ends in the longitudinal direction. Therefore, electric discharge tends to occur at the central section in the longitudinal direction. By setting the charge voltage with the charge voltage setting section based on the information about the size of the gap at the central section in the longitudinal direction of the developer bearing body, it becomes possible to suppress the occurrence of electric discharge between the developer bearing body and the image bearing body more effectively.

In the above-mentioned image forming apparatus, the information about the size of the gap may be information about a size of the space keeping member.

Depending on the structure of the image forming apparatus, there may be cases where it is not possible to measure the gap between the image bearing body and the developer bearing body. On the other hand, the size of the gap is dependent on the size of the space keeping member. Therefore, by adopting the information about the size of the space keeping member as the information about the size of the gap, it becomes possible to set the charge voltage easily.

In the above-mentioned image forming apparatus, the image forming apparatus may further comprise a developing device that is attachable to and detachable from the image forming apparatus, that is provided with the developer bearing body, and that is for containing the developer to be borne by the developer bearing body; the developing device may be provided with a developing-device storage section in which the information about the size of the gap is stored; and the charge voltage setting section may set the charge voltage based on the information about the size of the gap that has been read out from the developing-device storage section.

In the above-mentioned image forming apparatus, the image forming apparatus may further comprise a first voltage setting section for setting the first voltage in accordance with the information about the size of the gap; and the image darkness adjusting section may adjust the darkness of the image to be formed on the medium by maintaining the first voltage that has been set by the first voltage setting section, and changing the second voltage.

In this way, the first voltage is set appropriately, and therefore, it becomes possible to effectively prevent selective development from occurring, as well as effectively suppress occurrence of electric discharge between the developer bearing body and the image bearing body.

In the above-mentioned image forming apparatus, the transferring section may include a transferring medium member through which the developer image formed on the image bearing body is transferred onto the medium; the transferring section may transfer the developer image formed on the image bearing body onto the transferring medium member, and transfer the developer image transferred on the transferring medium member onto the medium, to form the image; the image forming apparatus may further comprise a darkness detection member that detects a darkness of a test pattern formed on the transferring medium member for adjustment of the darkness of the image to be formed on the medium; and the image darkness adjusting section may change the second voltage based on a result of detection of the darkness of the test pattern by the darkness detection member.

In this way, it becomes possible to adjust the image darkness in a simple manner.

In the above-mentioned image forming apparatus, the developer bearing body may be made of metal.

In cases where the developer bearing body is made of metal, the image force between the developer and the developer bearing body is strong. Therefore, selective development is likely to occur. Therefore, in cases where the developer bearing body is made of metal, it is likely that the second voltage will be set to a small value from the viewpoint of preventing selective development. As a result, electric discharge is prone to occur. Therefore, the effect that it is possible to prevent selective development and suppress the occurrence of electric discharge between the developer bearing body and the image bearing body, is attained more effectively in cases where the developer bearing body is made of metal.

In the above-mentioned image forming apparatus, the developer may be manufactured using a grinding method.

In cases where the developer is made through the grinding method, the charge distribution of the developer becomes wide, and thus, selective development is likely to occur. Therefore, in cases where the developer is made through the grinding method, it is likely that the second voltage will be set to a small value from the viewpoint of preventing selective development. As a result, electric discharge is prone to occur. Therefore, the effect that it is possible to prevent selective development and suppress the occurrence of electric discharge between the developer bearing body and the image bearing body, is attained more effectively in cases where the developer is made through the grinding method.

In the above-mentioned image forming apparatus, the developer borne by the developer bearing body does not have to be in contact with the image bearing body before the voltage applying section applies the first voltage and the second voltage to the developer bearing body; when the voltage applying section applies the first voltage to the developer bearing body, the developer borne on the developer bearing body may fly toward the image bearing body and adhere thereto; and when the voltage applying section applies the second voltage to the developer bearing body, the developer adhering to the image bearing body may fly toward the developer bearing body and return thereto.

Further, an image forming apparatus may comprise: an image bearing body for bearing a latent image; a charging section for charging the image bearing body; a latent image forming section for forming the latent image on the image bearing body that has been charged by the charging section; a developer bearing body that is arranged in opposition to the image bearing body with a gap therebetween, that bears a developer, and that is for developing, with the developer, the latent image that has been formed on the image bearing body by the latent image forming section; a transferring section that transfers, onto a medium, a developer image formed on the image bearing body by the development of the latent image, to form an image; a charge voltage applying section that applies a charge voltage to the charging section for charging the image bearing body; a charge voltage setting section for setting the charge voltage in accordance with information about a size of the gap; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; an image darkness adjusting section for adjusting a darkness of the image to be formed on the medium by changing only the second voltage, among the first voltage and the second voltage; and a space keeping member that is arranged at both ends of the developer bearing body in a longitudinal direction thereof and that is for keeping a space between the image bearing body and the developer bearing body by abutting against the image bearing body, such that the developer bearing body is arranged in opposition to the image bearing body with the gap therebetween; wherein: the developer bearing body is supported at both ends in the longitudinal direction thereof; the image forming apparatus further comprises a pressing member that abuts against the developer bearing body along the longitudinal direction thereof and that presses the developer bearing body toward the image bearing body; the information about the size of the gap is information about a size of the gap at a central section in the longitudinal direction of the developer bearing body; the image forming apparatus further comprises a developing device that is attachable to and detachable from the image forming apparatus, that is provided with the developer bearing body, and that is for containing the developer to be borne by the developer bearing body; the developing device is provided with a developing-device storage section in which the information about the size of the gap is stored; the charge voltage setting section sets the charge voltage based on the information about the size of the gap that has been read out from the developing-device storage section; the image forming apparatus further comprises a first voltage setting section for setting the first voltage in accordance with the information about the size of the gap; the image darkness adjusting section adjusts the darkness of the image to be formed on the medium by maintaining the first voltage that has been set by the first voltage setting section, and changing the second voltage; the transferring section includes a transferring medium member through which the developer image formed on the image bearing body is transferred onto the medium; the transferring section transfers the developer image formed on the image bearing body onto the transferring medium member, and transfers the developer image transferred on the transferring medium member onto the medium, to form the image; the image forming apparatus further comprises a darkness detection member that detects a darkness of a test pattern formed on the transferring medium member for adjustment of the darkness of the image to be formed on the medium; the image darkness adjusting section changes the second voltage based on a result of detection of the darkness of the test pattern by the darkness detection member; the developer bearing body is made of metal; the developer is manufactured using a grinding method; the developer borne by the developer bearing body is not in contact with the image bearing body before the voltage applying section applies the first voltage and the second voltage to the developer bearing body; when the voltage applying section applies the first voltage to the developer bearing body, the developer borne on the developer bearing body flies toward the image bearing body and adheres thereto; and when the voltage applying section applies the second voltage to the developer bearing body, the developer adhering to the image bearing body flies toward the developer bearing body and returns thereto.

With this image forming apparatus, the effect that it becomes possible to prevent selective development from occurring and suppress the occurrence of electric discharge between the developer bearing body and the image bearing body, is achieved most effectively.

(2-1) It is also possible to achieve an image forming system comprising: a computer; and an image forming apparatus that is connectable to the computer and that includes: an image bearing body for bearing a latent image; a developer bearing body that is arranged in opposition to said image bearing body with a gap therebetween, that bears a developer, and that is for developing the latent image borne on said image bearing body with said developer; a transferring section that transfers, onto a medium, a developer image formed on said image bearing body by the development of said latent image, to form an image; a voltage applying section that alternately applies, to said developer bearing body, a first voltage for making the developer move from said developer bearing body toward said image bearing body in order to develop said latent image, and a second voltage for making the developer move from said image bearing body toward said developer bearing body; a first voltage setting section for setting said first voltage in accordance with information about a size of said gap; and an image darkness adjusting section for adjusting a darkness of the image to be formed on said medium by maintaining said first voltage that has been set by said first voltage setting section, and changing said second voltage.

Since this image forming system includes an image forming apparatus with which selective development can be prevented and the occurrence of electric discharge between the developer bearing body and the image bearing body can be suppressed, it is possible to achieve an image forming system that is superior to conventional systems.

(2-2) It is also possible to achieve an image forming system comprising: a computer; and an image forming apparatus that is connectable to the computer and that includes: an image bearing body for bearing a latent image; a charging section for charging said image bearing body; a latent image forming section for forming the latent image on said image bearing body that has been charged by said charging section; a developer bearing body that is arranged in opposition to said image bearing body with a gap therebetween, that bears a developer, and that is for developing, with said developer, the latent image that has been formed on said image bearing body by said latent image forming section; a transferring section that transfers, onto a medium, a developer image formed on said image bearing body by the development of said latent image, to form an image; a charge voltage applying section that applies a charge voltage to said charging section for charging said image bearing body; a charge voltage setting section for setting said charge voltage in accordance with information about a size of said gap; a voltage applying section that alternately applies, to said developer bearing body, a first voltage for making the developer move from said developer bearing body toward said image bearing body in order to develop said latent image, and a second voltage for making the developer move from said image bearing body toward said developer bearing body; and an image darkness adjusting section for adjusting a darkness of the image to be formed on said medium by changing only said second voltage, among said first voltage and said second voltage.

Since this image forming system includes an image forming apparatus with which selective development can be prevented and the occurrence of electric discharge between the developer bearing body and the image bearing body can be suppressed, it is possible to achieve an image forming system that is superior to conventional systems.

(2-1) It is also possible to achieve an image forming method comprising the steps of: setting, in accordance with information about a size of a gap between a developer bearing body and an image bearing body, a first voltage for making a developer move from the developer bearing body toward the image bearing body that bears a latent image; maintaining the first voltage that has been set, and changing a second voltage for making the developer move from the image bearing body toward the developer bearing body, in order to adjust a darkness of an image to be formed on a medium; developing the latent image by alternately applying, to the developer bearing body, the first voltage that has been maintained and the second voltage that has been changed; and forming an image by transferring, onto the medium, a developer image formed on the image bearing body by the development of the latent image.

With this image forming method, it becomes possible to prevent selective development from occurring and suppress the occurrence of electric discharge between the developer bearing body and the image bearing body.

(2-2) It is also possible to achieve an image forming method comprising the steps of: setting a charge voltage in accordance with information about a size of a gap between a developer bearing body and an image bearing body; applying the charge voltage to a charging section for charging the image bearing body; forming a latent image on the image bearing body that has been charged by the charging section; among a first voltage for making a developer move from the developer bearing body that bears the developer toward the image bearing body that bears a latent image, and a second voltage for making the developer move from the image bearing body toward the developer bearing body, changing only the second voltage in order to adjust a darkness of an image to be formed on a medium; developing the latent image by alternately applying, to the developer bearing body, the first voltage and the second voltage that has been changed; and forming an image by transferring, onto the medium, a developer image formed on the image bearing body by the development of the latent image.

With this image forming method, it becomes possible to prevent selective development from occurring and suppress the occurrence of electric discharge between the developer bearing body and the image bearing body.

(3) In the above-mentioned image forming apparatus, the image forming apparatus may further comprise a first voltage setting section for setting the first voltage in accordance with developer information which is information about the developer; and the image darkness adjusting section may adjust the darkness of the image to be formed on the medium by maintaining the first voltage that has been set by the first voltage setting section, and changing the second voltage.

That is, another aspect of an image forming apparatus comprises: an image bearing body for bearing a latent image; a developer bearing body that bears a developer and that is for developing the latent image borne on the image bearing body with the developer; a transferring section that transfers, onto a medium, a developer image formed on the image bearing body by the development of the latent image, to form an image; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; a first voltage setting section for setting the first voltage in accordance with developer information which is information about the developer; and an image darkness adjusting section for adjusting a darkness of the image to be formed on the medium by maintaining the first voltage that has been set by the first voltage setting section, and changing the second voltage.

With this image forming apparatus, it is possible to set an appropriate first voltage based on the developer information. Therefore, it becomes possible to prevent selective development from occurring, as well as prevent an increase in fogging or scattering of developer.

In the above-mentioned image forming apparatus, the developer information may be particle-size information which is about a particle size of the developer.

In cases where the developer includes developer particles having small particle sizes (referred to also as "small-size developer") and developer particles having large particle sizes (referred to also as "large-size developer") and where the amount of small-size developers is large, there is a tendency that a layer of small-size developers borne on the developer bearing body, which have large charge amounts, will be formed on the inner side, and a layer of large-size developers borne on the developer bearing body, which have small charge amounts, will be formed on the outer side. In such a case, the large-size developers having small charge amounts tend to increase fogging or scattering of developer. By setting the first voltage with the first voltage setting section according to the particle-size information, it becomes possible to set an appropriate first voltage by which it is possible to prevent selective development from occurring, as well as prevent an increase in fogging or scattering of developer.

In the above-mentioned image forming apparatus, the developer may include a core particle and an external additive that is applied on the core particle; and the developer information may be external-additive information which is information about the external additive.

The amount of fogging may differ depending on how the external additive is applied on the core particle. For example, if a plurality of types of external additives are applied to the core particle, then the amount of fogging may differ according to the ratio of the external additives. By setting the first voltage with the first voltage setting section according to the external-additive information, it becomes possible to set an appropriate first voltage by which it is possible to prevent selective development from occurring, as well as prevent an increase in fogging or scattering of developer.

In the above-mentioned image forming apparatus, the transferring section may include a transferring medium member through which the developer image formed on the image bearing body is transferred onto the medium; the transferring section may transfer the developer image formed on the image bearing body onto the transferring medium member, and transfer the developer image transferred on the transferring medium member onto the medium, to form the image; the image forming apparatus may further comprise a darkness detection member that detects a darkness of a test pattern formed on the transferring medium member for adjustment of the darkness of the image to be formed on the medium; and the image darkness adjusting section may change the second voltage based on a result of detection of the darkness of the test pattern by the darkness detection member.

In this way, it becomes possible to adjust the image darkness in a simple manner.

In the above-mentioned image forming apparatus, the image forming apparatus may further comprise a developing device that is attachable to and detachable from the image forming apparatus, that is provided with the developer bearing body, and that is for containing the developer to be borne by the developer bearing body; the developing device may be provided with a developing-device storage section in which the developer information about the developer contained in that developing device is stored; and the first voltage setting section may set the first voltage based on the developer information that has been read out from the developing-device storage section.

In the above-mentioned image forming apparatus, the developer information may be fogging-darkness information which is information about a darkness of fogging; the transferring section may include a transferring medium member through which the developer image formed on the image bearing body is transferred onto the medium; the transferring section may transfer the developer image formed on the image bearing body onto the transferring medium member, and transfer the developer image transferred on the transferring medium member onto the medium, to form the image; the image forming apparatus may further comprise a darkness detection member for detecting a darkness of fogging that has occurred on the transferring medium member; and the fogging-darkness information may be obtained by the darkness detection member detecting the darkness of fogging that has occurred on the transferring medium member.

With such a structure, since the fogging-darkness information is obtained by actually detecting the darkness of fogging right before the developer is used for development, it becomes possible to set a most appropriate first voltage with the first voltage setting section.

In the above-mentioned image forming apparatus, the developer bearing body may be made of metal.

In cases where the developer bearing body is made of metal, the image force between the developer and the developer bearing body is strong. Therefore, selective development is likely to occur. Therefore, in cases where the developer bearing body is made of metal, it is likely that the first voltage will be set to a large value from the viewpoint of preventing selective development. As a result, fogging and developer scattering tend to increase. Therefore, the effect that it is possible to prevent selective development and also prevent an increase in fogging and developer scattering, is attained more effectively in cases where the developer bearing body is made of metal.

In the above-mentioned image forming apparatus, the developer may be manufactured using a grinding method.

In cases where the developer is made through the grinding method, the charge distribution of the developer becomes wide, and thus, selective development is likely to occur. Therefore, in cases where the developer is made through the grinding method, it is likely that the first voltage will be set to a large value from the viewpoint of preventing selective development. As a result, fogging and developer scattering tend to increase. Therefore, the effect that it is possible to prevent selective development and also prevent an increase in fogging and developer scattering, is attained more effectively in cases where the developer is made through the grinding method.

In the above-mentioned image forming apparatus, the developer borne by the developer bearing body does not have to be in contact with the image bearing body before the voltage applying section applies the first voltage and the second voltage to the developer bearing body; when the voltage applying section applies the first voltage to the developer bearing body, the developer borne on the developer bearing body may fly toward the image bearing body and adhere thereto; and when the voltage applying section applies the second voltage to the developer bearing body, the developer adhering to the image bearing body may fly toward the developer bearing body and return thereto.

Further, an image forming apparatus may comprise: an image bearing body for bearing a latent image; a developer bearing body that bears a developer and that is for developing the latent image borne on the image bearing body with the developer; a transferring section that transfers, onto a medium, a developer image formed on the image bearing body by the development of the latent image, to form an image; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; a first voltage setting section for setting the first voltage in accordance with developer information which is information about the developer; and an image darkness adjusting section for adjusting a darkness of the image to be formed on the medium by maintaining the first voltage that has been set by the first voltage setting section, and changing the second voltage; wherein: the developer information is particle-size information which is about a particle size of the developer; the developer includes a core particle and an external additive that is applied on the core particle; the developer information is external-additive information which is information about the external additive; the transferring section includes a transferring medium member through which the developer image formed on the image bearing body is transferred onto the medium; the transferring section transfers the developer image formed on the image bearing body onto the transferring medium member, and transfers the developer image transferred on the transferring medium member onto the medium, to form the image; the image forming apparatus further comprises a darkness detection member that detects a darkness of a test pattern formed on the transferring medium member for adjustment of the darkness of the image to be formed on the medium; the image darkness adjusting section changes the second voltage based on a result of detection of the darkness of the test pattern by the darkness detection member; the image forming apparatus further comprises a developing device that is attachable to and detachable from the image forming apparatus, that is provided with the developer bearing body, and that is for containing the developer to be borne by the developer bearing body; the developing device is provided with a developing-device storage section in which the developer information about the developer contained in that developing device is stored; the first voltage setting section sets the first voltage based on the developer information that has been read out from the developing-device storage section; the developer information is fogging-darkness information which is information about a darkness of fogging; the transferring section includes a transferring medium member through which the developer image formed on the image bearing body is transferred onto the medium; the transferring section transfers the developer image formed on the image bearing body onto the transferring medium member, and transfers the developer image transferred on the transferring medium member onto the medium, to form the image; the image forming apparatus further comprises a darkness detection member for detecting a darkness of fogging that has occurred on the transferring medium member; the fogging-darkness information is obtained by the darkness detection member detecting the darkness of fogging that has occurred on the transferring medium member; the developer bearing body is made of metal; the developer is manufactured using a grinding method; the developer borne by the developer bearing body is not in contact with the image bearing body before the voltage applying section applies the first voltage and the second voltage to the developer bearing body; when the voltage applying section applies the first voltage to the developer bearing body, the developer borne on the developer bearing body flies toward the image bearing body and adheres thereto; and when the voltage applying section applies the second voltage to the developer bearing body, the developer adhering to the image bearing body flies toward the developer bearing body and returns thereto.

With this image forming apparatus, the effect that it becomes possible to prevent selective development from occurring and also prevent an increase in fogging and developer scattering, is achieved most effectively.

It is also possible to achieve an image forming system comprising: a computer; and an image forming apparatus that is connectable to the computer and that includes: an image bearing body for bearing a latent image; a developer bearing body that bears a developer and that is for developing the latent image borne on said image bearing body with said developer; a transferring section that transfers, onto a medium, a developer image formed on said image bearing body by the development of said latent image, to form an image; a voltage applying section that alternately applies, to said developer bearing body, a first voltage for making the developer move from said developer bearing body toward said image bearing body in order to develop said latent image, and a second voltage for making the developer move from said image bearing body toward said developer bearing body; a first voltage setting section for setting said first voltage in accordance with developer information which is information about the developer; and an image darkness adjusting section for adjusting a darkness of the image to be formed on said medium by maintaining said first voltage that has been set by said first voltage setting section, and changing said second voltage.

Since this image forming system includes an image forming apparatus with which selective development can be prevented and an increase in fogging and scattering of developer can also be prevented, it is possible to achieve an image forming system that is superior to conventional systems.

It is also possible to achieve an image forming method comprising the steps of: setting, in accordance with developer information which is information about a developer, a first voltage for making a developer move from a developer bearing body that bears the developer toward an image bearing body that bears a latent image; maintaining the first voltage that has been set, and changing a second voltage for making the developer move from the image bearing body toward the developer bearing body, in order to adjust a darkness of an image to be formed on a medium; developing the latent image by alternately applying, to the developer bearing body, the first voltage that has been maintained and the second voltage that has been changed; and forming an image by transferring, onto the medium, a developer image formed on the image bearing body by the development of the latent image.

With this image forming method, it becomes possible to prevent selective development from occurring and also prevent an increase in fogging and developer scattering.

(4) In the above-mentioned image forming apparatus, the developer bearing body may bear the developer, may carry the developer to a position that is in opposition to the image bearing body, and may develop the latent image borne on the image bearing body with the developer that has been carried up to that position; the image forming apparatus may further comprise a first voltage setting section for setting the first voltage in accordance with carry-amount information which is information about a carry amount of the developer carried by the developer bearing body; and the image darkness adjusting section may adjust the darkness of the image to be formed on the medium by maintaining the first voltage that has been set by the first voltage setting section, and changing the second voltage.

That is, another aspect of an image forming apparatus comprises: an image bearing body for bearing a latent image; a developer bearing body that bears a developer, that carries the developer to a position that is in opposition to the image bearing body, and that is for developing the latent image borne on the image bearing body with the developer that has been carried up to that position; a transferring section that transfers, onto a medium, a developer image formed on the image bearing body by the development of the latent image, to form an image; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; a first voltage setting section for setting the first voltage in accordance with carry-amount information which is information about a carry amount of the developer carried by the developer bearing body; and an image darkness adjusting section for adjusting a darkness of the image to be formed on the medium by maintaining the first voltage that has been set by the first voltage setting section, and changing the second voltage.

With this image forming apparatus, it is possible to set an appropriate first voltage according to the carry amount of the developer bearing body. Therefore, it becomes possible to prevent darkness non-uniformities in an image and also prevent an increase in fogging or scattering of developer.

In the above-mentioned image forming apparatus, the image forming apparatus may further comprise a layer-thickness restricting member that abuts against the developer bearing body and that is for restricting a thickness of a layer of the developer borne on the developer bearing body; and the carry amount of the developer may be a carry amount after the layer thickness has been restricted by the layer-thickness restricting member.

In cases where the image forming apparatus is provided with a layer-thickness restricting member, the developer is used for development of the latent image after the thickness of the layer of developer borne on the developer bearing body is restricted to a predetermined level. Therefore, it would be most effective to use a developer carry amount of the developer bearing body obtained after the layer thickness has been restricted by the layer-thickness restricting member, as the developer carry amount of the developer bearing body. By setting the first voltage with the first voltage setting section according to developer information about the developer carry amount of the developer bearing body obtained after the layer thickness has been restricted by the layer-thickness restricting member, it becomes possible to effectively prevent darkness non-uniformities in an image and also effectively prevent an increase in fogging or scattering of developer.

In the above-mentioned image forming apparatus, the layer-thickness restricting member may be arranged such that a tip end of the layer-thickness restricting member on a side where the layer-thickness restricting member abuts against the developer bearing body faces toward an upstream side of a rotating direction of the developer bearing body with respect to an abutting position where the layer-thickness restricting member abuts against the developer bearing body; and the carry-amount information may be distance information about a distance from the tip end to the abutting position.

When the distance from the tip end to the abutting position changes, the amount of developer that can be borne on the developer bearing body also changes, and therefore, the developer carry amount of the developer bearing body also changes. By adopting the distance information as the carry-amount information, it becomes possible to get hold of the developer carry amount of the developer bearing body appropriately and in a simple manner.

In the above-mentioned image forming apparatus, the carry-amount information may be surface-roughness information about a surface roughness of the developer bearing body.

When the surface roughness of the developer bearing body changes, the developer carry amount of the developer bearing body also changes. By adopting the surface-roughness information as the carry-amount information, it becomes possible to get hold of the developer carry amount of the developer bearing body appropriately and in a simple manner.

In the above-mentioned image forming apparatus, the image forming apparatus may further comprise a developing device that is attachable to and detachable from the image forming apparatus, that is provided with the developer bearing body, and that is for containing the developer to be borne by the developer bearing body; the developing device may be provided with a developing-device storage section in which the carry-amount information about the carry amount of the developer contained in that developing device is stored; and the first voltage setting section may set the first voltage based on the carry-amount information that has been read out from the developing-device storage section.

In the above-mentioned image forming apparatus, the transferring section may include a transferring medium member through which the developer image formed on the image bearing body is transferred onto the medium; the transferring section may transfer the developer image formed on the image bearing body onto the transferring medium member, and transfer the developer image transferred on the transferring medium member onto the medium, to form the image; the image forming apparatus may further comprise a darkness detection member that detects a darkness of a test pattern formed on the transferring medium member for adjustment of the darkness of the image to be formed on the medium; and the image darkness adjusting section may change the second voltage based on a result of detection of the darkness of the test pattern by the darkness detection member.

In this way, it becomes possible to adjust the image darkness in a simple manner.

In the above-mentioned image forming apparatus, the developer bearing body may be made of metal.

In cases where the developer bearing body is made of metal, the image force between the developer and the developer bearing body is strong. Therefore, it is likely that the absolute value of the first voltage will be set to a large value from the viewpoint of preventing selective development. As a result, fogging and developer scattering tend to increase. Therefore, the effect that it is possible to prevent an increase in fogging and developer scattering, is attained more effectively in cases where the developer bearing body is made of metal.

In the above-mentioned image forming apparatus, the developer may be manufactured using a grinding method.

In cases where the developer is made through the grinding method, the charge distribution of the developer becomes wide. Therefore, it is likely that the first voltage will be set to a large value from the viewpoint of preventing selective development. As a result, fogging and developer scattering tend to increase. Therefore, the effect that it is possible to prevent an increase in fogging and developer scattering, is attained more effectively in cases where the developer is made through the grinding method.

In the above-mentioned image forming apparatus, the developer borne by the developer bearing body does not have to be in contact with the image bearing body before the voltage applying section applies the first voltage and the second voltage to the developer bearing body; when the voltage applying section applies the first voltage to the developer bearing body, the developer borne on the developer bearing body may fly toward the image bearing body and adhere thereto; and when the voltage applying section applies the second voltage to the developer bearing body, the developer adhering to the image bearing body may fly toward the developer bearing body and return thereto.

Further, an image forming apparatus may comprise: an image bearing body for bearing a latent image; a developer bearing body that bears a developer, that carries the developer to a position that is in opposition to the image bearing body, and that is for developing the latent image borne on the image bearing body with the developer that has been carried up to that position; a transferring section that transfers, onto a medium, a developer image formed on the image bearing body by the development of the latent image, to form an image; a voltage applying section that alternately applies, to the developer bearing body, a first voltage for making the developer move from the developer bearing body toward the image bearing body in order to develop the latent image, and a second voltage for making the developer move from the image bearing body toward the developer bearing body; a first voltage setting section for setting the first voltage in accordance with carry-amount information which is information about a carry amount of the developer carried by the developer bearing body; and an image darkness adjusting section for adjusting a darkness of the image to be formed on the medium by maintaining the first voltage that has been set by the first voltage setting section, and changing the second voltage; wherein: the image forming apparatus further comprises a layer-thickness restricting member that abuts against the developer bearing body and that is for restricting a thickness of a layer of the developer borne on the developer bearing body; the carry amount of the developer is a carry amount after the layer thickness has been restricted by the layer-thickness restricting member; the layer-thickness restricting member is arranged such that a tip end of the layer-thickness restricting member on a side where the layer-thickness restricting member abuts against the developer bearing body faces toward an upstream side of a rotating direction of the developer bearing body with respect to an abutting position where the layer-thickness restricting member abuts against the developer bearing body; the carry-amount information is distance information about a distance from the tip end to the abutting position; the carry-amount information is surface-roughness information about a surface roughness of the developer bearing body; the image forming apparatus further comprises a developing device that is attachable to and detachable from the image forming apparatus, that is provided with the developer bearing body, and that is for containing the developer to be borne by the developer bearing body; the developing device is provided with a developing-device storage section in which the carry-amount information about the carry amount of the developer contained in that developing device is stored; the first voltage setting section sets the first voltage based on the carry-amount information that has been read out from the developing-device storage section; the transferring section includes a transferring medium member through which the developer image formed on the image bearing body is transferred onto the medium; the transferring section transfers the developer image formed on the image bearing body onto the transferring medium member, and transfers the developer image transferred on the transferring medium member onto the medium, to form the image; the image forming apparatus further comprises a darkness detection member that detects a darkness of a test pattern formed on the transferring medium member for adjustment of the darkness of the image to be formed on the medium; the image darkness adjusting section changes the second voltage based on a result of detection of the darkness of the test pattern by the darkness detection member; the developer bearing body is made of metal; the developer is manufactured using a grinding method; the developer borne by the developer bearing body is not in contact with the image bearing body before the voltage applying section applies the first voltage and the second voltage to the developer bearing body; when the voltage applying section applies the first voltage to the developer bearing body, the developer borne on the developer bearing body flies toward the image bearing body and adheres thereto; and when the voltage applying section applies the second voltage to the developer bearing body, the developer adhering to the image bearing body flies toward the developer bearing body and returns thereto.

With this image forming apparatus, the effect that it becomes possible to prevent darkness non-uniformities in an image and also prevent an increase in fogging and developer scattering, is achieved most effectively.

It is also possible to achieve an image forming system comprising: a computer; and an image forming apparatus that is connectable to the computer and that includes: an image bearing body for bearing a latent image; a developer bearing body that bears a developer, that carries the developer to a position that is in opposition to said image bearing body, and that is for developing the latent image borne on said image bearing body with the developer that has been carried up to that position; a transferring section that transfers, onto a medium, a developer image formed on said image bearing body by the development of said latent image, to form an image; a voltage applying section that alternately applies, to said developer bearing body, a first voltage for making the developer move from said developer bearing body toward said image bearing body in order to develop said latent image, and a second voltage for making the developer move from said image bearing body toward said developer bearing body; a first voltage setting section for setting said first voltage in accordance with carry-amount information which is information about a carry amount of the developer carried by said developer bearing body; and an image darkness adjusting section for adjusting a darkness of the image to be formed on said medium by maintaining said first voltage that has been set by said first voltage setting section, and changing said second voltage.

Since this image forming system includes an image forming apparatus with which darkness non-uniformities in an image can be prevented and an increase in fogging and scattering of developer can also be prevented, it is possible to achieve an image forming system that is superior to conventional systems.

It is also possible to achieve an image forming method comprising the steps of: setting, in accordance with carry-amount information which is information about a carry amount of a developer carried by a developer bearing body that bears the developer, a first voltage for making a developer move from the developer bearing body toward an image bearing body that bears a latent image; maintaining the first voltage that has been set, and changing a second voltage for making the developer move from the image bearing body toward the developer bearing body, in order to adjust a darkness of an image to be formed on a medium; developing the latent image by alternately applying, to the developer bearing body, the first voltage that has been maintained and the second voltage that has been changed; and forming an image by transferring, onto the medium, a developer image formed on the image bearing body by the development of the latent image.

With this image forming method, it becomes possible to prevent darkness non-uniformities in an image and also prevent an increase in fogging and developer scattering.

FIRST EMBODIMENT

(1) Overall Configuration of Image Forming Apparatus

Next, taking a laser beam printer 10 (referred to also as "printer 10" below) as an example of an "image forming apparatus", an overall configuration of the printer 10 is described with reference to FIG. 1. FIG. 1 is a diagram showing main structural components constructing the printer 10. It should be noted that in FIG. 1, the vertical direction is shown by the arrow, and, for example, a paper supply tray 92 is arranged at a lower section of the printer 10, and a fusing unit 90 is arranged at an upper section of the printer 10.

<Overall Configuration of Printer 10>

As shown in FIG. 1, the printer 10 according to the present embodiment includes a charging unit 30, an exposing unit 40, a developing-unit holding unit 50, a first transferring unit 60, an intermediate transferring body 70, and a cleaning unit 75. These units are arranged in the direction of rotation of a photoconductor 20, which serves as an example of an "image bearing body" for bearing a latent image. The printer 10 further includes a second transferring unit 80, a fusing unit 90, a displaying unit 95 constructed of a liquid-crystal panel and serving as means for making notifications to the user etc., and a control unit 100 for controlling these units etc. and managing the operations as a printer.

The photoconductor 20 has a cylindrical conductive base and a photoconductive layer formed on the outer peripheral surface of the conductive base, and it is rotatable about its central axis. In the present embodiment, the photoconductor 20 rotates clockwise, as shown by the arrow in FIG. 1.

The charging unit 30 is a device for electrically charging the photoconductor 20. The charge potential of the surface of the photoconductor 20 that has been electrically charged by the charging unit 30 is uniform. To charge the photoconductor 20, a charge-bias generating device 127*b* (see FIG. 6) provided in a charging unit drive control circuit applies a charge bias to the charging unit 30. Further, the charging unit drive control circuit includes a charge-bias control circuit 127*a* that serves to control the ON/OFF of the charge bias and to set an appropriate charge-bias value.

The exposing unit 40 is a device for forming a latent image on the charged photoconductor 20 by radiating a laser beam thereon. The exposing unit 40 has, for example, a semiconductor laser, a polygon mirror, and an F-θ lens, and radiates a modulated laser beam onto the charged photoconductor 20 according to image signals having been input from a not-shown host computer such as a personal computer or a word processor. In this way, the section of the photoconductor 20 onto which the laser has been irradiated becomes the "image section", and the section of the photoconductor 20 onto which the laser was not irradiated becomes the "non-image section". It should be noted that the electric potential of the image section is different from the electric potential (charge potential) of the non-image section.

The developing-unit holding unit 50 is a device for developing the latent image formed on the photoconductor 20 using black (K) toner contained in a black developing unit 51, magenta (M) toner contained in a magenta developing unit 53, cyan (C) toner contained in a cyan developing unit 52, and yellow (Y) toner contained in a yellow developing unit 54.

In the present embodiment, the developing-unit holding unit 50 rotates to allow the positions of the four developing units 51, 52, 53, and 54, which serve as an example of "developing devices", to be moved. More specifically, the developing-unit holding unit 50 holds the four developing units 51, 52, 53, and 54 with four attach/detach sections 50*a*, 50*b*, 50*c*, and 50*d*, respectively, and the four developing units 51, 52, 53, and 54 can be rotated about a rotating shaft 50*e* while maintaining their relative positions. A different one of the developing units is made to selectively oppose the photoconductor 20 each time the photoconductor 20 makes one revolution, thereby successively developing the latent image formed on the photoconductor 20 using the toner T, which is an example of a "developer", contained in each of the developing units 51, 52, 53, and 54. It should be noted that details on the developing units are described further below.

The first transferring unit 60 is a device for transferring a toner image, which is an example of a "developer image", formed on the photoconductor 20 onto the intermediate transferring body 70, which is an example of a "transferring medium member". When toner images of four colors are successively transferred in a superposed manner, a full-color toner image is formed on the intermediate transferring body 70. The intermediate transferring body 70 is an endless belt that is driven to rotate at substantially the same circumferential speed as the photoconductor 20.

Further, a patch sensor PS, which is an example of a "darkness detection member" for detecting the darkness of a patch image ("test pattern") formed on the intermediate transferring body 70 for adjusting the darkness of an image to be formed on a recording medium, is arranged in the vicinity of the intermediate transferring body 70. The patch sensor PS is a reflective optical sensor that achieves the function of detecting the darkness of the patch image. More specifically, the patch sensor PS has a light emitting section for emitting light and a light receiving section for receiving the light. The light emitted from the light emitting section toward the patch image, that is, the incident light, is reflected by the patch image. The reflected light is received by the light receiving section and is converted into an electric signal. The intensity of the electric signal is measured as the output value of the light receiving sensor corresponding to the intensity of the reflected light that has been received. Since there is a predetermined relationship between the darkness of the patch image and the intensity of the received reflected light, it is possible to detect the darkness of the patch image by measuring the intensity of the electric signal.

The second transferring unit 80 is a device for transferring the single-color toner image, or the full-color toner image, formed on the intermediate transferring body 70 onto a recording medium, which is an example of a "medium". It should be noted that the recording medium may be, for example, paper, film, or cloth. Further, the "transferring section" in this embodiment is the first transferring unit 60, the intermediate transferring body 70, and the second transferring unit 80. The intermediate transferring body 70 serves as a medium for when transferring, onto the recording medium, the toner image formed on the photoconductor 20.

The fusing unit 90 is a device for fusing the single-color toner image or the full-color toner image, which has been transferred to the recording medium, onto the recording medium such as paper to make it into a permanent image. The cleaning unit 75 is a device that is provided between the first transferring unit 60 and the charging unit 30, that has a rubber cleaning blade 76 made to abut against the surface of the photoconductor 20, and that is for removing the toner remaining on the photoconductor 20 by scraping it off with the cleaning blade 76 after the toner image has been transferred onto the intermediate transferring body 70 by the first transferring unit 60.

Figure 6:
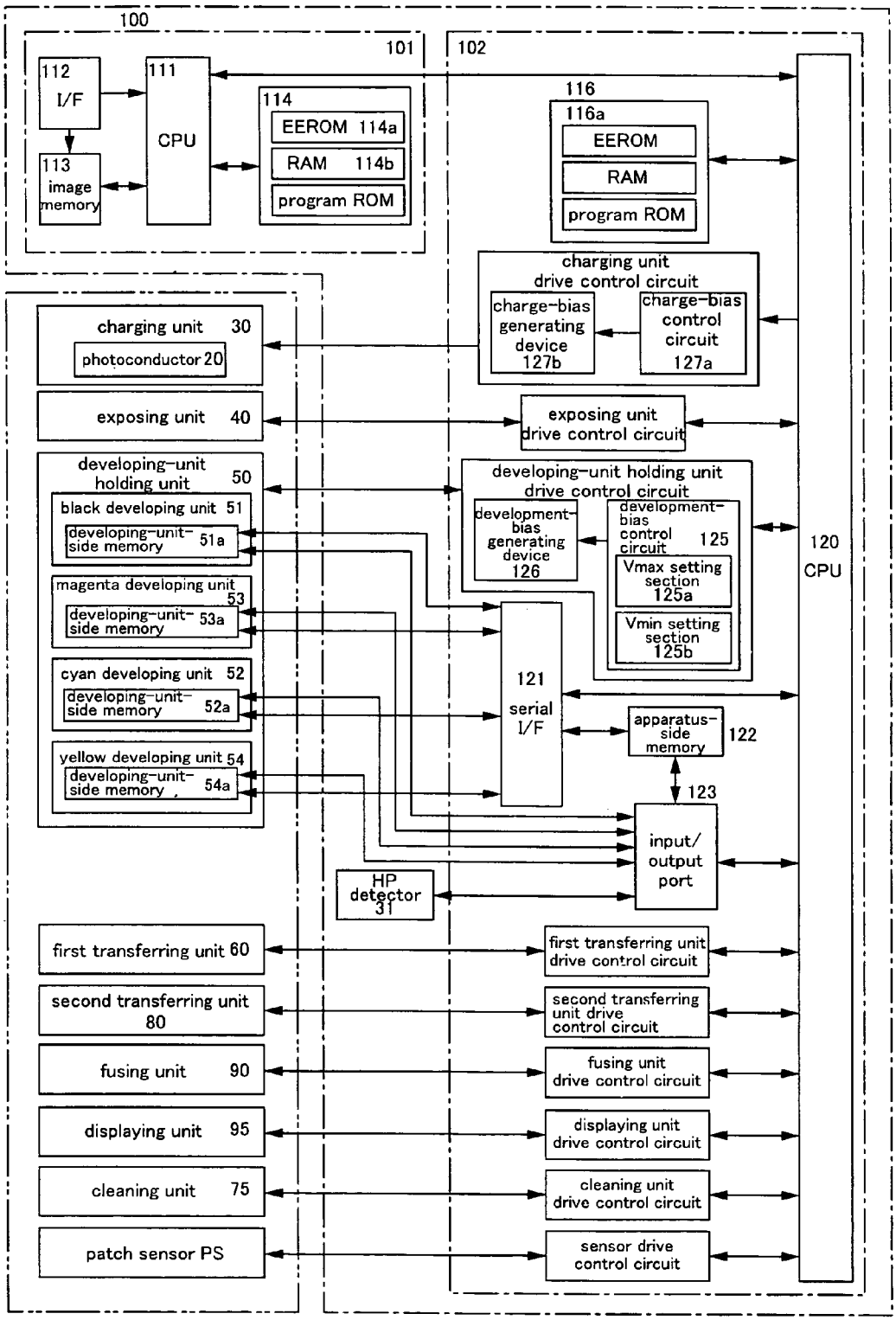
FIG. 6 is a block diagram showing a control unit 100 of the printer 10.

The control unit 100 includes a controller section 101 and a unit controller 102 as shown in FIG. 6. Image signals are input to the controller section 101, and according to instructions based on these image signals, the unit controller 102 controls each of the above-mentioned units etc. to form an image.

(1) Overview of the Developing Unit

Figure 2:
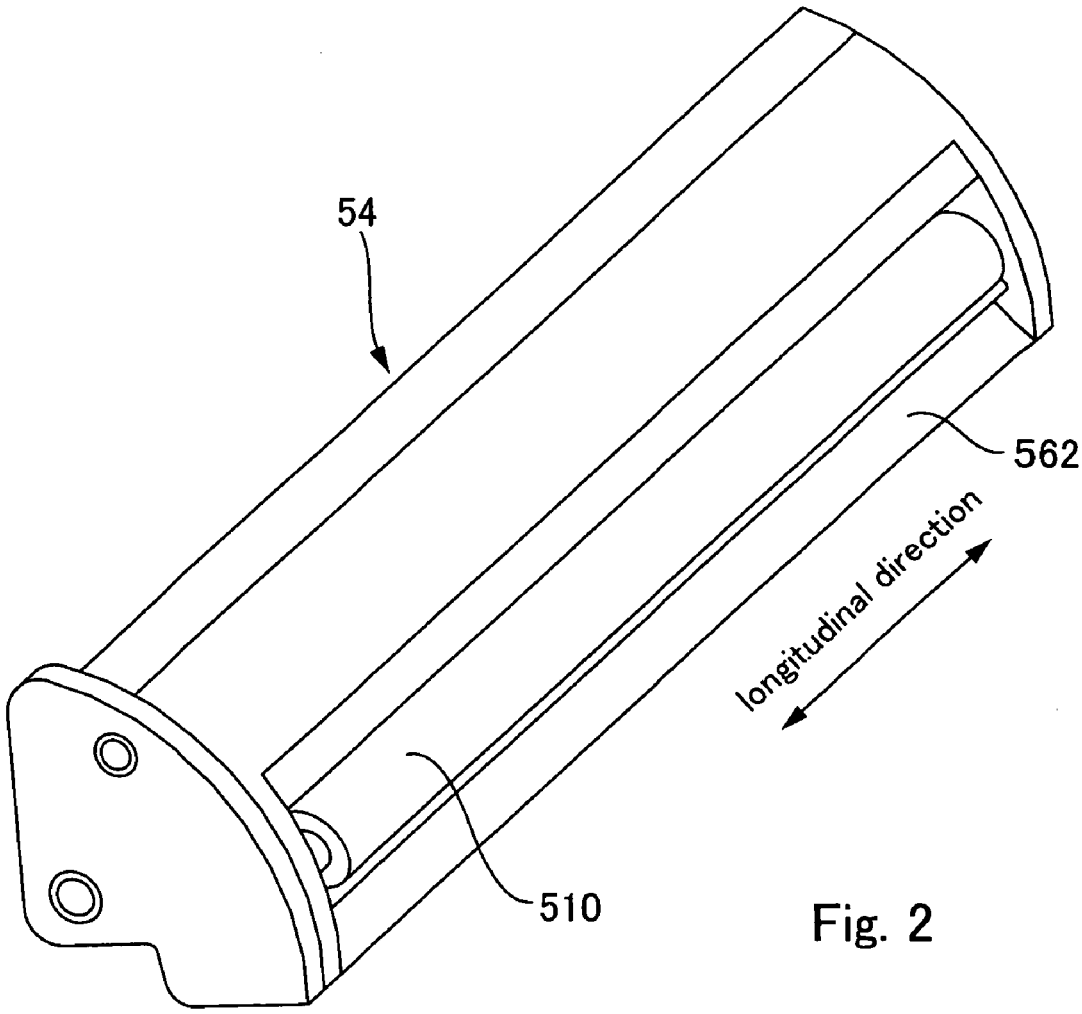
FIG. 2 is a conceptual diagram of a developing unit.
Figure 3:
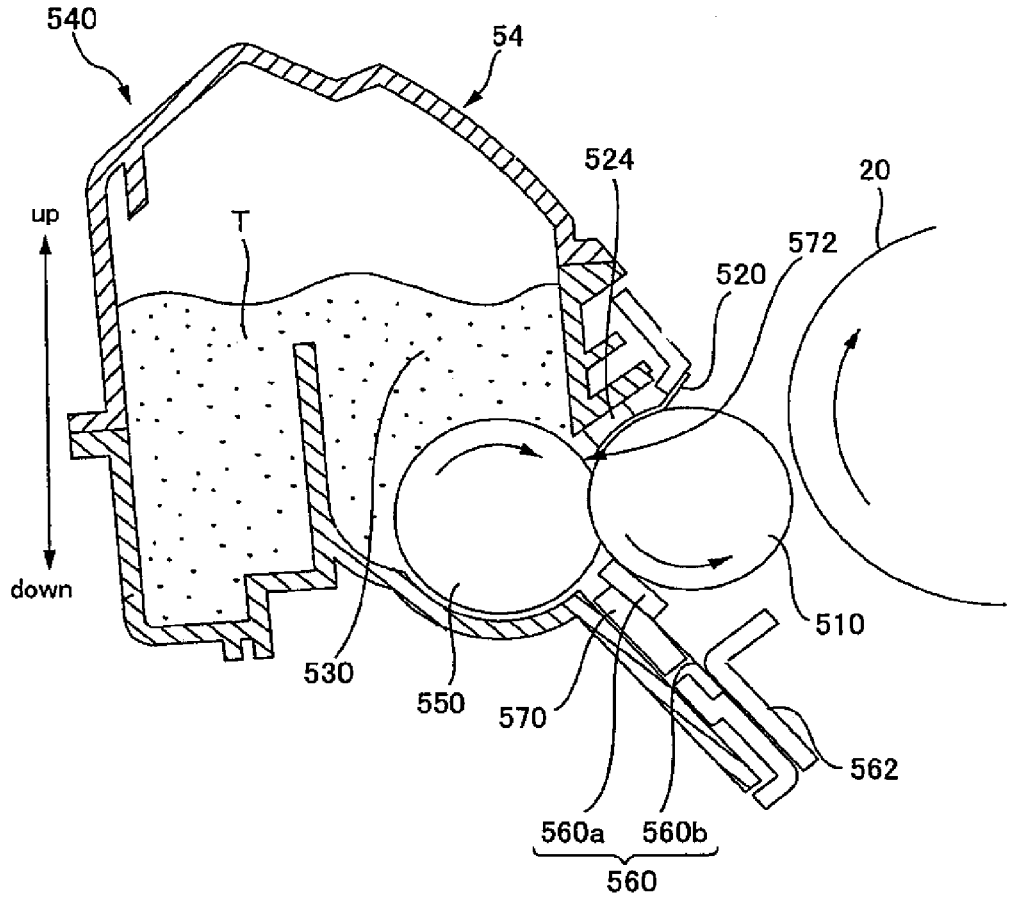
FIG. 3 is a section view showing main structural components of the developing unit.

Next, with reference to FIG. 2 and FIG. 3, an example of a configuration of the developing units will be described. FIG. 2 is a conceptual diagram of a developing unit. FIG. 3 is a section view showing main structural components of the developing unit. Note that the section view shown in FIG. 3 is a cross section of the developing unit taken along a plane perpendicular to the longitudinal direction shown in FIG. 2. Further, in FIG. 3, the arrow indicates the vertical direction as in FIG. 1, and, for example, the yellow developing unit 54 is shown to be in a state in which it is positioned at the developing position opposing the photoconductor 20.

To the developing-unit holding unit 50, it is possible to attach the black developing unit 51, the magenta developing unit 53, the cyan developing unit 52, and the yellow developing unit 54. Since the configuration of the developing units is the same, explanation will be made below only on the yellow developing unit 54.

The yellow developing unit 54 has, for example, a developing roller 510 serving as an example of a "developer bearing body", a sealing member 520, a toner containing section 530, a housing 540, a toner supplying roller 550, and a restriction blade 560.

The developing roller 510 bears toner T, carries it to the developing position opposing the photoconductor 20, and develops the latent image borne on the photoconductor 20 with the toner T carried to the developing position. The developing roller 510 is made of metal and, for example, it is manufactured from aluminum, stainless steel, or iron; if necessary, the roller 510 is plated with, for example, nickel plating or chromium plating, and the toner-bearing region is subjected to sandblasting, for example. Further, as shown in FIG. 2, the developing roller 510 is supported at both ends in its longitudinal direction and is rotatable about its central axis. As shown in FIG. 3, the developing roller 510 rotates in the opposite direction (counterclockwise in FIG. 3) to the rotating direction of the photoconductor 20 (clockwise in FIG. 3). Further, as shown in FIG. 3, the developing roller 510 of the yellow developing unit 54 and the photoconductor 20 oppose against each other with a spacing (gap) therebetween. That is, the yellow developing unit 54 develops the latent image formed on the photoconductor 20 in a non-contacting state.

Upon development of the latent image formed on the photoconductor 20, a development-bias generating device 126 (see FIG. 6), which is an example of a "voltage applying section" provided in a developing-unit holding unit drive control circuit, applies, to the developing roller 510, a development bias obtained by superposing a DC voltage and an AC voltage, and thus an alternating field is generated between the developing roller 510 and the photoconductor 20. The developing-unit holding unit drive control circuit includes a development-bias control circuit 125 that serves to control the ON/OFF of the development bias and to set an appropriate development-bias value. The development-bias control circuit 125 has a Vmax setting section 125*a*, which is an example of a "first voltage setting section" for setting a first voltage (Vmax), and a Vmin setting section 125*b*, which is an example of an "image darkness adjusting section" for setting a second voltage (Vmin) in order to adjust the darkness of an image. It should be noted that details on the development bias etc. are described further below.

The sealing member 520 prevents the toner T in the yellow developing unit 54 from spilling out therefrom, and also collects the toner T, which is on the developing roller 510 that has passed the developing position, into the developing unit without scraping it off. The sealing member 520 is a seal made of, for example, polyethylene film. The sealing member 520 is pressed against the developing roller 510 by the elastic force of a seal-urging member 524 that is made of, for example, Moltoprene and that is provided on the side opposite from the side of the developing roller 510.

The housing 540 is formed by welding together a plurality of integrally-molded housing sections. As shown in FIG. 3, the housing 540 has an opening 572 that opens toward the outside of the housing 540. The above-mentioned developing roller 510 is arranged from the outside of the housing 540 with its peripheral surface facing the opening 572 in such a state that a part of the roller 510 is exposed to the outside. The restriction blade 560, which is described in detail below, is also arranged from the outside of the housing 540 facing the opening 572.

Further, the housing 540 forms a toner containing section 530 that is capable of containing toner T. The toner T contained in the toner containing section 530 is manufactured according to a grinding method. The toner T includes a core particle and external additives that are applied on the core particle. The core particle includes materials such as coloring agents, charge control agents, release agents (WAX), and resin. The core particle is manufactured by: uniformly mixing the above-mentioned materials using a Henschel mixer, for example; melting and kneading the mixture using a twin screw extruder; cooling the batch; subjecting the batch to rough grinding and fine grinding; and classifying the particles.

The toner supplying roller 550 is provided in the toner containing section 530 described above and supplies the toner T contained in the toner containing section 530 to the developing roller 510. The toner supplying roller 550 is made of, for example, polyurethane foam, and is made to abut against the developing roller 510 in an elastically deformed state. The toner supplying roller 550 is arranged at a lower section of the toner containing section 530. The toner T contained in the toner containing section 530 is supplied to the developing roller 510 by the toner supplying roller 550 at the lower section of the toner containing section 530. The toner supplying roller 550 rotates about its central axis in the opposite direction (clockwise in FIG. 3) to the rotating direction of the developing roller 510 (counterclockwise in FIG. 3).

It should be noted that the toner supplying roller 550 has the function of supplying the toner T contained in the toner containing section 530 to the developing roller 510 as well as the function of stripping off, from the developing roller 510, the toner T remaining on the developing roller 510 after development.

The restriction blade 560 gives an electric charge to the toner T borne by the developing roller 510 to negatively charge the toner T. The restriction blade 560 also restricts the thickness of the layer of the toner T borne by the developing roller 510. This restriction blade 560 has a rubber section 560*a* and a rubber-supporting section 560*b*. The rubber section 560*a* is made of, for example, silicone rubber or urethane rubber. The rubber-supporting section 560*b* is a thin plate that is made of, for example, phosphor bronze or stainless steel, and that has a spring-like characteristic. The rubber section 560*a* is supported by the rubber-supporting section 560*b*. The rubber-supporting section 560*b* is attached to the housing 540 via a pair of blade-supporting metal plates 562 in a state that one end of the rubber-supporting section 560*b* is pinched between and supported by the blade-supporting metal plates 562. Further, a blade-backing member 570 made of, for example, Moltoprene is provided on one side of the restriction blade 560 opposite from the side of the developing roller 510.

The rubber section 560*a* is pressed against the developing roller 510 by the elastic force caused by the flexure of the rubber-supporting section 560*b*. Further, the blade-backing member 570 prevents the toner T from entering in between the rubber-supporting section 560*b* and the housing 540, stabilizes the elastic force caused by the flexure of the rubber-supporting section 560*b*, and also, applies force to the rubber section 560*a* from the back thereof towards the developing roller 510 to press the rubber section 560*a* against the developing roller 510. In this way, the blade-backing member 570 makes the rubber section 560*a* abut against the developing roller 510 evenly.

In the yellow developing unit 54 structured as above, the toner supplying roller 550 supplies the toner T contained in the toner containing section 530 to the developing roller 510. With the rotation of the developing roller 510, the toner T, which has been supplied to the developing roller 510, reaches the abutting position of the restriction blade 560; then, as the toner T passes the abutting position, the toner is electrically charged and its layer thickness is restricted. With further rotation of the developing roller 510, the toner T on the developing roller 510, whose layer thickness has been restricted, reaches the developing position opposing the photoconductor 20; then, under the alternating field, the toner T is used at the developing position for developing the latent image formed on the photoconductor 20. With further rotation of the developing roller 510, the toner T on the developing roller 510, which has passed the developing position, passes the sealing member 520 and is collected into the developing unit by the sealing member 520 without being scraped off.

Further, each developing unit 51, 52, 53, and 54 is also provided with a storage element, for example, a non-volatile storage memory such as a serial EEPROM (which is also referred to below as a "developing-unit-side memory") 51*a*, 52*a*, 53*a*, and 54*a* that is for storing various kinds of information about the developing unit, such as color information about the color of the toner T contained in each developing unit, the consumption amount of toner T indicating the amount of toner T that has been consumed, and the drive time of the developing roller 510 indicating the amount of time the developing roller 510 has been driven.

Developing-unit-side connectors 51*b*, 52*b*, 53*b*, and 54*b*, which are provided on one end surface of the respective developing units, come into connection, as necessary, with an apparatus-side connector 34, which is provided on the apparatus side (i.e., the printer side), and in this way, the developing-unit-side memories 51*a*, 52*a*, 53*a*, and 54*a* are electrically connected to the unit controller 102 of the control unit 100 of the apparatus.

(1) Overview of the Developing-unit Holding Unit

Next, an overview of the developing-unit holding unit 50 will be described with reference to FIG. 4A through FIG. 4C.

The developing-unit holding unit 50 has a rotating shaft 50*e* positioned at the center. A support frame 55 for holding the developing units is fixed to the rotating shaft 50*e*. The rotating shaft 50*e* is provided extending between two frame side plates (not shown) which form a casing of the printer 10, and both ends of the shaft 50*e* are supported thereby. It should be noted that the axial direction of the rotating shaft 50*e* intersects with the vertical direction.

The support frame 55 is provided with the four attach/detach sections 50*a*, 50*b*, 50*c*, and 50*d*, to which the above-described developing units 51, 52, 53, and 54 of the four colors are attached in an attachable/detachable manner about the rotating shaft 50*e*, and they are arranged in the circumferential direction at an interval of 90°.

A pulse motor, which is not shown, is connected to the rotating shaft 50*e*. By driving the pulse motor, it is possible to rotate the support frame 55 and position the four developing units 51, 52, 53, and 54 mentioned above at predetermined positions.

Figure 4A:
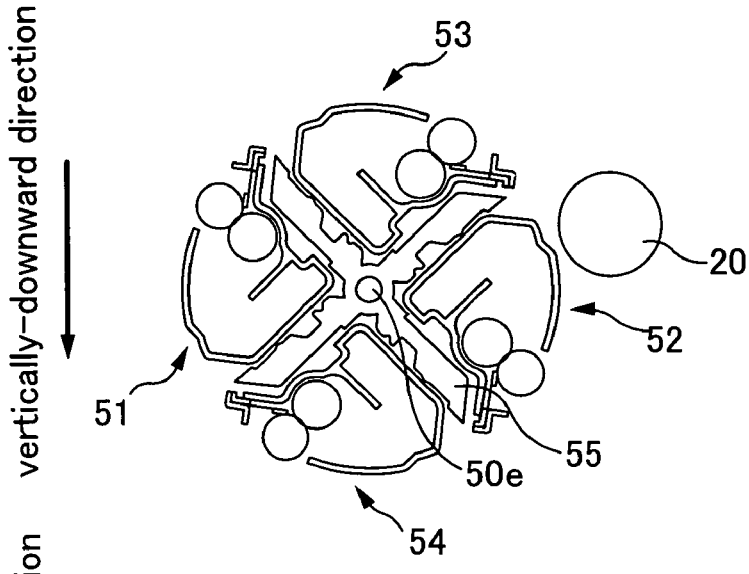
FIG. 4A shows the HP position.
Figure 4B:
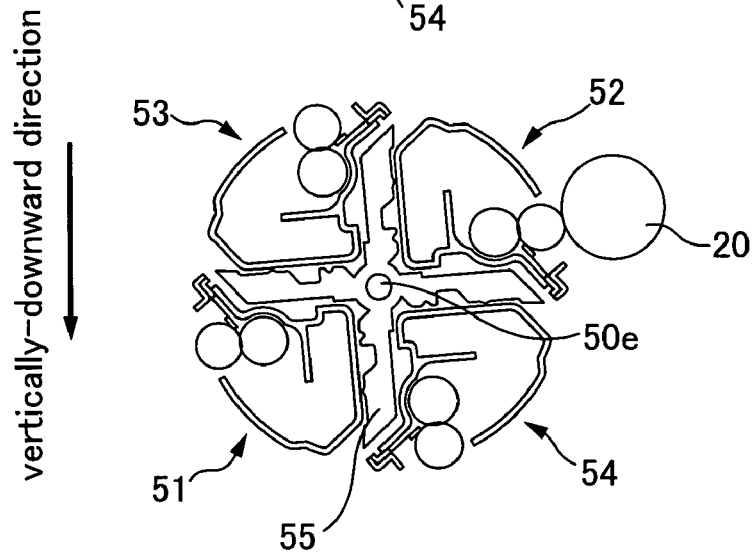
FIG. 4B shows the connector attach/detach position.
Figure 4C:
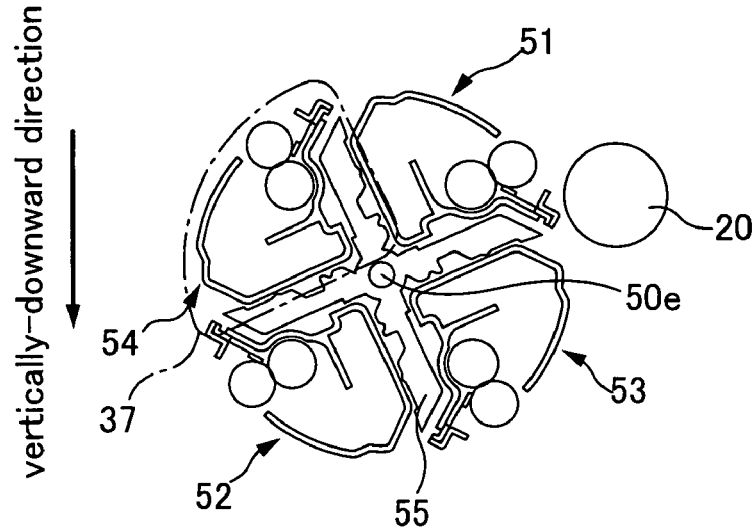
FIG. 4C shows the attach/detach position of a yellow developing unit 54.

FIG. 4A through FIG. 4C are diagrams showing three stop positions of the rotating developing-unit holding unit 50. FIG. 4A shows the home position (referred to as "HP position" below) which is the standby position for when the printer is on standby for image formation to be carried out, and which is also the halt position serving as the reference position in the rotating direction of the developing-unit holding unit 50. FIG. 4B shows the connector attach/detach position where the developing-unit-side connector 54*b* of the yellow developing unit 54, which is attached to the developing-unit holding unit 50, and the apparatus-side connector 34, which is provided on the apparatus side, come into opposition. FIG. 4C shows the attach/detach position where the yellow developing unit 54 is attached and detached.

In FIG. 4B and FIG. 4C, the connector attach/detach position and the developing unit attach/detach position are explained with regard to the yellow developing unit 54, but these positions become the connector attach/detach position and the developing unit attach/detach position for each of the other developing units when the developing-unit holding unit 50 is rotated at 90° intervals.

First, the HP position shown in FIG. 4A will be described. An HP detector 31 (FIG. 6) for detecting the HP position is provided on the side of one end of the rotating shaft 50*e* of the developing-unit holding unit 50. The HP detector 31 is structured of a disk that is for generating signals and that is fixed to one end of the rotating shaft 50*e*, and an HP sensor that is made up of, for example, a photointerrupter having a light emitting section and a light receiving section. The peripheral section of the disk is arranged such that it is located between the light emitting section and the light receiving section of the HP sensor. When a slit formed in the disk moves up to a detecting position of the HP sensor, the signal that is output from the HP sensor changes from "L" to "H". The device is constructed such that the HP position of the developing-unit holding unit 50 is detected based on this change in signal level and the number of pulses of the pulse motor, and by taking this HP position as a reference, each of the developing units can be positioned at the developing position etc.

FIG. 4B shows the connector attach/detach position of the yellow developing unit 54 which is achieved by rotating the pulse motor for a predetermined number of pulses from the above-mentioned HP position. At this connector attach/detach position, the developing-unit-side connector 54*b* of the yellow developing unit 54, which is attached to the developing-unit holding unit 50, and the apparatus-side connector 34, which is provided on the apparatus side, come into opposition, and it becomes possible to connect or separate these connecters.

Figure 5A:
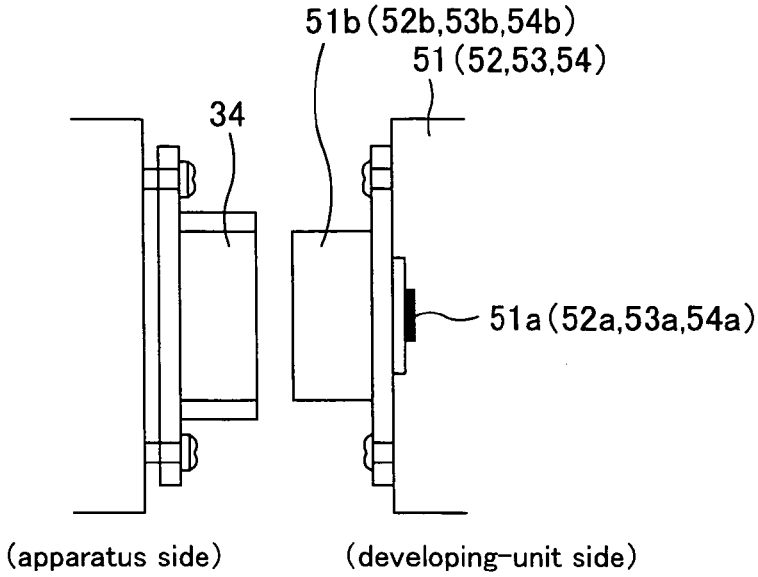
FIG. 5A is a diagram showing a separated position.
Figure 5B:
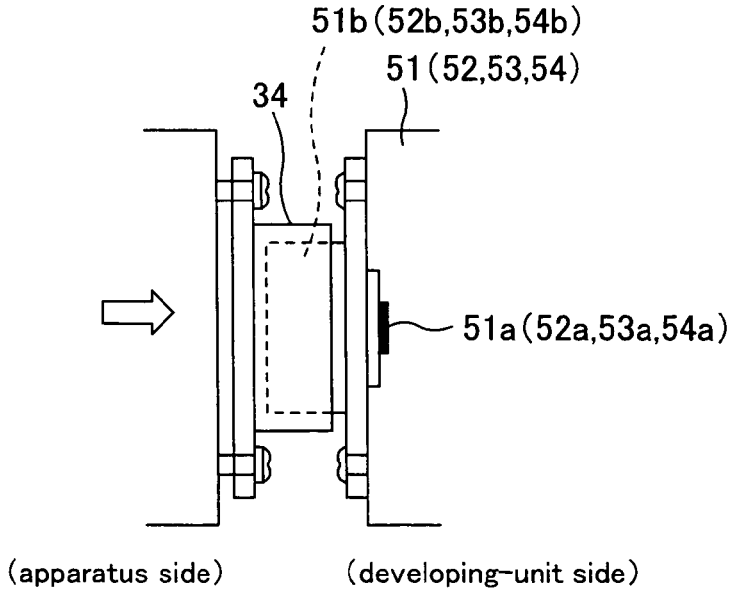
FIG. 5B is a diagram showing an abutting position.

Further explanation is given using FIG. 5A and FIG. 5B. FIG. 5A is a diagram showing a separated position. FIG. 5B is a diagram showing an abutting position.

FIG. 5A shows a state in which the apparatus-side connector 34 and the developing-unit-side connector 54*b* of the yellow developing unit 54 are separated from each other. The apparatus-side connector 34 is structured such that it can move toward, and move away from, the yellow developing unit 54. When necessary, the apparatus-side connector 34 moves in the direction towards the yellow developing unit 54 (the direction of the arrow shown in FIG. 5B). In this way, the apparatus-side connector 34 abuts against the developing-unit-side connector 54*b* of the yellow developing unit 54 as shown in FIG. 5B. Thus, the developing-unit-side memory 54*a* attached to the yellow developing unit 54 is electrically connected to the unit controller 102 of the control unit 100, and communication between the developing-unit-side memory 54*a* and the apparatus is established.

Conversely, the apparatus-side connector 34 moves, from the state shown in FIG. 5B in which the apparatus-side connector 34 and the developing-unit-side connector 54*b* of the yellow developing unit 54 abut against each other, in the direction away from the yellow developing unit 54 (the direction opposite to the direction of the arrow shown in FIG. 5B). In this way, the apparatus-side connector 34 is separated from the developing-unit-side connector 54*b* of the yellow developing unit 54, as shown in FIG. 5A.

It should be noted that the movement of the apparatus-side connector 34 is achieved by, for example, a not-shown mechanism structured of a pulse motor, a plurality of gears connected to the pulse motor, and an eccentric cam connected to the gears. More specifically, by rotating the pulse motor for a predetermined number of pulses, the above-mentioned mechanism moves the apparatus-side connector 34 from the predetermined separated position for a distance that corresponds to the above-mentioned number of pulses to position the apparatus-side connector 34 at the predetermined abutting position. On the contrary, by rotating the pulse motor in reverse for a predetermined number of pulses, the above-mentioned mechanism moves the apparatus-side connector 34 from the predetermined abutting position for a distance that corresponds to the above-mentioned number of pulses to position the apparatus-side connector 34 at the predetermined separated position.

Further, the connector attach/detach position for the yellow developing unit 54 is the developing position for the cyan developing unit 52 where the developing roller 510 of the cyan developing unit 52 and the photoconductor 20 oppose each other. That is, the connector attach/detach position of the developing-unit holding unit 50 for the yellow developing unit 54 is the developing position of the developing-unit holding unit 50 for the cyan developing unit 52. Further, the position achieved when the pulse motor rotates the developing-unit holding unit 50 counterclockwise by 90° is the connector attach/detach position for the black developing unit 51 and the developing position for the yellow developing unit 54; every time the developing-unit holding unit 50 is rotated by 90°, the connector attach/detach position and the developing position for each of the developing units are successively achieved.

One of the two frame side plates that support the developing-unit holding unit 50 and that form the casing of the printer 10 is provided with an attach/detach dedicated opening 37 through which one developing unit can pass and an inner cover (not shown) that openably/closably covers the attach/detach dedicated opening 37. The attach/detach dedicated opening 37 is formed in a position where only a relevant developing unit (here, the yellow developing unit 54) can be pulled out and detached in the direction of the rotating shaft 50*e*, as shown in FIG. 4C, when the developing-unit holding unit 50 is rotated and each developing unit is halted at the developing unit attach/detach position which is set for each developing unit. Further, the attach/detach dedicated opening 37 is formed slightly larger than the outer shape of a developing unit. At the developing unit attach/detach position, not only is it possible to detach the developing unit, but it is also possible to insert a new developing unit through this attach/detach dedicated opening 37 in the direction of the rotating shaft 50*e* and attach the developing unit to the support frame 55. While the developing-unit holding unit 50 is positioned at positions other than the developing unit attach/detach position, the attachment/detachment of that developing unit is restricted by the frame side plates.

It should be noted that a lock mechanism, which is not shown, is provided for certainly positioning and fixing the developing-unit holding unit 50 at the positions described above.

(1) Overview of Control Unit

Next, with reference to FIG. 6, the configuration of the control unit 100 will be described. FIG. 6 is a block diagram showing the control unit 100 of the printer 10.

The controller section 101 includes a CPU 111, an interface 112 for establishing connection with a not-shown computer, an image memory 113 for storing image signals etc. that have been input from the computer, and a controller-section-side memory 114 that is made up of, for example, an electrically rewritable EEPROM 114*a*, a RAM 114*b*, and a programmable ROM in which various programs for control are written. The controller section 101 receives various information such as image signals etc. from the computer connected to the printer 10.

The controller section 101 has a function of converting the RGB data of red, green, and blue, which is the image signal sent from the computer etc., into YMCK image data of yellow, magenta, cyan, and black, and storing the converted YMCK image data in the image memory 113. The controller section 101 also has a function of sending various information to the connected computer.

Furthermore, the controller section 101 has the function of counting the number of dots based on the converted YMCK image data when forming an image in each color on the recording medium, calculating a predicted consumption amount of toner that is predicted to be consumed when forming the images based on the YMCK image data, and outputting this information to the unit controller 102.

The unit controller 102 includes, for example, a CPU 120, a unit-controller-side memory 116 that is made up of, for example, an electrically rewritable EEPROM 116*a*, a RAM, and a programmable ROM in which various programs for control are written, and various drive control circuits for driving and controlling the units in the apparatus body (i.e., the charging unit 30, the exposing unit 40, the first transferring unit 60, the cleaning unit 75, the second transferring unit 80, the fusing unit 90, and the displaying unit 95) and the developing-unit holding unit 50.

The CPU 120 is electrically connected to each of the drive control circuits and controls the drive control circuits according to control signals from the CPU 111 of the controller section 101. More specifically, the unit controller 102 controls each of the units and the developing-unit holding unit 50 according to signals received from the controller section 101 while detecting the state of each of the units and the developing-unit holding unit 50 by receiving signals from sensors provided in each unit.

Further, the CPU 120 is connected, via a serial interface (indicated herein as "I/F") 121, to a non-volatile storage element 122 (which is referred to below as "apparatus-side memory") which is, for example, a serial EEPROM. Data necessary for controlling the apparatus are stored in the apparatus-side memory 122. The CPU 120 is not only connected to the apparatus-side memory 122, but is also connected to developing-unit-side memories 51*a*, 52*a*, 53*a*, and 54*a*, which are provided on the respective developing units 51, 52, 53, and 54, via the serial interface 121. Then, data can be exchanged between the apparatus-side memory 122 and the developing-unit-side memories 51*a*, 52*a*, 53*a*, and 54*a*, and also, it is possible to input chip-select signals CS to the developing-unit-side memories 51*a*, 52*a*, 53*a*, and 54*a* via the input/output port 123. The CPU 120 is also connected to the HP detector 31 via the input/output port 123.

Further, the CPU 120 becomes communicable with the developing-unit-side memories 51*a*, 52*a*, 53*a*, and 54*a* when the apparatus-side connector 34 and the connecter of one of the developing units positioned at the connector attach/detach position are connected. Then, various information about the developing unit is obtained from the developing-unit-side memory 51*a*, 52*a*, 53*a*, or 54*a* of the developing unit connected to the apparatus-side connector 34. Information about the developing unit includes, for example, color information about the color of toner contained in the attached developing unit, information about the total consumption amount of the toner T contained, and information about the total drive time of the developing roller 510. The various kinds of information that have been obtained are stored, corresponding to each developing unit, in a predetermined region of the apparatus-side memory 122 of the unit controller 102. It should be noted that the number of dots counted by the controller section 101 (total dot-count number) is stored as the information about the total consumption amount of the toner T.

Further, when the CPU 120 detects information indicating a toner consumption amount (dot-count number) output from the controller section 101, it adds this toner consumption amount to the total consumption amount of toner T (total dot-count number) stored in the apparatus-side memory 122, and then stores the newly-calculated total consumption amount of toner T (total dot-count number) in the apparatus-side memory 122. Further, the CPU 120 calculates the drive time of the developing roller 510 from information that is included in a print request from the controller section 101 and that indicates the print size and the number of sheets to be printed, adds this drive time to the total drive time of the developing roller 510 stored in the apparatus-side memory 122, and then stores the calculated total drive time in the apparatus-side memory 122.

Furthermore, when a developing unit is to be detached from the attach/detach section, the CPU 120 stores, in the developing-unit-side memory 51*a*, 52*a*, 53*a*, or 54*a* of that developing unit, information such as the total consumption amount of toner T (total dot-count number) and the total drive time of the developing roller 510 which are stored in the apparatus-side memory 122.

(1) Development Bias

Figure 7:
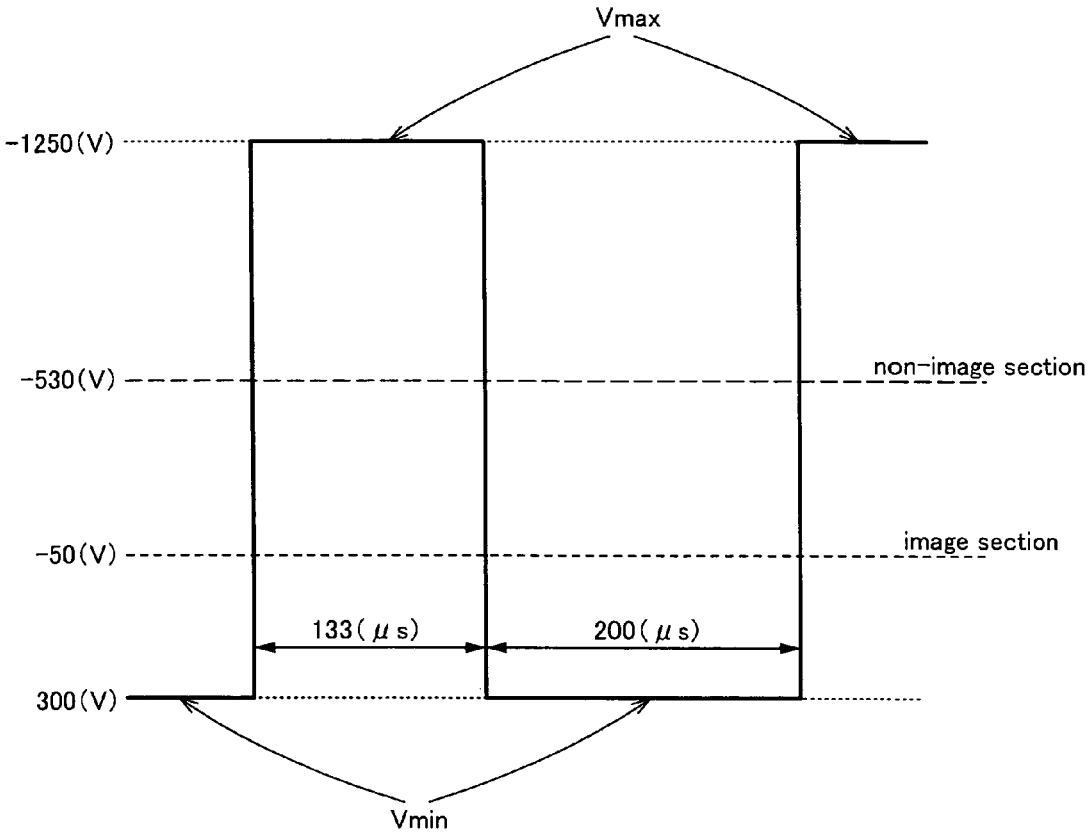
FIG. 7 shows a waveform of the development bias.

The development bias that is applied from the development-bias generating device 126 to the developing roller 510 is described with reference to FIG. 7. FIG. 7 shows a waveform of the development bias.

The development-bias generating device 126 applies, to the developing roller 510, a development bias of a rectangular waveform as shown in FIG. 7 for developing a latent image. More specifically, the development-bias generating device 126 alternately applies, to the developing roller 510, a first voltage (Vmax) for making the toner T move from the developing roller 510 toward the photoconductor 20 for developing a latent image, and a second voltage (Vmin) for making the toner T move from the photoconductor 20 toward the developing roller 510.

When the development-bias generating device 126 applies a Vmax to the developing roller 510, the toner T borne on the developing roller 510 flies toward the photoconductor 20 and adheres thereto. When the Vmax is applied to the developing roller 510, an electric field is generated due to the difference between the electric potential of the developing roller 510 (for example, −1250 V) caused by the Vmax, and the electric potential of the photoconductor 20 on which the latent image is formed (for example, electric potential of the image section: −50 V; electric potential of the non-image section: −530 V). The negatively-charged toner T borne on the developing roller 510 flies toward the photoconductor 20 due to the force caused by the electric field and adheres to the photoconductor 20. It should be noted that, the larger the absolute value of the Vmax is, the larger the force of the electric field becomes, and so the amount of toner T that adheres to the photoconductor 20 increases.

When the development-bias generating device 126 applies a Vmin to the developing roller 510, the toner T adhering to the photoconductor 20 flies toward the developing roller 510 and returns thereto. When the Vmin is applied to the developing roller 510, an electric field is generated due to the difference between the electric potential of the developing roller 510 (for example, 300 V) caused by the Vmin, and the electric potential of the photoconductor 20 on which the latent image is formed (for example, electric potential of the image section: −50 V; electric potential of the non-image section: −530 V). The negatively-charged toner T adhering to the photoconductor 20 flies toward the developing roller 510 due to the force caused by the electric field and returns to the developing roller 510. It should be noted that the toner T that returns to the developing roller 510 is a portion of the toner T that adhered to the photoconductor 20, and the toner T that remains on the photoconductor 20 without returning to the developing roller 510 is used for developing the latent image. It should be noted that, the larger the absolute value of the Vmin is, the larger the force of the electric field becomes, and so the amount of toner T that returns to the developing roller 510 increases.

Before the development-bias generating device 126 applies the Vmax and the Vmin to the developing roller 510, the toner T borne on the developing roller 510 is not in contact with the photoconductor 20. Therefore, development of a latent image will not be carried out if neither the Vmax nor Vmin is applied to the developing roller 510.

Further, as shown in FIG. 7, the time for which the development-bias generating device 126 applies the Vmax to the developing roller 510 is 133 μs, and the time for which it applies the Vmin to the developing roller 510 is 200 μm.

(1) Operation of the Printer 10

Figure 8:
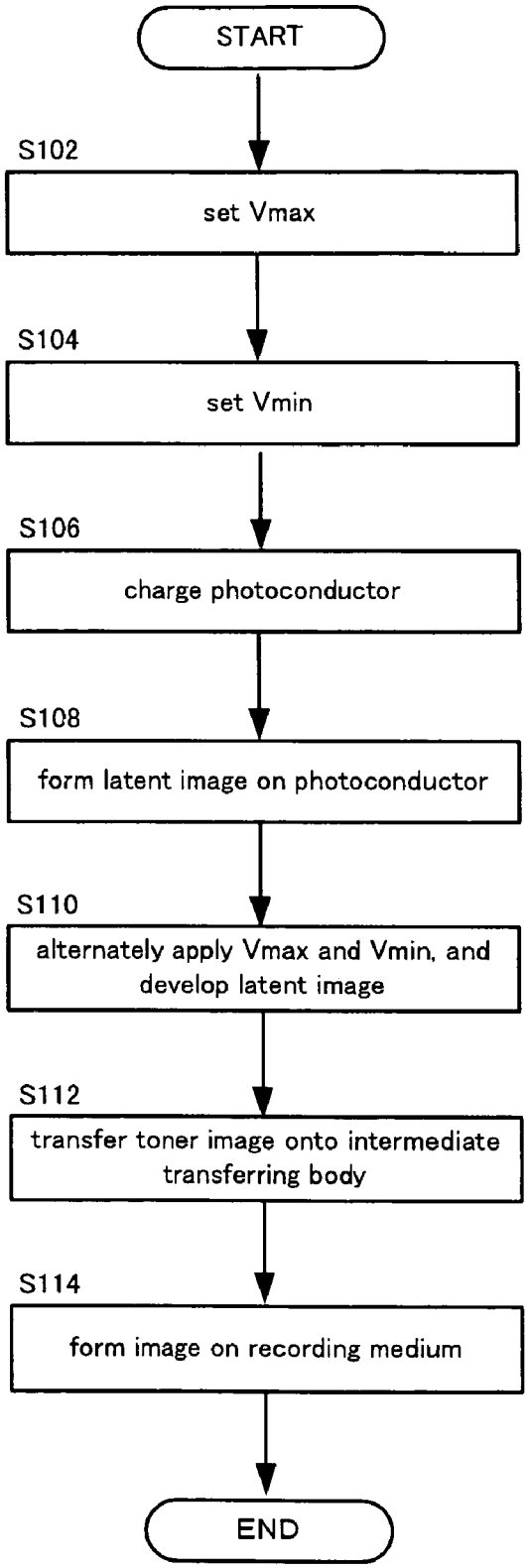
FIG. 8 is a flowchart for describing the operation of the printer 10.

The operation of the printer 10 in which it adjusts the darkness of an image and forms the image on a recording medium will be described with reference to FIG. 8. FIG. 8 is a flowchart for describing the operation of the printer 10.

The various operations of the printer 10 described below are mainly achieved by the controller section 101 or the unit controller 102 in the printer 10. Particularly, in the present embodiment, they are achieved by the CPU processing a program stored in a program ROM. The program is made of codes for achieving the various operations described below.

First, when the power of the printer 10 is turned ON, the Vmax setting section 125*a* provided in the unit controller 102 sets, for each developing unit, a Vmax in accordance with the amount of usage of each of the developing units 51, 52, 53, and 54 (S102). In the present embodiment, the Vmax setting section 125*a* sets the Vmax value to −1250 V when the amount of usage of the developing unit (developing-unit usage amount) is in the initial stage, sets the Vmax value to −1300 V when the developing-unit usage amount is in the mid-stage, and sets the Vmax value to −1350 V when the developing-unit usage amount is in the terminal stage. That is, the Vmax setting section 125*a* makes the absolute value of the Vmax larger as the developing-unit usage amount becomes larger. It should be noted that the method of setting the Vmax in accordance with the usage amount of the developing units 51, 52, 53, and 54 will be described further below.

Next, in order to adjust the darkness of an image to be formed on a recording medium, the Vmin setting section 125*b* provided in the unit controller 102 sets, for each developing unit, a Vmin based on a result of detecting the darkness of a patch image using the patch sensor PS (S104). Here, of the Vmax and the Vmin, the Vmin setting section 125*b* changes only the Vmin; that is, it maintains the Vmax set by the Vmax setting section 125*a* at S102, but changes the Vmin to adjust the darkness of an image to be formed on a recording medium.

Figure 9:
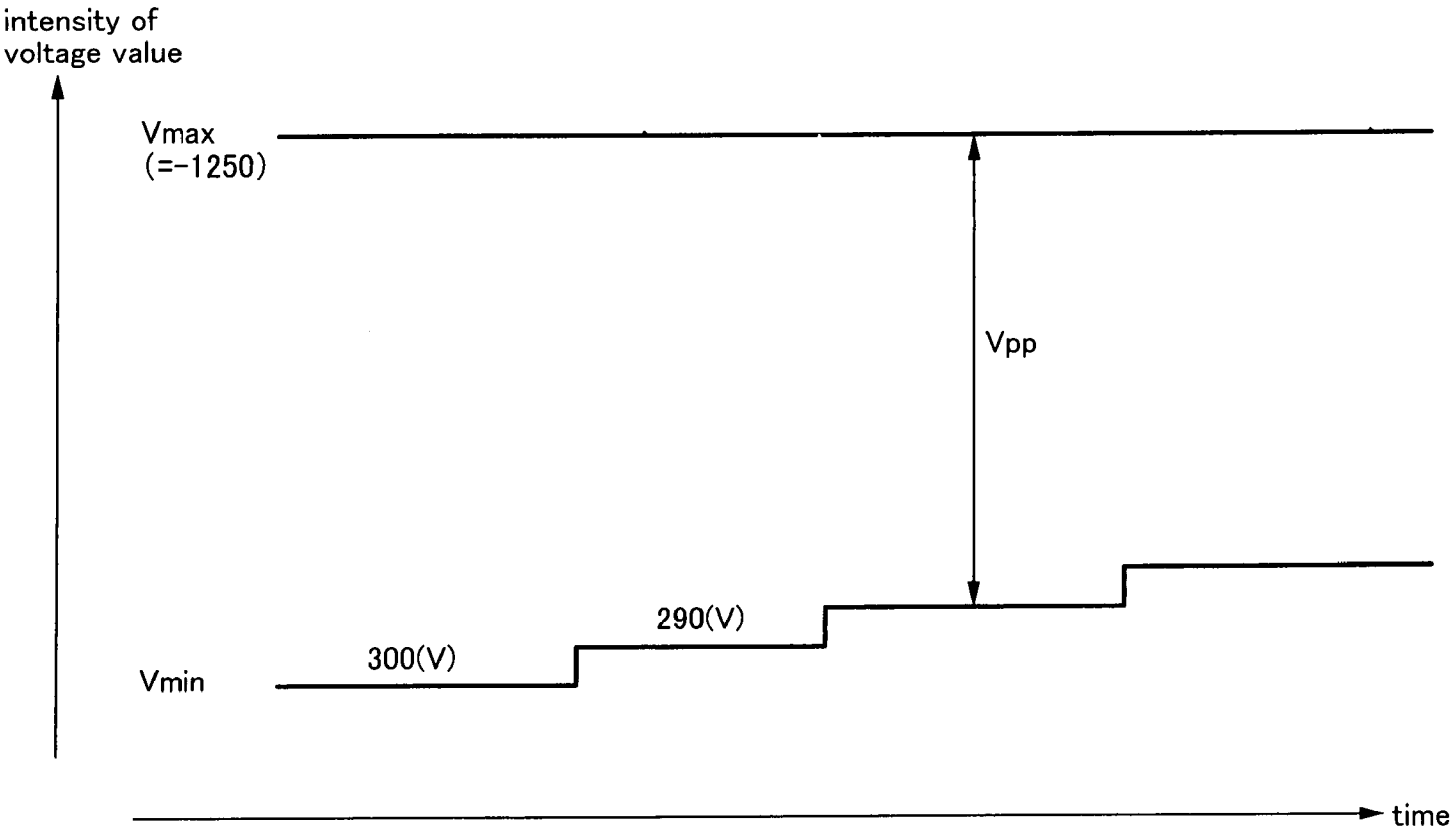
FIG. 9 is a schematic diagram showing the change in Vmax and Vmin when the developing-unit usage amount is in the initial stage.

This is explained in more detail. As shown in FIG. 9, when the developing-unit usage amount is in the initial stage, the Vmin setting section 125*b* maintains the Vmax at −1250 V, but changes the Vmin (for example, changes it from 300 V to 290 V) to adjust the image darkness. It should be noted that since only the Vmin is changed, the difference between the Vmax and the Vmin ("Vpp" in FIG. 9) is not constant. Note that FIG. 9 is a schematic diagram showing the change in Vmax and Vmin when the developing-unit usage amount is in the initial stage.

It should be noted that the method of setting the Vmin in accordance with the result of detecting the darkness of a patch image using the patch sensor PS will be described further below.

Next, when an image signal is input from a not-shown host computer to the controller section 101 of the printer 10 through the interface (I/F) 112, the photoconductor 20, the developing roller which is provided in each developing unit 51, 52, 53, and 54, and the intermediate transferring body 70 rotate under the control of the unit controller 102 based on the instructions from the controller section 101. The unit controller 102 controls the charging unit 30 so as to charge the photoconductor 20 (S106). The charging unit 30 successively charges the rotating photoconductor 20 at a charging position.

Next, the unit controller 102 controls the exposing unit 40 so as to form a latent image on the charged photoconductor 20 (S108). With the rotation of the photoconductor 20, the charged area of the photoconductor 20 reaches an exposing position, and a latent image that corresponds to the image information about the first color, for example, yellow Y, is formed in that area by the exposing unit 40. Further, the developing-unit holding unit 50 positions the yellow developing unit 54, which contains yellow (Y) toner, at the developing position opposing the photoconductor 20.

Next, the development-bias generating device 126 provided in the unit controller 102 alternately applies, to the developing roller 510, the Vmax set by the Vmax setting section 125*a* at S102 and the Vmin set by the Vmin setting section 125*b* at S104 (S110). Here, the development-bias generating device 126 alternately applies, to the developing roller 510, a Vmax whose value is −1250 V and a Vmin whose value is 290 V. In this way, the latent image formed on the photoconductor 20 reaches the developing position along with the rotation of the photoconductor 20, and is developed with toner by the developing roller 510. Thus, a toner image is formed on the photoconductor 20.

Next, the unit controller 102 controls the first transferring unit so as to transfer, onto the intermediate transferring body 70, the toner image that has been formed on the photoconductor 20 (S112). With the rotation of the photoconductor 20, the toner image formed on the photoconductor 20 reaches a first transferring position, and is transferred onto the intermediate transferring body 70 by the first transferring unit 60. At this time, a first transferring voltage, which is in an opposite polarity from the polarity to which the toner is charged, is applied to the first transferring unit 60. It should be noted that, during this process, the second transferring unit 80 is kept separated from the intermediate transferring body 70.

By successively performing the above-mentioned processes (S106 to S112) for the second, the third, and the fourth colors, toner images in four colors corresponding to the respective image signals are transferred onto the intermediate transferring body 70 in a superimposed manner. As a result, a full-color toner image is formed on the intermediate transferring body 70. Then, with the rotation of the intermediate transferring body 70, the full-color toner image formed on the intermediate transferring body 70 reaches a second transferring position, where it is transferred onto a recording medium by the second transferring unit 80. In this way, an image is formed on a recording medium (S114). It should be noted that the recording medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 70.

The full-color toner image transferred onto the recording medium is heated and pressurized by the fusing unit 90 and fused to the recording medium. On the other hand, after the photoconductor 20 has passed the first transferring position, the toner adhering to the surface of the photoconductor 20 is scraped off by the cleaning blade 76 that is supported on the cleaning unit 75, and the photoconductor 20 is prepared for charging for formation of the next latent image. The scraped-off toner is collected into a remaining-toner collector of the cleaning unit 75.

(1) Method of Setting Vmax in Accordance with Developing-unit Usage Amount

As described above, the value of Vmax differs depending on the amount of usage of each of the developing units 51, 52, 53, and 54. In this example, the usage amount of each developing unit 51, 52, 53, 54 is the total drive time of the developing roller 510 provided in the relevant developing unit, and the total consumption amount of the toner T contained in the relevant developing unit (or, total dot-count number). Further, as shown in FIG. 10, the term "the developing-unit usage amount is in the initial stage" means that the total drive time of the developing roller 510 is 3000 s or less and the total dot-count number is 30000 or less; the term "the developing-unit usage amount is in the mid-stage" means that the total drive time of the developing roller 510 is 3000 s or less and the total dot-count number is 30001 to 60000, or, the total drive time is 3001 to 6000 s and the total dot-count number is 30000 or less; the term "the developing-unit usage amount is in the terminal stage" refers to a state in which the total drive time and the total dot-count number are not within the above-mentioned range. It should be noted that FIG. 10 is a diagram showing a Vmax setting table showing the relationship between Vmax, and the total drive time and the total dot-count number.

Figure 11:
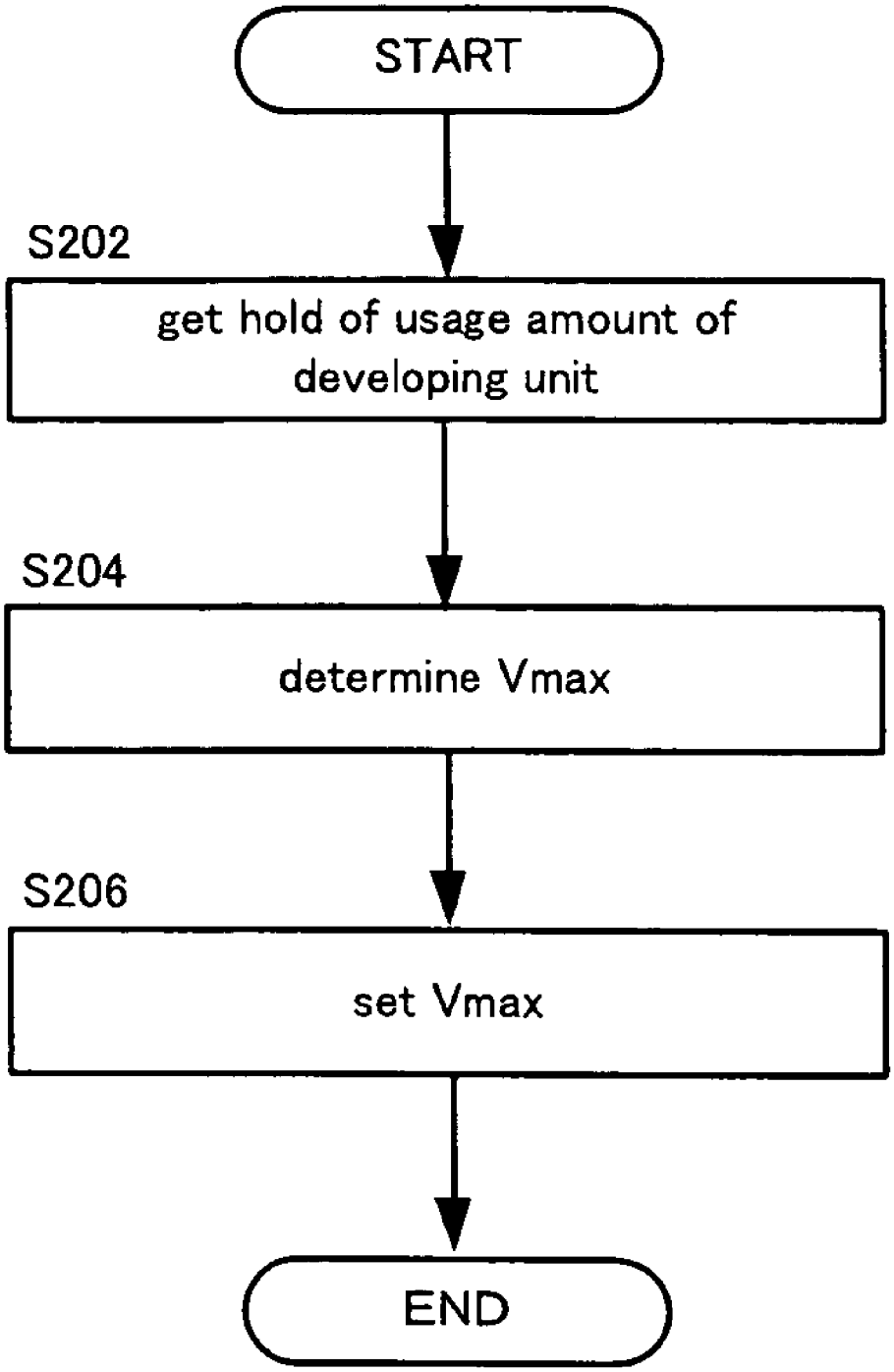
FIG. 11 is a flowchart showing a method of setting the Vmax in accordance with the developing-unit usage amount.

The method of setting the Vmax in accordance with the usage amount of the developing units 51, 52, 53, and 54 will be described with reference to FIG. 11. FIG. 11 is a flowchart showing a method of setting the Vmax in accordance with the developing-unit usage amount.

First, the unit controller 102 gets hold of the developing-unit usage amount (S202). The unit controller 102 references the total drive time of the developing roller 510 and the total dot-count number stored in the apparatus-side memory 122 to get hold of the developing-unit usage amount. In this example, it is assumed that the unit controller 102 has found that the total drive time of the developing roller 510 is 5000 s and the total dot-count number is 40000.

Next, the unit controller 102 references the Vmax setting table (see FIG. 10) stored, for example, in the unit-controller-side memory 116, and determines the Vmax (S204). For example, if the total drive time of the developing roller 510 is 5000 s and the total dot-count number is 40000, then the unit controller 102 determines the Vmax to be −1350 V by referencing the Vmax setting table. Then, the unit controller 102 stores the Vmax determined for each developing unit in a predetermined region of the apparatus-side memory 122.

Next, the Vmax setting section 125*a* sets, for each developing unit, the Vmax that has been determined (S206). For example, if the total drive time of the developing roller 510 is 5000 s and the total dot-count number is 40000, then the Vmax setting section 125*a* sets the Vmax to −1350 V.

Figure 12:
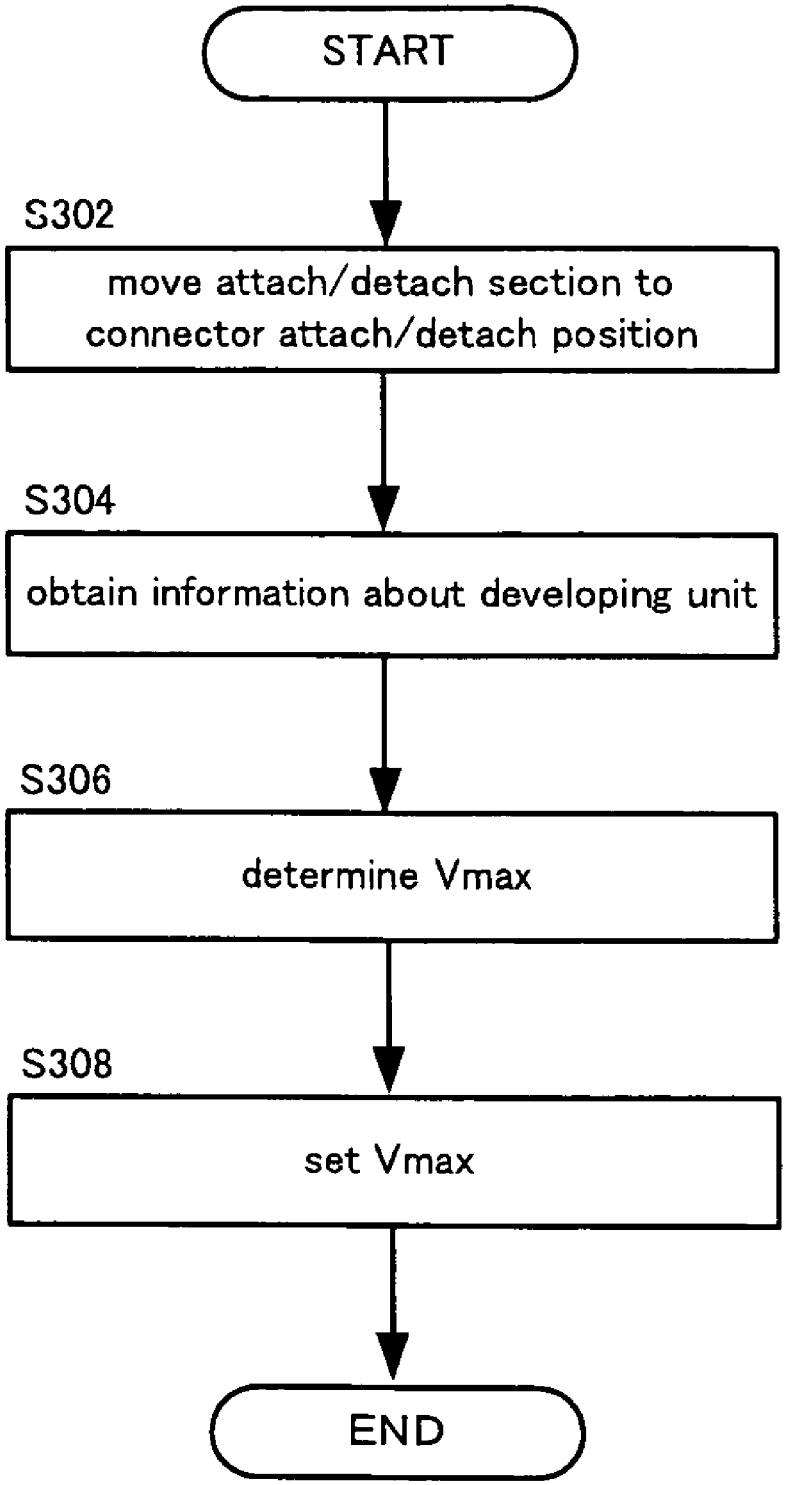
FIG. 12 is a flowchart showing a method of performing initial setting of the Vmax.

Incidentally, each of the developing units 51, 52, 53, and 54 is attachable to and detachable from the respective attach/detach sections 50*a*, 50*b*, 50*c*, and 50*d*. The printer 10 carries out setting of the Vmax (which is also referred to as "initial setting of the Vmax") when each of the developing units 51, 52, 53, and 54 is attached to the respective attach/detach section. The initial setting of the Vmax is described with reference to FIG. 12. FIG. 12 is a flowchart showing a method of performing initial setting of the Vmax.

Initial setting of the Vmax is started in a state where the developing units have been attached to their respective attach/detach sections. The unit controller 102 rotates the developing-unit holding unit 50 to successively move the four attach/detach sections to the connector attach/detach position (S302).

Next, the unit controller 102 moves the apparatus-side connector 34 to obtain information stored in the developing-unit-side memory of a developing unit if there is a developing unit attached to the attach/detach section positioned at the connector attach/detach position (S304). For example, if a yellow developing unit 54 is attached to the attach/detach section 50*d* positioned at the connector attach/detach position, then the unit controller 102 obtains information stored in the developing-unit-side memory 54*a* of the yellow developing unit 54. The unit controller 102 reads out, as information about the developing unit, such information as color information regarding the color of the toner contained, the total consumption amount of the toner T contained (total dot-count number), and total drive time of the developing roller 510. Then, the unit controller 102 stores, for each developing unit, the information in a predetermined region of the apparatus-side memory 122.

Next, the unit controller 102 determines the Vmax (S306) by referencing the information about the developing unit stored in the apparatus-side memory 122 and the Vmax setting table (see FIG. 10) stored, for example, in the unit-controller-side memory 116. For example, if the total drive time of the developing roller 510 is 1000 s and the total dot-count number is 8000, then the unit controller 102 determines the Vmax to be −1250 V. Then, the unit controller 102 stores the Vmax determined for each developing unit in a predetermined region of the apparatus-side memory 122.

Next, the Vmax setting section 125*a* sets, for each developing unit, the Vmax that has been determined (S308). For example, if the total drive time of the developing roller 510 is 1000 s and the total dot-count number is 8000, the Vmax setting section 125*a* sets the Vmax to −1250 V.

(1) Method of Setting Vmin

Figure 13:
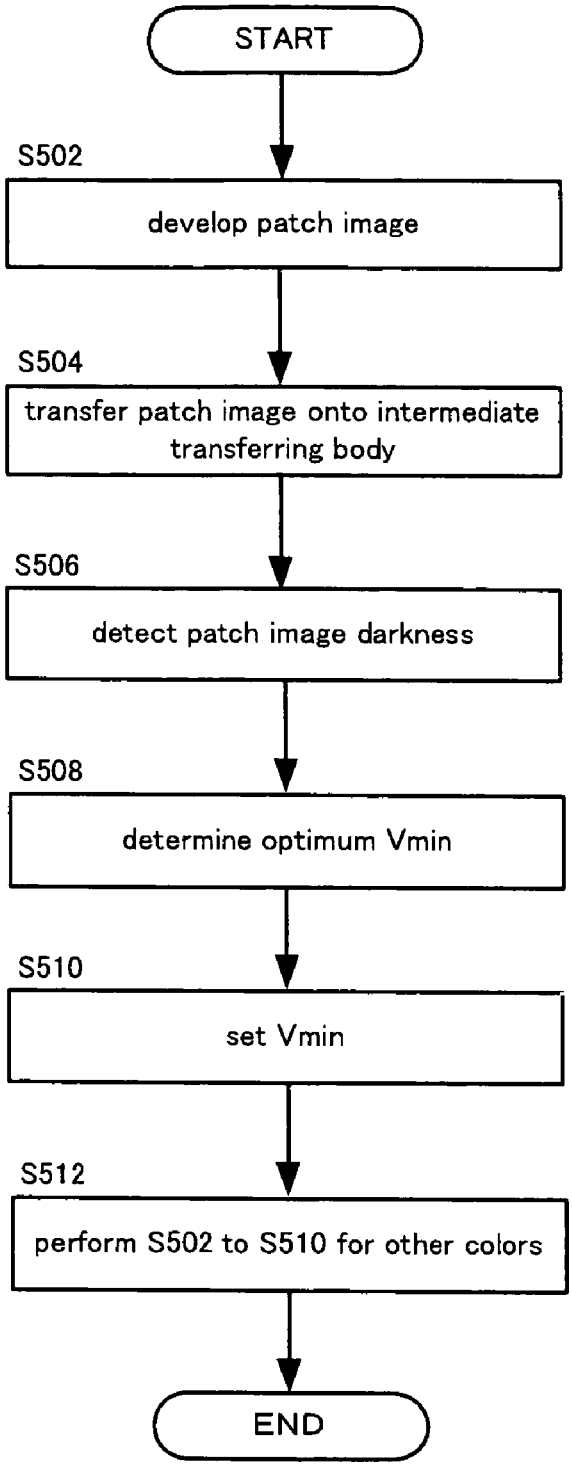
FIG. 13 is a flowchart showing a method of setting the Vmin.
Figure 14:
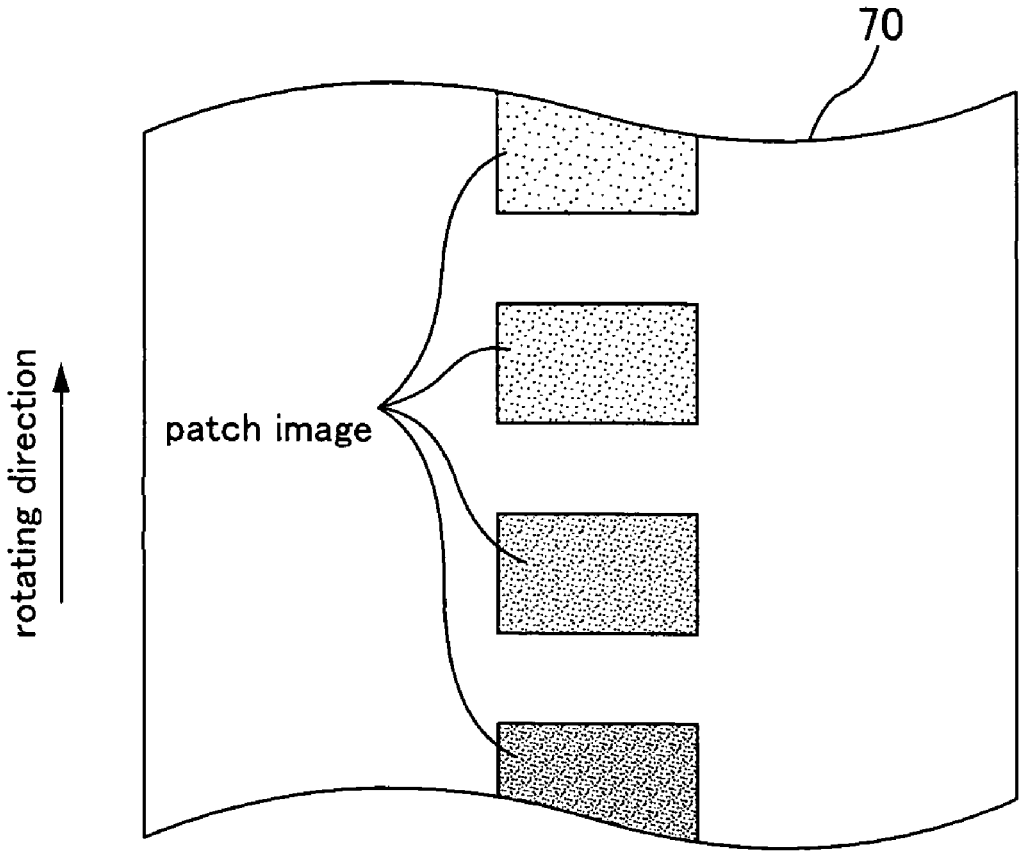
FIG. 14 is a schematic diagram showing how patch images are formed on an intermediate transferring body 70.

As described above, the printer 10 carries out, at a predetermined timing, a control operation for adjusting the darkness of an image (or, "Vmin setting operation"). Here, an example of the control operation is described with reference to FIG. 13 and FIG. 14. FIG. 13 is a flowchart showing a method of setting the Vmin. FIG. 14 is a schematic diagram showing how patch images are formed on the intermediate transferring body 70. It should be noted that the various operations of the printer 10 described below are mainly achieved by the controller section 101 or the unit controller 102 in the printer 10. Particularly, in the present embodiment, they are achieved by the CPU processing a program stored in a program ROM. The program is made of codes for achieving the various operations described below.

First, the printer 10 develops patch images (step S502). While being rotated, the photoconductor 20 is successively charged by the charging unit 30 at the charging position. With the rotation of the photoconductor 20, the charged area of the photoconductor 20 reaches the exposing position, and patch latent images that correspond to information about patch images of the first color, for example, yellow Y, are formed in that area by the exposing unit 40. With the rotation of the photoconductor 20, the patch latent images formed on the photoconductor 20 reach the developing position and are developed with yellow toner by the yellow developing unit 54. Here, development of the patch latent images is performed while changing the Vmin of the development bias applied by the development-bias generating device 126, that is, by changing the DC voltage and the AC voltage. In this way, patch images are formed on the photoconductor 20.

With the rotation of the photoconductor 20, the patch images formed on the photoconductor 20 reach the first transferring position, and are transferred onto the intermediate transferring body 70 by the first transferring unit 60 (step S504). In this way, a plurality of patch images, each having a different darkness, are formed in a line on the intermediate transferring body 70, as shown in FIG. 14.

As each patch image on the intermediate transferring body 70 reaches the position that is in opposition to the patch sensor PS with the rotation of the intermediate transferring body 70, the darkness of that patch image is detected by the patch sensor PS (step S506).

Then, when the darkness of all the patch images has been detected, the optimum Vmin, i.e., the optimum DC voltage and AC voltage, is determined based on the darkness-detection result, that is, by comparing the darkness detected for each patch image with the desired image darkness (step S508). The Vmin that has been determined is then stored, for each developing unit, in a predetermined region of the apparatus-side memory 122.

Next, the above-mentioned Vmin setting section 125*b* sets the Vmin that has been determined, so that it is possible to carry out development at an optimum development bias after performing the above-mentioned control operation (step S510).

It should be noted that the remaining toner T that forms the patch images for which darkness detection has finished is successively cleaned by a intermediate-transferring-body cleaning unit (not shown).

By successively performing, for each developing unit, the above-mentioned processes for the second, the third, and the fourth colors, the optimum Vmin is set for each color, and the control operation for adjusting the image darkness is completed (step S512).

It should be noted that in the foregoing, a plurality of patch images each having a different darkness were formed. This, however, is not a limitation, and for example, it is also possible to form a single patch image whose darkness gradually changes.

(1) Selective Development

As described above, when a development bias is applied to the developing roller 510, the toner T borne on the developing roller 510 flies toward the photoconductor 20 and adheres thereto, thereby developing a latent image. However, depending on the intensity of the development bias, there are cases in which so-called "selective development" occurs, in which a portion of the toner T borne on the developing roller 510 does not fly toward the photoconductor 20 and thus latent-image development is not carried out properly.

The reason why "selective development" occurs is as follows. The toner T borne on the developing roller 510 is electrically charged by the restriction blade 560. However, the charge amount of the toner T is not uniform, and toner particles having different charge amounts are borne on the developing roller 510. Incidentally, the toner T is borne on the developing roller 510 by means of, for example, an image force that acts between it and the developing roller 510. Therefore, if the absolute value of the Vmax applied to the developing roller 510 is too small, then the force for making the toner T move from the developing roller 510 toward the photoconductor 20 becomes smaller than the image force etc., and thus, it becomes unable to make the highly-charged toner to move from the developing roller 510 toward the photoconductor 20.

The relationship between the development bias and selective development is explained in more detail using measurement results.

Figure 15A:
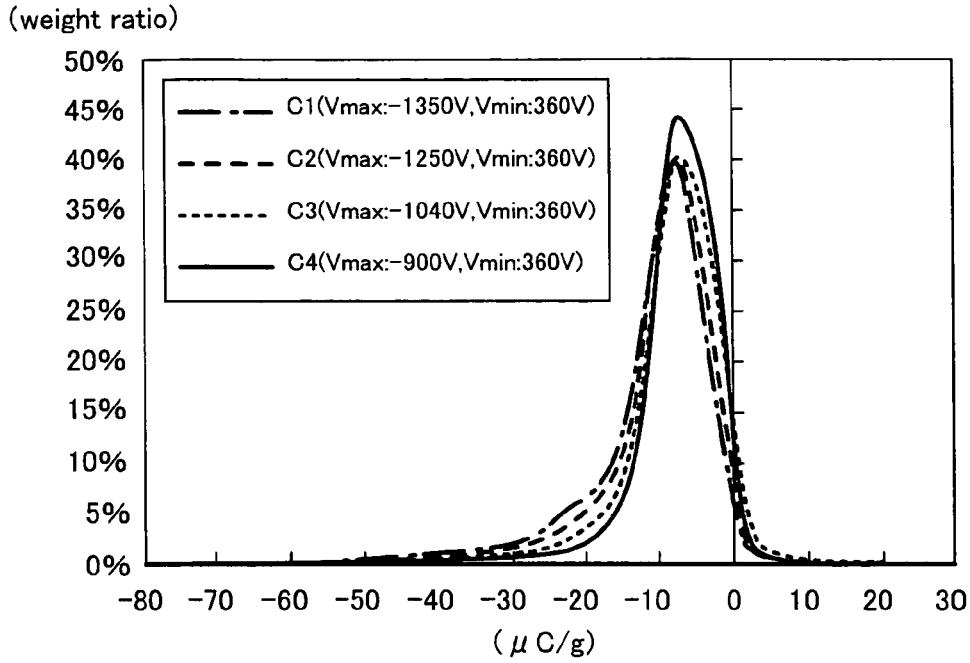
FIG. 15A is a graph showing the relationship between the charge amount of toner T adhering to the photoconductor 20 and the weight of the toner T when only the Vmax is changed.
Figure 15B:
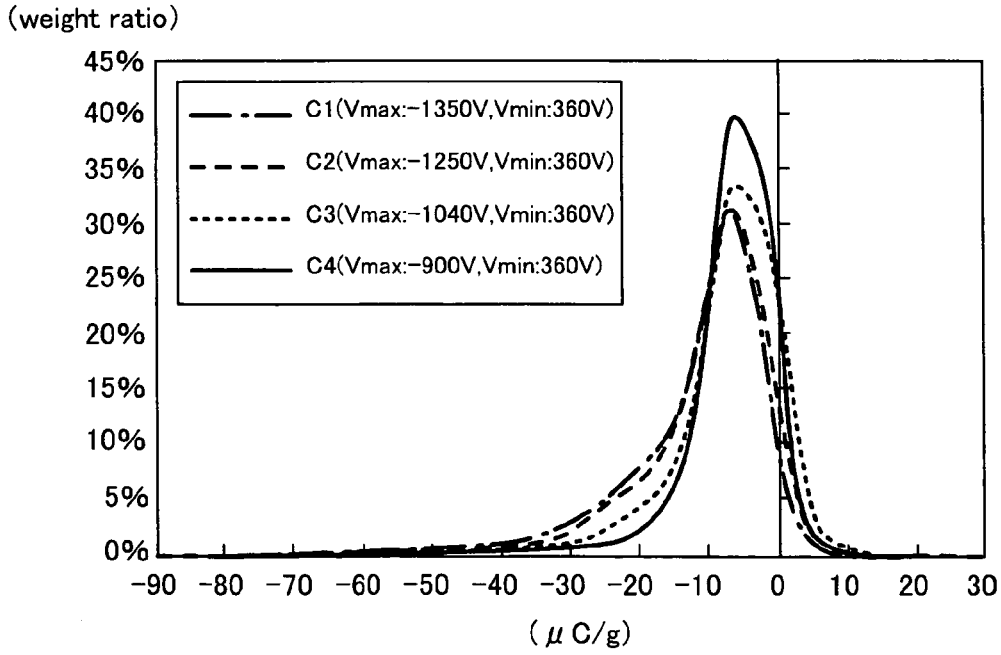
FIG. 15B is a graph showing the relationship between the charge amount of toner T adhering to the photoconductor 20 and the number of particles of toner T when only the Vmax is changed.

First, the relationship between the development bias and selective development for a case where only the Vmax of the development bias was changed is described with reference to FIG. 15A and FIG. 15B. FIG. 15A is a graph showing the relationship between the charge amount of toner T adhering to the photoconductor 20 and the weight of the toner T when only the Vmax is changed. FIG. 15B is a graph showing the relationship between the charge amount of toner T adhering to the photoconductor 20 and the number of particles of toner T when only the Vmax is changed.

In this example, four types of development biases C1, C2, C3, and C4, each having a different Vmax, are each applied to the developing roller 510. Development bias C1 has a Vmax of −1350 V and a Vmin of 360 V. Development bias C2 has a Vmax of −1250 V and a Vmin of 360 V. Development bias C3 has a Vmax of −1040 V and a Vmin of 360 V. Development bias C4 has a Vmax of −900 V and a Vmin of 360 V.

As shown in FIG. 15A and FIG. 15B, it can be seen that, for all types of development biases C1, C2, C3, and C4, the amount of adherence, to the photoconductor 20, of toner T whose charge amount is around −5 μC/g is large, whereas the adherence amount of toner T, to the photoconductor 20, whose charge amount is around −20 μC/g (which is referred to as "highly-charged toner" below) is small.

As for development biases C3 and C4, the amount of highly-charged toner adhering to the photoconductor 20 is smaller, compared to development biases C1 and C2. That is, as for development biases C3 and C4, it is difficult for the highly-charged toner T borne on the developing roller 510 to fly toward the photoconductor 20, and thus, selective development occurs. Furthermore, when comparing development bias C3 and development bias C4, the tendency of occurrence of selective development is stronger for development bias C4, whose Vmax absolute value is smaller. Therefore, it can be said that making the Vmax absolute value of the development bias larger would be effective in order to prevent selective development from occurring.

Figure 16A:
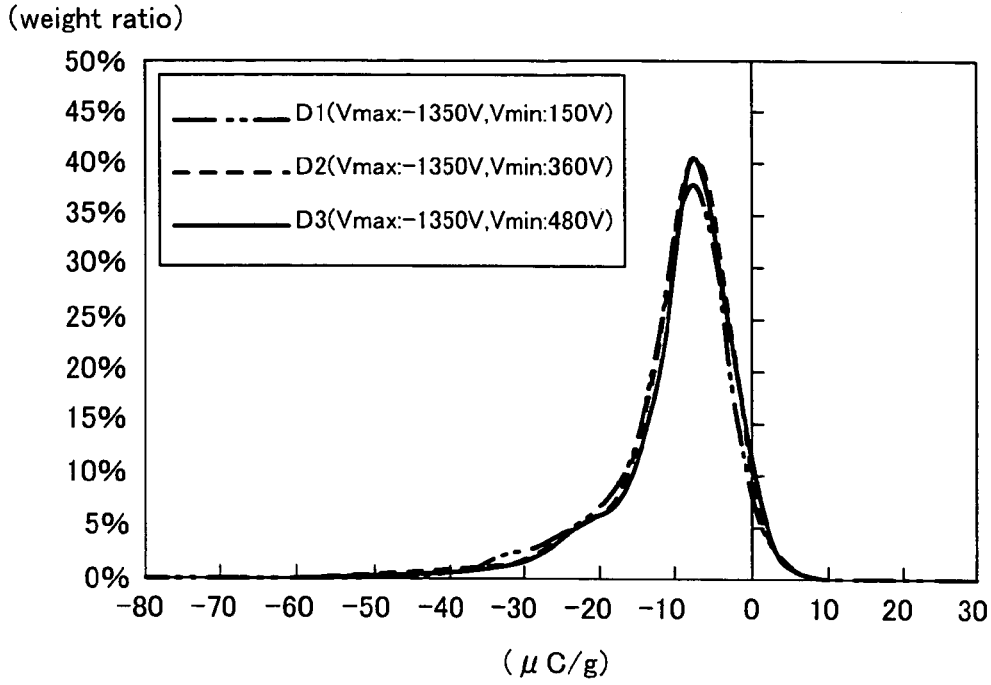
FIG. 16A is a graph showing the relationship between the charge amount of toner T adhering to the photoconductor 20 and the weight of the toner T when only the Vmin is changed.
Figure 16B:
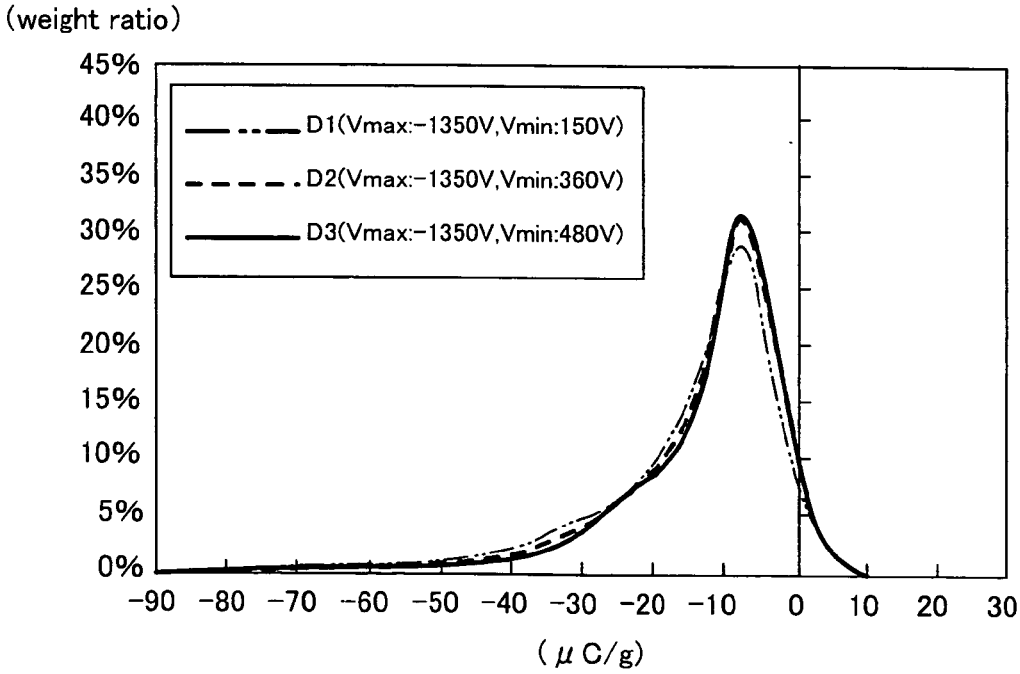
FIG. 16B is a graph showing the relationship between the charge amount of toner T adhering to the photoconductor 20 and the number of particles of toner T when only the Vmin is changed.

Next, the relationship between the development bias and selective development for a case where only the Vmin of the development bias is changed is described with reference to FIG. 16A and FIG. 16B. FIG. 16A is a graph showing the relationship between the charge amount of toner T adhering to the photoconductor 20 and the weight of the toner T when only the Vmin is changed. FIG. 16B is a graph showing the relationship between the charge amount of toner T adhering to the photoconductor 20 and the number of particles of toner T when only the Vmin is changed.

In this example, three types of development biases D1, D2, and D3, each having a different Vmin, are each applied to the developing roller 510. Development bias D1 has a Vmax of −1350 V and a Vmin of 150 V. Development bias D2 has a Vmax of −1350 V and a Vmin of 360 V. Development bias D3 has a Vmax of −1350 V and a Vmin of 480 V.

As shown in FIG. 16A and FIG. 16B, it can be seen that there is not much difference in the amount of highly-charged toner T that adheres to the photoconductor 20 among development biases D1, D2, and D3. Therefore, it can be said that selective development is less likely to occur even when the Vmin of the development bias is changed.

(1) Function of Development Bias According to the Present Embodiment

As described above, the Vmin setting section 125*b* changes only the Vmin, of the Vmax (first voltage) and the Vmin (second voltage), to adjust the darkness of an image to be formed on a recording medium. In this way, it becomes possible to prevent so-called selective development from occurring. This is described in more detail below.

Figure 17:
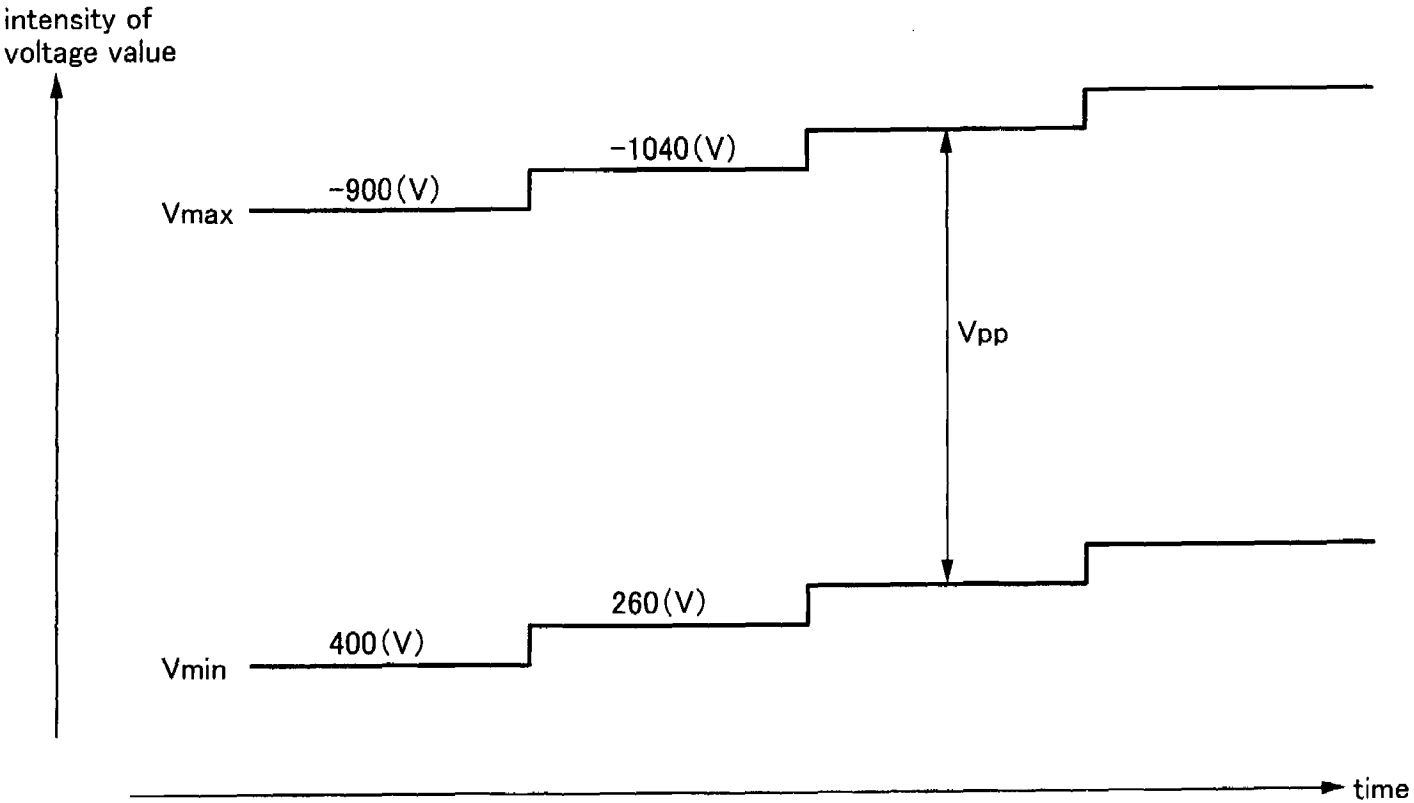
FIG. 17 is a diagram for describing a comparative example.

First, a comparative example is described with reference to FIG. 17. FIG. 17 is a diagram for describing a comparative example. In the comparative example, both the Vmax and Vmin are changed at the same time when adjusting the darkness of an image to be formed on a recording medium. More specifically, of the AC voltage and the DC voltage, only the DC voltage is changed, so that both the Vmax and Vmin become larger or smaller. Since only the DC voltage changes, the difference between the Vmax and Vmin ("Vpp" in FIG. 17) is always constant. In such a case, there are situations in which the Vmax becomes small.

When the Vmax is small, a portion of the highly-charged toner T does not fly from the developing roller 510 toward the photoconductor 20, and thus, so-called selective development occurs. For example, when the Vmax is −900 V or −1040 V, a portion of the highly-charged toner T borne on the developing roller 510 does not fly toward the photoconductor 20 even when the development bias is applied to the developing roller 510, as shown in FIG. 15A and FIG. 15B, and this causes the so-called selective development.

Furthermore, when selective development occurs, the highly-charged toner T remains borne on the developing roller 510; thus, it becomes difficult for the developing roller 510 to bear new toner T supplied by the toner supplying roller 550.

On the other hand, in the present embodiment, the Vmin setting section 125*b* changes only the Vmin, of the Vmax and the Vmin, when adjusting the darkness of an image to be formed on a recording medium. As shown in FIG. 9, the Vmin setting section 125*b* maintains the Vmax at a constant value of −1250 V, for example, but changes the Vmin in order to adjust the darkness of the image to be formed on the recording medium. In that case, since it is possible to prevent the Vmax from becoming small, it becomes possible to make the highly-charged toner T move toward the photoconductor 20 appropriately and therefore prevent the so-called selective development from occurring.

Furthermore, since the highly-charged toner T flies toward the photoconductor 20, the problem that it is difficult for the new toner T supplied by the toner supplying roller 550 to adhere to the developing roller 510, can be resolved.

As described above, by changing only the Vmin, of the Vmax and the Vmin, it becomes possible to make the highly-charged toner T fly toward the photoconductor 20 and thus prevent the so-called selective development from occurring.

(1) Other Considerations

An image forming apparatus according to the present first embodiment is a printer 10 (image forming apparatus) comprising: a photoconductor 20 (image bearing body); a developing roller 510 (developer bearing body); a transferring section (first transferring unit 60, intermediate transferring body 70, second transferring unit 80); a development-bias generating device 126 (voltage applying section); and a Vmin setting section 125*b* (image darkness adjusting section).

In the foregoing embodiment, as shown in FIG. 3 and FIG. 6, the printer 10 had a developing unit 51, 52, 53, 54 (developing device) that is provided with the developing roller 510 and that is for containing the toner to be borne by the developing roller 510, and a Vmax setting section 125*a* (first voltage setting section) for setting the Vmax in accordance with an amount of usage of the developing unit. Further, as shown in FIG. 9, the Vmin setting section 125*b* adjusted the darkness of the image to be formed on the recording medium by maintaining the Vmax that has been set by the Vmax setting section 125*a*, and changing the Vmin.

This, however, is not a limitation. For example, the printer 10 does not have to be provided with a Vmax setting section 125*a*, and the Vmin setting section 125*b* may maintain a Vmax that is a fixed value and change only the Vmin to adjust the darkness of an image to be formed on a recording medium.

However, under conditions where the Vmax is fixed, there is a tendency that the amount of toner T that adheres to the photoconductor 20 when the usage amount of the developing unit 51, 52, 53, 54 is small becomes larger, compared to the amount of toner T that adheres to the photoconductor 20 when the usage amount of the developing unit 51, 52, 53, 54 is large. Under such a condition, if the absolute value of the Vmax is increased from the viewpoint of preventing selective development, the amount of toner T that adheres to the photoconductor 20 will further increase. If an excessive amount of toner T adheres to the photoconductor 20, then there is a possibility that the quality of images, such as narrow lines, may deteriorate. Therefore, if a fixed value is used for the Vmax, then there is a possibility that the quality of images, such as narrow lines, may deteriorate.

On the other hand, in a case where the Vmax setting section 125*a* sets the Vmax in accordance with the amount of usage of the developing unit 51, 52, 53, 54, it is possible to prevent the amount of toner T adhering to the photoconductor 20 from becoming excessive by making the absolute value of the Vmax become larger in a stepwise manner according to the amount of usage of the developing unit. Therefore, it becomes possible to prevent selective development and also prevent deterioration in the quality of images, such as narrow lines. The foregoing embodiment is therefore more preferable.

In the foregoing embodiment, as shown in FIG. 10, the total drive time of the developing roller 510 provided in the developing unit and the total consumption amount of the toner T contained in the developing unit (total dot-count number) were used as the amount of usage of the developing unit 51, 52, 53, 54.

This, however, is not a limitation. For example, the amount of usage of the developing unit 51, 52, 53, 54 may be either one of the total drive time and the total dot-count number. The developing roller 510 is driven when the developing unit is used. Therefore, it becomes possible to get hold of the amount of usage of the developing unit accurately by adopting the total drive time of the developing roller 510 as the amount of usage of the developing unit. Further, the toner T is consumed when the developing unit is used. Therefore, it becomes possible to get hold of the amount of usage of the developing unit accurately by adopting the total consumption amount of toner T as the amount of usage of the developing unit. Further, the amount of usage of the developing unit 51, 52, 53, 54 may be information other than the total drive time and the total dot-count number.

However, by using both the total drive time and the total dot-count number as the amount of usage of the developing unit 51, 52, 53, 54, it becomes possible to get hold of the usage amount of developing unit more accurately.

In the foregoing embodiment, as shown in FIG. 1, the transferring section included an intermediate transferring body 70 (transferring medium member) through which the toner image (developer image) formed on the photoconductor 20 is transferred onto the recording medium (medium). Further, the transferring section transferred the toner image formed on the photoconductor 20 onto the intermediate transferring body 70, and transferred the toner image transferred on the intermediate transferring body 70 onto the recording medium, to form the image. Further, as shown in FIG. 1, the printer 10 had a patch sensor PS (darkness detection member) that detects a darkness of a patch image (test pattern) formed on the intermediate transferring body 70 for adjustment of the darkness of the image to be formed on the recording medium. Further, the Vmin setting section 125*b* changed the Vmin based on a result of detection of the darkness of the patch image by the patch sensor PS.

This, however, is not a limitation. For example, the patch sensor PS may detect the darkness of patch images formed on the photoconductor 20.

In the foregoing embodiment, the developing roller 510 was made of metal. This, however, is not a limitation. For example, the developing roller 510 may be non-metal.

However, when the developing roller 510 is made of metal, the image force between the toner T and the developing roller 510 is stronger compared to when the developing roller 510 is non-metal. Therefore, so-called selective development is likely to occur in cases where the absolute value of the Vmax is small. Therefore, the effect that it is possible to prevent so-called selective development is attained more effectively in cases where the developing roller 510 is made of metal. The foregoing embodiment is therefore more preferable.

In the foregoing embodiment, the toner T was manufactured using a grinding method. This, however, is not a limitation. For example, the toner may be made according to a polymerizing method.

However, a toner made through the grinding method has a wider charge distribution compared to a toner manufactured by the polymerizing method, and thus, so-called selective development is likely to occur. Therefore, the effect that it is possible to prevent so-called selective development is attained more effectively in cases where the toner is manufactured through the grinding method. The foregoing embodiment is therefore more preferable.

SECOND EMBODIMENT

(2) Overall Configuration of Image Forming Apparatus

Figure 18:
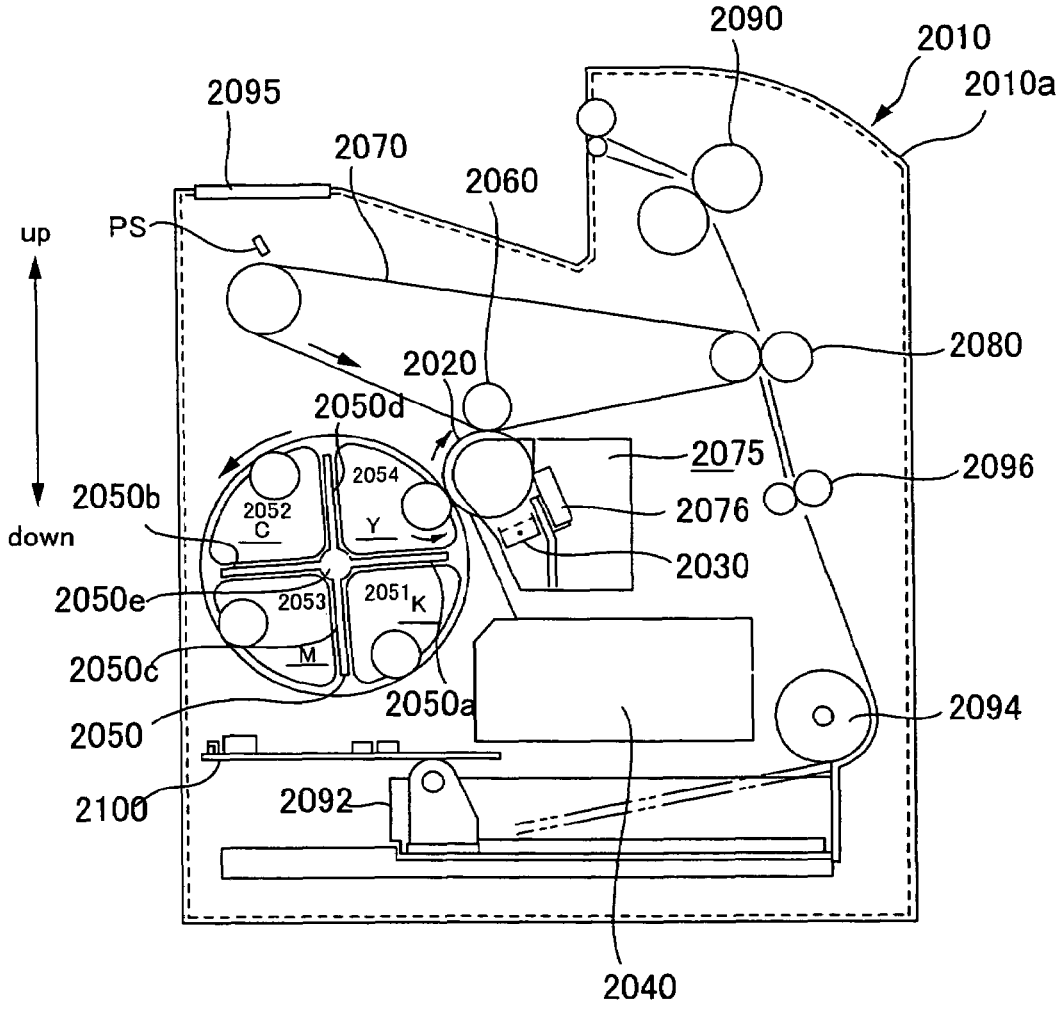
FIG. 18 is a diagram showing main structural components constructing a printer 2010.

Next, taking a laser beam printer 2010 (referred to also as "printer 2010" below) as an example of an "image forming apparatus", an overall configuration of the printer 2010 is described with reference to FIG. 18. FIG. 18 is a diagram showing main structural components constructing the printer 2010. It should be noted that in FIG. 18, the vertical direction is shown by the arrow, and, for example, a paper supply tray 2092 is arranged at a lower section of the printer 2010, and a fusing unit 2090 is arranged at an upper section of the printer 2010.

<Overall Configuration of Printer 2010>

As shown in FIG. 18, the printer 2010 according to the present embodiment includes a charging unit 2030 which is an example of a "charging section", an exposing unit 2040 which is an example of a "latent image forming section", a developing-unit holding unit 2050, a first transferring unit 2060, an intermediate transferring body 2070, and a cleaning unit 2075. These units are arranged in the direction of rotation of a photoconductor 2020, which serves as an example of an "image bearing body" for bearing a latent image. The printer 2010 further includes a second transferring unit 2080, a fusing unit 2090, a displaying unit 2095 constructed of a liquid-crystal panel and serving as means for making notifications to the user etc., and a control unit 2100 for controlling these units etc. and managing the operations as a printer.

The photoconductor 2020 has a cylindrical conductive base and a photoconductive layer formed on the outer peripheral surface of the conductive base, and it is rotatable about its central axis. In the present embodiment, the photoconductor 2020 rotates clockwise, as shown by the arrow in FIG. 18.

The charging unit 2030 is a device for electrically charging the photoconductor 2020. It should be noted that details on the charging unit 2030 will be described further below.

The exposing unit 2040 is a device for forming a latent image on the charged photoconductor 2020 by radiating a laser beam thereon. The exposing unit 2040 has, for example, a semiconductor laser, a polygon mirror, and an F-θ lens, and radiates a modulated laser beam onto the charged photoconductor 2020 according to image signals having been input from a not-shown host computer such as a personal computer or a word processor. In this way, the section of the photoconductor 2020 onto which the laser has been irradiated becomes the "image section", and the section of the photoconductor 2020 onto which the laser was not irradiated becomes the "non-image section". It should be noted that the electric potential of the image section is different from the electric potential (charge potential) of the non-image section.

The developing-unit holding unit 2050 is a device for developing the latent image formed on the photoconductor 2020 using black (K) toner contained in a black developing unit 2051, magenta (M) toner contained in a magenta developing unit 2053, cyan (C) toner contained in a cyan developing unit 2052, and yellow (Y) toner contained in a yellow developing unit 2054.

In the present embodiment, the developing-unit holding unit 2050 rotates to allow the positions of the four developing units 2051, 2052, 2053, and 2054, which serve as an example of "developing devices", to be moved. More specifically, the developing-unit holding unit 2050 holds the four developing units 2051, 2052, 2053, and 2054 respectively with four attach/detach sections 2050*a*, 2050*b*, 2050*c*, and 2050*d*, which are provided in the body 2010*a* of the printer 2010 (body of the image forming apparatus), and the four developing units 2051, 2052, 2053, and 2054 can be rotated about a rotating shaft 2050*e* while maintaining their relative positions. A different one of the developing units is made to selectively oppose the photoconductor 2020 each time the photoconductor 2020 makes one revolution, thereby successively developing the latent image formed on the photoconductor 2020 using the toner T, which is an example of a "developer", contained in each of the developing units 2051, 2052, 2053, and 2054. It should be noted that details on the developing units are described further below.

The first transferring unit 2060 is a device for transferring a toner image, which is an example of a "developer image", formed on the photoconductor 2020 onto the intermediate transferring body 2070, which is an example of a "transferring medium member". When toner images of four colors are successively transferred in a superposed manner, a full-color toner image is formed on the intermediate transferring body 2070. The intermediate transferring body 2070 is an endless belt that is driven to rotate at substantially the same circumferential speed as the photoconductor 2020.

Further, a patch sensor PS, which is an example of a "darkness detection member" for detecting the darkness of a patch image ("test pattern") formed on the intermediate transferring body 2070 for adjusting the darkness of an image to be formed on a recording medium, is arranged in the vicinity of the intermediate transferring body 2070. The patch sensor PS is a reflective optical sensor that achieves the function of detecting the darkness of the patch image. More specifically, the patch sensor PS has a light emitting section for emitting light and a light receiving section for receiving the light. The light emitted from the light emitting section toward the patch image, that is, the incident light, is reflected by the patch image. The reflected light is received by the light receiving section and is converted into an electric signal. The intensity of the electric signal is measured as the output value of the light receiving sensor corresponding to the intensity of the reflected light that has been received. Since there is a predetermined relationship between the darkness of the patch image and the intensity of the received reflected light, it is possible to detect the darkness of the patch image by measuring the intensity of the electric signal.

The second transferring unit 2080 is a device for transferring the single-color toner image, or the full-color toner image, formed on the intermediate transferring body 2070 onto a recording medium, which is an example of a "medium". It should be noted that the recording medium may be, for example, paper, film, or cloth. Further, the "transferring section" in this embodiment is the first transferring unit 2060, the intermediate transferring body 2070, and the second transferring unit 2080. The intermediate transferring body 2070 serves as a medium for when transferring, onto the recording medium, the toner image formed on the photoconductor 2020.

The fusing unit 2090 is a device for fusing the single-color toner image or the full-color toner image, which has been transferred to the recording medium, onto the recording medium such as paper to make it into a permanent image. The cleaning unit 2075 is a device that is provided between the first transferring unit 2060 and the charging unit 2030, that has a rubber cleaning blade 2076 made to abut against the surface of the photoconductor 2020, and that is for removing the toner remaining on the photoconductor 2020 by scraping it off with the cleaning blade 2076 after the toner image has been transferred onto the intermediate transferring body 2070 by the first transferring unit 2060.

Figure 26:
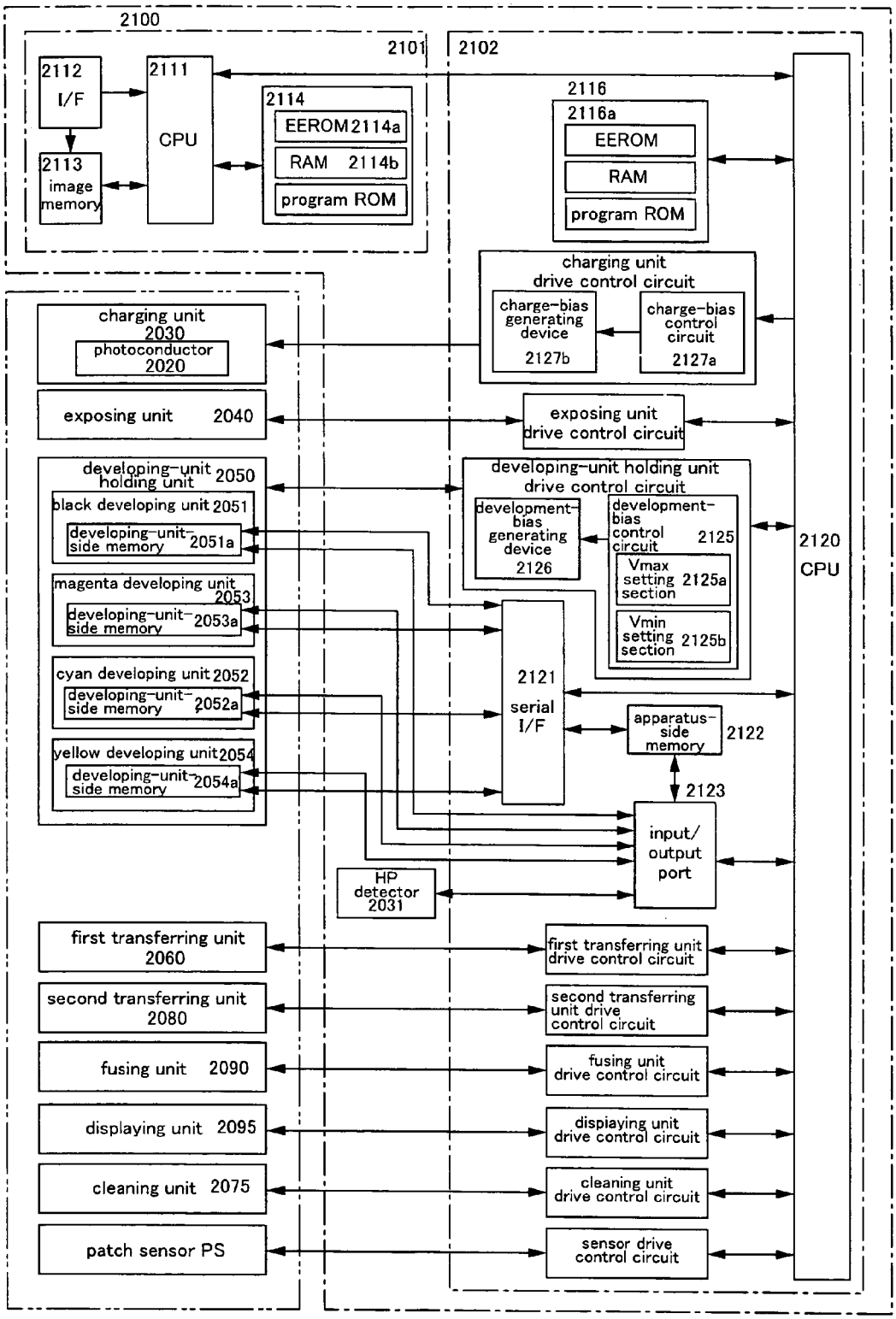
FIG. 26 is a block diagram showing a control unit 2100 of the printer 2010.

The control unit 2100 includes a controller section 2101 and a unit controller 2102 as shown in FIG. 26. Image signals are input to the controller section 2101, and according to instructions based on these image signals, the unit controller 2102 controls each of the above-mentioned units etc. to form an image.

(2) Overview of the Charging Unit

Figure 19:
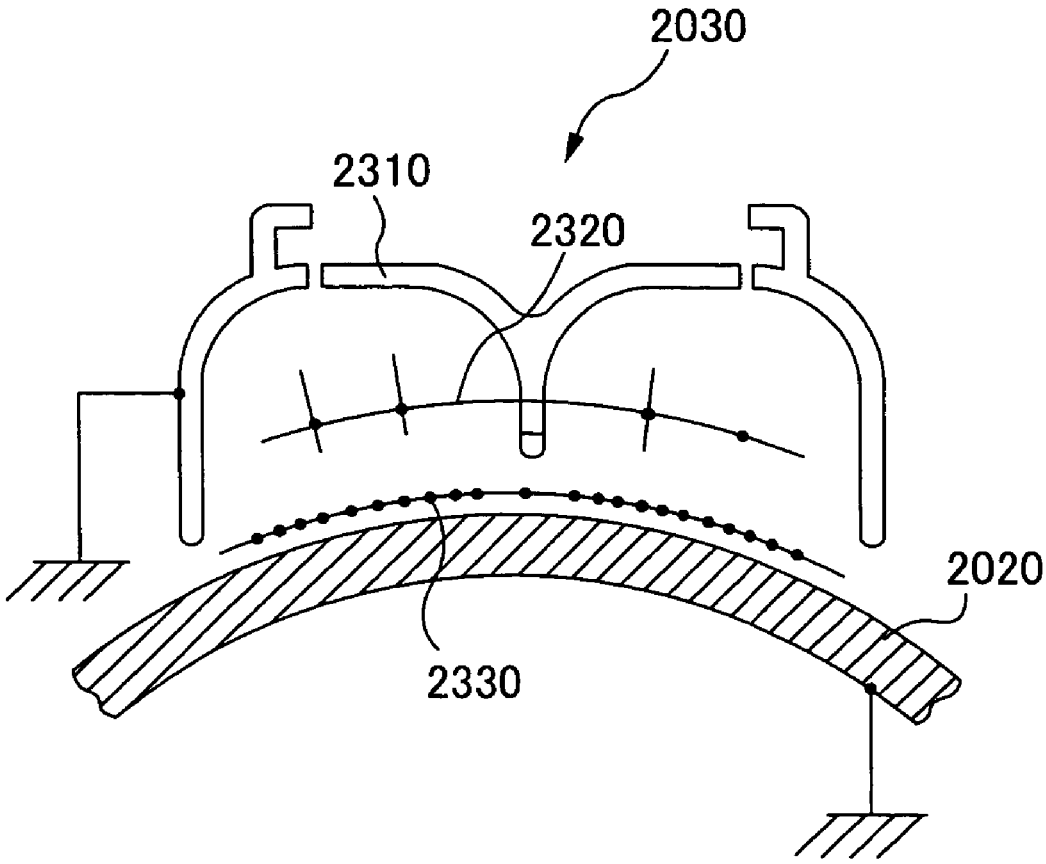
FIG. 19 is a section view showing main structural components of a charging unit 2030.

Next, with reference to FIG. 19, an overview of the charging unit 2030 will be described. FIG. 19 is a section view showing main structural components of the charging unit 2030.

In the present embodiment, a scorotron charging device is used as the charging unit 2030, as shown in FIG. 19. The scorotron charging device has a shield casing 2310, a discharge electrode 2320, and a grid 2330.

The shield casing 2310 has an opening on the side of the photoconductor 2020, and its cross-sectional shape is substantially like the letter "E".

The discharge electrode 2320 is provided substantially in the center of the shield casing 2310, and is a wire of approximately 50 to 100 μm in dimension. Both ends of the wire are supported by insulators, and thus, the shield casing 2310 and the discharge electrode 2320 are isolated from one another.

The grid 2330 is provided in the opening of the shield casing 2310 and is in opposition to the photoconductor 2020. The grid 2330 is made by arranging stainless-steel wires or tungsten wires at intervals of 1 to 3 mm. However, the grid 2330 may instead be made into a mesh-like form by subjecting a plate-like material to etching so that it is made into a net or so that it is provided with multiple parallel slits. A charge-bias generating device 2127*b* (see FIG. 26), which is an example of a "charge voltage applying section", provided in the charging unit drive control circuit applies a grid voltage (Vg), which is an example of a "charge voltage", to the grid 2330. Further, the charge-bias generating device 2127*b* also applies a predetermined electrode voltage to the discharge electrode 2320. It should be noted that the charging unit drive control circuit is provided with a charge-bias control circuit 2127*a* which is an example of a "charge voltage setting section" that serves to control the ON/OFF of the Vg and the electrode voltage and to set an appropriate grid-voltage value.

When a high voltage is applied to the discharge electrode 2320, an air discharge (corona discharge) occurs within the shield casing 2310, and corona ions are created. The corona ions thus created are controlled by the grid-voltage value applied to the grid 2330, to charge the surface of the photoconductor 2020 uniformly to a desired charge potential (Vo). For example, the Vg to be applied to the grid 2330 is set to −600 V in order to set the Vo of the photoconductor surface to −580 V.

(2) Overview of the Developing Unit

Figure 20:
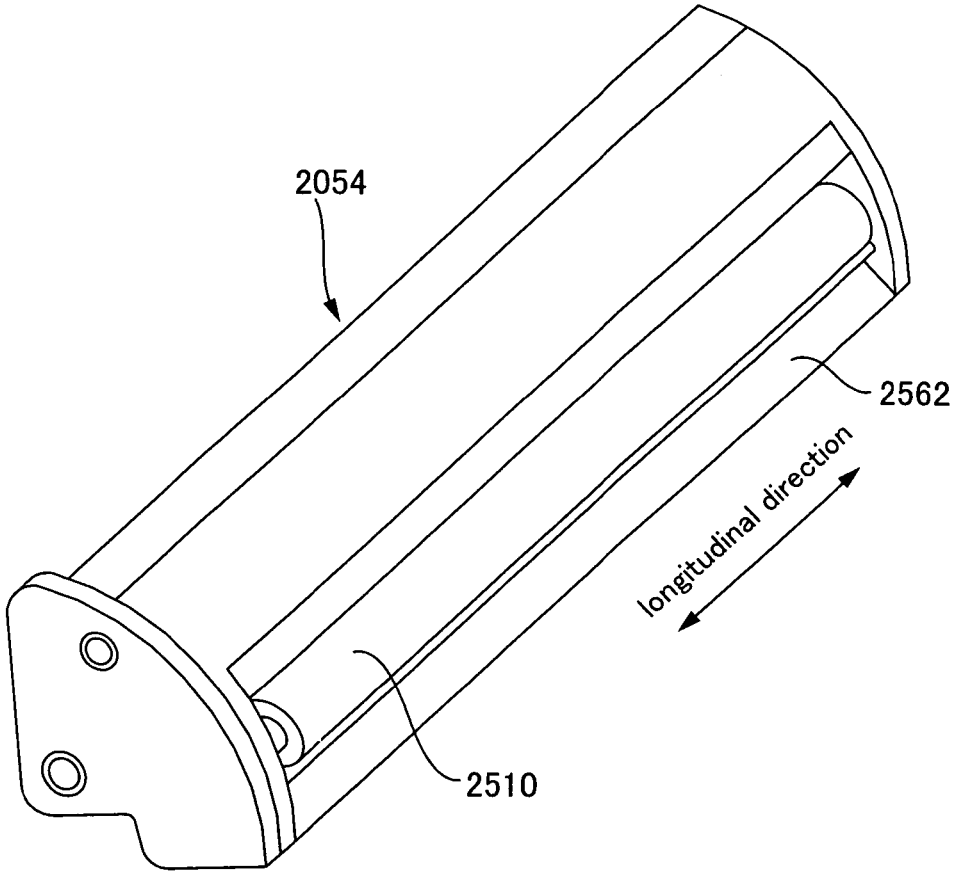
FIG. 20 is a conceptual diagram of a developing unit.
Figure 21:
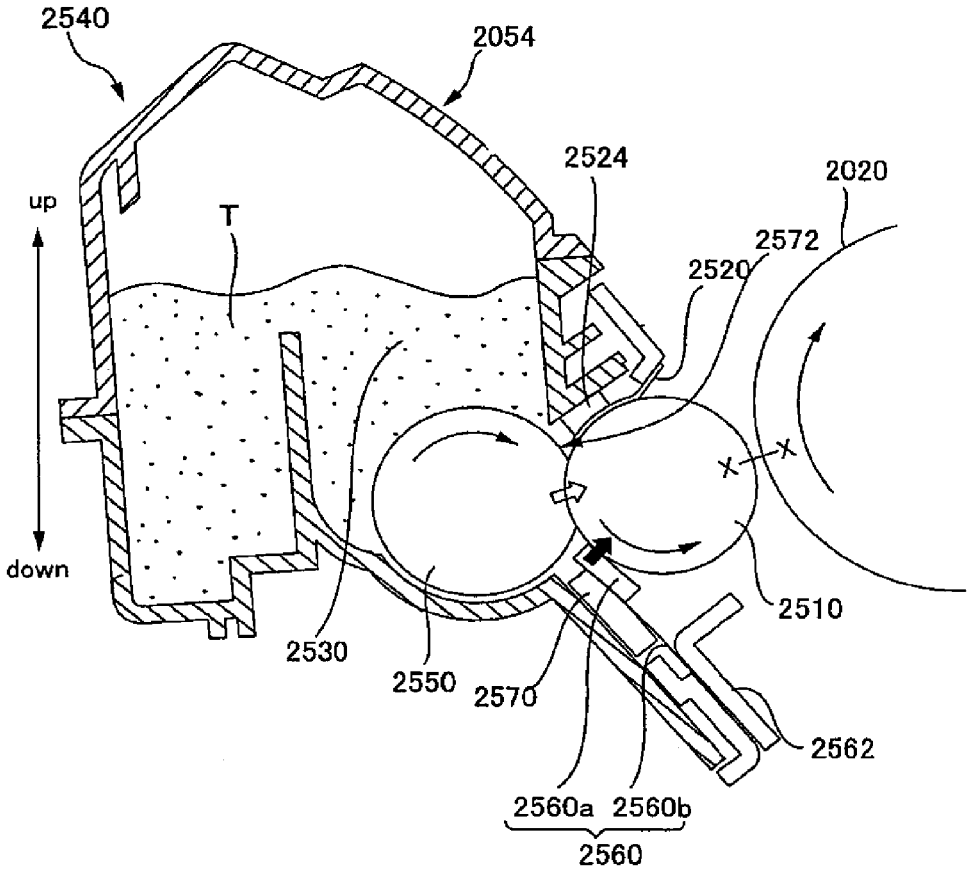
FIG. 21 is a section view showing main structural components of the developing unit.
Figure 22:
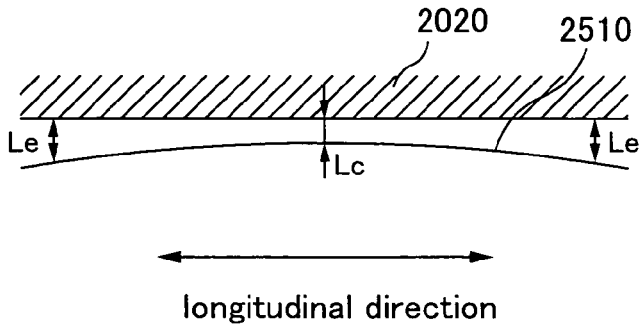
FIG. 22 is a diagram schematically showing the section taken along line X-X of FIG. 21.
Figure 23:
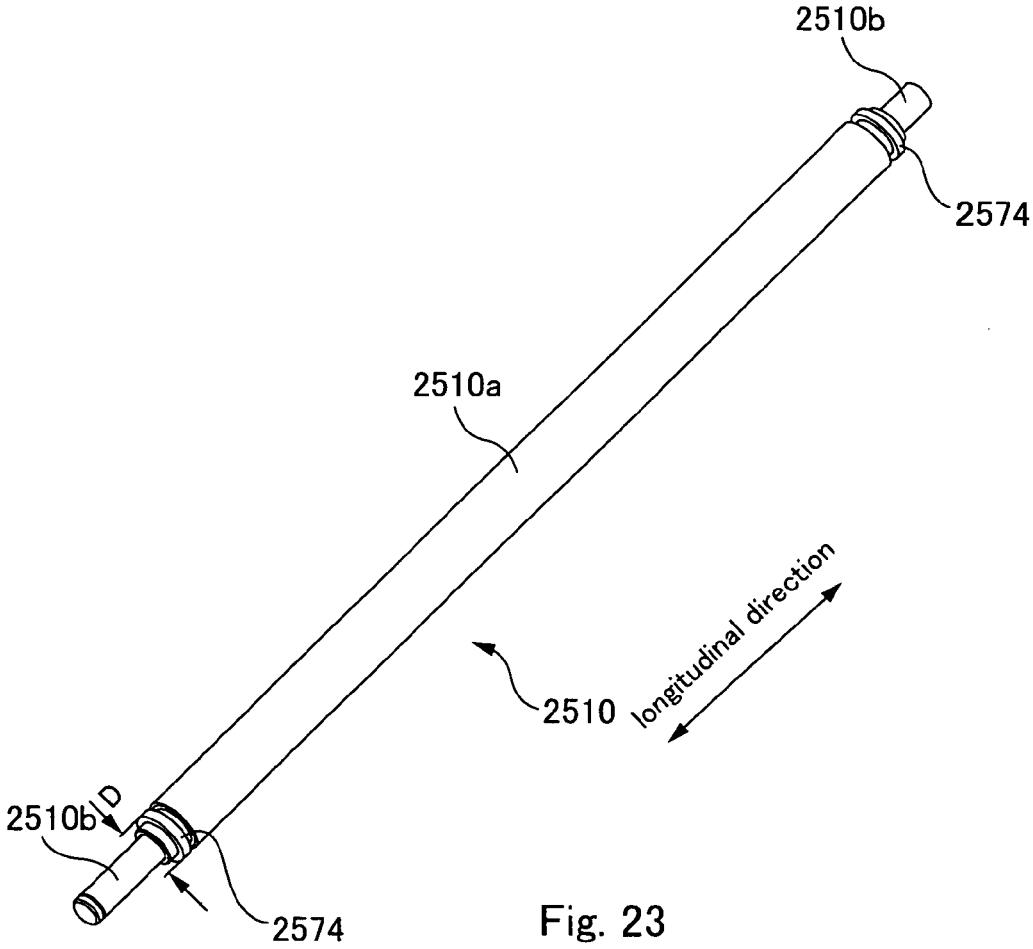
FIG. 23 is a perspective view of a developing roller 2510 on which gap rollers 2574 are provided.

Next, with reference to FIG. 20 through FIG. 23, an example of a configuration of the developing units will be described. FIG. 20 is a conceptual diagram of a developing unit. FIG. 21 is a section view showing main structural components of the developing unit. FIG. 22 is a diagram schematically showing the section taken along line X-X of FIG. 21. FIG. 23 is a perspective view of the developing roller 2510 on which the gap rollers 2574 are provided. Note that the section view shown in FIG. 21 is a cross section of the developing unit taken along a plane perpendicular to the longitudinal direction shown in FIG. 20. Further, in FIG. 21, the arrow indicates the vertical direction as in FIG. 18, and, for example, the yellow developing unit 2054 is shown to be in a state in which it is positioned at the developing position opposing the photoconductor 2020.

To the developing-unit holding unit 2050, it is possible to attach the black developing unit 2051, the magenta developing unit 2053, the cyan developing unit 2052, and the yellow developing unit 2054. Since the configuration of the developing units is the same, explanation will be made below only on the yellow developing unit 2054.

The yellow developing unit 2054 has, for example, a developing roller 2510 serving as an example of a "developer bearing body", a sealing member 2520, a toner containing section 2530, a housing 2540, a toner supplying roller 2550, and a restriction blade 2560. It should be noted that the toner supplying roller 2550 and the restriction blade 2560 serve as the "pressing member" in the present embodiment.

The developing roller 2510 is arranged in opposition to the photoconductor 2020 with a gap (space) therebetween. The developing roller 2510 bears toner T and develops the latent image borne on the photoconductor 2020 with the toner T. The developing roller 2510 is made of metal and, for example, it is manufactured from aluminum, stainless steel, or iron; if necessary, the roller 2510 is plated with, for example, nickel plating or chromium plating, and the toner-bearing region is subjected to sandblasting, for example. Further, as shown in FIG. 20, the developing roller 2510 is supported at both ends in its longitudinal direction and is rotatable about its central axis. As shown in FIG. 21, the developing roller 2510 rotates in the opposite direction (counterclockwise in FIG. 21) to the rotating direction of the photoconductor 2020 (clockwise in FIG. 21). That is, the yellow developing unit 2054 develops the latent image formed on the photoconductor 2020 in a non-contacting state.

Further, upon development of the latent image formed on the photoconductor 2020, a development-bias generating device 2126 (see FIG. 26), which is an example of a "voltage applying section" provided in a developing-unit holding unit drive control circuit, applies, to the developing roller 2510, a development bias obtained by superposing a DC voltage and an AC voltage, and thus an alternating field is generated between the developing roller 2510 and the photoconductor 2020. The developing-unit holding unit drive control circuit includes a development-bias control circuit 2125 that serves to control the ON/OFF of the development bias and to set an appropriate development-bias value. The development-bias control circuit 2125 has a Vmax setting section 2125*a*, which is an example of a "first voltage setting section" for setting a first voltage (Vmax), and a Vmin setting section 2125*b*, which is an example of an "image darkness adjusting section" for setting a second voltage (Vmin) in order to adjust the darkness of an image. It should be noted that details on the development bias etc. are described further below.

Furthermore, as shown in FIG. 23, gap rollers 2574 (also referred to simply as "rollers" below), which are an example of a "space keeping member", are provided at both ends of the developing roller 2510 in the longitudinal direction thereof. The rollers 2574 keep a space (also referred to as "development gap" below) between the photoconductor 2020 and the developing roller 2510 by abutting against the photoconductor 2020, such that the developing roller 2510 can appropriately come into opposition with the photoconductor 2020 with a gap therebetween. It should be noted that as described above, both ends of the developing roller 2510 in the longitudinal direction thereof are supported, and as described below, the developing roller 2510 is pressed toward the photoconductor 2020 by the toner supplying roller 2550 and the restriction blade 2560. Therefore, as shown in FIG. 22, the development gap Lc at the central section in the longitudinal direction of the developing roller 2510 becomes smaller than the development gap Le at the edges of the developing roller 2510 in the longitudinal direction thereof.

The sealing member 2520 prevents the toner T in the yellow developing unit 2054 from spilling out therefrom, and also collects the toner T, which is on the developing roller 2510 that has passed the developing position, into the developing unit without scraping it off. The sealing member 2520 is a seal made of, for example, polyethylene film. The sealing member 2520 is pressed against the developing roller 2510 by the elastic force of a seal-urging member 2524 that is made of, for example, Moltoprene and that is provided on the side opposite from the side of the developing roller 2510.

The housing 2540 is formed by welding together a plurality of integrally-molded housing sections. As shown in FIG. 21, the housing 2540 has an opening 2572 that opens toward the outside of the housing 2540. The above-mentioned developing roller 2510 is arranged from the outside of the housing 2540 with its peripheral surface facing the opening 2572 in such a state that a part of the roller 2510 is exposed to the outside. The restriction blade 2560, which is described in detail below, is also arranged from the outside of the housing 2540 facing the opening 2572.

Further, the housing 2540 forms a toner containing section 2530 that is capable of containing toner T. The toner T contained in the toner containing section 2530 is manufactured according to a grinding method. The toner T includes a core particle and external additives that are applied on the core particle. The core particle includes materials such as coloring agents, charge control agents, release agents (WAX), and resin. The core particle is manufactured by: uniformly mixing the above-mentioned materials using a Henschel mixer, for example; melting and kneading the mixture using a twin screw extruder; cooling the batch; subjecting the batch to rough grinding and fine grinding; and classifying the particles.

The toner supplying roller 2550 is provided in the toner containing section 2530 described above and supplies the toner T contained in the toner containing section 2530 to the developing roller 2510. The toner supplying roller 2550 is made of, for example, polyurethane foam, and is made to abut against the developing roller 2510 in an elastically deformed state. The toner supplying roller 2550 is arranged at a lower section of the toner containing section 2530. The toner T contained in the toner containing section 2530 is supplied to the developing roller 2510 by the toner supplying roller 2550 at the lower section of the toner containing section 2530. The toner supplying roller 2550 rotates about its central axis in the opposite direction (clockwise in FIG. 21) to the rotating direction of the developing roller 2510 (counterclockwise in FIG. 21).

It should be noted that the toner supplying roller 2550 has the function of supplying the toner T contained in the toner containing section 2530 to the developing roller 2510 as well as the function of stripping off, from the developing roller 2510, the toner T remaining on the developing roller 2510 after development. Furthermore, by abutting against the developing roller 2510 along the longitudinal direction thereof, the toner supplying roller 2550 presses the developing roller 2510 toward the photoconductor 2020 as shown by the white arrow in FIG. 21.

The restriction blade 2560 gives an electric charge to the toner T borne by the developing roller 2510 to negatively charge the toner T. The restriction blade 2560 also restricts the thickness of the layer of the toner T borne by the developing roller 2510. This restriction blade 2560 has a rubber section **2560*a* and a rubber-supporting section 2560*b*. The rubber section 2560*a* is made of, for example, silicone rubber or urethane rubber. The rubber-supporting section 2560*b* is a thin plate that is made of, for example, phosphor bronze or stainless steel, and that has a spring-like characteristic. The rubber section 2560*a* is supported by the rubber-supporting section 2560*b*. The rubber-supporting section 2560*b* is attached to the housing 2540 via a pair of blade-supporting metal plates 2562 in a state that one end of the rubber-supporting section 2560*b* is pinched between and supported by the blade-supporting metal plates 2562. Further, a blade-backing member 2570 made of, for example, Moltoprene is provided on one side of the restriction blade 2560 opposite from the side of the developing roller 2510**.

The rubber section **2560*a* is pressed against the developing roller 2510 by the elastic force caused by the flexure of the rubber-supporting section 2560*b*. By abutting against the developing roller 2510 along the longitudinal direction thereof, the rubber section 2560*a* of the restriction blade 2560 presses the developing roller 2510 toward the photoconductor 2020 as shown by the black arrow in FIG. 21. Further, the blade-backing member 2570 prevents the toner T from entering in between the rubber-supporting section 2560*b* and the housing 2540, stabilizes the elastic force caused by the flexure of the rubber-supporting section 2560*b*, and also, applies force to the rubber section 2560*a* from the back thereof towards the developing roller 2510 to press the rubber section 2560*a* against the developing roller 2510. In this way, the blade-backing member 2570 makes the rubber section 2560*a* abut against the developing roller 2510** evenly.

In the yellow developing unit 2054 structured as above, the toner supplying roller 2550 supplies the toner T contained in the toner containing section 2530 to the developing roller 2510. With the rotation of the developing roller 2510, the toner T, which has been supplied to the developing roller 2510, reaches the abutting position of the restriction blade 2560; then, as the toner T passes the abutting position, the toner is electrically charged and its layer thickness is restricted. With further rotation of the developing roller 2510, the toner T on the developing roller 2510, whose layer thickness has been restricted, reaches the developing position opposing the photoconductor 2020; then, under the alternating field, the toner T is used at the developing position for developing the latent image formed on the photoconductor 2020. With further rotation of the developing roller 2510, the toner T on the developing roller 2510, which has passed the developing position, passes the sealing member 2520 and is collected into the developing unit by the sealing member 2520 without being scraped off.

Further, each developing unit 2051, 2052, 2053, and 2054 is also provided with a storage element, for example, a non-volatile storage memory such as a serial EEPROM (which is also referred to below as a "developing-unit-side memory") 2051*a*, 2052*a*, 2053*a*, and 2054*a* that is an example of a "developing-device storage section" and that is for storing various kinds of information about the developing unit, such as color information about the color of the toner T contained in each developing unit and information about the development gap.

Developing-unit-side connectors 2051*b*, 2052*b*, 2053*b*, and 2054*b*, which are provided on one end surface of the respective developing units, come into connection, as necessary, with an apparatus-side connector 2034, which is provided on the apparatus side (i.e., the printer side), and in this way, the developing-unit-side memories 2051*a*, 2052*a*, 2053*a*, and 2054*a* are electrically connected to the unit controller 2102 of the control unit 2100 of the apparatus.

(2) Overview of the Developing-unit Holding Unit

Next, an overview of the developing-unit holding unit 2050 will be described with reference to FIG. 24A through FIG. 24C.

The developing-unit holding unit 2050 has a rotating shaft 2050*e* positioned at the center. A support frame 2055 for holding the developing units is fixed to the rotating shaft 2050*e*. The rotating shaft 2050*e* is provided extending between two frame side plates (not shown) which form a casing of the printer 2010, and both ends of the shaft 2050*e* are supported thereby. It should be noted that the axial direction of the rotating shaft 2050*e* intersects with the vertical direction.

The support frame 2055 is provided with the four attach/detach sections 2050*a*, 2050*b*, 2050*c*, and 2050*d*, to which the above-described developing units 2051, 2052, 2053, and 2054 of the four colors are attached in an attachable/detachable manner about the rotating shaft 2050*e*, and they are arranged in the circumferential direction at an interval of 90°.

A pulse motor, which is not shown, is connected to the rotating shaft 2050*e*. By driving the pulse motor, it is possible to rotate the support frame 2055 and position the four developing units 2051, 2052, 2053, and 2054 mentioned above at predetermined positions.

Figure 24A:
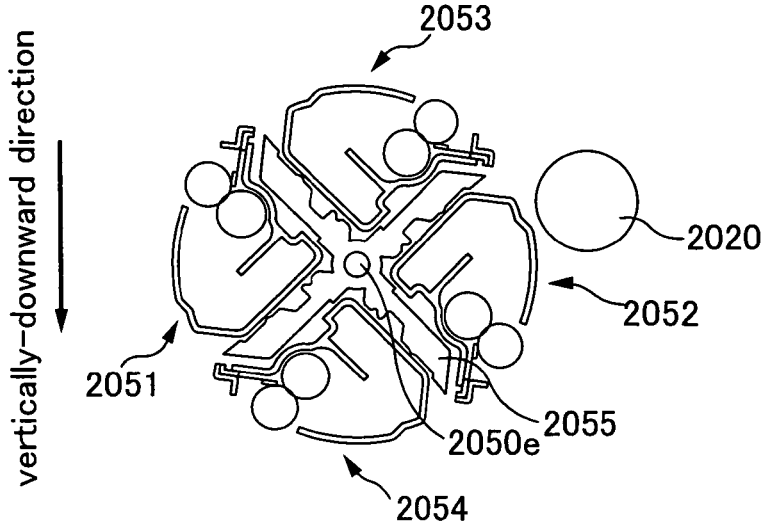
FIG. 24A shows the HP position.
Figure 24B:
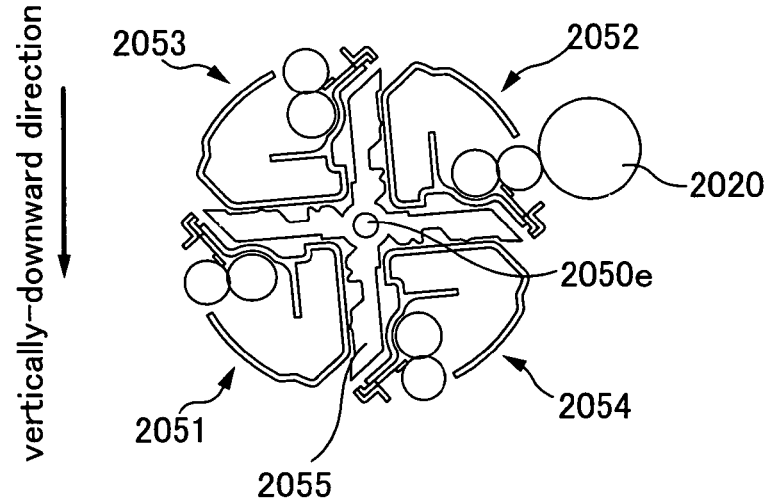
FIG. 24B shows the connector attach/detach position.
Figure 24C:
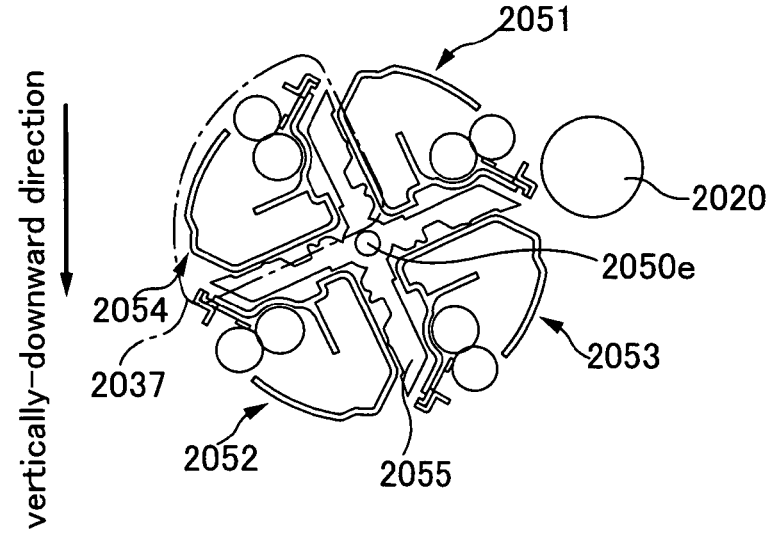
FIG. 24C shows the attach/detach position of a yellow developing unit 2054.

FIG. 24A through FIG. 24C are diagrams showing three stop positions of the rotating developing-unit holding unit 2050. FIG. 24A shows the home position (referred to as "HP position" below) which is the standby position for when the printer is on standby for image formation to be carried out, and which is also the halt position serving as the reference position in the rotating direction of the developing-unit holding unit 2050. FIG. 24B shows the connector attach/detach position where the developing-unit-side connector 2054*b* of the yellow developing unit 2054, which is attached to the developing-unit holding unit 2050, and the apparatus-side connector 2034, which is provided on the apparatus side, come into opposition. FIG. 24C shows the attach/detach position where the yellow developing unit 2054 is attached and detached.

In FIG. 24B and FIG. 24C, the connector attach/detach position and the developing unit attach/detach position are explained with regard to the yellow developing unit 2054, but these positions become the connector attach/detach position and the developing unit attach/detach position for each of the other developing units when the developing-unit holding unit 2050 is rotated at 90° intervals.

First, the HP position shown in FIG. 24A will be described. An HP detector 2031 (FIG. 26) for detecting the HP position is provided on the side of one end of the rotating shaft 2050*e* of the developing-unit holding unit 2050. The HP detector 2031 is structured of a disk that is for generating signals and that is fixed to one end of the rotating shaft 2050*e*, and an HP sensor that is made up of, for example, a photointerrupter having a light emitting section and a light receiving section. The peripheral section of the disk is arranged such that it is located between the light emitting section and the light receiving section of the HP sensor. When a slit formed in the disk moves up to a detecting position of the HP sensor, the signal that is output from the HP sensor changes from "L" to "H". The device is constructed such that the HP position of the developing-unit holding unit 2050 is detected based on this change in signal level and the number of pulses of the pulse motor, and by taking this HP position as a reference, each of the developing units can be positioned at the developing position etc.

FIG. 24B shows the connector attach/detach position of the yellow developing unit 2054 which is achieved by rotating the pulse motor for a predetermined number of pulses from the above-mentioned HP position. At this connector attach/detach position, the developing-unit-side connector 2054*b* of the yellow developing unit 2054, which is attached to the developing-unit holding unit 2050, and the apparatus-side connector 2034, which is provided on the apparatus side, come into opposition, and it becomes possible to connect or separate these connecters.

Figure 25A:
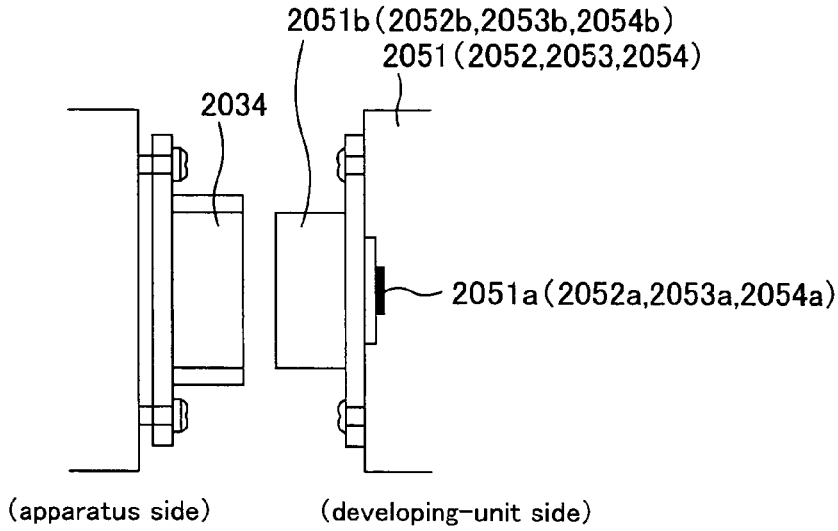
FIG. 25A is a diagram showing a separated position.
Figure 25B:
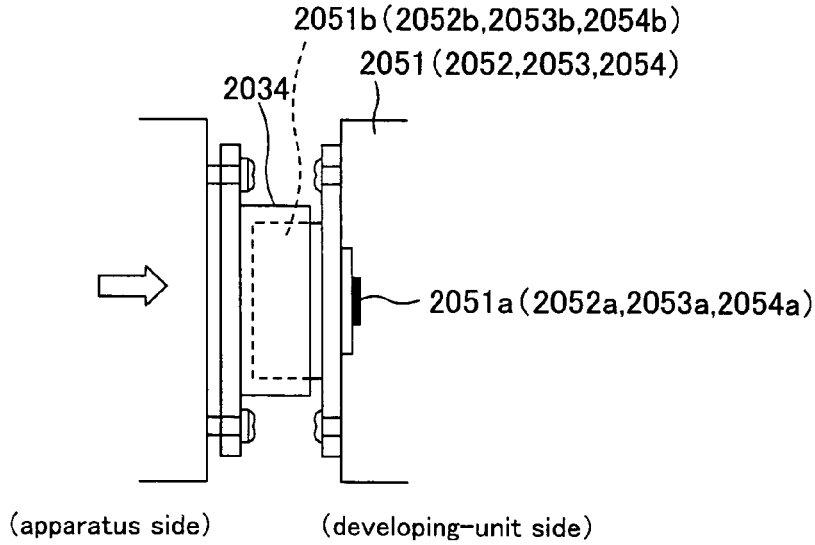
FIG. 25B is a diagram showing an abutting position.

Further explanation is given using FIG. 25A and FIG. 25B. FIG. 25A is a diagram showing a separated position. FIG. 25B is a diagram showing an abutting position.

FIG. 25A shows a state in which the apparatus-side connector 2034 and the developing-unit-side connector 2054*b* of the yellow developing unit 2054 are separated from each other. The apparatus-side connector 2034 is structured such that it can move toward, and move away from, the yellow developing unit 2054. When necessary, the apparatus-side connector 2034 moves in the direction towards the yellow developing unit 2054 (the direction of the arrow shown in FIG. 25B). In this way, the apparatus-side connector 2034 abuts against the developing-unit-side connector 2054*b* of the yellow developing unit 2054 as shown in FIG. 25B. Thus, the developing-unit-side memory 2054*a* attached to the yellow developing unit 2054 is electrically connected to the unit controller 2102 of the control unit 2100, and communication between the developing-unit-side memory 2054*a* and the apparatus is established.

Conversely, the apparatus-side connector 2034 moves, from the state shown in FIG. 25B in which the apparatus-side connector 2034 and the developing-unit-side connector 2054*b* of the yellow developing unit 2054 abut against each other, in the direction away from the yellow developing unit 2054 (the direction opposite to the direction of the arrow shown in FIG. 25B). In this way, the apparatus-side connector 2034 is separated from the developing-unit-side connector 2054*b* of the yellow developing unit 2054, as shown in FIG. 25A.

It should be noted that the movement of the apparatus-side connector 2034 is achieved by, for example, a not-shown mechanism structured of a pulse motor, a plurality of gears connected to the pulse motor, and an eccentric cam connected to the gears. More specifically, by rotating the pulse motor for a predetermined number of pulses, the above-mentioned mechanism moves the apparatus-side connector 2034 from the predetermined separated position for a distance that corresponds to the above-mentioned number of pulses to position the apparatus-side connector 2034 at the predetermined abutting position. On the contrary, by rotating the pulse motor in reverse for a predetermined number of pulses, the above-mentioned mechanism moves the apparatus-side connector 2034 from the predetermined abutting position for a distance that corresponds to the above-mentioned number of pulses to position the apparatus-side connector 2034 at the predetermined separated position.

Further, the connector attach/detach position for the yellow developing unit 2054 is the developing position for the cyan developing unit 2052 where the developing roller 2510 of the cyan developing unit 2052 and the photoconductor 2020 oppose each other. That is, the connector attach/detach position of the developing-unit holding unit 2050 for the yellow developing unit 2054 is the developing position of the developing-unit holding unit 2050 for the cyan developing unit 2052. Further, the position achieved when the pulse motor rotates the developing-unit holding unit 2050 counterclockwise by 90° is the connector attach/detach position for the black developing unit 2051 and the developing position for the yellow developing unit 2054; every time the developing-unit holding unit 2050 is rotated by 90°, the connector attach/detach position and the developing position for each of the developing units are successively achieved.

One of the two frame side plates that support the developing-unit holding unit 2050 and that form the casing of the printer 2010 is provided with an attach/detach dedicated opening 2037 through which one developing unit can pass and an inner cover (not shown) that openably/closably covers the attach/detach dedicated opening 2037. The attach/detach dedicated opening 2037 is formed in a position where only a relevant developing unit (here, the yellow developing unit 2054) can be pulled out and detached in the direction of the rotating shaft 2050*e*, as shown in FIG. 24C, when the developing-unit holding unit 2050 is rotated and each developing unit is halted at the developing unit attach/detach position which is set for each developing unit. Further, the attach/detach dedicated opening 2037 is formed slightly larger than the outer shape of a developing unit. At the developing unit attach/detach position, not only is it possible to detach the developing unit, but it is also possible to insert a new developing unit through this attach/detach dedicated opening 2037 in the direction of the rotating shaft 2050*e* and attach the developing unit to the support frame 2055. While the developing-unit holding unit 2050 is positioned at positions other than the developing unit attach/detach position, the attachment/detachment of that developing unit is restricted by the frame side plates.

It should be noted that a lock mechanism, which is not shown, is provided for certainly positioning and fixing the developing-unit holding unit 2050 at the positions described above.

(2) Overview of Control Unit

Next, with reference to FIG. 26, the configuration of the control unit 2100 will be described. FIG. 26 is a block diagram showing the control unit 2100 of the printer 2010.

The controller section 2101 includes a CPU 2111, an interface 2112 for establishing connection with a not-shown computer, an image memory 2113 for storing image signals etc. that have been input from the computer, and a controller-section-side memory 2114 that is made up of, for example, an electrically rewritable EEPROM 2114*a*, a RAM 2114*b*, and a programmable ROM in which various programs for control are written. The controller section 2101 receives various information such as image signals etc. from the computer connected to the printer 2010.

The controller section 2101 has a function of converting the RGB data of red, green, and blue, which is the image signal sent from the computer etc., into YMCK image data of yellow, magenta, cyan, and black, and storing the converted YMCK image data in the image memory 2113. The controller section 2101 also has a function of sending various information to the connected computer.

The unit controller 2102 includes, for example, a CPU 2120, a unit-controller-side memory 2116 that is made up of, for example, an electrically rewritable EEPROM 2116*a*, a RAM, and a programmable ROM in which various programs for control are written, and various drive control circuits for driving and controlling the units in the apparatus body (i.e., the charging unit 2030, the exposing unit 2040, the first transferring unit 2060, the cleaning unit 2075, the second transferring unit 2080, the fusing unit 2090, and the displaying unit 2095) and the developing-unit holding unit 2050.

The CPU 2120 is electrically connected to each of the drive control circuits and controls the drive control circuits according to control signals from the CPU 2111 of the controller section 2101. More specifically, the unit controller 2102 controls each of the units and the developing-unit holding unit 2050 according to signals received from the controller section 2101 while detecting the state of each of the units and the developing-unit holding unit 2050 by receiving signals from sensors provided in each unit.

Further, the CPU 2120 is connected, via a serial interface (indicated herein as "I/F") 2121, to a non-volatile storage element 2122 (which is referred to below as "apparatus-side memory") which is, for example, a serial EEPROM. Data necessary for controlling the apparatus are stored in the apparatus-side memory 2122. The CPU 2120 is not only connected to the apparatus-side memory 2122, but is also connected to developing-unit-side memories 2051*a*, 2052*a*, 2053*a*, and 2054*a*, which are provided on the respective developing units 2051, 2052, 2053, and 2054, via the serial interface 2121. Then, data can be exchanged between the apparatus-side memory 2122 and the developing-unit-side memories 2051*a*, 2052*a*, 2053*a*, and 2054*a*, and also, it is possible to input chip-select signals CS to the developing-unit-side memories 2051*a*, 2052*a*, 2053*a*, and 2054*a* via the input/output port 2123. The CPU 2120 is also connected to the HP detector 2031 via the input/output port 2123.

Further, the CPU 2120 becomes communicable with the developing-unit-side memories 2051*a*, 2052*a*, 2053*a*, and 2054*a* when the apparatus-side connector 2034 and the connecter of one of the developing units positioned at the connector attach/detach position are connected. Then, various information about the developing unit is obtained from the developing-unit-side memory 2051*a*, 2052*a*, 2053*a*, or 2054*a* of the developing unit connected to the apparatus-side connector 2034. Information about the developing unit includes, for example, color information about the color of toner contained in the attached developing unit and information about the development gap Lc. The various kinds of information that have been obtained are stored, corresponding to each developing unit, in a predetermined region of the apparatus-side memory 2122 of the unit controller 2102.

Furthermore, when a developing unit is to be detached from the attach/detach section, the CPU 2120 stores, in the developing-unit-side memory 2051*a*, 2052*a*, 2053*a*, or 2054*a* of that developing unit, the information that is stored in the apparatus-side memory 2122.

(2) Development Bias

Figure 27:
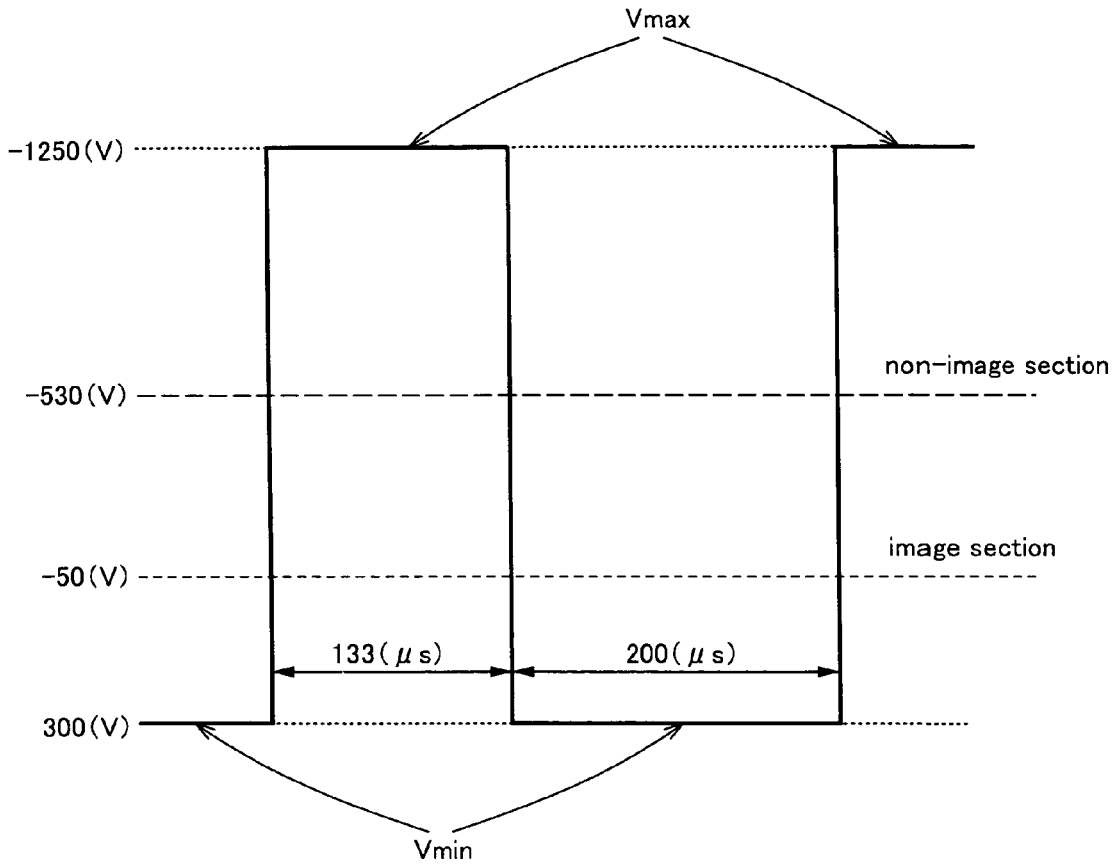
FIG. 27 shows a waveform of the development bias.

The development bias that is applied from the development-bias generating device 2126 to the developing roller 2510 is described with reference to FIG. 27. FIG. 27 shows a waveform of the development bias.

The development-bias generating device 2126 applies, to the developing roller 2510, a development bias of a rectangular waveform as shown in FIG. 27 for developing a latent image. More specifically, the development-bias generating device 2126 alternately applies, to the developing roller 2510, a first development voltage (Vmax) for making the toner T move from the developing roller 2510 toward the photoconductor 2020 for developing a latent image, and a second development voltage (Vmin) for making the toner T move from the photoconductor 2020 toward the developing roller 2510.

When the development-bias generating device 2126 applies a Vmax to the developing roller 2510, the toner T borne on the developing roller 2510 flies toward the photoconductor 2020 and adheres thereto. When the Vmax is applied to the developing roller 2510, an electric field is generated due to the difference between the electric potential of the developing roller 2510 (for example, −1250 V) caused by the Vmax, and the electric potential of the photoconductor 2020 on which the latent image is formed (for example, electric potential of the image section: −50 V; electric potential of the non-image section: −530 V). The negatively-charged toner T borne on the developing roller 2510 flies toward the photoconductor 2020 due to the force caused by the electric field and adheres to the photoconductor 2020. It should be noted that, the larger the absolute value of the Vmax is, the larger the force of the electric field becomes, and so the amount of toner T that adheres to the photoconductor 2020 increases.

When the development-bias generating device 2126 applies a Vmin to the developing roller 2510, the toner T adhering to the photoconductor 2020 flies toward the developing roller 2510 and returns thereto. When the Vmin is applied to the developing roller 2510, an electric field is generated due to the difference between the electric potential of the developing roller 2510 (for example, 300 V) caused by the Vmin, and the electric potential of the photoconductor 2020 on which the latent image is formed (for example, electric potential of the image section: −50 V; electric potential of the non-image section: −530 V). The negatively-charged toner T adhering to the photoconductor 2020 flies toward the developing roller 2510 due to the force caused by the electric field and returns to the developing roller 2510. It should be noted that the toner T that returns to the developing roller 2510 is a portion of the toner T that adhered to the photoconductor 2020, and the toner T that remains on the photoconductor 2020 without returning to the developing roller 2510 is used for developing the latent image. It should be noted that, the larger the absolute value of the Vmin is, the larger the force of the electric field becomes, and so the amount of toner T that returns to the developing roller 2510 increases.

Before the development-bias generating device 2126 applies the Vmax and the Vmin to the developing roller 2510, the toner T borne on the developing roller 2510 is not in contact with the photoconductor 2020. Therefore, development of a latent image will not be carried out if neither the Vmax nor Vmin is applied to the developing roller 2510.

Further, as shown in FIG. 27, the time for which the development-bias generating device 2126 applies the Vmax to the developing roller 2510 is 133 μs, and the time for which it applies the Vmin to the developing roller 2510 is 200 μm.

(2) Operation of the Printer 2010

Figure 28:
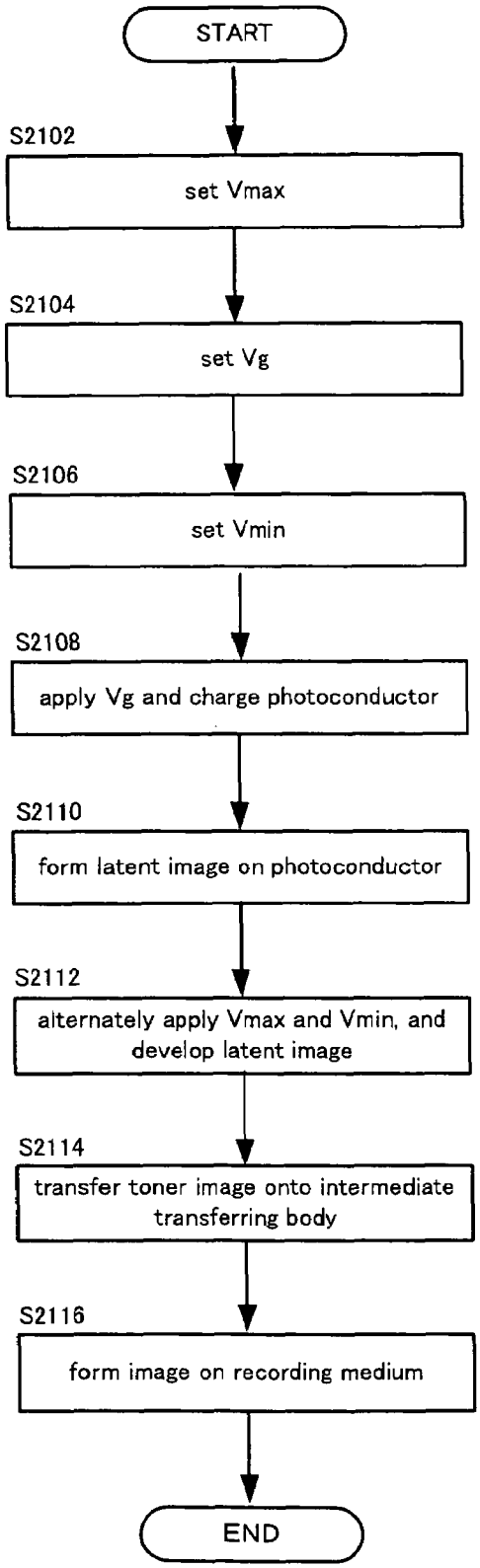
FIG. 28 is a flowchart for describing the operation of the printer 2010.

The operation of the printer 2010 in which it adjusts the darkness of an image and forms the image on a recording medium will be described with reference to FIG. 28. FIG. 28 is a flowchart for describing the operation of the printer 2010.

The various operations of the printer 2010 described below are mainly achieved by the controller section 2101 or the unit controller 2102 in the printer 2010. Particularly, in the present embodiment, they are achieved by the CPU processing a program stored in a program ROM. The program is made of codes for achieving the various operations described below.

First, when a developing unit is attached to the body 2010*a* of the printer and the power of the printer 2010 is turned ON, the Vmax setting section 2125*a* provided in the unit controller 2102 sets, for each developing unit, a first development voltage (Vmax) in accordance with the development gap information (S2102), and the charge-bias control circuit 2127*a* sets a grid voltage (Vg) in accordance with the development gap information (S2104). If the development gap Lc is small, the Vmax setting section 2125*a* sets the absolute value of the Vmax to a small value, and the charge-bias control circuit 2127*a* sets the absolute value of the Vg also to a small value. On the other hand, if the development gap Lc is large, the Vmax setting section 2125*a* sets the absolute value of the Vmax to a large value, and the charge-bias control circuit 2127*a* sets the absolute value of the Vg also to a large value.

Setting of the Vmax and the Vg based on the development gap information is carried out when a new developing unit is attached to the body 2010*a* of the printer. Once the Vmax and the Vg are set for that developing unit, the setting operation for the Vmax and the Vg is not performed until another developing unit is attached. It should be noted that the method of setting the Vmax and the method of setting the Vg in accordance with the development gap information will be described further below.

Next, in order to adjust the darkness of an image to be formed on a recording medium, the Vmin setting section 2125*b* provided in the unit controller 2102 sets a Vmin based on a result of detecting the darkness of a patch image using the patch sensor PS (S2106). Here, of the Vmax and the Vmin, the Vmin setting section 2125*b* changes only the Vmin; that is, it maintains the Vmax set by the Vmax setting section 2125*a* at S2102, but changes the Vmin to adjust the darkness of an image to be formed on a recording medium.

Figure 29:
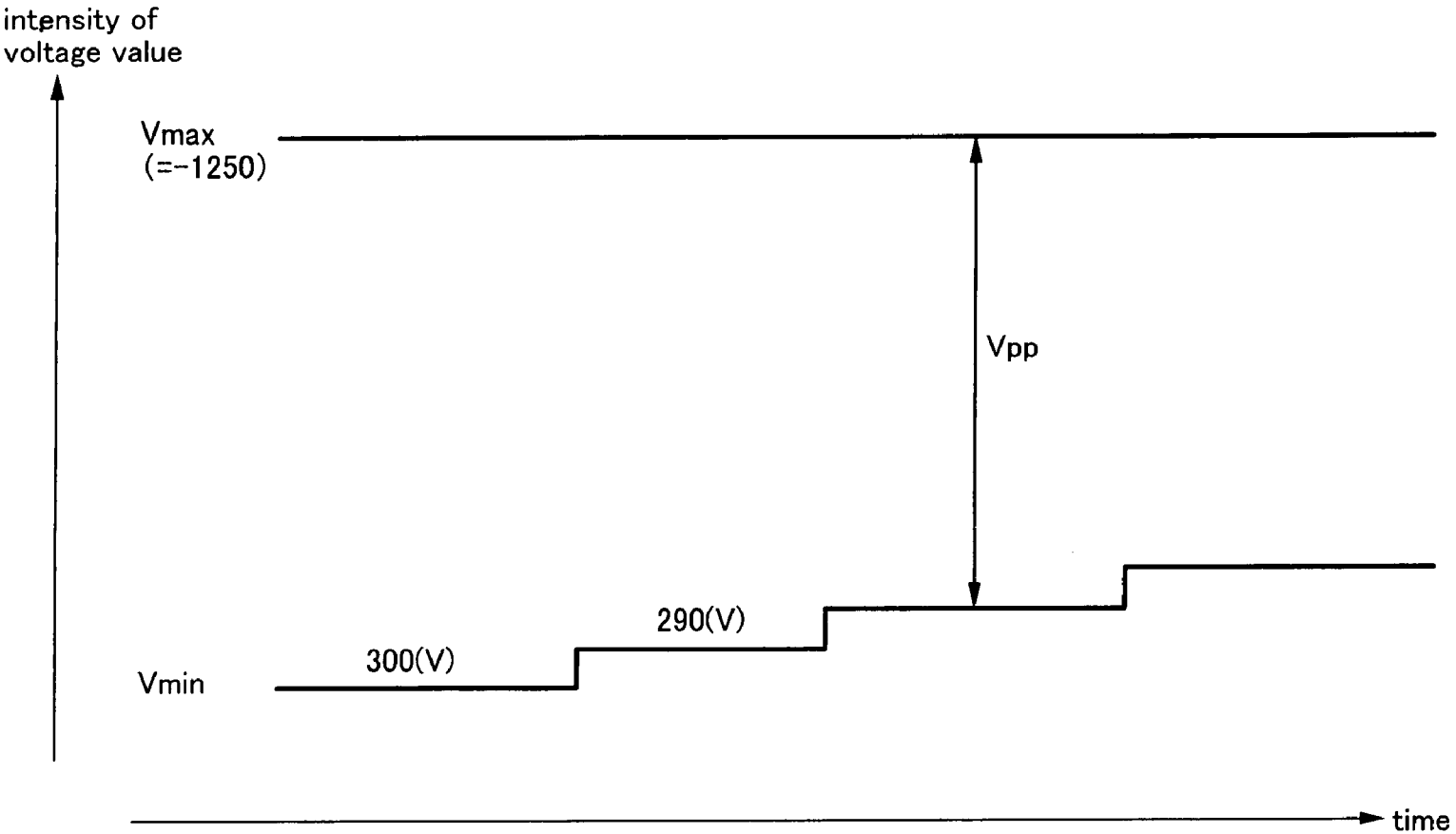
FIG. 29 is a schematic diagram showing the change in Vmax and Vmin.

This is explained in more detail. As shown in FIG. 29, the Vmin setting section 2125*b* maintains the Vmax at −1250 V, but changes the Vmin (for example, changes it from 300 V to 290 V) to adjust the image darkness. It should be noted that since only the Vmin is changed, the difference between the Vmax and the Vmin ("Vpp" in FIG. 29) is not constant. Note that FIG. 29 is a schematic diagram showing the change in Vmax and Vmin.

It should be noted that the method of setting the Vmin in accordance with the result of detecting the darkness of a patch image using the patch sensor PS will be described further below.

Next, when an image signal is input from a not-shown host computer to the controller section 2101 of the printer 2010 through the interface (I/F) 2112, the photoconductor 2020, the developing roller which is provided in each developing unit 2051, 2052, 2053, and 2054, and the intermediate transferring body 2070 rotate under the control of the unit controller 2102 based on the instructions from the controller section 2101. Then, the charge-bias generating device 2127*b* applies, to the grid 2330, the Vg that has been set by the charge-bias control circuit 2127*a* at S2104 to charge the photoconductor 2020 to a desired charge potential (S2108). The charging unit 2030 successively charges the rotating photoconductor 2020 at a charging position.

Next, the unit controller 2102 controls the exposing unit 2040 so as to form a latent image on the charged photoconductor 2020 (S2110). With the rotation of the photoconductor 2020, the charged area of the photoconductor 2020 reaches an exposing position, and a latent image that corresponds to the image information about the first color, for example, yellow Y, is formed in that area by the exposing unit 2040. Further, the developing-unit holding unit 2050 positions the yellow developing unit 2054, which contains yellow (Y) toner, at the developing position opposing the photoconductor 2020.

Next, the development-bias generating device 2126 provided in the unit controller 2102 alternately applies, to the developing roller 2510, the Vmax set by the Vmax setting section 2125*a* at S2102 and the Vmin set by the Vmin setting section 2125*b* at S2106 (S2112). Here, the development-bias generating device 2126 alternately applies, to the developing roller 2510, a Vmax whose intensity is −1250 V and a Vmin whose intensity is 290 V. In this way, the latent image formed on the photoconductor 2020 reaches the developing position along with the rotation of the photoconductor 2020, and is developed with toner by the developing roller 2510. Thus, a toner image is formed on the photoconductor 2020.

Next, the unit controller 2102 controls the first transferring unit so as to transfer, onto the intermediate transferring body 2070, the toner image that has been formed on the photoconductor 2020 (S2114). With the rotation of the photoconductor 2020, the toner image formed on the photoconductor 2020 reaches a first transferring position, and is transferred onto the intermediate transferring body 2070 by the first transferring unit 2060. At this time, a first transferring voltage, which is in an opposite polarity from the polarity to which the toner is charged, is applied to the first transferring unit 2060. It should be noted that, during this process, the second transferring unit 2080 is kept separated from the intermediate transferring body 2070.

By successively performing the above-mentioned processes (S2108 to S2114) for the second, the third, and the fourth colors, toner images in four colors corresponding to the respective image signals are transferred onto the intermediate transferring body 2070 in a superimposed manner. As a result, a full-color toner image is formed on the intermediate transferring body 2070. It should be noted that when the toner image is formed for each of the second, third, and fourth colors, the Vmax, Vmin, and Vg set for each color (each developing unit) are applied.

Then, with the rotation of the intermediate transferring body 2070, the full-color toner image formed on the intermediate transferring body 2070 reaches a second transferring position, where it is transferred onto a recording medium by the second transferring unit 2080. In this way, an image is formed on a recording medium (S2116). It should be noted that the recording medium is carried from the paper supply tray 2092 to the second transferring unit 2080 via the paper-feed roller 2094 and resisting rollers 2096. During transferring operations, a second transferring voltage is applied to the second transferring unit 2080 and also the unit 2080 is pressed against the intermediate transferring body 2070.

The full-color toner image transferred onto the recording medium is heated and pressurized by the fusing unit 2090 and fused to the recording medium. On the other hand, after the photoconductor 2020 has passed the first transferring position, the toner adhering to the surface of the photoconductor 2020 is scraped off by the cleaning blade 2076 that is supported on the cleaning unit 2075, and the photoconductor 2020 is prepared for charging for formation of the next latent image. The scraped-off toner is collected into a remaining-toner collector of the cleaning unit 2075.

Figure 30:
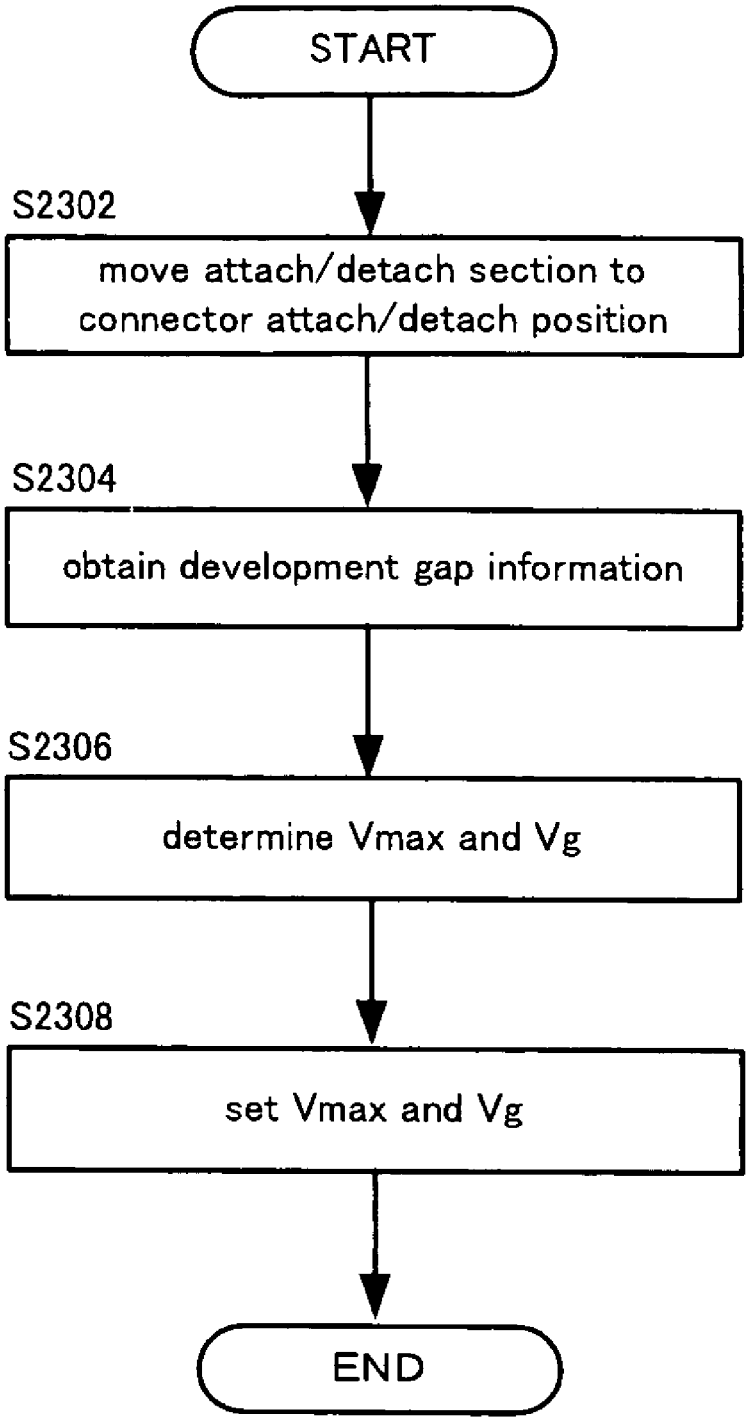
FIG. 30 is a flowchart showing a method of setting the Vmax and Vg in accordance with the development gap information.

(2) Method of Setting Vmax and Vg in Accordance with Development Gap Information The method of setting the Vmax and the Vg in accordance with the development gap information is described with reference to FIG. 30. FIG. 30 is a flowchart showing a method of setting the Vmax and Vg in accordance with the development gap information. It should be noted that the size of the development gap is measured in advance with a measurement device etc. (not shown) during the manufacturing processes of the developing unit. The information about the size of the development gap that has been measured is then stored in the developing-unit-side memory.

Setting of the Vmax is started in a state where the developing units have been attached to their respective attach/detach sections at their respective developing unit attach/detach positions (see FIG. 24C). The unit controller 2102 rotates the developing-unit holding unit 2050 to successively move the four attach/detach sections to the connector attach/detach position (see FIG. 24B) (S2302).

Next, the unit controller 2102 moves the apparatus-side connector 2034 to obtain information, such as the development gap information, stored in the developing-unit-side memory of a developing unit if there is a developing unit attached to the attach/detach section positioned at the connector attach/detach position (S2304). For example, if a yellow developing unit 2054 is attached to the attach/detach section 2050*d* positioned at the connector attach/detach position, then the apparatus-side connector 2034 is made to abut against the developing-unit-side connector 2054*b* and the unit controller 2102 obtains information stored in the developing-unit-side memory 2054*a* of the yellow developing unit 2054. The unit controller 2102 reads out information such as the development gap information. Then, the unit controller 2102 stores, for each developing unit, the information in a predetermined region of the apparatus-side memory 2122. Here, the unit controller 2102 acknowledges, from the development gap information that has been obtained, that the development gap Lc is 120 μm, for example.

Next, the unit controller 2102 determines the Vmax and the Vg (S2306) by referencing the development gap information that has been read out from the developing-unit-side memory and stored in the apparatus-side memory 2122 and a Vmax-Vg setting table (see FIG. 31) stored, for example, in the unit-controller-side memory 2116. For example, if the size of the development gap Lc is 120 μm, then the unit controller 2102 determines the Vmax to be −1250 V and the Vg to be −550 V. When the Vg is −550 V, the charge potential of the photoconductor 2020 will be −530 V. Then, the unit controller 2102 stores the Vmax and Vg determined for each developing unit in a predetermined region of the apparatus-side memory 2122. It should be noted that FIG. 31 is a diagram showing the Vmax-Vg setting table.

Next, the Vmax setting section 2125*a* sets, for each developing unit, the Vmax (the DC voltage and the AC voltage) that has been determined, and the charge-bias control circuit 2127*a* sets, for each developing unit, the Vg that has been determined (S2308). For example, for a developing unit having a development gap Lc of 120 μm, the Vmax setting section 2125*a* sets the Vmax to −1250 V and the charge-bias control circuit 2127*a* sets the Vg to −550 V.

(2) Method of Setting Vmin

Figure 32:
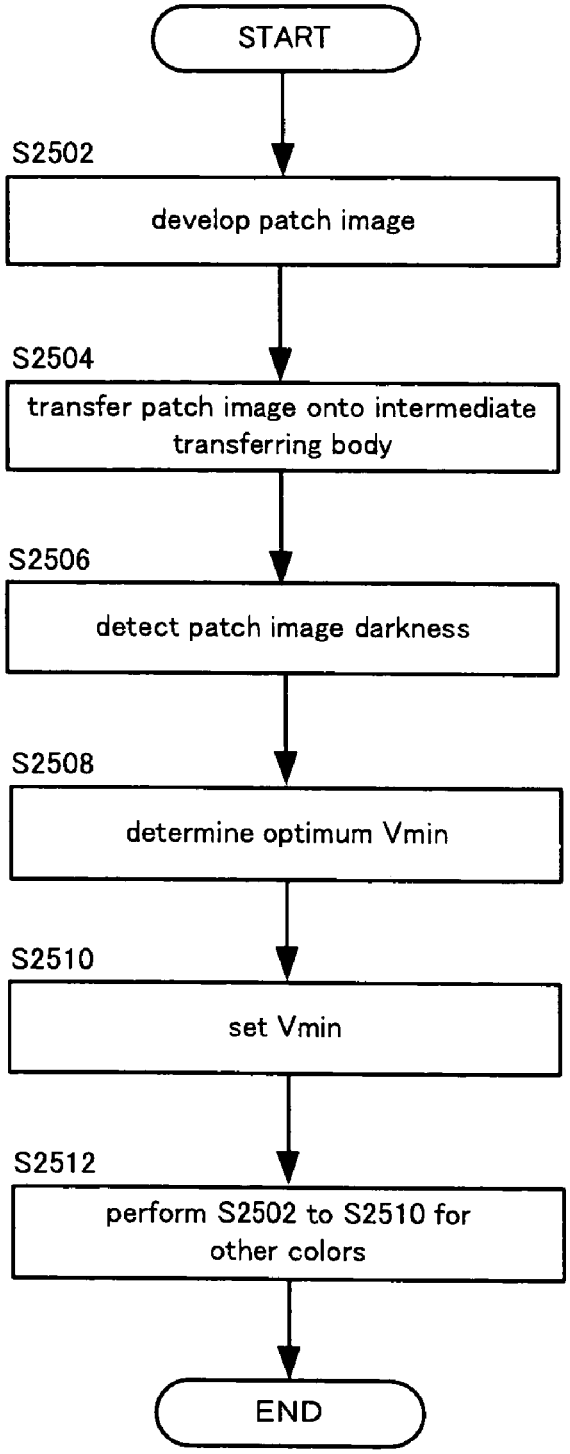
FIG. 32 is a flowchart showing a method of setting the Vmin.
Figure 33:
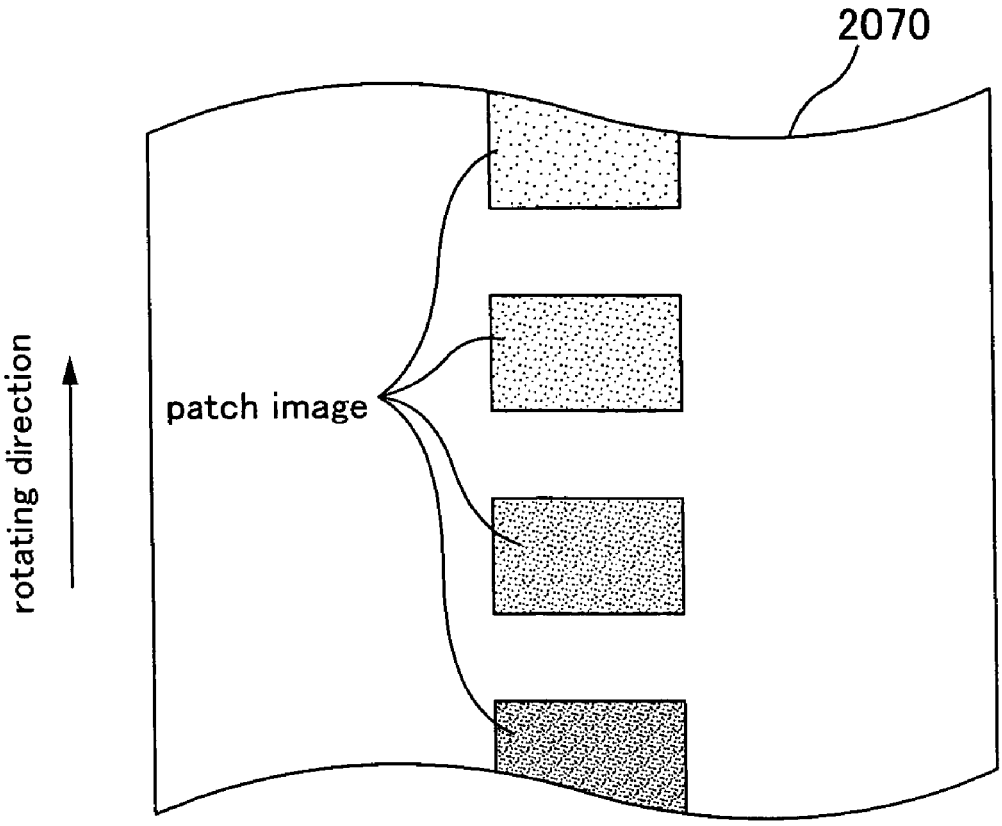
FIG. 33 is a schematic diagram showing how patch images are formed on an intermediate transferring body 2070.

As described above, the printer 2010 carries out, at a predetermined timing, a control operation for adjusting the darkness of an image (or, "Vmin setting operation"). Here, an example of the control operation is described with reference to FIG. 32 and FIG. 33. FIG. 32 is a flowchart showing a method of setting the Vmin. FIG. 33 is a schematic diagram showing how patch images are formed on the intermediate transferring body 2070. It should be noted that the various operations of the printer 2010 described below are mainly achieved by the controller section 2101 or the unit controller 2102 in the printer 2010. Particularly, in the present embodiment, they are achieved by the CPU processing a program stored in a program ROM. The program is made of codes for achieving the various operations described below.

First, the printer 2010 develops patch images (step S2502). While being rotated, the photoconductor 2020 is successively charged by the charging unit 2030 at the charging position. With the rotation of the photoconductor 2020, the charged area of the photoconductor 2020 reaches the exposing position, and patch latent images that correspond to information about patch images of the first color, for example, yellow Y, are formed in that area by the exposing unit 2040. With the rotation of the photoconductor 2020, the patch latent images formed on the photoconductor 2020 reach the developing position and are developed with yellow toner by the yellow developing unit 2054. Here, development of the patch latent images is performed while changing the Vmin of the development bias applied by the development-bias generating device 2126, that is, by changing the DC voltage and the AC voltage. In this way, patch images are formed on the photoconductor 2020.

With the rotation of the photoconductor 2020, the patch images formed on the photoconductor 2020 reach the first transferring position, and are transferred onto the intermediate transferring body 2070 by the first transferring unit 2060 (step S2504). In this way, a plurality of patch images, each having a different darkness, are formed in a line on the intermediate transferring body 2070, as shown in FIG. 33.

As each patch image on the intermediate transferring body 2070 reaches the position that is in opposition to the patch sensor PS with the rotation of the intermediate transferring body 2070, the darkness of that patch image is detected by the patch sensor PS (step S2506).

Then, when the darkness of all the patch images has been detected, the optimum Vmin, i.e., the optimum DC voltage and AC voltage, is determined based on the darkness-detection result, that is, by comparing the darkness detected for each patch image with the desired image darkness (step S2508). The Vmin that has been determined is then stored, for each developing unit, in a predetermined region of the apparatus-side memory 2122.

Next, the above-mentioned Vmin setting section 2125*b* sets the Vmin that has been determined, so that it is possible to carry out development at an optimum development bias after performing the above-mentioned control operation (step S2510).

It should be noted that the remaining toner T that forms the patch images for which darkness detection has finished is successively cleaned by a intermediate-transferring-body cleaning unit (not shown).

By successively performing, for each developing unit, the above-mentioned processes for the second, the third, and the fourth colors, the optimum Vmin is set for each color, and the control operation for adjusting the image darkness is completed (step S2512).

It should be noted that in the foregoing, a plurality of patch images each having a different darkness were formed. This, however, is not a limitation, and for example, it is also possible to form a single patch image whose darkness gradually changes.

(2) Selective Development

The reason why selective development occurs in the printer 2010 of the present second embodiment is the same as the reason why selective development occurs in the printer 10 described in the first embodiment using FIG. 15 and FIG. 16. Therefore, further explanation about the cause of selective development is omitted.

(2) Function of Development Bias According to the Present Embodiment

As described above, the Vmax setting section 2125*a* sets the Vmax (first development voltage) based on the development gap information, and the Vmin setting section 2125*b* maintains the Vmax set by the Vmax setting section 2125*a* and changes only the Vmin (second development voltage) to adjust the darkness of an image to be formed on a recording medium. Further, the charge-bias control circuit 2127*a* sets the Vg (charge voltage) based on the development gap information. In this way, it becomes possible to prevent selective development from occurring, as well as suppress occurrence of electric discharge between the developing roller 2510 and the photoconductor 2020. This is described in detail below.

In consideration of preventing the so-called "selective development", it is effective to adjust the darkness of an image by fixing the Vmax at a large absolute value, and changing only the Vmin.

However, if the darkness of an image is to be adjusted simply by changing only the Vmin, then the Vmin could take a wide variety of values. If the absolute value of the Vmin is too large, then the difference between the electric potential of the developing roller 2510 caused by the Vmin and the electric potential (charge potential) of a non-image section of the photoconductor 2020 will be too large, which may give rise to electric discharge. On the other hand, if the absolute value of the fixed Vmax is too large, then the difference between the electric potential of the developing roller 2510 caused by the Vmax and the electric potential of an image section of the photoconductor 2020 will be too large, which may also give rise to electric discharge.

In view of the above, in the present embodiment, the Vmax setting section 2125*a* sets the Vmax based on the development gap information. Further, the charge-bias control circuit 2127*a* sets the Vg based on the development gap information. This is described in more detail.

Electric discharge between the developing roller 2510 and the photoconductor 2020 is likely to occur when the development gap between the developing roller 2510 and the photoconductor 2020 is small and the potential difference between the electric potential of the developing roller 2510 and the electric potential of the photoconductor 2020 is large. Accordingly, the Vmax setting section 2125*a* sets the absolute value of the Vmax to a small value if the development gap is small. In this way, it becomes possible to suppress the occurrence of electric discharge due to the potential difference between the electric potential of the developing roller 2510 caused by the Vmax and the electric potential of the image section of the photoconductor 2020. On the other hand, the charge-bias control circuit 2127*a* sets the absolute value of the Vg to a small value if the development gap is small. In this way, it becomes possible to suppress the occurrence of electric discharge due to the potential difference between the electric potential of the developing roller 2510 caused by the Vmin and the electric potential (charge potential) of the non-image section of the image section of the photoconductor 2020.

As described above, by setting the Vmax with the Vmax setting section 2125*a* based on the development gap information, or setting the Vg with the charge-bias control circuit 2127*a* based on the development gap information, it becomes possible to prevent selective development from occurring, as well as suppress occurrence of electric discharge between the developing roller 2510 and the photoconductor 2020.

(2) Other Considerations

An image forming apparatus according to the present second embodiment is a printer 2010 (image forming apparatus) comprising: a photoconductor 2020 (image bearing body); a developing roller 2510 (developer bearing body); a transferring section (first transferring unit 2060, intermediate transferring body 2070, and second transferring unit 2080); a development-bias generating device 2126 (voltage applying section); a Vmax setting section 2125*a* (first voltage setting section); and a Vmin setting section 2125*b* (image darkness adjusting section).

Another image forming apparatus according to the present second embodiment is a printer 2010 (image forming apparatus) comprising: a photoconductor 2020 (image bearing body); a charging unit 2030 (charging section); an exposing unit 2040 (latent image forming section); a developing roller 2510 (developer bearing body); a transferring section (first transferring unit 2060, intermediate transferring body 2070, and second transferring unit 2080); a charge-bias generating device 2127*b* (charge voltage applying section); a charge-bias control circuit 2127*a* (charge voltage setting section); a development-bias generating device 2126 (voltage applying section); and a Vmin setting section 2125*b* (image darkness adjusting section).

In the foregoing embodiment, a scorotron charging device was taken as an example of a charging unit. This, however, is not a limitation. For example, the charging unit may be a corotron charging device that does not have a grid 2330. Further, the charging unit may be a roller or a brush that comes into contact with the surface of the photoconductor 2020.

In the foregoing embodiment, as shown in FIG. 23, the printer 2010 had a roller 2574 (space keeping member) that is arranged at both ends of the developing roller 2510 in a longitudinal direction thereof and that is for keeping a development gap (space) between the photoconductor 2020 and the developing roller 2510 by abutting against the photoconductor 2020, such that the developing roller 2510 is arranged in opposition to the photoconductor 2020 with the gap therebetween. This, however, is not a limitation. For example, the printer 2010 does not have to have a roller 2574.

However, by keeping a development gap between the photoconductor 2020 and the developing roller 2510 using a roller 2574, it is possible to adjust the size of the development gap with high precision. With such a structure, it is possible to set an appropriate Vmax or Vg, and thus, it becomes possible to effectively suppress the occurrence of electric discharge between the developing roller 2510 and the photoconductor 2020. The foregoing embodiment is therefore more preferable.

In the foregoing embodiment, as shown in FIG. 20, the developing roller 2510 was supported at both ends in the longitudinal direction thereof. Further, as shown in FIG. 21, the printer 2010 had a toner supplying roller 2550 and a restriction blade 2560 (pressing member) that abut against the developing roller 2510 along the longitudinal direction thereof and that press the developing roller 2510 toward the photoconductor 2020. Further, the information about the size of the gap was information about the size of the gap at a central section in the longitudinal direction of the developing roller 2510.

This, however, is not a limitation. For example, the information about the size of the gap may be information about a size of the roller 2574. Here, the size of a roller 2574 refers to its outer diameter D (see FIG. 23). Depending on the structure of the photoconductor 2020 and the developing unit, there are cases where it is not possible to measure the development gap between the photoconductor 2020 and the developing roller 2510. On the other hand, the size of the development gap is dependent on the size (outer diameter D) of the roller 2574. That is, the larger the outer diameter D of the roller 2574, the larger the development gap becomes. Therefore, by adopting the information about the outer diameter D of the roller 2574 as the information about the size of the gap, it becomes possible to set the Vmax or Vg easily.

However, in a structure where the developing roller 2510 is supported at both ends in the longitudinal direction thereof and the toner supplying roller 2550 and the restriction blade 2560 press the developing roller 2510 toward the photoconductor 2020, the size of the development gap Lc at the central section in the longitudinal direction of the developing roller 2510 is smaller than the size of the development gap Le at the ends in the longitudinal direction. Therefore, electric discharge between the developing roller 2510 and the photoconductor 2020 tends to occur at the central section in the longitudinal direction. By setting the Vmax with the Vmax setting section 2125*a* based on the information about the size of the development gap Lc at the central section in the longitudinal direction of the developing roller 2510, or by setting the Vg with the charge-bias control circuit 2127*a* based on the information about the size of the development gap Lc at the central section in the longitudinal direction of the developing roller 2510, it becomes possible to suppress the occurrence of electric discharge between the developing roller 2510 and the photoconductor 2020 more effectively. The foregoing embodiment is therefore more preferable.

The information about the size of the gap may be information about the size of the development gap Le at the ends of the developing roller 2510 in the longitudinal direction thereof. Further, although both the toner supplying roller 2550 and the restriction blade 2560 served as the pressing member, the pressing member may be either one of the toner supplying roller 2550 and the restriction blade 2560.

In the foregoing embodiment, as shown in FIG. 18 and FIG. 21, the printer 2010 had a developing unit 2051, 2052, 2053, 2054 (developing device) that is attachable to and detachable from the body 2010*a* of the printer (body of image forming apparatus), that is provided with the developing roller 2510, and that is for containing the toner T (developer) to be borne by the developing roller 2510. Further, as shown in FIG. 26, the developing unit 2051, 2052, 2053, 2054 was provided with a developing-unit-side memory 2051*a*, 2052*a*, 2053*a*, 2054*a* (developing-device storage section) in which the information about the size of the gap is stored. Further, as shown in FIG. 30, the Vmax setting section 2125*a* set the Vmax (first voltage) based on the information about the size of the gap that has been read out from the developing-unit-side memory 2051*a*, 2052*a*, 2053*a*, 2054*a*. Further, as shown in FIG. 30, the charge-bias control circuit 2127*a* (charge voltage setting section) set the Vg (charge voltage) based on the information about the size of the gap that has been read out from the developing-unit-side memory 2051*a*, 2052*a*, 2053*a*, 2054*a*.

This, however, is not a limitation. For example, a user etc. may input the information about the size of the gap.

In the foregoing embodiment, as shown in FIG. 18, the transferring section included an intermediate transferring body 2070 (transferring medium member) through which the toner image (developer image) formed on the photoconductor 2020 is transferred onto the recording medium (medium). Further, the transferring section transferred the toner image formed on the photoconductor 2020 onto the intermediate transferring body 2070, and transferred the toner image transferred on the intermediate transferring body 2070 onto the recording medium, to form the image. Further, as shown in FIG. 18, the printer 2010 had a patch sensor PS (darkness detection member) that detects a darkness of a patch image (test pattern) formed on the intermediate transferring body 2070 for adjustment of the darkness of the image to be formed on the recording medium. Further, as shown in FIG. 28, the Vmin setting section 2125*b* changed the Vmin (second voltage) based on a result of detection of the darkness of the patch image by the patch sensor PS.

This, however, is not a limitation. For example, the patch sensor PS may detect the darkness of patch images formed on the photoconductor 2020.

In the foregoing embodiment, the developing roller 2510 was made of metal. This, however, is not a limitation. For example, the developing roller 2510 may be non-metal.

However, in cases where the developing roller 2510 is made of metal, the image force between the toner and the developing roller 2510 is strong. Therefore, so-called selective development is likely to occur. Therefore, in cases where the developing roller 2510 is made of metal, it is likely that the absolute value of the Vmax will be set to a large value, or the absolute value of the Vmin will be set to a small value, from the viewpoint of preventing selective development. As a result, electric discharge between the developing roller 2510 and the photoconductor 2020 is prone to occur. Therefore, the effect that it is possible to prevent selective development and suppress the occurrence of electric discharge between the developing roller 2510 and the photoconductor 2020, is attained more effectively in cases where the developing roller 2510 is made of metal. The foregoing embodiment is therefore more preferable.

In the foregoing embodiment, the toner T was manufactured using a grinding method. This, however, is not a limitation. For example, the toner may be manufactured according to a polymerizing method.

However, in cases where the toner T is made through the grinding method, the charge distribution of the toner T becomes wide, and thus, so-called selective development is likely to occur. Therefore, in cases where the toner T is made through the grinding method, it is likely that the absolute value of the Vmax will be set to a large value, or the absolute value of the Vmin will be set to a small value, from the viewpoint of preventing selective development. As a result, electric discharge between the developing roller 2510 and the photoconductor 2020 is prone to occur. Therefore, the effect that it is possible to prevent selective development and suppress the occurrence of electric discharge between the developing roller 2510 and the photoconductor 2020, is attained more effectively in cases where the toner T is made through the grinding method. The foregoing embodiment is therefore more preferable.

THIRD EMBODIMENT (3) Overall Configuration of Image Forming Apparatus

Figure 34:
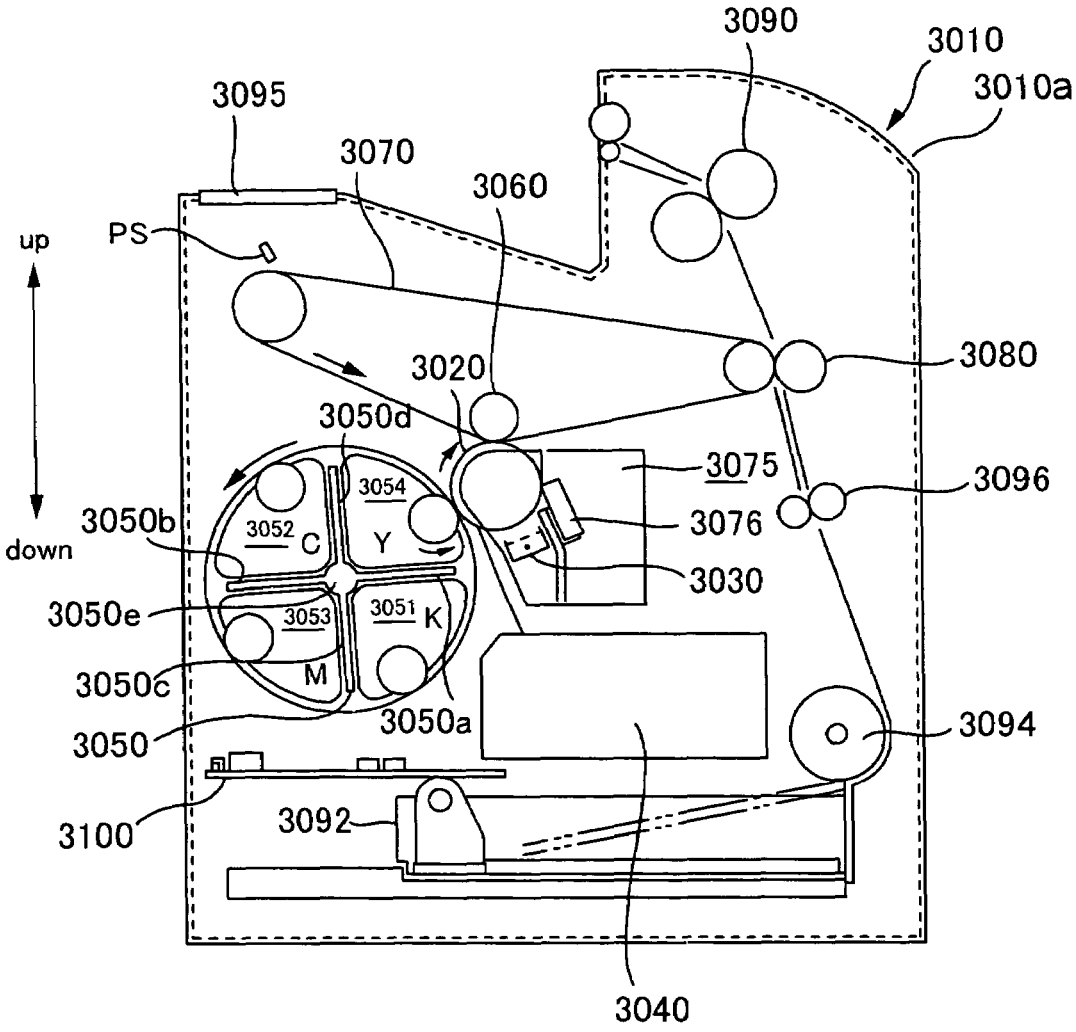
FIG. 34 is a diagram showing main structural components constructing a printer 3010.

Next, taking a laser beam printer 3010 (referred to also as "printer 3010" below) as an example of an "image forming apparatus", an overall configuration of the printer 3010 is described with reference to FIG. 34. FIG. 34 is a diagram showing main structural components constructing the printer 3010. It should be noted that in FIG. 34, the vertical direction is shown by the arrow, and, for example, a paper supply tray 3092 is arranged at a lower section of the printer 3010, and a fusing unit 3090 is arranged at an upper section of the printer 3010.

<Overall Configuration of Printer 3010>

As shown in FIG. 34, the printer 3010 according to the present embodiment includes a charging unit 3030, an exposing unit 3040, a developing-unit holding unit 3050, a first transferring unit 3060, an intermediate transferring body 3070, and a cleaning unit 3075. These units are arranged in the direction of rotation of a photoconductor 3020, which serves as an example of an "image bearing body" for bearing a latent image. The printer 3010 further includes a second transferring unit 3080, a fusing unit 3090, a displaying unit 3095 constructed of a liquid-crystal panel and serving as means for making notifications to the user etc., and a control unit 3100 for controlling these units etc. and managing the operations as a printer.

The photoconductor 3020 has a cylindrical conductive base and a photoconductive layer formed on the outer peripheral surface of the conductive base, and it is rotatable about its central axis. In the present embodiment, the photoconductor 3020 rotates clockwise, as shown by the arrow in FIG. 34.

The charging unit 3030 is a device for electrically charging the photoconductor 3020. The charge potential of the surface of the photoconductor 3020 that has been electrically charged by the charging unit 3030 is uniform. To charge the photoconductor 3020, a charge-bias generating device 3127*b* (see FIG. 39) provided in a charging unit drive control circuit applies a charge bias to the charging unit 3030. Further, the charging unit drive control circuit includes a charge-bias control circuit 3127*a* that serves to control the ON/OFF of the charge bias and to set an appropriate charge-bias value.

The exposing unit 3040 is a device for forming a latent image on the charged photoconductor 3020 by radiating a laser beam thereon. The exposing unit 3040 has, for example, a semiconductor laser, a polygon mirror, and an F-θ lens, and radiates a modulated laser beam onto the charged photoconductor 3020 according to image signals having been input from a not-shown host computer such as a personal computer or a word processor. In this way, the section of the photoconductor 3020 onto which the laser has been irradiated becomes the "image section", and the section of the photoconductor 3020 onto which the laser was not irradiated becomes the "non-image section". It should be noted that the electric potential of the image section is different from the electric potential (charge potential) of the non-image section.

The developing-unit holding unit 3050 is a device for developing the latent image formed on the photoconductor 3020 using black (K) toner contained in a black developing unit 3051, magenta (M) toner contained in a magenta developing unit 3053, cyan (C) toner contained in a cyan developing unit 3052, and yellow (Y) toner contained in a yellow developing unit 3054.

In the present embodiment, the developing-unit holding unit 3050 rotates to allow the positions of the four developing units 3051, 3052, 3053, and 3054, which serve as an example of "developing devices", to be moved. More specifically, the developing-unit holding unit 3050 holds the four developing units 3051, 3052, 3053, and 3054 respectively with four attach/detach sections 3050*a*, 3050*b*, 3050*c*, and 3050*d* which are provided in the body 3010*a* of the printer (body of the image forming apparatus), and the four developing units 3051, 3052, 3053, and 3054 can be rotated about a rotating shaft 3050*e* while maintaining their relative positions. A different one of the developing units is made to selectively oppose the photoconductor 3020 each time the photoconductor 3020 makes one revolution, thereby successively developing the latent image formed on the photoconductor 3020 using the toner T, which is an example of a "developer", contained in each of the developing units 3051, 3052, 3053, and 3054. It should be noted that details on the developing units are described further below.

The first transferring unit 3060 is a device for transferring a toner image, which is an example of a "developer image", formed on the photoconductor 3020 onto the intermediate transferring body 3070, which is an example of a "transferring medium member". When toner images of four colors are successively transferred in a superposed manner, a full-color toner image is formed on the intermediate transferring body 3070. The intermediate transferring body 3070 is an endless belt that is driven to rotate at substantially the same circumferential speed as the photoconductor 3020.

Further, a patch sensor PS, which is an example of a "darkness detection member" for detecting the darkness of a patch image ("test pattern") formed on the intermediate transferring body 3070 for adjusting the darkness of an image to be formed on a recording medium, is arranged in the vicinity of the intermediate transferring body 3070. The patch sensor PS is a reflective optical sensor that achieves the function of detecting the darkness of the patch image. More specifically, the patch sensor PS has a light emitting section for emitting light and a light receiving section for receiving the light. The light emitted from the light emitting section toward the patch image, that is, the incident light, is reflected by the patch image. The reflected light is received by the light receiving section and is converted into an electric signal. The intensity of the electric signal is measured as the output value of the light receiving sensor corresponding to the intensity of the reflected light that has been received. Since there is a predetermined relationship between the darkness of the patch image and the intensity of the received reflected light, it is possible to detect the darkness of the patch image by measuring the intensity of the electric signal. It should be noted that the patch sensor PS can also detect the darkness of fogging that has occurred on the intermediate transferring body 3070.

The second transferring unit 3080 is a device for transferring the single-color toner image, or the full-color toner image, formed on the intermediate transferring body 3070 onto a recording medium, which is an example of a "medium". It should be noted that the recording medium may be, for example, paper, film, or cloth. Further, the "transferring section" in this embodiment is the first transferring unit 3060, the intermediate transferring body 3070, and the second transferring unit 3080. The intermediate transferring body 3070 serves as a medium for when transferring, onto the recording medium, the toner image formed on the photoconductor 3020.

The fusing unit 3090 is a device for fusing the single-color toner image or the full-color toner image, which has been transferred to the recording medium, onto the recording medium such as paper to make it into a permanent image. The cleaning unit 3075 is a device that is provided between the first transferring unit 3060 and the charging unit 3030, that has a rubber cleaning blade 3076 made to abut against the surface of the photoconductor 3020, and that is for removing the toner remaining on the photoconductor 3020 by scraping it off with the cleaning blade 3076 after the toner image has been transferred onto the intermediate transferring body 3070 by the first transferring unit 3060.

Figure 39:
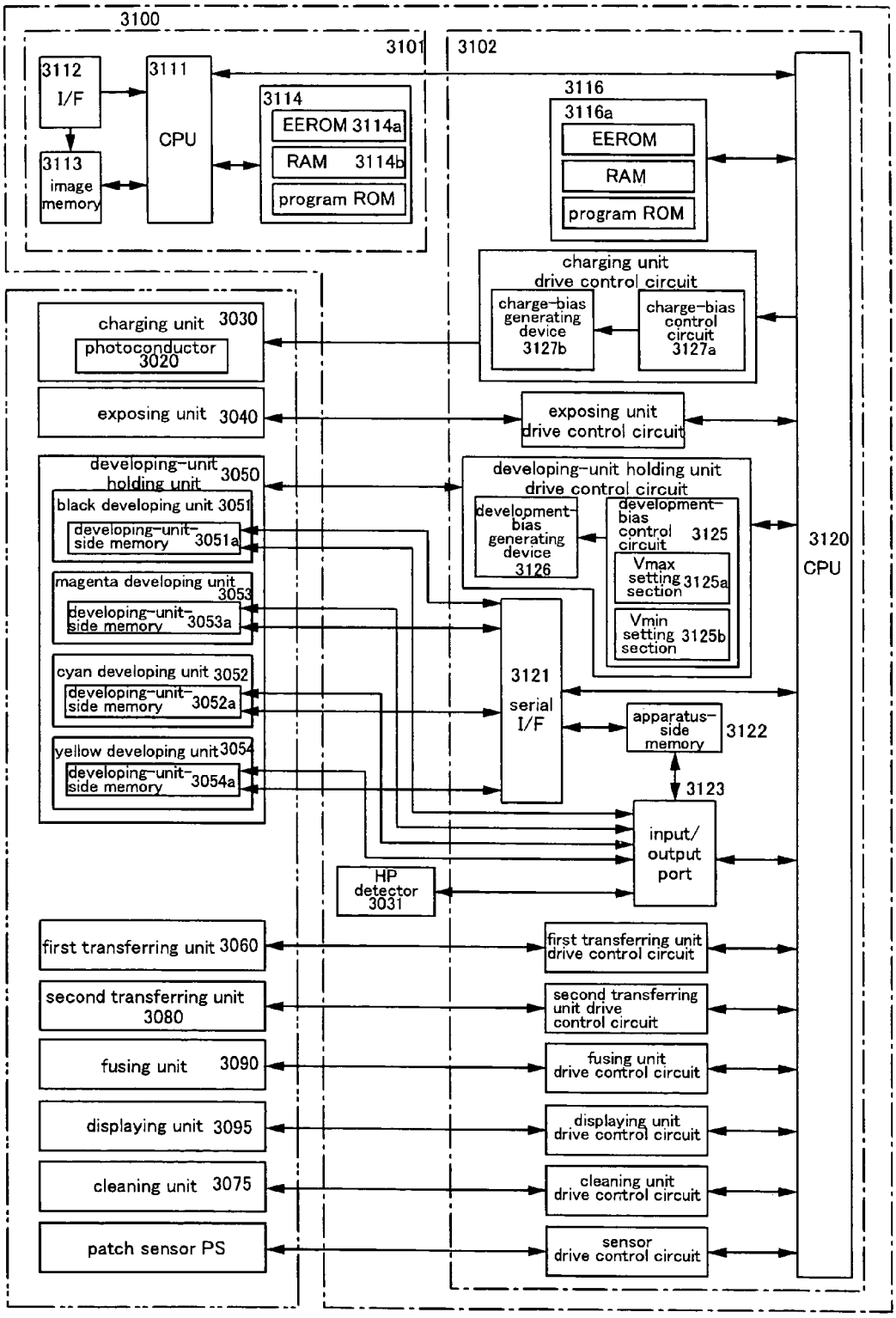
FIG. 39 is a block diagram showing a control unit 3100 of the printer 3010.

The control unit 3100 includes a controller section 3101 and a unit controller 3102 as shown in FIG. 39. Image signals are input to the controller section 3101, and according to instructions based on these image signals, the unit controller 3102 controls each of the above-mentioned units etc. to form an image.

(3) Overview of the Developing Unit

Figure 35:
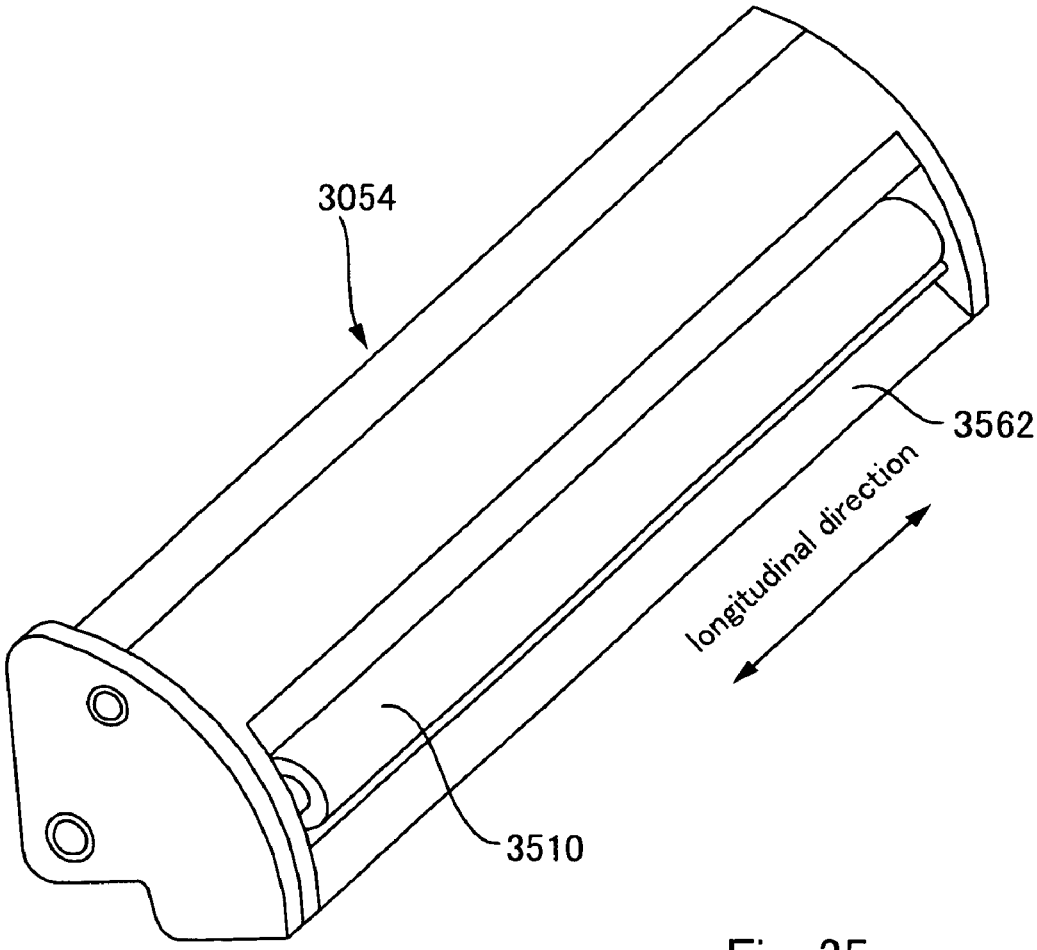
FIG. 35 is a conceptual diagram of a developing unit.
Figure 36:
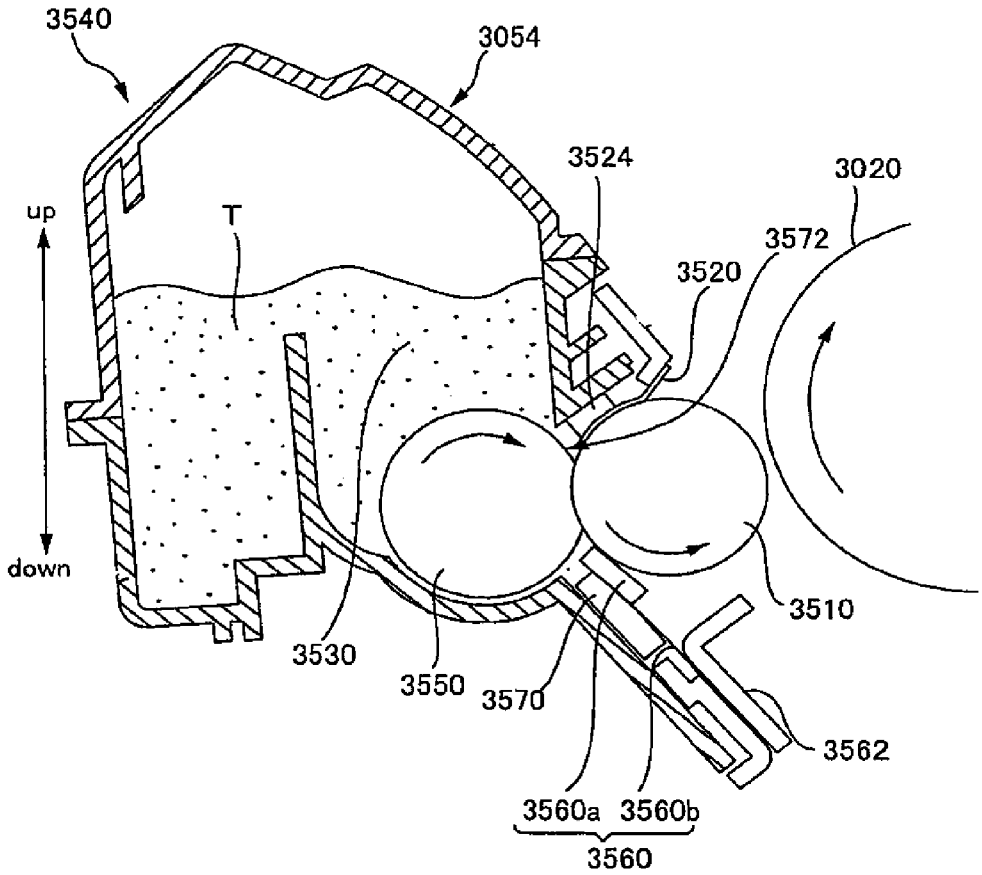
FIG. 36 is a section view showing main structural components of the developing unit.

Next, with reference to FIG. 35 and FIG. 36, an example of a configuration of the developing units will be described. FIG. 35 is a conceptual diagram of a developing unit. FIG. 36 is a section view showing main structural components of the developing unit. Note that the section view shown in FIG. 36 is a cross section of the developing unit taken along a plane perpendicular to the longitudinal direction shown in FIG. 35. Further, in FIG. 36, the arrow indicates the vertical direction as in FIG. 34, and, for example, the yellow developing unit 3054 is shown to be in a state in which it is positioned at the developing position opposing the photoconductor 3020.

To the developing-unit holding unit 3050, it is possible to attach the black developing unit 3051, the magenta developing unit 3053, the cyan developing unit 3052, and the yellow developing unit 3054. Since the configuration of the developing units is the same, explanation will be made below only on the yellow developing unit 3054.

The yellow developing unit 3054 has, for example, a developing roller 3510 serving as an example of a "developer bearing body", a sealing member 3520, a toner containing section 3530, a housing 3540, a toner supplying roller 3550, and a restriction blade 3560.

The developing roller 3510 bears toner T, carries it to the developing position opposing the photoconductor 3020, and develops the latent image borne on the photoconductor 3020 with the toner T carried to the developing position. The developing roller 3510 is made of metal and, for example, it is manufactured from aluminum, stainless steel, or iron; if necessary, the roller 3510 is plated with, for example, nickel plating or chromium plating, and the toner-bearing region is subjected to sandblasting, for example. Further, as shown in FIG. 35, the developing roller 3510 is supported at both ends in its longitudinal direction and is rotatable about its central axis. As shown in FIG. 36, the developing roller 3510 rotates in the opposite direction (counterclockwise in FIG. 36) to the rotating direction of the photoconductor 3020 (clockwise in FIG. 36). Further, as shown in FIG. 36, the developing roller 3510 of the yellow developing unit 3054 and the photoconductor 3020 oppose against each other with a spacing (gap) therebetween. That is, the yellow developing unit 3054 develops the latent image formed on the photoconductor 3020 in a non-contacting state.

Upon development of the latent image formed on the photoconductor 3020, a development-bias generating device 3126 (see FIG. 39), which is an example of a "voltage applying section" provided in a developing-unit holding unit drive control circuit, applies, to the developing roller 3510, a development bias obtained by superposing a DC voltage and an AC voltage, and thus an alternating field is generated between the developing roller 3510 and the photoconductor 3020. The developing-unit holding unit drive control circuit includes a development-bias control circuit 3125 that serves to control the ON/OFF of the development bias and to set an appropriate development-bias value. The development-bias control circuit 3125 has a Vmax setting section 3125*a*, which is an example of a "first voltage setting section" for setting a first voltage (Vmax), and a Vmin setting section 3125*b*, which is an example of an "image darkness adjusting section" for setting a second voltage (Vmin) in order to adjust the darkness of an image. It should be noted that details on the development bias etc. are described further below.

The sealing member 3520 prevents the toner T in the yellow developing unit 3054 from spilling out therefrom, and also collects the toner T, which is on the developing roller 3510 that has passed the developing position, into the developing unit without scraping it off. The sealing member 3520 is a seal made of, for example, polyethylene film. The sealing member 3520 is pressed against the developing roller 3510 by the elastic force of a seal-urging member 3524 that is made of, for example, Moltoprene and that is provided on the side opposite from the side of the developing roller 3510.

The housing 3540 is formed by welding together a plurality of integrally-molded housing sections. As shown in FIG. 36, the housing 3540 has an opening 3572 that opens toward the outside of the housing 3540. The above-mentioned developing roller 3510 is arranged from the outside of the housing 3540 with its peripheral surface facing the opening 3572 in such a state that a part of the roller 3510 is exposed to the outside. The restriction blade 3560, which is described in detail below, is also arranged from the outside of the housing 3540 facing the opening 3572.

Further, the housing 3540 forms a toner containing section 3530 that is capable of containing toner T. The toner T contained in the toner containing section 3530 is manufactured according to a grinding method. The particle size of the toner T is not uniform, and the toner T is made of particles having various particle sizes. It should be noted that the detailed structure etc. of the toner T will be described further below.

The toner supplying roller 3550 is provided in the toner containing section 3530 described above and supplies the toner T contained in the toner containing section 3530 to the developing roller 3510. The toner supplying roller 3550 is made of, for example, polyurethane foam, and is made to abut against the developing roller 3510 in an elastically deformed state. The toner supplying roller 3550 is arranged at a lower section of the toner containing section 3530. The toner T contained in the toner containing section 3530 is supplied to the developing roller 3510 by the toner supplying roller 3550 at the lower section of the toner containing section 3530. The toner supplying roller 3550 rotates about its central axis in the opposite direction (clockwise in FIG. 36) to the rotating direction of the developing roller 3510 (counterclockwise in FIG. 36).

It should be noted that the toner supplying roller 3550 has the function of supplying the toner T contained in the toner containing section 3530 to the developing roller 3510 as well as the function of stripping off, from the developing roller 3510, the toner T remaining on the developing roller 3510 after development.

The restriction blade 3560 gives an electric charge to the toner T borne by the developing roller 3510 to negatively charge the toner T. The restriction blade 3560 also restricts the thickness of the layer of the toner T borne by the developing roller 3510. This restriction blade 3560 has a rubber section 3560*a* and a rubber-supporting section 3560*b*. The rubber section 3560*a* is made of, for example, silicone rubber or urethane rubber. The rubber-supporting section 3560*b* is a thin plate that is made of, for example, phosphor bronze or stainless steel, and that has a spring-like characteristic. The rubber section 3560*a* is supported by the rubber-supporting section 3560*b*. The rubber-supporting section 3560*b* is attached to the housing 3540 via a pair of blade-supporting metal plates 3562 in a state that one end of the rubber-supporting section 3560*b* is pinched between and supported by the blade-supporting metal plates 3562. Further, a blade-backing member 3570 made of, for example, Moltoprene is provided on one side of the restriction blade 3560 opposite from the side of the developing roller 3510.

The rubber section 3560*a* is pressed against the developing roller 3510 by the elastic force caused by the flexure of the rubber-supporting section 3560*b*. Further, the blade-backing member 3570 prevents the toner T from entering in between the rubber-supporting section 3560*b* and the housing 3540, stabilizes the elastic force caused by the flexure of the rubber-supporting section 3560*b*, and also, applies force to the rubber section 3560*a* from the back thereof towards the developing roller 3510 to press the rubber section 3560*a* against the developing roller 3510. In this way, the blade-backing member 3570 makes the rubber section 3560*a* abut against the developing roller 3510 evenly.

In the yellow developing unit 3054 structured as above, the toner supplying roller 3550 supplies the toner T contained in the toner containing section 3530 to the developing roller 3510. With the rotation of the developing roller 3510, the toner T, which has been supplied to the developing roller 3510, reaches the abutting position of the restriction blade 3560; then, as the toner T passes the abutting position, the toner is electrically charged and its layer thickness is restricted. With further rotation of the developing roller 3510, the toner T on the developing roller 3510, whose layer thickness has been restricted, reaches the developing position opposing the photoconductor 3020; then, under the alternating field, the toner T is used at the developing position for developing the latent image formed on the photoconductor 3020. With further rotation of the developing roller 3510, the toner T on the developing roller 3510, which has passed the developing position, passes the sealing member 3520 and is collected into the developing unit by the sealing member 3520 without being scraped off.

Further, each developing unit 3051, 3052, 3053, and 3054 is also provided with a storage element, for example, a non-volatile storage memory such as a serial EEPROM (which is also referred to below as a "developing-unit-side memory") 3051*a*, 3052*a*, 3053*a*, and 3054*a* that is an example of a "developing-device storage section" and that is for storing toner information, which is "developer information" about the toner T contained in each of the developing units, and various kinds of information about the developing unit.

Developing-unit-side connectors 3051*b*, 3052*b*, 3053*b*, and 3054*b*, which are provided on one end surface of the respective developing units, come into connection, as necessary, with an apparatus-side connector 3034, which is provided on the apparatus side (i.e., the printer side), and in this way, the developing-unit-side memories 3051*a*, 3052*a*, 3053*a*, and 3054*a* are electrically connected to the unit controller 3102 of the control unit 3100 of the apparatus.

(3) Overview of the Developing-unit Holding Unit

Next, an overview of the developing-unit holding unit 3050 will be described with reference to FIG. 37A through FIG. 37C.

The developing-unit holding unit 3050 has a rotating shaft 3050*e* positioned at the center. A support frame 3055 for holding the developing units is fixed to the rotating shaft 3050*e*. The rotating shaft 3050*e* is provided extending between two frame side plates (not shown) which form a casing of the printer 3010, and both ends of the shaft 3050*e* are supported thereby. It should be noted that the axial direction of the rotating shaft 3050*e* intersects with the vertical direction.

The support frame 3055 is provided with the four attach/detach sections 3050*a*, 3050*b*, 3050*c*, and 3050*d*, to which the above-described developing units 3051, 3052, 3053, and 3054 of the four colors are attached in an attachable/detachable manner about the rotating shaft 3050*e*, and they are arranged in the circumferential direction at an interval of 90°.

A pulse motor, which is not shown, is connected to the rotating shaft 3050*e*. By driving the pulse motor, it is possible to rotate the support frame 3055 and position the four developing units 3051, 3052, 3053, and 3054 mentioned above at predetermined positions.

Figure 37A:
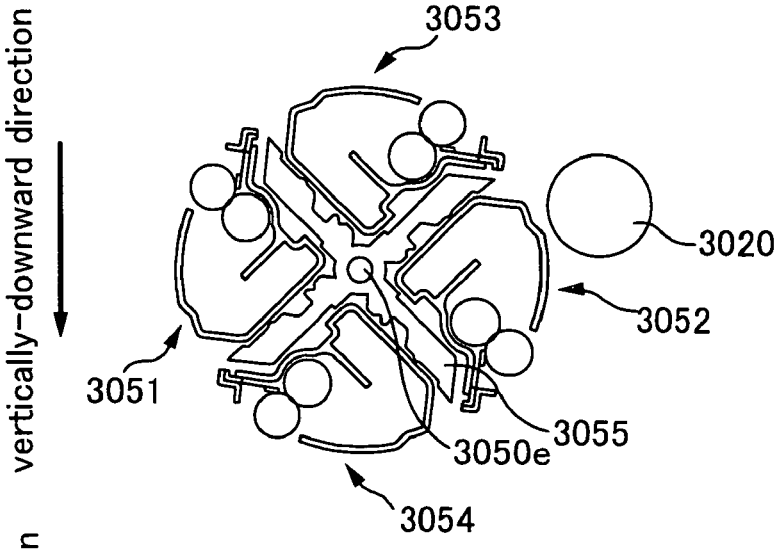
FIG. 37A shows the HP position.
Figure 37B:
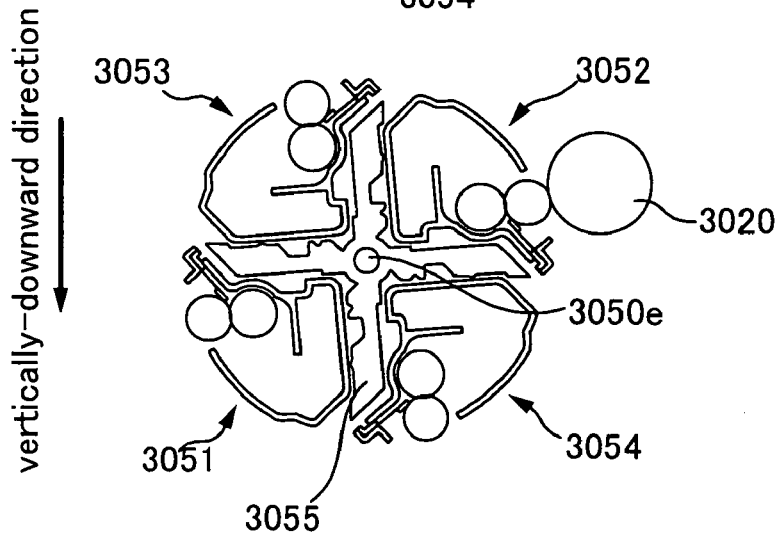
FIG. 37B shows the connector attach/detach position.
Figure 37C:
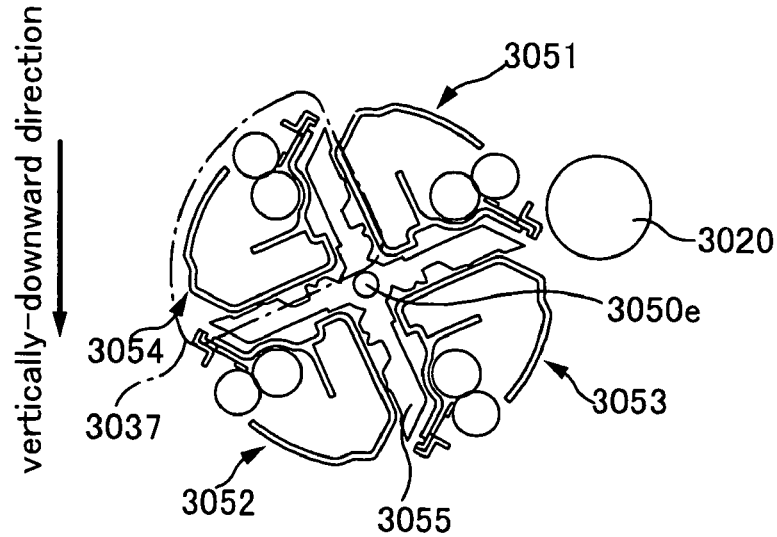
FIG. 37C shows the attach/detach position of a yellow developing unit 3054.

FIG. 37A through FIG. 37C are diagrams showing three stop positions of the rotating developing-unit holding unit 3050. FIG. 37A shows the home position (referred to as "HP position" below) which is the standby position for when the printer is on standby for image formation to be carried out, and which is also the halt position serving as the reference position in the rotating direction of the developing-unit holding unit 3050. FIG. 37B shows the connector attach/detach position where the developing-unit-side connector 3054*b* of the yellow developing unit 3054, which is attached to the developing-unit holding unit 3050, and the apparatus-side connector 3034, which is provided on the apparatus side, come into opposition. FIG. 37C shows the attach/detach position where the yellow developing unit 3054 is attached and detached.

In FIG. 37B and FIG. 37C, the connector attach/detach position and the developing unit attach/detach position are explained with regard to the yellow developing unit 3054, but these positions become the connector attach/detach position and the developing unit attach/detach position for each of the other developing units when the developing-unit holding unit 3050 is rotated at 90° intervals.

First, the HP position shown in FIG. 37A will be described. An HP detector 3031 (FIG. 39) for detecting the HP position is provided on the side of one end of the rotating shaft 3050*e* of the developing-unit holding unit 3050. The HP detector 3031 is structured of a disk that is for generating signals and that is fixed to one end of the rotating shaft 3050*e*, and an HP sensor that is made up of, for example, a photointerrupter having a light emitting section and a light receiving section. The peripheral section of the disk is arranged such that it is located between the light emitting section and the light receiving section of the HP sensor. When a slit formed in the disk moves up to a detecting position of the HP sensor, the signal that is output from the HP sensor changes from "L" to "H". The device is constructed such that the HP position of the developing-unit holding unit 3050 is detected based on this change in signal level and the number of pulses of the pulse motor, and by taking this HP position as a reference, each of the developing units can be positioned at the developing position etc.

FIG. 37B shows the connector attach/detach position of the yellow developing unit 3054 which is achieved by rotating the pulse motor for a predetermined number of pulses from the above-mentioned HP position. At this connector attach/detach position, the developing-unit-side connector 3054*b* of the yellow developing unit 3054, which is attached to the developing-unit holding unit 3050, and the apparatus-side connector 3034, which is provided on the apparatus side, come into opposition, and it becomes possible to connect or separate these connecters.

Figure 38A:
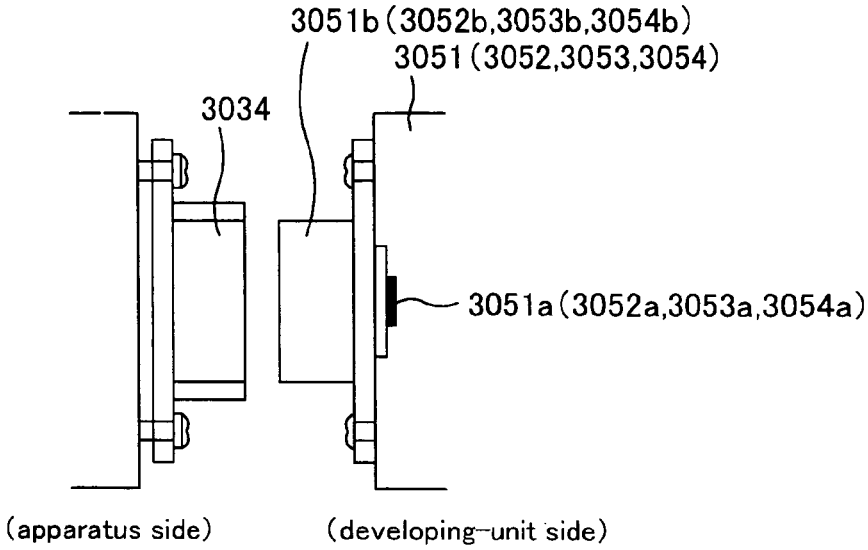
FIG. 38A is a diagram showing a separated position.
Figure 38B:
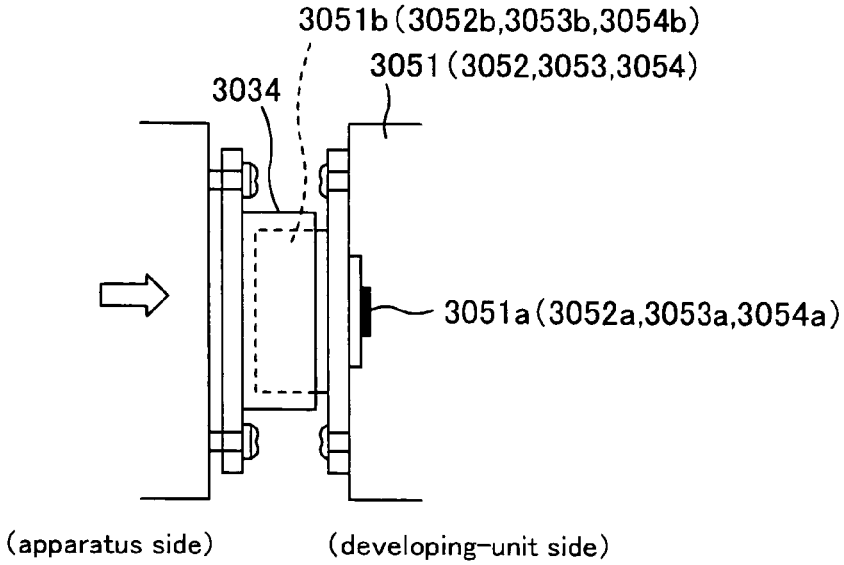
FIG. 38B is a diagram showing an abutting position.

Further explanation is given using FIG. 38A and FIG. 38B. FIG. 38A is a diagram showing a separated position. FIG. 38B is a diagram showing an abutting position.

FIG. 38A shows a state in which the apparatus-side connector 3034 and the developing-unit-side connector 3054*b* of the yellow developing unit 3054 are separated from each other. The apparatus-side connector 3034 is structured such that it can move toward, and move away from, the yellow developing unit 3054. When necessary, the apparatus-side connector 3034 moves in the direction towards the yellow developing unit 3054 (the direction of the arrow shown in FIG. 38B). In this way, the apparatus-side connector 3034 abuts against the developing-unit-side connector 3054*b* of the yellow developing unit 3054 as shown in FIG. 38B. Thus, the developing-unit-side memory 3054*a* attached to the yellow developing unit 3054 is electrically connected to the unit controller 3102 of the control unit 3100, and communication between the developing-unit-side memory 3054*a* and the apparatus is established.

Conversely, the apparatus-side connector 3034 moves, from the state shown in FIG. 38B in which the apparatus-side connector 3034 and the developing-unit-side connector 3054*b* of the yellow developing unit 3054 abut against each other, in the direction away from the yellow developing unit 3054 (the direction opposite to the direction of the arrow shown in FIG. 38B). In this way, the apparatus-side connector 3034 is separated from the developing-unit-side connector 3054*b* of the yellow developing unit 3054, as shown in FIG. 38A.

It should be noted that the movement of the apparatus-side connector 3034 is achieved by, for example, a not-shown mechanism structured of a pulse motor, a plurality of gears connected to the pulse motor, and an eccentric cam connected to the gears. More specifically, by rotating the pulse motor for a predetermined number of pulses, the above-mentioned mechanism moves the apparatus-side connector 3034 from the predetermined separated position for a distance that corresponds to the above-mentioned number of pulses to position the apparatus-side connector 3034 at the predetermined abutting position. On the contrary, by rotating the pulse motor in reverse for a predetermined number of pulses, the above-mentioned mechanism moves the apparatus-side connector 3034 from the predetermined abutting position for a distance that corresponds to the above-mentioned number of pulses to position the apparatus-side connector 3034 at the predetermined separated position.

Further, the connector attach/detach position for the yellow developing unit 3054 is the developing position for the cyan developing unit 3052 where the developing roller 3510 of the cyan developing unit 3052 and the photoconductor 3020 oppose each other. That is, the connector attach/detach position of the developing-unit holding unit 3050 for the yellow developing unit 3054 is the developing position of the developing-unit holding unit 3050 for the cyan developing unit 3052. Further, the position achieved when the pulse motor rotates the developing-unit holding unit 3050 counterclockwise by 90° is the connector attach/detach position for the black developing unit 3051 and the developing position for the yellow developing unit 3054; every time the developing-unit holding unit 3050 is rotated by 90°, the connector attach/detach position and the developing position for each of the developing units are successively achieved.

One of the two frame side plates that support the developing-unit holding unit 3050 and that form the casing of the printer 3010 is provided with an attach/detach dedicated opening 3037 through which one developing unit can pass and an inner cover (not shown) that openably/closably covers the attach/detach dedicated opening 3037. The attach/detach dedicated opening 3037 is formed in a position where only a relevant developing unit (here, the yellow developing unit 3054) can be pulled out and detached in the direction of the rotating shaft 3050*e*, as shown in FIG. 37C, when the developing-unit holding unit 3050 is rotated and each developing unit is halted at the developing unit attach/detach position which is set for each developing unit. Further, the attach/detach dedicated opening 3037 is formed slightly larger than the outer shape of a developing unit. At the developing unit attach/detach position, not only is it possible to detach the developing unit, but it is also possible to insert a new developing unit through this attach/detach dedicated opening 3037 in the direction of the rotating shaft 3050*e* and attach the developing unit to the support frame 3055. While the developing-unit holding unit 3050 is positioned at positions other than the developing unit attach/detach position, the attachment/detachment of that developing unit is restricted by the frame side plates.

It should be noted that a lock mechanism, which is not shown, is provided for certainly positioning and fixing the developing-unit holding unit 3050 at the positions described above.

(3) Toner Structure

Next, the structure of the toner T according to the present embodiment is described. The toner T manufactured according to the grinding method includes a core particle and external additives that are applied on the core particle.

The core particle includes materials such as coloring agents, charge control agents, release agents (WAX), and resin. The core particle is manufactured by: uniformly mixing the above-mentioned materials using a Henschel mixer, for example; melting and kneading the mixture using a twin screw extruder; cooling the batch; subjecting the batch to rough grinding and fine grinding; and classifying the particles. Note that the core particle may further include, for example, dispersing agents, magnetic materials, and other additives.

For example, it is possible to use one kind, or two or more kinds blended, of the following materials as the core particle: polystyrene and copolymers thereof, such as hydrogenated styrene resin, styrene isobutylene copolymer, ABS resin, ASA resin, AS resin, AAS resin, ACS resin, AES resin, styrene p-chlorostyrene copolymer, styrene propylene copolymer, styrene butadiene crosslinked polymer, styrene butadiene chlorinated-paraffin copolymer, styrene allylalcohol copolymer, styrene butadiene rubber emulsion, styrene maleate copolymer, styrene isobutylene copolymer, and styrene maleic anhydride copolymer; acrylate resins, methacrylate resins, and copolymers thereof; styrene acrylic resins and copolymers thereof, such as styrene acryl copolymer, styrene diethylaminoethyl methacrylate copolymer, styrene butadiene acrylate copolymer, styrene methyl methacrylate copolymer, styrene n-butyl methacrylate copolymer, styrene methyl methacrylate n-butyl acrylate copolymer, styrene methyl methacrylate butyl acrylate N-(ethoxymethyl) acrylamide copolymer, styrene glycidyl methacrylate copolymer, styrene butadiene dimethyl aminoethyl methacrylate copolymer, styrene acrylate maleate copolymer, styrene methyl methacrylate 2-ethylhexyl acrylate copolymer, styrene n-butyl acrylate ethylglycol methacrylate copolymer, styrene n-butyl methacrylate acrylic acid copolymer, styrene n-butyl methacrylate maleic anhydride copolymer, and styrene butyl acrylate isobutyl maleic acid half-ester divinylbenzene copolymer; polyesters and copolymers thereof; polyethylene and copolymers thereof; epoxy resins; silicone resins; polypropylene and copolymers thereof; fluorocarbon resins; polyamide resins; polyvinyl alcohol resins; polyurethane resins; and polyvinyl butyral resins.

For example, it is possible to use the following materials as coloring agents: carbon black; spirit black; nigrosine; rhodamines; triaminotriphenylmethane; cations; dioxazine; copper phthalocyanine pigments; perylene; azo dyes; metal-containing azo pigments; azo chromium complex; carmines; benzidines; solar pure yellow 8G; quinacridon; poly-tungstophosphoric acid; indanthrene blue; and sulfonamide derivatives.

For example, it is possible to use the following materials as charge control agents: electron acceptor organic complexes; chlorinated polyethers; nitrohumic acid; quaternary ammonium salts; and pyridinyl salts.

The following materials are preferably used as the release agents (WAX): low molecular-weight polypropylene; low molecular-weight polyethylene; ethylene bis-amide; and paraffin-based waxes such as microcrystalline wax, carnauba wax, and bees wax. It is not particularly limited to the above, however, as long as it is not miscible to the core particle of the toner and stays separate therefrom. Note that, in the present embodiment, "not miscible" indicates a state in which, when molten and kneaded, the wax disperses in the core particle like "islands" without being taken into the molecular chain of the resin.

It should be noted that, in order to prevent the toner T from adhering to the fusing roller during the fusing process, there are cases in which oil is coated on the fusing roller. In the present embodiment, however, the core particle is made to contain a large amount of the release agent in order to omit oil coating. The content of the release agent is 3-10 wt % with respect to the amount of resin.

It is possible to use, for example, metallic soaps and polyethylene glycol as dispersing agents. As other additives, it is possible to use, for example, zinc stearate, zinc oxide, and ceric oxide.

For example, it is possible to use the following materials as magnetic materials: metal powder such as Fe, Co, Ni, Cr, Mn, and Zn; metal oxides such as $Fe_3O_4$, $Fe_2O_3$, $Cr_2O_3$, and ferrites; and alloys that display ferromagnetism by treating, for example, alloys containing manganese and acid with heat. The magnetic material may be pretreated in advance with, for example, a coupling agent.

It is possible to use, as the external additives, various materials whose surface has been treated to have hydrophobic characteristics. A mixture of silica and titanium oxide is used as the external additive of the toner T according to the present embodiment. Other than silica and titanium oxide, however, it is possible to use inorganic particles such as: particles of metal oxides, such as aluminum oxide, strontium titanate, ceric oxide, magnesium oxide, and chromium oxide; particles of nitrides, such as silicon nitride; particles of carbides, such as silicon carbide; particles of metal salts, such as calcium sulfate, barium sulfate, and calcium carbonate; and materials obtained by combining the above. It is also possible to use organic particles such as particles of acrylic resin. Further, it is possible to use, for example, silane coupling agents, titanate coupling agents, fluorine-containing silane coupling agents, and silicone oil as surface treatment agents for treating the external additives. It is preferable that the hydrophobic ratio of the external additives having been treated with the above-mentioned treatment agents is 60% or higher, according to a conventional methanol method. If the ratio is lower than this value, deterioration in the charging characteristic and fluidity will easily occur in a hot and wet environment due to adsorption of moisture, and therefore it is not preferable. It is preferable for the particle size of the external additives to be 0.001 to 1 μm from the viewpoint of carrying performance and charging characteristics.

(3) Overview of Control Unit

Next, with reference to FIG. 39, the configuration of the control unit 3100 will be described. FIG. 39 is a block diagram showing the control unit 3100 of the printer 3010.

The controller section 3101 includes a CPU 3111, an interface 3112 for establishing connection with a not-shown computer, an image memory 3113 for storing image signals etc. that have been input from the computer, and a controller-section-side memory 3114 that is made up of, for example, an electrically rewritable EEPROM 3114*a*, a RAM 3114*b*, and a programmable ROM in which various programs for control are written. The controller section 3101 receives various information such as image signals etc. from the computer connected to the printer 3010.

The controller section 3101 has a function of converting the RGB data of red, green, and blue, which is the image signal sent from the computer etc., into YMCK image data of yellow, magenta, cyan, and black, and storing the converted YMCK image data in the image memory 3113. The controller section 3101 also has a function of sending various information to the connected computer.

The unit controller 3102 includes, for example, a CPU 3120, a unit-controller-side memory 3116 that is made up of, for example, an electrically rewritable EEPROM 3116*a*, a RAM, and a programmable ROM in which various programs for control are written, and various drive control circuits for driving and controlling the units in the apparatus body (i.e., the charging unit 3030, the exposing unit 3040, the first transferring unit 3060, the cleaning unit 3075, the second transferring unit 3080, the fusing unit 3090, and the displaying unit 3095) and the developing-unit holding unit 3050.

The CPU 3120 is electrically connected to each of the drive control circuits and controls the drive control circuits according to control signals from the CPU 3111 of the controller section 3101. More specifically, the unit controller 3102 controls each of the units and the developing-unit holding unit 3050 according to signals received from the controller section 3101 while detecting the state of each of the units and the developing-unit holding unit 3050 by receiving signals from sensors provided in each unit.

Further, the CPU 3120 is connected, via a serial interface (indicated herein as "I/F") 3121, to a non-volatile storage element 3122 (which is referred to below as "apparatus-side memory") which is, for example, a serial EEPROM. Data necessary for controlling the apparatus are stored in the apparatus-side memory 3122. The CPU 3120 is not only connected to the apparatus-side memory 3122, but is also connected to developing-unit-side memories 3051*a*, 3052*a*, 3053*a*, and 3054*a*, which are provided on the respective developing units 3051, 3052, 3053, and 3054, via the serial interface 3121. Then, data can be exchanged between the apparatus-side memory 3122 and the developing-unit-side memories 3051*a*, 3052*a*, 3053*a*, and 3054*a*, and also, it is possible to input chip-select signals CS to the developing-unit-side memories 3051*a*, 3052*a*, 3053*a*, and 3054*a* via the input/output port 3123. The CPU 3120 is also connected to the HP detector 3031 via the input/output port 3123.

Further, the CPU 3120 becomes communicable with the developing-unit-side memories 3051*a*, 3052*a*, 3053*a*, and 3054*a* when the apparatus-side connector 3034 and the connecter of one of the developing units positioned at the connector attach/detach position are connected. Then, various information about the developing unit is obtained from the developing-unit-side memory 3051*a*, 3052*a*, 3053*a*, or 3054*a* of the developing unit connected to the apparatus-side connector 3034. Information about the developing unit includes, for example, toner information (fogging-darkness information) about the toner T contained in the attached developing unit. The various kinds of information that have been obtained are stored, corresponding to each developing unit, in a predetermined region of the apparatus-side memory 3122 of the unit controller 3102. It should be noted that the fogging-darkness information is information that indicates the darkness of fogging that has occurred on the intermediate transferring body 3070.

(3) Development Bias

Figure 40:
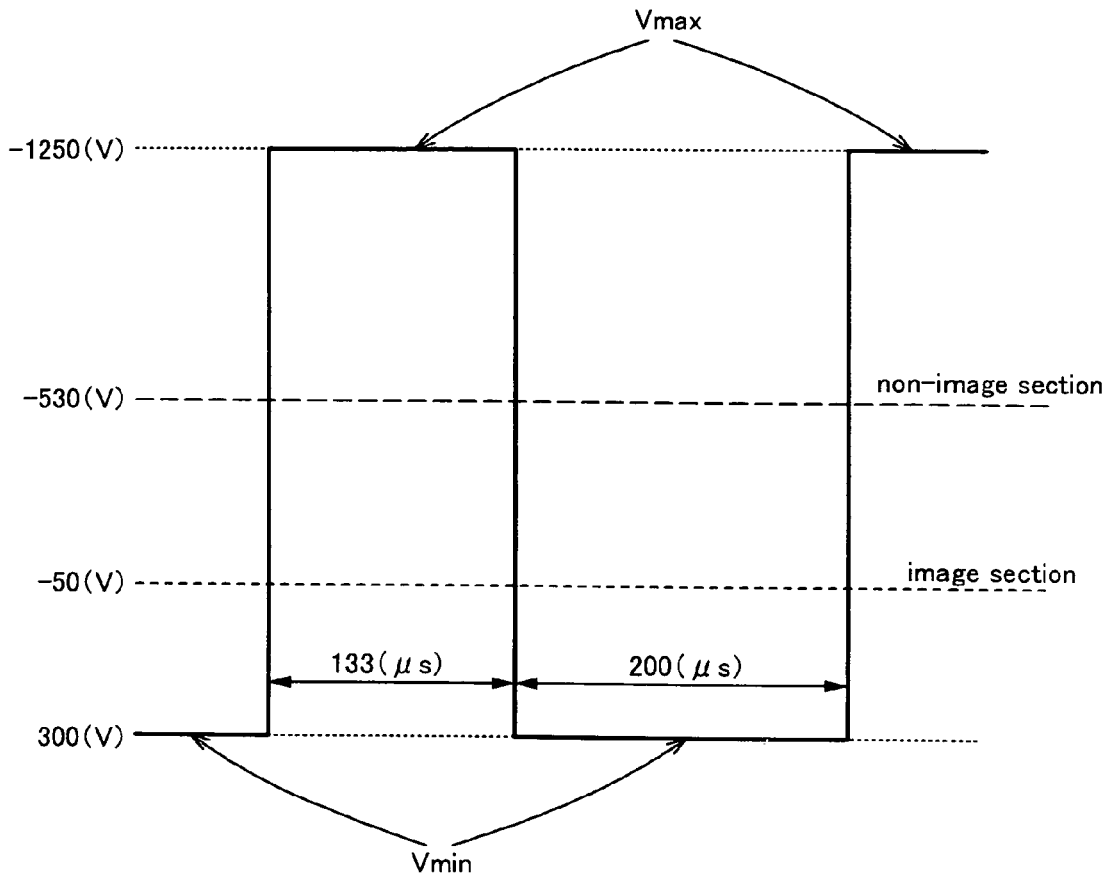
FIG. 40 shows a waveform of the development bias.

The development bias that is applied from the development-bias generating device 3126 to the developing roller 3510 is described with reference to FIG. 40. FIG. 40 shows a waveform of the development bias.

The development-bias generating device 3126 applies, to the developing roller 3510, a development bias of a rectangular waveform as shown in FIG. 40 for developing a latent image. More specifically, the development-bias generating device 3126 alternately applies, to the developing roller 3510, a first voltage (Vmax) for making the toner T move from the developing roller 3510 toward the photoconductor 3020 for developing a latent image, and a second voltage (Vmin) for making the toner T move from the photoconductor 3020 toward the developing roller 3510.

When the development-bias generating device 3126 applies a Vmax to the developing roller 3510, the toner T borne on the developing roller 3510 flies toward the photoconductor 3020 and adheres thereto. When the Vmax is applied to the developing roller 3510, an electric field is generated due to the difference between the electric potential of the developing roller 3510 (for example, −1250 V) caused by the Vmax, and the electric potential of the photoconductor 3020 on which the latent image is formed (for example, electric potential of the image section: −50 V; electric potential of the non-image section: −530 V). The negatively-charged toner T borne on the developing roller 3510 flies toward the photoconductor 3020 due to the force caused by the electric field and adheres to the photoconductor 3020. It should be noted that, the larger the absolute value of the Vmax is, the larger the force of the electric field becomes, and so the amount of toner T that adheres to the photoconductor 3020 increases.

When the development-bias generating device 3126 applies a Vmin to the developing roller 3510, the toner T adhering to the photoconductor 3020 flies toward the developing roller 3510 and returns thereto. When the Vmin is applied to the developing roller 3510, an electric field is generated due to the difference between the electric potential of the developing roller 3510 (for example, 300 V) caused by the Vmin, and the electric potential of the photoconductor 3020 on which the latent image is formed (for example, electric potential of the image section: −50 V; electric potential of the non-image section: −530 V). The negatively-charged toner T adhering to the photoconductor 3020 flies toward the developing roller 3510 due to the force caused by the electric field and returns to the developing roller 3510. It should be noted that the toner T that returns to the developing roller 3510 is a portion of the toner T that adhered to the photoconductor 3020, and the toner T that remains on the photoconductor 3020 without returning to the developing roller 3510 is used for developing the latent image. It should be noted that, the larger the absolute value of the Vmin is, the larger the force of the electric field becomes, and so the amount of toner T that returns to the developing roller 3510 increases.

Before the development-bias generating device 3126 applies the Vmax and the Vmin to the developing roller 3510, the toner T borne on the developing roller 3510 is not in contact with the photoconductor 3020. Therefore, development of a latent image will not be carried out if neither the Vmax nor Vmin is applied to the developing roller 3510.

Further, as shown in FIG. 40, the time for which the development-bias generating device 3126 applies the Vmax to the developing roller 3510 is 133 μs, and the time for which it applies the Vmin to the developing roller 3510 is 200 μm.

(3) Operation of the Printer 3010

Figure 41:
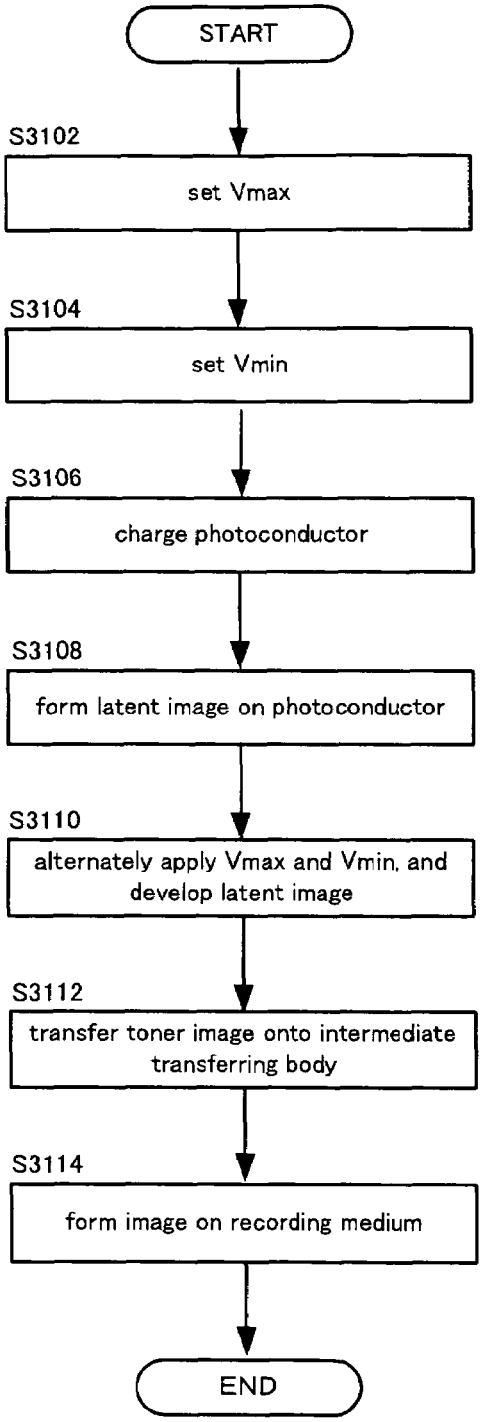
FIG. 41 is a flowchart for describing the operation of the printer 3010.

The operation of the printer 3010 in which it adjusts the darkness of an image and forms the image on a recording medium will be described with reference to FIG. 41. FIG. 41 is a flowchart for describing the operation of the printer 3010.

The various operations of the printer 3010 described below are mainly achieved by the controller section 3101 or the unit controller 3102 in the printer 3010. Particularly, in the present embodiment, they are achieved by the CPU processing a program stored in a program ROM. The program is made of codes for achieving the various operations described below.

First, when a developing unit is attached to the body 3010*a* of the printer and the power of the printer 3010 is turned ON, the Vmax setting section 3125*a* provided in the unit controller 3102 sets, for each developing unit, a Vmax in accordance with the toner information (fogging-darkness information) (S3102). Setting of the Vmax by the Vmax setting section 3125*a* is carried out when a new developing unit is attached to the body 3010*a* of the printer. Once the Vmax is set for that developing unit, the setting operation for the Vmax is not performed until another developing unit is attached. It should be noted that the method of setting the Vmax in accordance with the fogging-darkness information will be described further below.

Next, in order to adjust the darkness of an image to be formed on a recording medium, the Vmin setting section 3125*b* provided in the unit controller 3102 sets a Vmin based on a result of detecting the darkness of a patch image using the patch sensor PS (S3104). Here, of the Vmax and the Vmin, the Vmin setting section 3125*b* changes only the Vmin; that is, it maintains the Vmax set by the Vmax setting section 3125*a* at S3102, but changes the Vmin to adjust the darkness of an image to be formed on a recording medium.

Figure 42:
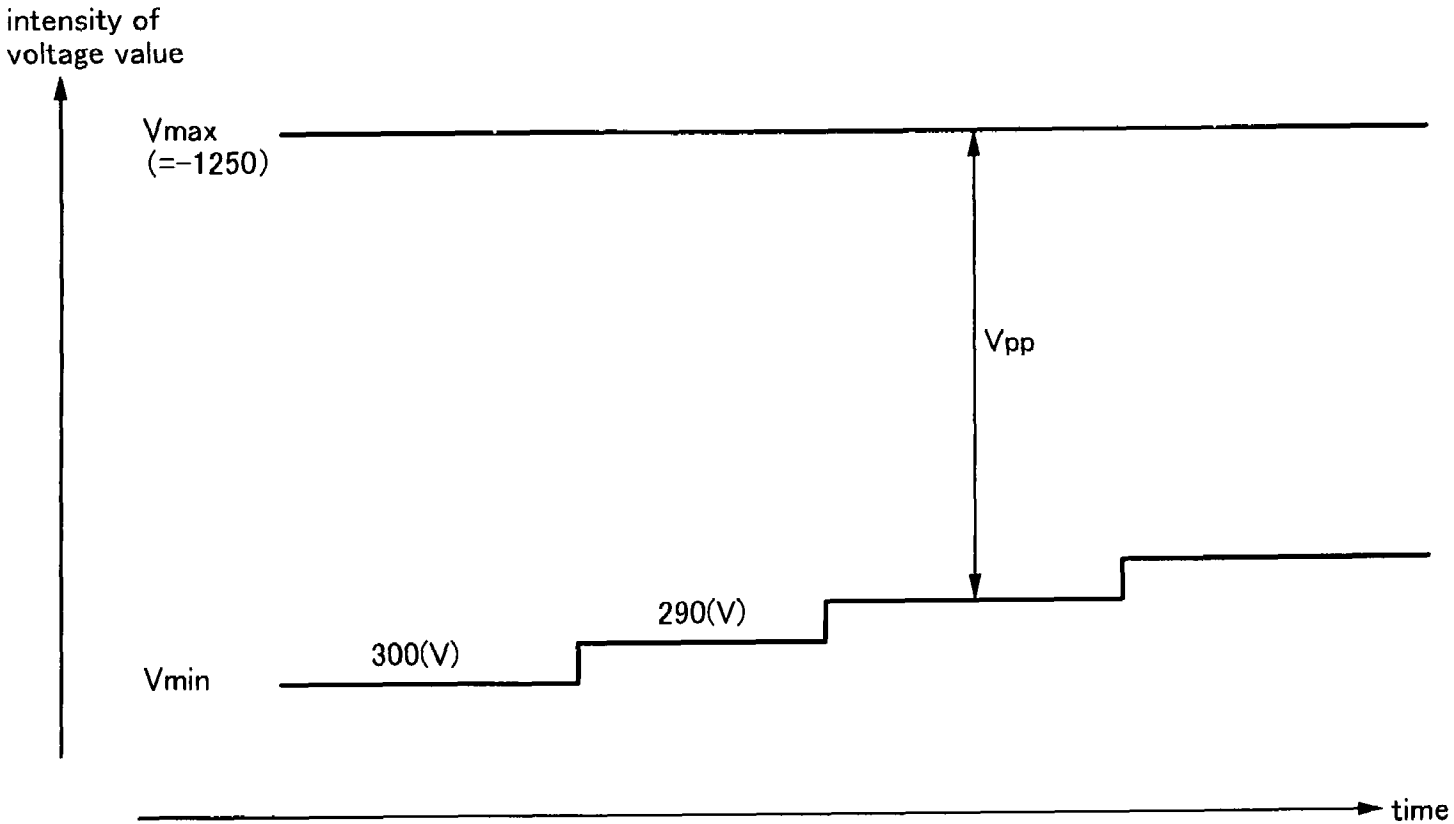
FIG. 42 is a schematic diagram showing the change in Vmax and Vmin.

This is explained in more detail. As shown in FIG. 42, the Vmin setting section 3125*b* maintains the Vmax at −1250 V, but changes the Vmin (for example, changes it from 300 V to 290 V) to adjust the image darkness. It should be noted that since only the Vmin is changed, the difference between the Vmax and the Vmin ("Vpp" in FIG. 42) is not constant. Note that FIG. 42 is a schematic diagram showing the change in Vmax and Vmin.

It should be noted that the method of setting the Vmin in accordance with the result of detecting the darkness of a patch image using the patch sensor PS will be described further below.

Next, when an image signal is input from a not-shown host computer to the controller section 3101 of the printer 3010 through the interface (I/F) 3112, the photoconductor 3020, the developing roller which is provided in each developing unit 3051, 3052, 3053, and 3054, and the intermediate transferring body 3070 rotate under the control of the unit controller 3102 based on the instructions from the controller section 3101. The unit controller 3102 controls the charging unit 3030 so as to charge the photoconductor 3020 (S3106). The charging unit 3030 successively charges the rotating photoconductor 3020 at a charging position.

Next, the unit controller 3102 controls the exposing unit 3040 so as to form a latent image on the charged photoconductor 3020 (S3108). With the rotation of the photoconductor 3020, the charged area of the photoconductor 3020 reaches an exposing position, and a latent image that corresponds to the image information about the first color, for example, yellow Y, is formed in that area by the exposing unit 3040. Further, the developing-unit holding unit 3050 positions the yellow developing unit 3054, which contains yellow (Y) toner, at the developing position opposing the photoconductor 3020.

Next, the development-bias generating device 3126 provided in the unit controller 3102 alternately applies, to the developing roller 3510, the Vmax set by the Vmax setting section 3125*a* at S3102 and the Vmin set by the Vmin setting section 3125*b* at S3104 (S3110). Here, the development-bias generating device 3126 alternately applies, to the developing roller 3510, a Vmax whose value is −1250 V and a Vmin whose value is 290 V. In this way, the latent image formed on the photoconductor 3020 reaches the developing position along with the rotation of the photoconductor 3020, and is developed with toner by the developing roller 3510. Thus, a toner image is formed on the photoconductor 3020.

Next, the unit controller 3102 controls the first transferring unit so as to transfer, onto the intermediate transferring body 3070, the toner image that has been formed on the photoconductor 3020 (S3112). With the rotation of the photoconductor 3020, the toner image formed on the photoconductor 3020 reaches a first transferring position, and is transferred onto the intermediate transferring body 3070 by the first transferring unit 3060. At this time, a first transferring voltage, which is in an opposite polarity from the polarity to which the toner is charged, is applied to the first transferring unit 3060. It should be noted that, during this process, the second transferring unit 3080 is kept separated from the intermediate transferring body 3070.

By successively performing the above-mentioned processes (S3102 to S3112) for the second, the third, and the fourth colors, toner images in four colors corresponding to the respective image signals are transferred onto the intermediate transferring body 3070 in a superimposed manner. As a result, a full-color toner image is formed on the intermediate transferring body 3070. Then, with the rotation of the intermediate transferring body 3070, the full-color toner image formed on the intermediate transferring body 3070 reaches a second transferring position, where it is transferred onto a recording medium by the second transferring unit 3080. In this way, an image is formed on a recording medium (S3114). It should be noted that the recording medium is carried from the paper supply tray 3092 to the second transferring unit 3080 via the paper-feed roller 3094 and resisting rollers 3096. During transferring operations, a second transferring voltage is applied to the second transferring unit 3080 and also the unit 3080 is pressed against the intermediate transferring body 3070.

The full-color toner image transferred onto the recording medium is heated and pressurized by the fusing unit 3090 and fused to the recording medium. On the other hand, after the photoconductor 3020 has passed the first transferring position, the toner adhering to the surface of the photoconductor 3020 is scraped off by the cleaning blade 3076 that is supported on the cleaning unit 3075, and the photoconductor 3020 is prepared for charging for formation of the next latent image. The scraped-off toner is collected into a remaining-toner collector of the cleaning unit 3075.

(3) Method of Setting Vmax in Accordance with Toner Information

Figure 43:
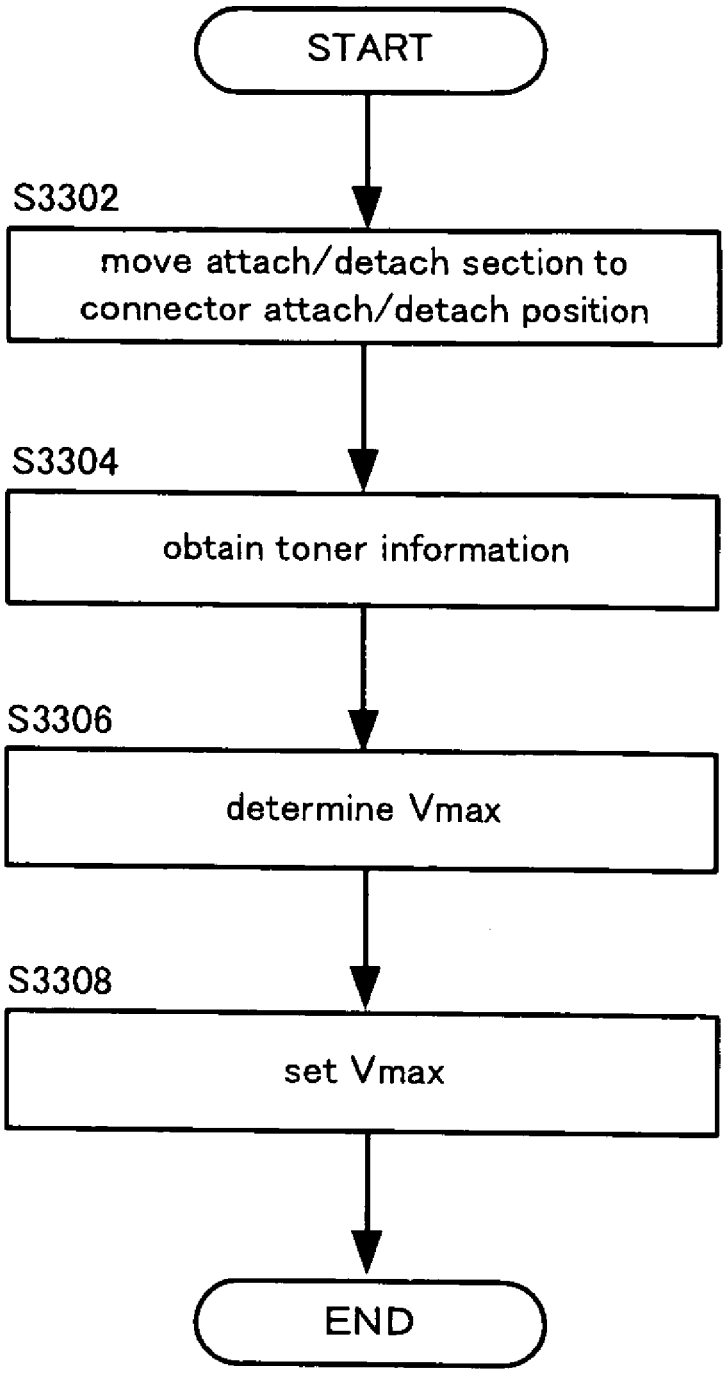
FIG. 43 is a flowchart showing a method of setting the Vmax based on fogging-darkness information read out from a developing-unit-side memory.

As described above, the Vmax setting section 3125*a* sets the Vmax in accordance with the fogging-darkness information that has been read out from the developing-unit-side memory. Below, the method of setting the Vmax according to the fogging-darkness information stored in the developing-unit-side memory is described with reference to FIG. 43. FIG. 43 is a flowchart showing a method of setting the Vmax based on fogging-darkness information read out from the developing-unit-side memory.

It should be noted that the fogging-darkness information is obtained according to the method described further below, and is stored in the developing-unit-side memory before the manufacturer etc. ships the developing unit.

Setting of the Vmax is started in a state where the developing units have been attached to their respective attach/detach sections at their respective developing unit attach/detach positions (see FIG. 37C). The unit controller 3102 rotates the developing-unit holding unit 3050 to successively move the four attach/detach sections to the connector attach/detach position (see FIG. 37B) (S3302).

Next, the unit controller 3102 moves the apparatus-side connector 3034 to obtain information, such as the toner information (fogging-darkness information), stored in the developing-unit-side memory of a developing unit if there is a developing unit attached to the attach/detach section positioned at the connector attach/detach position (S3304). For example, if a yellow developing unit 3054 is attached to the attach/detach section 3050*d* positioned at the connector attach/detach position, then the apparatus-side connector 3034 is made to abut against the developing-unit-side connector 3054*b* and the unit controller 3102 obtains the fogging-darkness information stored in the developing-unit-side memory 3054*a* of the yellow developing unit 3054. The unit controller 3102 reads out the fogging-darkness information etc., and then stores, for each developing unit, the information in a predetermined region of the apparatus-side memory 3122. Here, the unit controller 3102 acknowledges, from the fogging-darkness information that has been obtained, that the fogging darkness of toner T contained in the yellow developing unit 3054 is 0.07, for example.

Next, the unit controller 3102 determines the Vmax (S3306) by referencing the fogging-darkness information read out from the developing-unit-side memory and stored in the apparatus-side memory 3122 and a Vmax setting table (see FIG. 44) stored, for example, in the unit-controller-side memory 3116. For example, if the fogging darkness is 0.07, then the unit controller 3102 determines the Vmax to be −1300 V. Then, the unit controller 3102 stores the Vmax determined for each developing unit in a predetermined region of the apparatus-side memory 3122. It should be noted that FIG. 44 is a diagram showing the Vmax setting table.

Next, the Vmax setting section 3125*a* sets, for each developing unit, the Vmax (the DC voltage and the AC voltage) that has been determined (S3308). For example, the Vmax setting section 3125*a* sets the Vmax to −1300 V for a yellow developing unit 3054 that contains toner T having a fogging darkness of 0.07.

(3) Method of Setting Vmin

Figure 45:
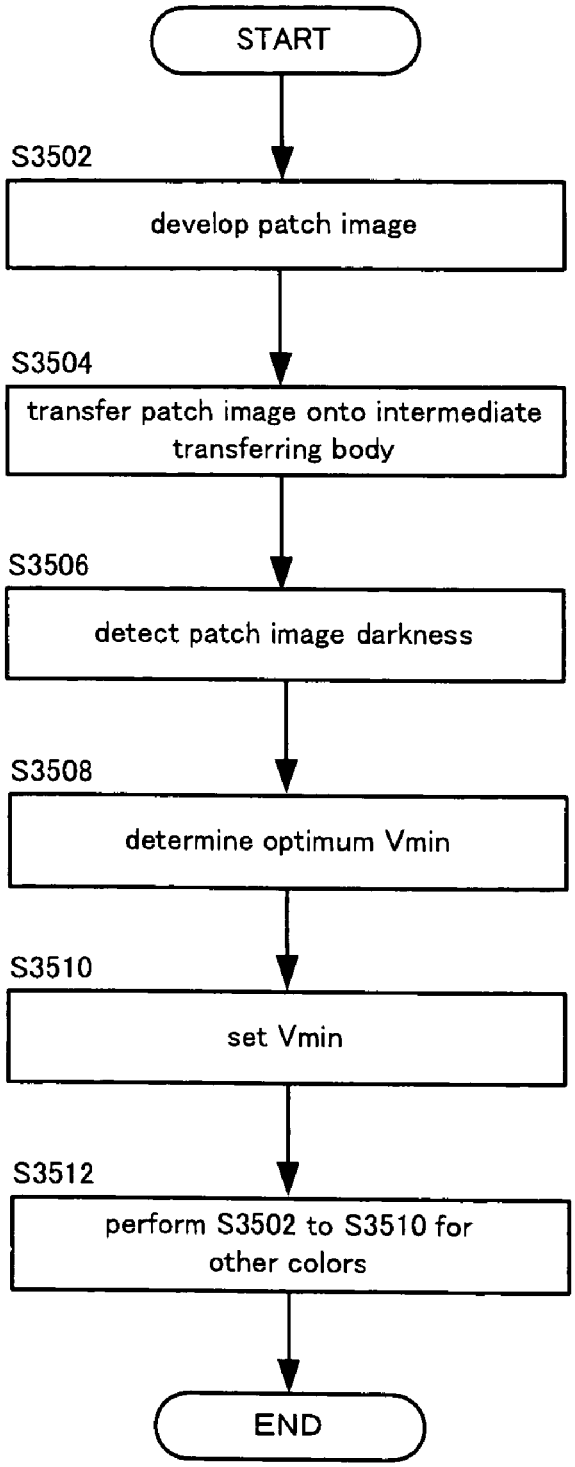
FIG. 45 is a flowchart showing a method of setting the Vmin.
Figure 46:
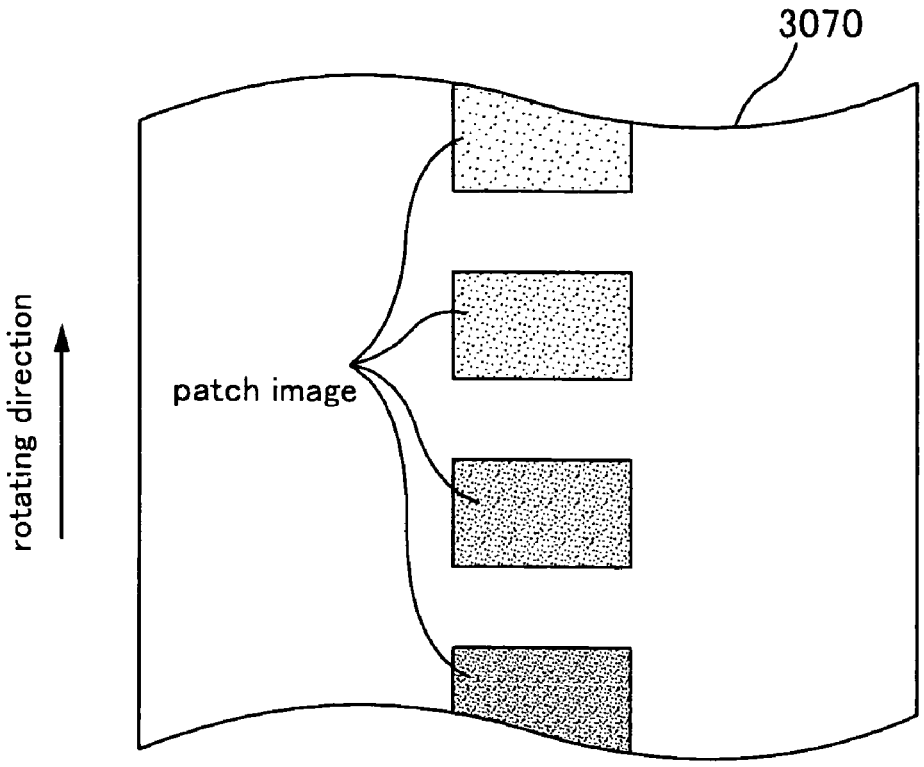
FIG. 46 is a schematic diagram showing how patch images are formed on an intermediate transferring body 3070.

As described above, the printer 3010 carries out, at a predetermined timing, a control operation for adjusting the darkness of an image (or, "Vmin setting operation"). Here, an example of the control operation is described with reference to FIG. 45 and FIG. 46. FIG. 45 is a flowchart showing a method of setting the Vmin. FIG. 46 is a schematic diagram showing how patch images are formed on the intermediate transferring body 3070. It should be noted that the various operations of the printer 3010 described below are mainly achieved by the controller section 3101 or the unit controller 3102 in the printer 3010. Particularly, in the present embodiment, they are achieved by the CPU processing a program stored in a program ROM. The program is made of codes for achieving the various operations described below.

First, the printer 3010 develops patch images (step S3502). While being rotated, the photoconductor 3020 is successively charged by the charging unit 3030 at the charging position. With the rotation of the photoconductor 3020, the charged area of the photoconductor 3020 reaches the exposing position, and patch latent images that correspond to information about patch images of the first color, for example, yellow Y, are formed in that area by the exposing unit 3040. With the rotation of the photoconductor 3020, the patch latent images formed on the photoconductor 3020 reach the developing position and are developed with yellow toner by the yellow developing unit 3054. Here, development of the patch latent images is performed while changing the Vmin of the development bias applied by the development-bias generating device 3126, that is, by changing the DC voltage and the AC voltage. In this way, patch images are formed on the photoconductor 3020.

With the rotation of the photoconductor 3020, the patch images formed on the photoconductor 3020 reach the first transferring position, and are transferred onto the intermediate transferring body 3070 by the first transferring unit 3060 (step S3504). In this way, a plurality of patch images, each having a different darkness, are formed in a line on the intermediate transferring body 3070, as shown in FIG. 46.

As each patch image on the intermediate transferring body 3070 reaches the position that is in opposition to the patch sensor PS with the rotation of the intermediate transferring body 3070, the darkness of that patch image is detected by the patch sensor PS (step S3506).

Then, when the darkness of all the patch images has been detected, the optimum Vmin, i.e., the optimum DC voltage and AC voltage, is determined based on the darkness-detection result, that is, by comparing the darkness detected for each patch image with the desired image darkness (step S3508). The Vmin that has been determined is then stored, for each developing unit, in a predetermined region of the apparatus-side memory 3122.

Next, the above-mentioned Vmin setting section 3125*b* sets the Vmin that has been determined, so that it is possible to carry out development at an optimum development bias after performing the above-mentioned control operation (step S3510).

It should be noted that the remaining toner T that forms the patch images for which darkness detection has finished is successively cleaned by a intermediate-transferring-body cleaning unit (not shown).

By successively performing, for each developing unit, the above-mentioned processes for the second, the third, and the fourth colors, the optimum Vmin is set for each color, and the control operation for adjusting the image darkness is completed (step S3512).

It should be noted that in the foregoing, a plurality of patch images each having a different darkness were formed. This, however, is not a limitation, and for example, it is also possible to form a single patch image whose darkness gradually changes.

(3) Selective Development

The reason why selective development occurs in the printer 3010 of the present third embodiment is the same as the reason why selective development occurs in the printer 10 described in the first embodiment using FIG. 15 and FIG. 16. Therefore, further explanation about the cause of selective development is omitted.

(3) Function of Development Bias According to the Present Embodiment

As described above, the Vmax setting section 3125*a* sets the Vmax based on the toner information, and the Vmin setting section 3125*b* maintains the Vmax set by the Vmax setting section 3125*a* but changes the Vmin to adjust the darkness of an image to be formed on a recording medium. In this way, it becomes possible to prevent selective development from occurring, as well as prevent an increase in fogging or scattering of toner T.

In consideration of preventing the so-called "selective development", it is effective to adjust the darkness of an image by fixing the absolute value of the Vmax at a large value and changing only the Vmin.

However, if the absolute value of the fixed Vmax is too large, then the amount of toner T that flies from the developing roller 3510 toward the photoconductor 3020 will increase. This increase may give rise to an increase in fogging on the photoconductor 3020 at non-image sections or scattering of toner T from the developing roller 3510.

Incidentally, various types of toner T are used in a printer 3010. The absolute value of the Vmax at which fogging and/or scattering of toner T is likely to occur may differ depending on the type of toner T.

In view of the above, in the present embodiment, the Vmax setting section 3125*a* sets the Vmax in accordance with the toner information.

This is described in more detail. The Vmax setting section 3125*a* sets the Vmax according to the fogging-darkness information serving as the toner information. That is, if development is to be performed using a toner T with which fogging etc. is likely to occur, then the Vmax setting section 3125*a* sets the absolute value of the Vmax to a small value. In this way, it is possible to prevent the amount of toner T moving from the developing roller 3510 toward the photoconductor 3020 from increasing, and thus, it becomes possible to prevent an increase in fogging. Further, by preventing the amount of toner T that moves from the developing roller 3510 toward the photoconductor 3020 from increasing, it also becomes possible to prevent an increase in scattering of toner T. On the other hand, if development is to be performed using a toner T with which fogging etc. is less likely to occur, then the Vmax setting section 3125*a* sets the absolute value of the Vmax to a high value. In this way, it becomes possible to effectively prevent selective development from occurring.

As described above, by setting the Vmax with the Vmax setting section 3125*a* according to the toner information (fogging-darkness information), an appropriately Vmax will be set in accordance with the type of toner T used for development, and thus, it becomes possible to prevent selective development from occurring, as well as prevent an increase in fogging or scattering of toner T.

(3) Second Example of Operation of Printer 3010

In the printer described above, the Vmax setting section 3125*a* set the Vmax in accordance with a fogging darkness stored in the developing-unit-side memory. In the printer described below, the Vmax setting section 3125*a* sets the Vmax according to a fogging darkness obtained by the patch sensor PS detecting the darkness of fogging that has occurred on the intermediate transferring body 3070 (this is referred to also as "obtained fogging darkness" below).

Figure 47:
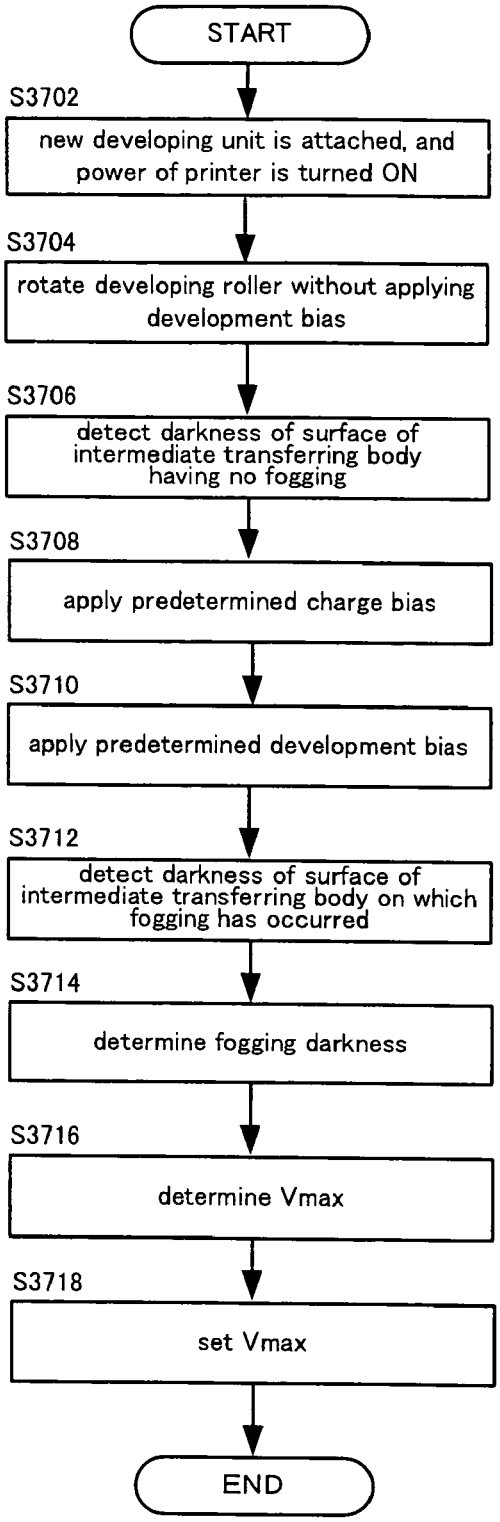
FIG. 47 is a flowchart showing a method of setting the Vmax according to another example of the third embodiment.

The method of setting the Vmax according to the obtained fogging darkness is described with reference to FIG. 47. FIG. 47 is a flowchart showing a method of setting the Vmax according to another example.

Setting of the Vmax is started in a state where a new developing unit has been attached to the body 3010*a* of the printer and the power of the printer 3010 has been turned ON (S3702).

The unit controller 3102 rotates the developing roller 3510 without applying a development bias thereto (S3704). Since no development bias is applied to the developing roller 3510, no toner T flies from the developing roller 3510 toward the photoconductor 3020, and thus no fogging occurs on the photoconductor 3020. Further, the unit controller 3102 rotates the units other than the developing unit, that is, it rotates the intermediate transferring body 3070 and so forth.

Next, the unit controller 3102 controls the patch sensor PS to detect the darkness of the intermediate transferring body 3070 (S3706). The patch sensor PS detects the darkness of the surface of the intermediate transferring body 3070 on which no fogging has occurred. In this example, it is assumed that the darkness detected by the patch sensor PS is 0.10.

Next, the charge-bias generating device 3127*b* applies a predetermined charge bias to the charging unit 3030 (S3708). For example, the charge-bias generating device 3127*b* applies a charge bias to the charging unit 3030 such that the charge potential of the surface of the photoconductor 3020 becomes −380 V. It should be noted that this charge potential of −380 V is different from the charge potential (−530 V) normally used for forming an image; when the charge potential is −380 V, fogging tends to occur on the photoconductor 3020. The unit controller 3102 controls the exposing unit 3040 so that no laser beam is emitted onto the charged photoconductor 3020, that is, so that no latent image is formed on the photoconductor 3020.

Next, the development-bias generating device 3126 applies a predetermined development bias to the developing roller 3510 (S3710). In this example, the Vmax applied to the developing roller 3510 by the development-bias generating device 3126 is −1250 V. Since a development bias is applied to the developing roller 3510, fogging occurs on the photoconductor 3020. The unit controller 3102 then controls the first transferring unit 3060 to transfer the fogging on the photoconductor 3020 onto the intermediate transferring body 3070.

Next, the unit controller 3102 controls the patch sensor PS to detect the darkness of the intermediate transferring body 3070 (S3712). The patch sensor PS detects the darkness of the surface of the intermediate transferring body 3070 on which fogging has occurred. In this example, it is assumed that the darkness detected by the patch sensor PS is 0.17.

Next, the unit controller 3102 determines the fogging darkness by calculating the difference between the darkness detected at S3706 and the darkness detected at S3712 (S3714). Since the darkness detected at S3706 is 0.10 and the darkness detected at S3712 is 0.17, the darkness of fogging is 0.07.

Next, the unit controller 3102 determines the Vmax (S3716) by referencing the Vmax setting table (see FIG. 44). Since the fogging darkness obtained at S3714 is 0.07, the unit controller 3102 determines the Vmax to be −1300 V by referencing the Vmax setting table. Then, the unit controller 3102 stores the Vmax determined for each developing unit in a predetermined region of the apparatus-side memory 3122. Then, the Vmax setting section 3125*a* sets, for each developing unit, the Vmax (the DC voltage and the AC voltage) that has been determined (S3718).

It should be noted that the fogging-darkness information explained in the section labeled "Method of setting Vmax in accordance with toner information", which described the method of obtaining the fogging-darkness information stored in a developing-unit-side memory, is obtained through similar processes as the steps S3702 through S3714 described above.

(3) Other Considerations

An image forming apparatus according to the present third embodiment is a printer 3010 (image forming apparatus) comprising: a photoconductor 3020 (image bearing body); a developing roller 3510 (developer bearing body); a transferring section (first transferring unit 3060, intermediate transferring body 3070, and second transferring unit 3080); a development-bias generating device 3126 (voltage applying section); a Vmax setting section 3125*a* (first voltage setting section); and a Vmin setting section 3125*b* (image darkness adjusting section).

In the foregoing embodiment, fogging-darkness information was used as the toner information stored in the developing-unit-side memory. This, however, is not a limitation.

For example, particle-size information may be used as the toner information stored in the developing-unit-side memory. Here, particle-size information is, for example, information indicating the ratio of toner particles having a particle size of 5 μm or less. In cases where both toner particles having a particle size of 5 μm or less (referred to also as "small toner particles") and toner particles having a particle size of more than 5 μm (referred to also as "large toner particles") are included and where the amount of small toner particles is large, there is a tendency that a layer of small toner particles borne on the developing roller 3510, which have large charge amounts, will be formed on the inner side, and a layer of large toner particles borne on the developing roller 3510, which have small charge amounts, will be formed on the outer side. In such a case, the large toner particles having small charge amounts are likely to cause an increase in fogging or scattering of toner. By setting the Vmax with the Vmax setting section 3125*a* according to the ratio of toner particles having a particle size of 5 μm or less, it becomes possible to set an appropriate Vmax by which it is possible to prevent selective development from occurring, as well as prevent an increase in fogging or scattering of toner T.

In the foregoing embodiment, external-additive information may be used as the toner information. Here, external-additive information is, for example, the ratio of silica and titanium oxide. The amount of fogging or scattering of toner may differ depending on the ratio of silica and titanium oxide. By setting the Vmax with the Vmax setting section 3125*a* according to the ratio of silica and titanium oxide, it becomes possible to set an appropriate Vmax by which it is possible to prevent selective development from occurring, as well as prevent an increase in fogging or scattering of toner T.

Further, color information about the color of toner T and lot information about the lot of the toner T may be used as the toner information stored in the developing-unit-side memory. The amount of fogging or scattering of toner T may differ depending on the color of the toner T because the constituents of the toner will differ. Further, the amount of fogging or scattering of toner T may differ because the characteristics of toner T may differ lot by lot. By setting the Vmax with the Vmax setting section 3125*a* according to the color information or the lot information, it becomes possible to set an optimum Vmax by which it is possible to prevent selective development from occurring, as well as prevent an increase in fogging or scattering of toner T.

In the foregoing embodiment, the Vmax setting section 3125*a* set the Vmax based on a single type of information (fogging-darkness information). This, however, is not a limitation. For example, the Vmax setting section 3125*a* may set the Vmax based on two or more types of the above-mentioned information, that is, the fogging-darkness information, particle-size information, external-additive information, color information, and lot information.

In the foregoing embodiment, as shown in FIG. 34, the transferring section included an intermediate transferring body 3070 (transferring medium member) through which the toner image (developer image) formed on the photoconductor 3020 is transferred onto the recording medium (medium). Further, the transferring section transferred the toner image formed on the photoconductor 3020 onto the intermediate transferring body 3070, and transferred the toner image transferred on the intermediate transferring body 3070 onto the recording medium, to form the image. Further, as shown in FIG. 34, the printer 3010 had a patch sensor PS (darkness detection member) that detects a darkness of a patch image (test pattern) formed on the intermediate transferring body 3070 for adjustment of the darkness of the image to be formed on the recording medium. Further, the Vmin setting section 3125*b* changed the Vmin based on a result of detection of the darkness of the patch image by the patch sensor PS.

This, however, is not a limitation. For example, the patch sensor PS may detect the darkness of patch images formed on the photoconductor 3020.

In the foregoing embodiment, as shown in FIG. 34 and FIG. 36, the printer 3010 had a developing unit 3051, 3052, 3053, 3054 (developing device) that is attachable to and detachable from the body 3010*a* of the printer (body of image forming apparatus), that is provided with the developing roller 3510, and that is for containing the toner T to be borne by the developing roller 3510. Further, as shown in FIG. 38A and FIG. 38B, the developing unit 3051, 3052, 3053, 3054 was provided with a developing-unit-side memory 3051*a*, 3052*a*, 3053*a*, 3054*a* (developing-device storage section) in which the toner information about the toner T contained in that developing unit is stored. Further, as shown in FIG. 43, the Vmax setting section 3125*a* set the Vmax based on the toner information that has been read out from the developing-unit-side memory 3051*a*, 3052*a*, 3053*a*, 3054*a*.

This, however, is not a limitation. For example, a user etc. may input the toner information.

In the foregoing embodiment, as shown in FIG. 34, the transferring section included an intermediate transferring body 3070 through which the toner image formed on the photoconductor 3020 is transferred onto the recording medium. Further, the transferring section transferred the toner image formed on the photoconductor 3020 onto the intermediate transferring body 3070, and transferred the toner image transferred on the intermediate transferring body 3070 onto the recording medium, to form the image. Further, as shown in FIG. 34, the printer 3010 had a patch sensor PS (darkness detection member) for detecting a darkness of fogging that has occurred on the intermediate transferring body 3070. Further, as shown in FIG. 47, the fogging-darkness information was obtained by the patch sensor PS detecting the darkness of fogging that has occurred on the intermediate transferring body 3070.

This, however, is not a limitation. For example, the patch sensor PS may detect the darkness of fogging that has occurred on the photoconductor 3020 to obtain the fogging-darkness information.

In the foregoing embodiment, the developing roller 3510 was made of metal. This, however, is not a limitation. For example, the developing roller 3510 may be non-metal.

However, in cases where the developing roller 3510 is made of metal, the image force between the toner T and the developing roller 3510 is stronger compared to when the developing roller 3510 is non-metal. Therefore, so-called selective development is likely to occur. Therefore, in cases where the developing roller 3510 is made of metal, it is likely that the Vmax will be set to a large value from the viewpoint of preventing selective development. As a result, fogging and toner scattering tend to increase. Therefore, the effect that it is possible to prevent an increase in fogging and scattering of toner T, is attained more effectively in cases where the developing roller 3510 is made of metal. The foregoing embodiment is therefore more preferable.

In the foregoing embodiment, the toner T was manufactured using a grinding method. This, however, is not a limitation. For example, the toner may be manufactured according to a polymerizing method.

However, in cases where the toner is made through the grinding method, the charge distribution of the toner becomes wider compared to when the toner is manufactured through the polymerizing method, and thus, so-called selective development is likely to occur. Therefore, in cases where the toner T is made through the grinding method, it is likely that the first voltage will be set to a large value from the viewpoint of preventing selective development. As a result, fogging and developer scattering tend to increase. Therefore, the effect that it is possible to prevent an increase in fogging and scattering of toner T, is attained more effectively in cases where the toner T is made through the grinding method. The foregoing embodiment is therefore more preferable.

FOURTH EMBODIMENT

(4) Overall Configuration of Image Forming Apparatus

Figure 48:
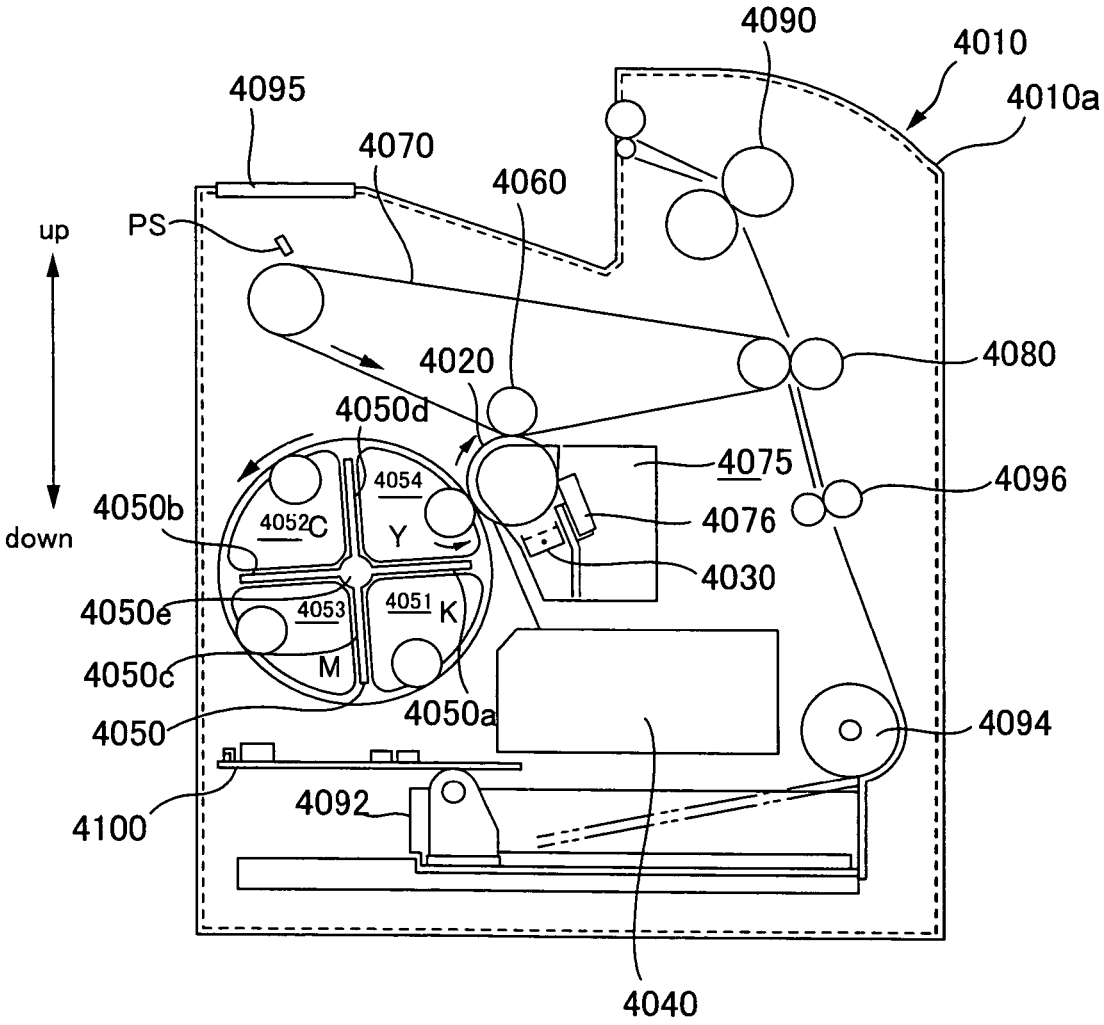
FIG. 48 is a diagram showing main structural components constructing a printer 4010.

Next, taking a laser beam printer 4010 (referred to also as "printer 4010" below) as an example of an "image forming apparatus", an overall configuration of the printer 4010 is described with reference to FIG. 48. FIG. 48 is a diagram showing main structural components constructing the printer 4010. It should be noted that in FIG. 48, the vertical direction is shown by the arrow, and, for example, a paper supply tray 4092 is arranged at a lower section of the printer 4010, and a fusing unit 4090 is arranged at an upper section of the printer 4010.

<Overall Configuration of Printer 4010>

As shown in FIG. 48, the printer 4010 according to the present embodiment includes a charging unit 4030, an exposing unit 4040, a developing-unit holding unit 4050, a first transferring unit 4060, an intermediate transferring body 4070, and a cleaning unit 4075. These units are arranged in the direction of rotation of a photoconductor 4020, which serves as an example of an "image bearing body" for bearing a latent image. The printer 4010 further includes a second transferring unit 4080, a fusing unit 4090, a displaying unit 4095 constructed of a liquid-crystal panel and serving as means for making notifications to the user etc., and a control unit 4100 for controlling these units etc. and managing the operations as a printer.

The photoconductor 4020 has a cylindrical conductive base and a photoconductive layer formed on the outer peripheral surface of the conductive base, and it is rotatable about its central axis. In the present embodiment, the photoconductor 4020 rotates clockwise, as shown by the arrow in FIG. 48.

The charging unit 4030 is a device for electrically charging the photoconductor 4020. The charge potential of the surface of the photoconductor 4020 that has been electrically charged by the charging unit 4030 is uniform. To charge the photoconductor 4020, a charge-bias generating device 4127*b* (see FIG. 54) provided in a charging unit drive control circuit applies a charge bias to the charging unit 4030. Further, the charging unit drive control circuit includes a charge-bias control circuit 4127*a* that serves to control the ON/OFF of the charge bias and to set an appropriate charge-bias value.

The exposing unit 4040 is a device for forming a latent image on the charged photoconductor 4020 by radiating a laser beam thereon. The exposing unit 4040 has, for example, a semiconductor laser, a polygon mirror, and an F-θ lens, and radiates a modulated laser beam onto the charged photoconductor 4020 according to image signals having been input from a not-shown host computer such as a personal computer or a word processor. In this way, the section of the photoconductor 4020 on to which the laser has been irradiated becomes the "image section", and the section of the photoconductor 4020 onto which the laser was not irradiated becomes the "non-image section". It should be noted that the electric potential of the image section is different from the electric potential (charge potential) of the non-image section.

The developing-unit holding unit 4050 is a device for developing the latent image formed on the photoconductor 4020 using black (K) toner contained in a black developing unit 4051, magenta (M) toner contained in a magenta developing unit 4053, cyan (C) toner contained in a cyan developing unit 4052, and yellow (Y) toner contained in a yellow developing unit 4054.

In the present embodiment, the developing-unit holding unit 4050 rotates to allow the positions of the four developing units 4051, 4052, 4053, and 4054, which serve as an example of "developing devices", to be moved. More specifically, the developing-unit holding unit 4050 holds the four developing units 4051, 4052, 4053, and 4054 respectively with four attach/detach sections 4050*a*, 4050*b*, 4050*c*, and 4050*d* which are provided in the body 4010*a* of the printer (the body of the image forming apparatus), and the four developing units 4051, 4052, 4053, and 4054 can be rotated about a rotating shaft 4050*e* while maintaining their relative positions. A different one of the developing units is made to selectively oppose the photoconductor 4020 each time the photoconductor 4020 makes one revolution, thereby successively developing the latent image formed on the photoconductor 4020 using the toner T, which is an example of a "developer", contained in each of the developing units 4051, 4052, 4053, and 4054. It should be noted that details on the developing units are described further below.

The first transferring unit 4060 is a device for transferring a toner image, which is an example of a "developer image", formed on the photoconductor 4020 onto the intermediate transferring body 4070, which is an example of a "transferring medium member". When toner images of four colors are successively transferred in a superposed manner, a full-color toner image is formed on the intermediate transferring body 4070. The intermediate transferring body 4070 is an endless belt that is driven to rotate at substantially the same circumferential speed as the photoconductor 4020.

Further, a patch sensor PS, which is an example of a "darkness detection member" for detecting the darkness of a patch image ("test pattern") formed on the intermediate transferring body 4070 for adjusting the darkness of an image to be formed on a recording medium, is arranged in the vicinity of the intermediate transferring body 4070. The patch sensor PS is a reflective optical sensor that achieves the function of detecting the darkness of the patch image. More specifically, the patch sensor PS has a light emitting section for emitting light and a light receiving section for receiving the light. The light emitted from the light emitting section toward the patch image, that is, the incident light, is reflected by the patch image. The reflected light is received by the light receiving section and is converted into an electric signal. The intensity of the electric signal is measured as the output value of the light receiving sensor corresponding to the intensity of the reflected light that has been received. Since there is a predetermined relationship between the darkness of the patch image and the intensity of the received reflected light, it is possible to detect the darkness of the patch image by measuring the intensity of the electric signal.

The second transferring unit 4080 is a device for transferring the single-color toner image, or the full-color toner image, formed on the intermediate transferring body 4070 onto a recording medium, which is an example of a "medium". It should be noted that the recording medium may be, for example, paper, film, or cloth. Further, the "transferring section" in this embodiment is the first transferring unit 4060, the intermediate transferring body 4070, and the second transferring unit 4080. The intermediate transferring body 4070 serves as a medium for when transferring, onto the recording medium, the toner image formed on the photoconductor 4020.

The fusing unit 4090 is a device for fusing the single-color toner image or the full-color toner image, which has been transferred to the recording medium, onto the recording medium such as paper to make it into a permanent image. The cleaning unit 4075 is a device that is provided between the first transferring unit 4060 and the charging unit 4030, that has a rubber cleaning blade 4076 made to abut against the surface of the photoconductor 4020, and that is for removing the toner remaining on the photoconductor 4020 by scraping it off with the cleaning blade 4076 after the toner image has been transferred onto the intermediate transferring body 4070 by the first transferring unit 4060.

Figure 54:
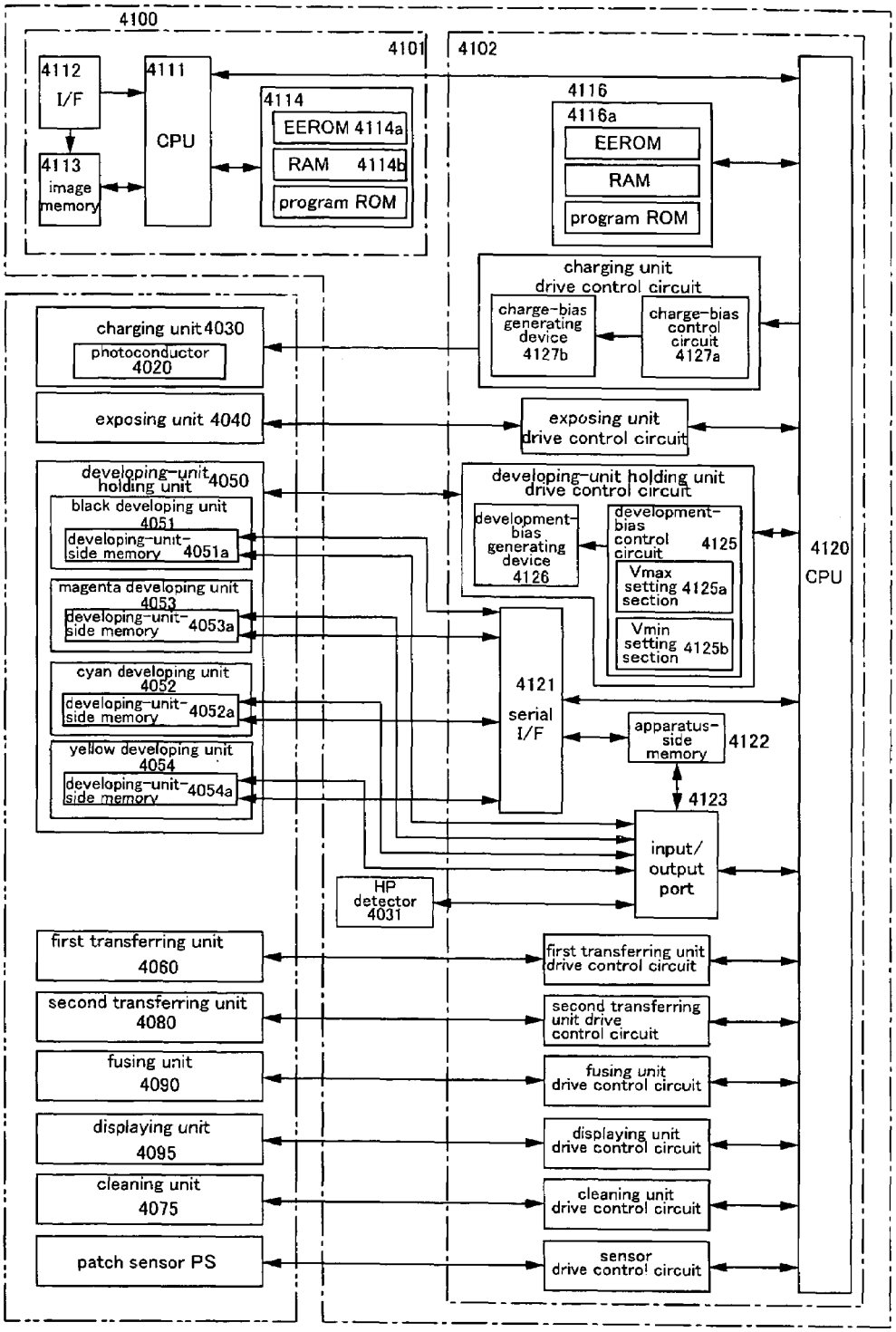
FIG. 54 is a block diagram showing a control unit 4100 of the printer 4010.

The control unit 4100 includes a controller section 4101 and a unit controller 4102 as shown in FIG. 54. Image signals are input to the controller section 4101, and according to instructions based on these image signals, the unit controller 4102 controls each of the above-mentioned units etc. to form an image.

(4) Overview of the Developing Unit

Figure 49:
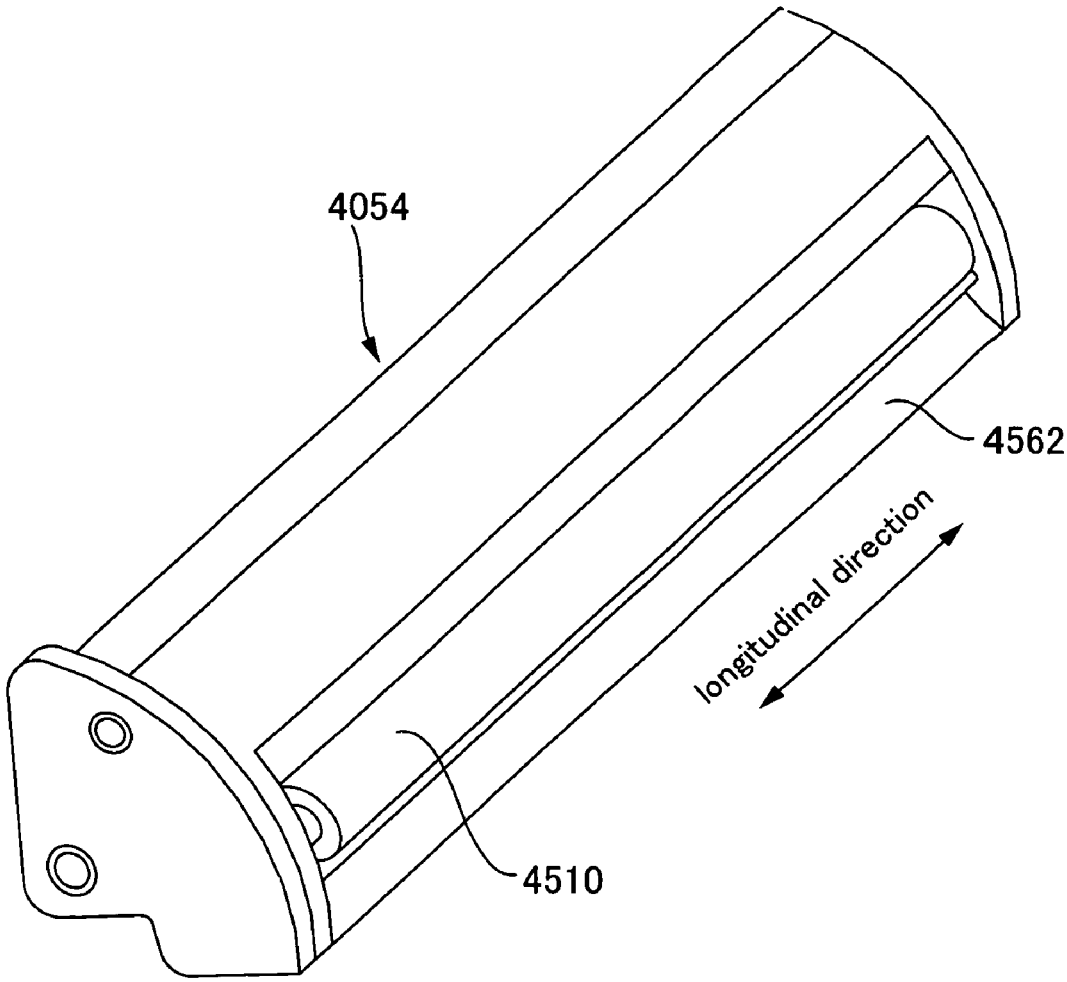
FIG. 49 is a conceptual diagram of a developing unit.
Figure 50:
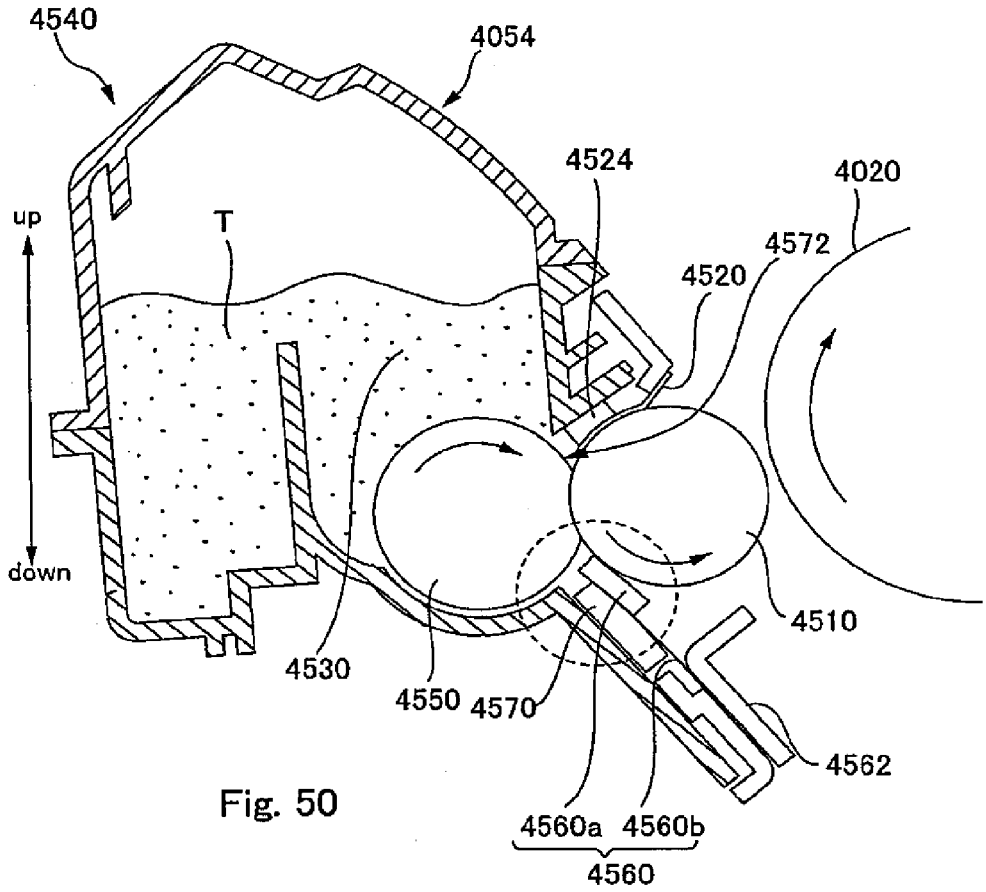
FIG. 50 is a section view showing main structural components of the developing unit.
Figure 51:
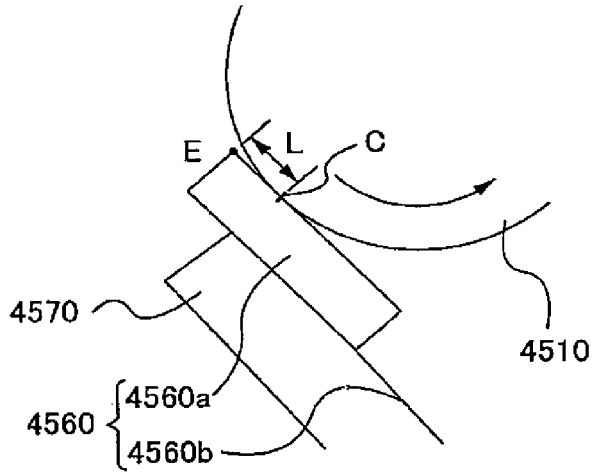
FIG. 51 is a diagram showing the structure in the periphery of a restriction blade 4560.

Next, with reference to FIG. 49 through FIG. 51, an example of a configuration of the developing units will be described. FIG. 49 is a conceptual diagram of a developing unit. FIG. 50 is a section view showing main structural components of the developing unit. FIG. 51 is a diagram showing the structure in the periphery of the restriction blade 4560. Note that the section view shown in FIG. 50 is a cross section of the developing unit taken along a plane perpendicular to the longitudinal direction shown in FIG. 49. Further, in FIG. 50, the arrow indicates the vertical direction as in FIG. 48, and, for example, the yellow developing unit 4054 is shown to be in a state in which it is positioned at the developing position opposing the photoconductor 4020.

To the developing-unit holding unit 4050, it is possible to attach the black developing unit 4051, the magenta developing unit 4053, the cyan developing unit 4052, and the yellow developing unit 4054. Since the configuration of the developing units is the same, explanation will be made below only on the yellow developing unit 4054.

The yellow developing unit 4054 has, for example, a developing roller 4510 serving as an example of a "developer bearing body", a sealing member 4520, a toner containing section 4530, a housing 4540, a toner supplying roller 4550, and a restriction blade 4560 serving as an example of a "layer-thickness restricting member".

The developing roller 4510 bears toner T, carries it to a position (developing position) opposing the photoconductor 4020, and develops the latent image borne on the photoconductor 4020 with the toner T carried to the developing position. The developing roller 4510 is made of metal and, for example, it is manufactured from aluminum, stainless steel, or iron; if necessary, the roller 4510 is plated with, for example, nickel plating or chromium plating, and the toner-bearing region is subjected to sandblasting, for example. The surface of the developing roller 4510 has a predetermined surface roughness Rz (Rz indicates a ten point average roughness), and the developing roller 4510 mainly bears and carries the toner T between the protrusions on its surface. It should be noted that if the surface roughness Rz is large, the amount of toner T carried by the developing roller 4510 (i.e., the carry amount) becomes large.

Further, as shown in FIG. 49, the developing roller 4510 is supported at both ends in its longitudinal direction and is rotatable about its central axis. As shown in FIG. 50, the developing roller 4510 rotates in the opposite direction (counterclockwise in FIG. 50) to the rotating direction of the photoconductor 4020 (clockwise in FIG. 50). Further, as shown in FIG. 50, the developing roller 4510 of the yellow developing unit 4054 and the photoconductor 4020 oppose against each other with a spacing (gap) therebetween. That is, the yellow developing unit 4054 develops the latent image formed on the photoconductor 4020 in a non-contacting state.

Upon development of the latent image formed on the photoconductor 4020, a development-bias generating device 4126 (see FIG. 54), which is an example of a "voltage applying section" provided in a developing-unit holding unit drive control circuit, applies, to the developing roller 4510, a development bias obtained by superposing a DC voltage and an AC voltage, and thus an alternating field is generated between the developing roller 4510 and the photoconductor 4020. The developing-unit holding unit drive control circuit includes a development-bias control circuit 4125 that serves to control the ON/OFF of the development bias and to set an appropriate development-bias value. The development-bias control circuit 4125 has a Vmax setting section 4125*a*, which is an example of a "first voltage setting section" for setting a first voltage (Vmax), and a Vmin setting section 4125*b*, which is an example of an "image darkness adjusting section" for setting a second voltage (Vmin) in order to adjust the darkness of an image. It should be noted that details on the development bias etc. are described further below.

The sealing member 4520 prevents the toner T in the yellow developing unit 4054 from spilling out therefrom, and also collects the toner T, which is on the developing roller 4510 that has passed the developing position, into the developing unit without scraping it off. The sealing member 4520 is a seal made of, for example, polyethylene film. The sealing member 4520 is pressed against the developing roller 4510 by the elastic force of a seal-urging member 4524 that is made of, for example, Moltoprene and that is provided on the side opposite from the side of the developing roller 4510.

The housing 4540 is formed by welding together a plurality of integrally-molded housing sections. As shown in FIG. 50, the housing 4540 has an opening 4572 that opens toward the outside of the housing 4540. The above-mentioned developing roller 4510 is arranged from the outside of the housing 4540 with its peripheral surface facing the opening 4572 in such a state that a part of the roller 4510 is exposed to the outside. The restriction blade 4560, which is described in detail below, is also arranged from the outside of the housing 4540 facing the opening 4572.

Further, the housing 4540 forms a toner containing section 4530 that is capable of containing toner T. The toner T contained in the toner containing section 4530 is manufactured according to a grinding method. The toner T includes a core particle and external additives that are applied on the core particle. The core particle includes materials such as coloring agents, charge control agents, release agents (WAX), and resin. The core particle is manufactured by: uniformly mixing the above-mentioned materials using a Henschel mixer, for example; melting and kneading the mixture using a twin screw extruder; cooling the batch; subjecting the batch to rough grinding and fine grinding; and classifying the particles.

The toner supplying roller 4550 is provided in the toner containing section 4530 described above and supplies the toner T contained in the toner containing section 4530 to the developing roller 4510. The toner supplying roller 4550 is made of, for example, polyurethane foam, and is made to abut against the developing roller 4510 in an elastically deformed state. The toner supplying roller 4550 is arranged at a lower section of the toner containing section 4530. The toner T contained in the toner containing section 4530 is supplied to the developing roller 4510 by the toner supplying roller 4550 at the lower section of the toner containing section 4530. The toner supplying roller 4550 rotates about its central axis in the opposite direction (clockwise in FIG. 50) to the rotating direction of the developing roller 4510 (counterclockwise in FIG. 50).

It should be noted that the toner supplying roller 4550 has the function of supplying the toner T contained in the toner containing section 4530 to the developing roller 4510 as well as the function of stripping off, from the developing roller 4510, the toner T remaining on the developing roller 4510 after development.

The restriction blade 4560 gives an electric charge to the toner T borne by the developing roller 4510 to negatively charge the toner T. The restriction blade 4560 also restricts the thickness of the layer of the toner T borne by the developing roller 4510. This restriction blade 4560 has a rubber section 4560*a* and a rubber-supporting section 4560*b*. The rubber section 4560*a* is made of, for example, silicone rubber or urethane rubber. The rubber-supporting section 4560*b* is a thin plate that is made of, for example, phosphor bronze or stainless steel, and that has a spring-like characteristic. The rubber section 4560*a* is supported by the rubber-supporting section 4560*b*. The rubber-supporting section 4560*b* is attached to the housing 4540 via a pair of blade-supporting metal plates 4562 in a state that one end of the rubber-supporting section 4560*b* is pinched between and supported by the blade-supporting metal plates 4562. Further, a blade-backing member 4570 made of, for example, Moltoprene is provided on one side of the restriction blade 4560 opposite from the side of the developing roller 4510.

Further, as shown in FIG. 51, the end of the restricting blade 4560 opposite from the end that is being supported by the blade-supporting metal plates 4562, i.e., the tip end E of the restriction blade 4560, is not placed in contact with the developing roller 4510; rather, a section (abutting position C) at a predetermined distance L away from the tip end E contacts the developing roller 4510. That is, the restriction blade 4560 does not abut against the developing roller 4510 at its edge, but abuts against the roller 4510 near its central portion. Further, the restriction blade 4560 is arranged so that its tip end E faces toward the upstream side in the rotating direction of the developing roller 4510 with respect to the abutting position C, and thus, makes a so-called counter-abutment with respect to the roller 4510. It should be noted that, the larger the distance L (also referred to as "protruding amount L" below) from the tip end E to the abutting position C is, the easier it becomes for the developing roller 4510 to bear the toner T; thus, the amount of toner T carried by the developing roller 4510 becomes large.

In the yellow developing unit 4054 structured as above, the toner supplying roller 4550 supplies the toner T contained in the toner containing section 4530 to the developing roller 4510. With the rotation of the developing roller 4510, the toner T, which has been supplied to the developing roller 4510, reaches the abutting position of the restriction blade 4560; then, as the toner T passes the abutting position, the toner is electrically charged and its layer thickness is restricted. With further rotation of the developing roller 4510, the toner T on the developing roller 4510, whose layer thickness has been restricted, reaches the developing position opposing the photoconductor 4020; then, under the alternating field, the toner T is used at the developing position for developing the latent image formed on the photoconductor 4020. With further rotation of the developing roller 4510, the toner T on the developing roller 4510, which has passed the developing position, passes the sealing member 4520 and is collected into the developing unit by the sealing member 4520 without being scraped off.

Further, each developing unit 4051, 4052, 4053, and 4054 is also provided with a storage element, for example, a non-volatile storage memory such as a serial EEPROM (which is also referred to below as a "developing-unit-side memory") 4051*a*, 4052*a*, 4053*a*, and 4054*a* that is an example of a "developing-device storage section" and that is for storing various kinds of information about the developing unit, such as color information about the color of the toner T contained in each developing unit, information about the protruding amount L, and information about the surface roughness Rz.

Developing-unit-side connectors 4051*b*, 4052*b*, 4053*b*, and 4054*b*, which are provided on one end surface of the respective developing units, come into connection, as necessary, with an apparatus-side connector 4034, which is provided on the apparatus side (i.e., the printer side), and in this way, the developing-unit-side memories 4051*a*, 4052*a*, 4053*a*, and 4054*a* are electrically connected to the unit controller 4102 of the control unit 4100 of the apparatus.

(4) Overview of the Developing-unit Holding Unit

Next, an overview of the developing-unit holding unit 4050 will be described with reference to FIG. 52A through FIG. 52C.

The developing-unit holding unit 4050 has a rotating shaft 4050*e* positioned at the center. A support frame 4055 for holding the developing units is fixed to the rotating shaft 4050*e*. The rotating shaft 4050*e* is provided extending between two frame side plates (not shown) which form a casing of the printer 4010, and both ends of the shaft 4050*e* are supported thereby. It should be noted that the axial direction of the rotating shaft 4050*e* intersects with the vertical direction.

The support frame 4055 is provided with the four attach/detach sections 4050*a*, 4050*b*, 4050*c*, and 4050*d*, to which the above-described developing units 4051, 4052, 4053, and 4054 of the four colors are attached in an attachable/detachable manner about the rotating shaft 4050*e*, and they are arranged in the circumferential direction at an interval of 90°.

A pulse motor, which is not shown, is connected to the rotating shaft 4050*e*. By driving the pulse motor, it is possible to rotate the support frame 4055 and position the four developing units 4051, 4052, 4053, and 4054 mentioned above at predetermined positions.

Figure 52A:
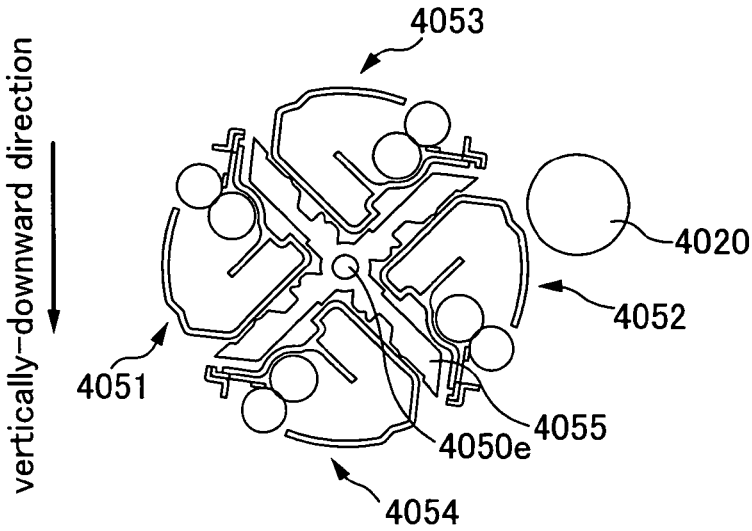
FIG. 52A shows the HP position.
Figure 52B:
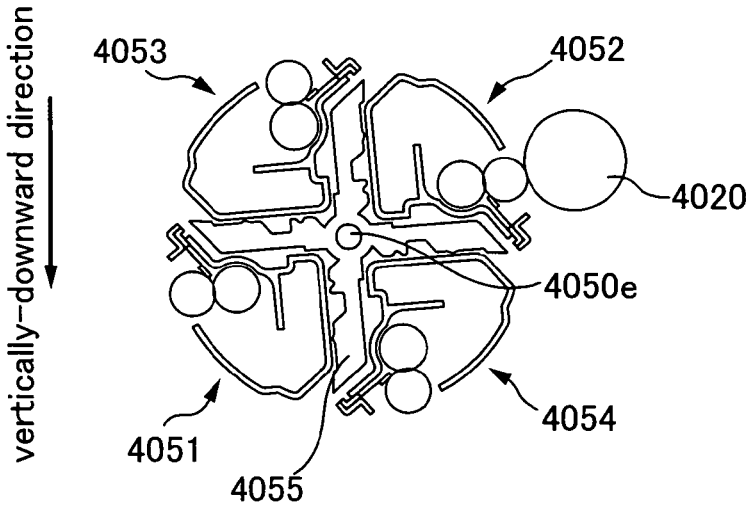
FIG. 52B shows the connector attach/detach position.
Figure 52C:
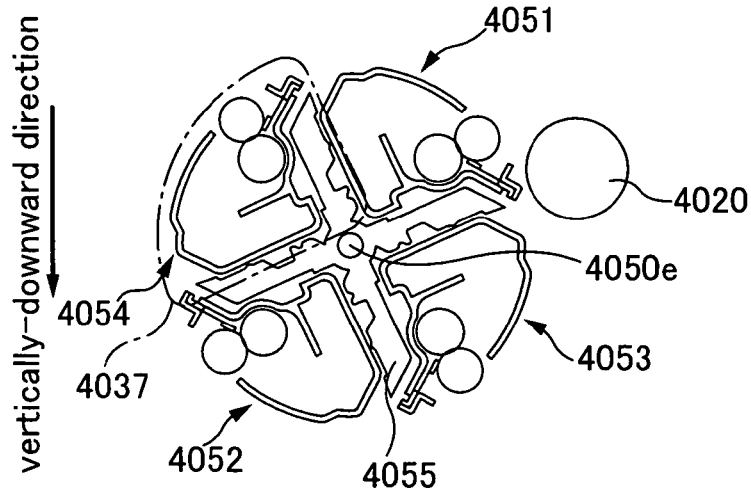
FIG. 52C shows the attach/detach position of a yellow developing unit 4054.

FIG. 52A through FIG. 52C are diagrams showing three stop positions of the rotating developing-unit holding unit 4050. FIG. 52A shows the home position (referred to as "HP position" below) which is the standby position for when the printer is on standby for image formation to be carried out, and which is also the halt position serving as the reference position in the rotating direction of the developing-unit holding unit 4050. FIG. 52B shows the connector attach/detach position where the developing-unit-side connector 4054*b* of the yellow developing unit 4054, which is attached to the developing-unit holding unit 4050, and the apparatus-side connector 4034, which is provided on the apparatus side, come into opposition. FIG. 52C shows the attach/detach position where the yellow developing unit 4054 is attached and detached.

In FIG. 52B and FIG. 52C, the connector attach/detach position and the developing unit attach/detach position are explained with regard to the yellow developing unit 4054, but these positions become the connector attach/detach position and the developing unit attach/detach position for each of the other developing units when the developing-unit holding unit 4050 is rotated at 90° intervals.

First, the HP position shown in FIG. 52A will be described. An HP detector 4031 (FIG. 54) for detecting the HP position is provided on the side of one end of the rotating shaft 4050*e* of the developing-unit holding unit 4050. The HP detector 4031 is structured of a disk that is for generating signals and that is fixed to one end of the rotating shaft 4050*e*, and an HP sensor that is made up of, for example, a photointerrupter having a light emitting section and a light receiving section. The peripheral section of the disk is arranged such that it is located between the light emitting section and the light receiving section of the HP sensor. When a slit formed in the disk moves up to a detecting position of the HP sensor, the signal that is output from the HP sensor changes from "L" to "H". The device is constructed such that the HP position of the developing-unit holding unit 4050 is detected based on this change in signal level and the number of pulses of the pulse motor, and by taking this HP position as a reference, each of the developing units can be positioned at the developing position etc.

FIG. 52B shows the connector attach/detach position of the yellow developing unit 4054 which is achieved by rotating the pulse motor for a predetermined number of pulses from the above-mentioned HP position. At this connector attach/detach position, the developing-unit-side connector 4054*b* of the yellow developing unit 4054, which is attached to the developing-unit holding unit 4050, and the apparatus-side connector 4034, which is provided on the apparatus side, come into opposition, and it becomes possible to connect or separate these connecters.

Figure 53A:
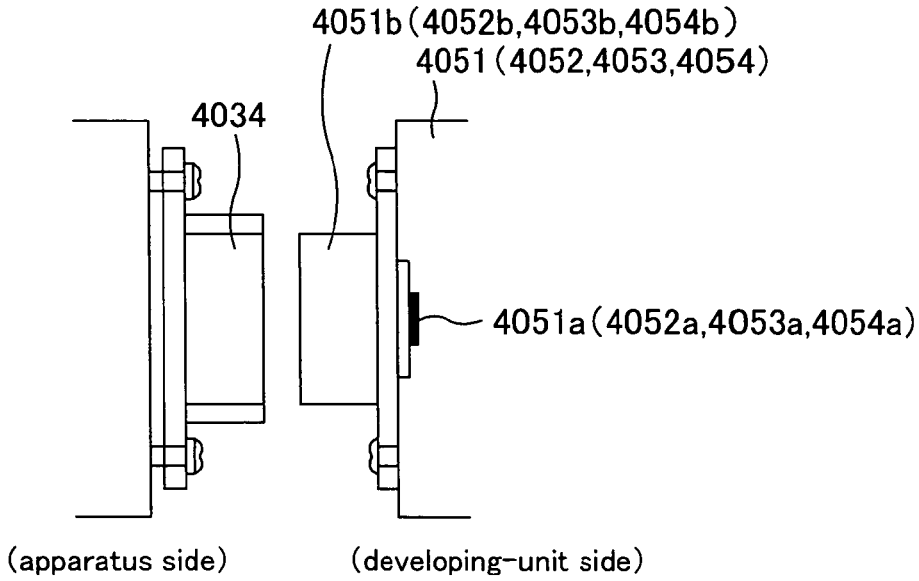
FIG. 53A is a diagram showing a separated position.
Figure 53B:
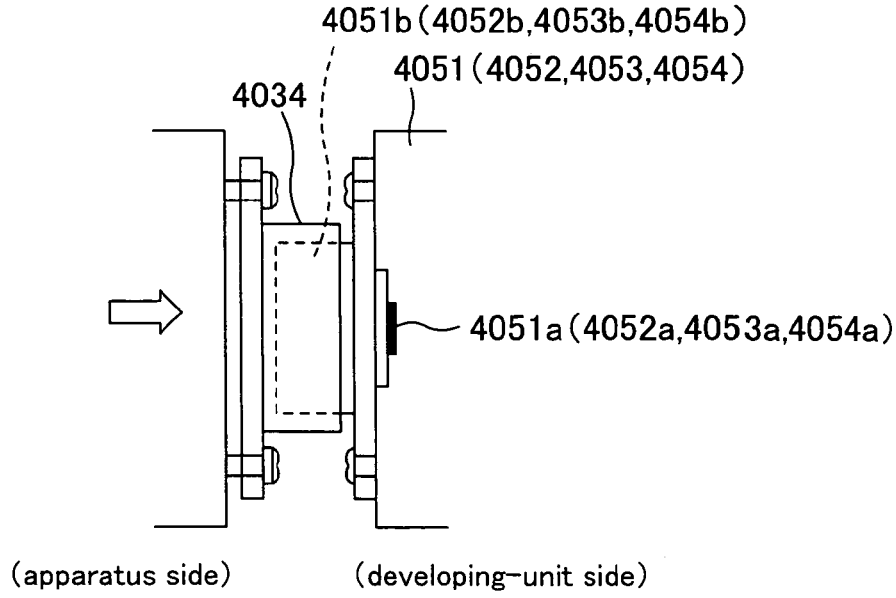
FIG. 53B is a diagram showing an abutting position.

Further explanation is given using FIG. 53A and FIG. 53B. FIG. 53A is a diagram showing a separated position. FIG. 53B is a diagram showing an abutting position.

FIG. 53A shows a state in which the apparatus-side connector 4034 and the developing-unit-side connector 4054*b* of the yellow developing unit 4054 are separated from each other. The apparatus-side connector 4034 is structured such that it can move toward, and move away from, the yellow developing unit 4054. When necessary, the apparatus-side connector 4034 moves in the direction towards the yellow developing unit 4054 (the direction of the arrow shown in FIG. 53B). In this way, the apparatus-side connector 4034 abuts against the developing-unit-side connector 4054*b* of the yellow developing unit 4054 as shown in FIG. 53B. Thus, the developing-unit-side memory 4054*a* attached to the yellow developing unit 4054 is electrically connected to the unit controller 4102 of the control unit 4100, and communication between the developing-unit-side memory 4054*a* and the apparatus is established.

Conversely, the apparatus-side connector 4034 moves, from the state shown in FIG. 53B in which the apparatus-side connector 4034 and the developing-unit-side connector 4054*b* of the yellow developing unit 4054 abut against each other, in the direction away from the yellow developing unit 4054 (the direction opposite to the direction of the arrow shown in FIG. 53B). In this way, the apparatus-side connector 4034 is separated from the developing-unit-side connector 4054*b* of the yellow developing unit 4054, as shown in FIG. 53A.

It should be noted that the movement of the apparatus-side connector 4034 is achieved by, for example, a not-shown mechanism structured of a pulse motor, a plurality of gears connected to the pulse motor, and an eccentric cam connected to the gears. More specifically, by rotating the pulse motor for a predetermined number of pulses, the above-mentioned mechanism moves the apparatus-side connector 4034 from the predetermined separated position for a distance that corresponds to the above-mentioned number of pulses to position the apparatus-side connector 4034 at the predetermined abutting position. On the contrary, by rotating the pulse motor in reverse for a predetermined number of pulses, the above-mentioned mechanism moves the apparatus-side connector 4034 from the predetermined abutting position for a distance that corresponds to the above-mentioned number of pulses to position the apparatus-side connector 4034 at the predetermined separated position.

Further, the connector attach/detach position for the yellow developing unit 4054 is the developing position for the cyan developing unit 4052 where the developing roller 4510 of the cyan developing unit 4052 and the photoconductor 4020 oppose each other. That is, the connector attach/detach position of the developing-unit holding unit 4050 for the yellow developing unit 4054 is the developing position of the developing-unit holding unit 4050 for the cyan developing unit 4052. Further, the position achieved when the pulse motor rotates the developing-unit holding unit 4050 counterclockwise by 90° is the connector attach/detach position for the black developing unit 4051 and the developing position for the yellow developing unit 4054; every time the developing-unit holding unit 4050 is rotated by 90°, the connector attach/detach position and the developing position for each of the developing units are successively achieved.

One of the two frame side plates that support the developing-unit holding unit 4050 and that form the casing of the printer 4010 is provided with an attach/detach dedicated opening 4037 through which one developing unit can pass and an inner cover (not shown) that openably/closably covers the attach/detach dedicated opening 4037. The attach/detach dedicated opening 4037 is formed in a position where only a relevant developing unit (here, the yellow developing unit 4054) can be pulled out and detached in the direction of the rotating shaft 4050*e*, as shown in FIG. 52C, when the developing-unit holding unit 4050 is rotated and each developing unit is halted at the developing unit attach/detach position which is set for each developing unit. Further, the attach/detach dedicated opening 4037 is formed slightly larger than the outer shape of a developing unit. At the developing unit attach/detach position, not only is it possible to detach the developing unit, but it is also possible to insert a new developing unit through this attach/detach dedicated opening 4037 in the direction of the rotating shaft 4050*e* and attach the developing unit to the support frame 4055. While the developing-unit holding unit 4050 is positioned at positions other than the developing unit attach/detach position, the attachment/detachment of that developing unit is restricted by the frame side plates.

It should be noted that a lock mechanism, which is not shown, is provided for certainly positioning and fixing the developing-unit holding unit 4050 at the positions described above.

(4) Overview of Control Unit

Next, with reference to FIG. 54, the configuration of the control unit 4100 will be described. FIG. 54 is a block diagram showing the control unit 4100 of the printer 4010.

The controller section 4101 includes a CPU 4111, an interface 4112 for establishing connection with a not-shown computer, an image memory 4113 for storing image signals etc. that have been input from the computer, and a controller-section-side memory 4114 that is made up of, for example, an electrically rewritable EEPROM 4114*a*, a RAM 4114*b*, and a programmable ROM in which various programs for control are written. The controller section 4101 receives various information such as image signals etc. from the computer connected to the printer 4010.

The controller section 4101 has a function of converting the RGB data of red, green, and blue, which is the image signal sent from the computer etc., into YMCK image data of yellow, magenta, cyan, and black, and storing the converted YMCK image data in the image memory 4113. The controller section 4101 also has a function of sending various information to the connected computer.

The unit controller 4102 includes, for example, a CPU 4120, a unit-controller-side memory 4116 that is made up of, for example, an electrically rewritable EEPROM 4116*a*, a RAM, and a programmable ROM in which various programs for control are written, and various drive control circuits for driving and controlling the units in the apparatus body (i.e., the charging unit 4030, the exposing unit 4040, the first transferring unit 4060, the cleaning unit 4075, the second transferring unit 4080, the fusing unit 4090, and the displaying unit 4095) and the developing-unit holding unit 4050.

The CPU 4120 is electrically connected to each of the drive control circuits and controls the drive control circuits according to control signals from the CPU 4111 of the controller section 4101. More specifically, the unit controller 4102 controls each of the units and the developing-unit holding unit 4050 according to signals received from the controller section 4101 while detecting the state of each of the units and the developing-unit holding unit 4050 by receiving signals from sensors provided in each unit.

Further, the CPU 4120 is connected, via a serial interface (indicated herein as "I/F") 4121, to a non-volatile storage element 4122 (which is referred to below as "apparatus-side memory") which is, for example, a serial EEPROM. Data necessary for controlling the apparatus are stored in the apparatus-side memory 4122. The CPU 4120 is not only connected to the apparatus-side memory 4122, but is also connected to developing-unit-side memories 4051*a*, 4052*a*, 4053*a*, and 4054*a*, which are provided on the respective developing units 4051, 4052, 4053, and 4054, via the serial interface 4121. Then, data can be exchanged between the apparatus-side memory 4122 and the developing-unit-side memories 4051*a*, 4052*a*, 4053*a*, and 4054*a*, and also, it is possible to input chip-select signals CS to the developing-unit-side memories 4051*a*, 4052*a*, 4053*a*, and 4054*a* via the input/output port 4123. The CPU 4120 is also connected to the HP detector 4031 via the input/output port 4123.

Further, the CPU 4120 becomes communicable with the developing-unit-side memories 4051*a*, 4052*a*, 4053*a*, and 4054*a* when the apparatus-side connector 4034 and the connecter of one of the developing units positioned at the connector attach/detach position are connected. Then, various information about the developing unit is obtained from the developing-unit-side memory 4051*a*, 4052*a*, 4053*a*, or 4054*a* of the developing unit connected to the apparatus-side connector 4034. Information about the developing unit includes, for example, color information about the color of toner contained in the attached developing unit, information about the protruding amount L, and information about the surface roughness Rz. The various kinds of information that have been obtained are stored, corresponding to each developing unit, in a predetermined region of the apparatus-side memory 4122 of the unit controller 4102.

Furthermore, when a developing unit is to be detached from the attach/detach section, the CPU 4120 stores, in the developing-unit-side memory 4051*a*, 4052*a*, 4053*a*, or 4054*a* of that developing unit, information such as the information about the protruding amount L and the surface roughness Rz which are stored in the apparatus-side memory 4122.

(4) Development Bias

Figure 55:
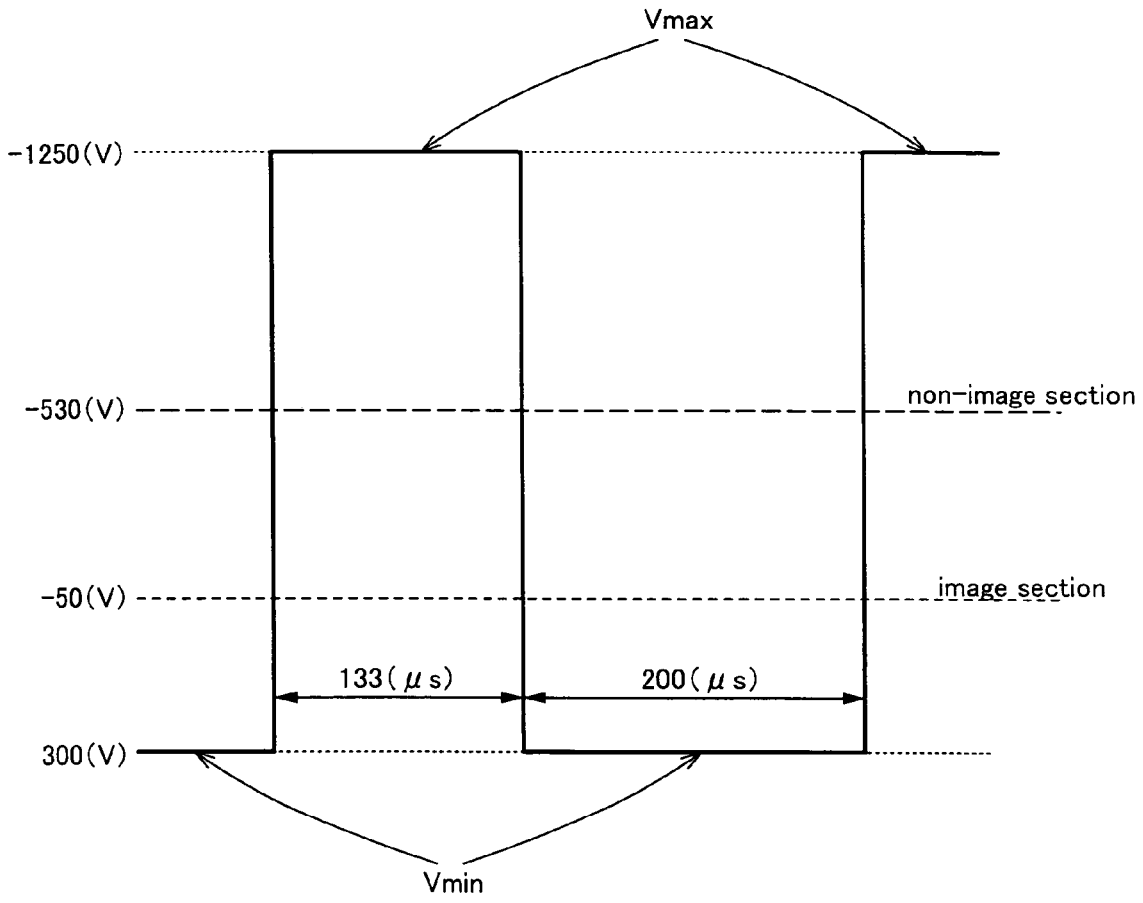
FIG. 55 shows a waveform of the development bias.

The development bias that is applied from the development-bias generating device 4126 to the developing roller 4510 is described with reference to FIG. 55. FIG. 55 shows a waveform of the development bias.

The development-bias generating device 4126 applies, to the developing roller 4510, a development bias of a rectangular waveform as shown in FIG. 55 for developing a latent image. More specifically, the development-bias generating device 4126 alternately applies, to the developing roller 4510, a first voltage (Vmax) for making the toner T move from the developing roller 4510 toward the photoconductor 4020 for developing a latent image, and a second voltage (Vmin) for making the toner T move from the photoconductor 4020 toward the developing roller 4510.

When the development-bias generating device 4126 applies a Vmax to the developing roller 4510, the toner T borne on the developing roller 4510 flies toward the photoconductor 4020 and adheres thereto. When the Vmax is applied to the developing roller 4510, an electric field is generated due to the difference between the electric potential of the developing roller 4510 (for example, −1250 V) caused by the Vmax, and the electric potential of the photoconductor 4020 on which the latent image is formed (for example, electric potential of the image section: −50 V; electric potential of the non-image section: −530 V). The negatively-charged toner T borne on the developing roller 4510 flies toward the photoconductor 4020 due to the force caused by the electric field and adheres to the photoconductor 4020. It should be noted that, the larger the absolute value of the Vmax is, the larger the force of the electric field becomes, and so the amount of toner T that adheres to the photoconductor 4020 increases.

When the development-bias generating device 4126 applies a Vmin to the developing roller 4510, the toner T adhering to the photoconductor 4020 flies toward the developing roller 4510 and returns thereto. When the Vmin is applied to the developing roller 4510, an electric field is generated due to the difference between the electric potential of the developing roller 4510 (for example, 300 V) caused by the Vmin, and the electric potential of the photoconductor 4020 on which the latent image is formed (for example, electric potential of the image section: −50 V; electric potential of the non-image section: −530 V). The negatively-charged toner T adhering to the photoconductor 4020 flies toward the developing roller 4510 due to the force caused by the electric field and returns to the developing roller 4510. It should be noted that the toner T that returns to the developing roller 4510 is a portion of the toner T that adhered to the photoconductor 4020, and the toner T that remains on the photoconductor 4020 without returning to the developing roller 4510 is used for developing the latent image. It should be noted that, the larger the absolute value of the Vmin is, the larger the force of the electric field becomes, and so the amount of toner T that returns to the developing roller 4510 increases.

Before the development-bias generating device 4126 applies the Vmax and the Vmin to the developing roller 4510, the toner T borne on the developing roller 4510 is not in contact with the photoconductor 4020. Therefore, development of a latent image will not be carried out if neither the Vmax nor Vmin is applied to the developing roller 4510.

Further, as shown in FIG. 55, the time for which the development-bias generating device 4126 applies the Vmax to the developing roller 4510 is 133 μs, and the time for which it applies the Vmin to the developing roller 4510 is 200 μm.

(4) Operation of the Printer 4010

Figure 56:
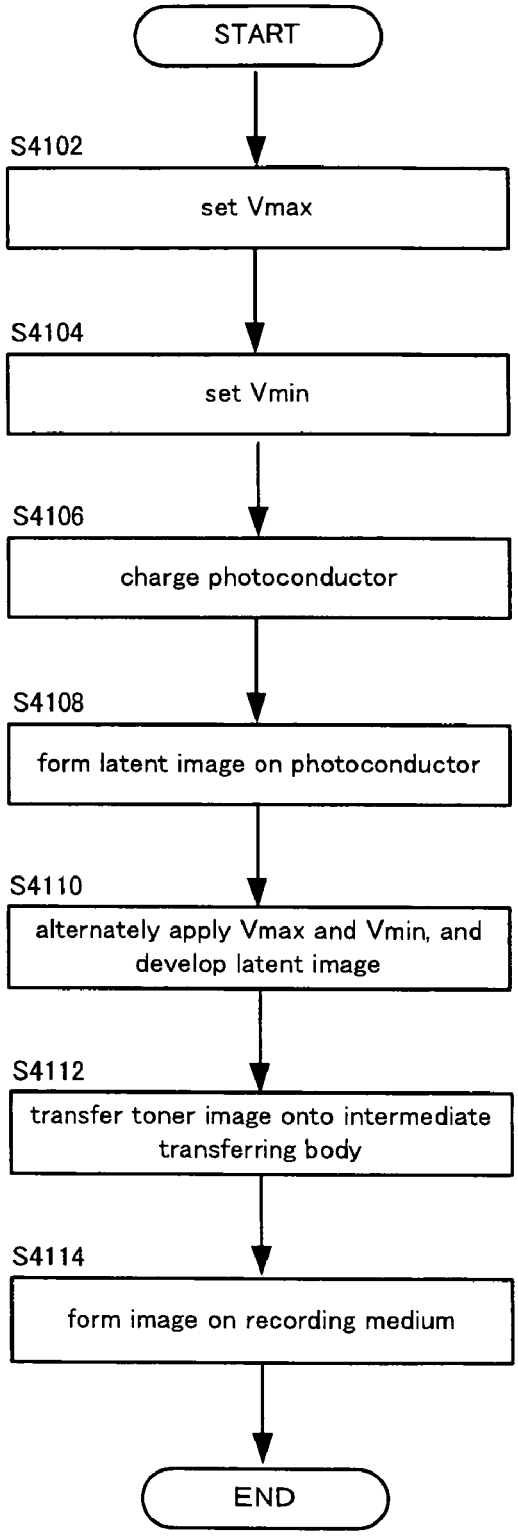
FIG. 56 is a flowchart for describing the operation of the printer 4010.

The operation of the printer 4010 in which it adjusts the darkness of an image and forms the image on a recording medium will be described with reference to FIG. 56. FIG. 56 is a flowchart for describing the operation of the printer 4010.

The various operations of the printer 4010 described below are mainly achieved by the controller section 4101 or the unit controller 4102 in the printer 4010. Particularly, in the present embodiment, they are achieved by the CPU processing a program stored in a program ROM. The program is made of codes for achieving the various operations described below.

First, when a developing unit is attached to the body 4010*a* of the printer and the power of the printer 4010 is turned ON, the Vmax setting section 4125*a* provided in the unit controller 4102 sets, for each developing unit, a Vmax in accordance with the carry-amount information about the amount of toner T carried by the developing roller 4510 (S4102). The Vmax setting section 4125*a* sets the absolute value of the Vmax to a small value if the carry amount by the developing roller 4510 is large, and sets the absolute value of the Vmax to a large value if the carry amount by the developing roller 4510 is small. Setting of the Vmax is carried out when a new developing unit is attached to the body 4010*a* of the printer. Once the Vmax is set for that developing unit, the setting operation for the Vmax is not performed until another developing unit is attached. It should be noted that the method of setting the Vmax in accordance with the carry-amount information will be described further below.

Next, in order to adjust the darkness of an image to be formed on a recording medium, the Vmin setting section 4125*b* provided in the unit controller 4102 sets a Vmin based on a result of detecting the darkness of a patch image using the patch sensor PS (S4104). Here, of the Vmax and the Vmin, the Vmin setting section 4125*b* changes only the Vmin; that is, it maintains the Vmax set by the Vmax setting section 4125*a* at S4102, but changes the Vmin to adjust the darkness of an image to be formed on a recording medium.

Figure 57:
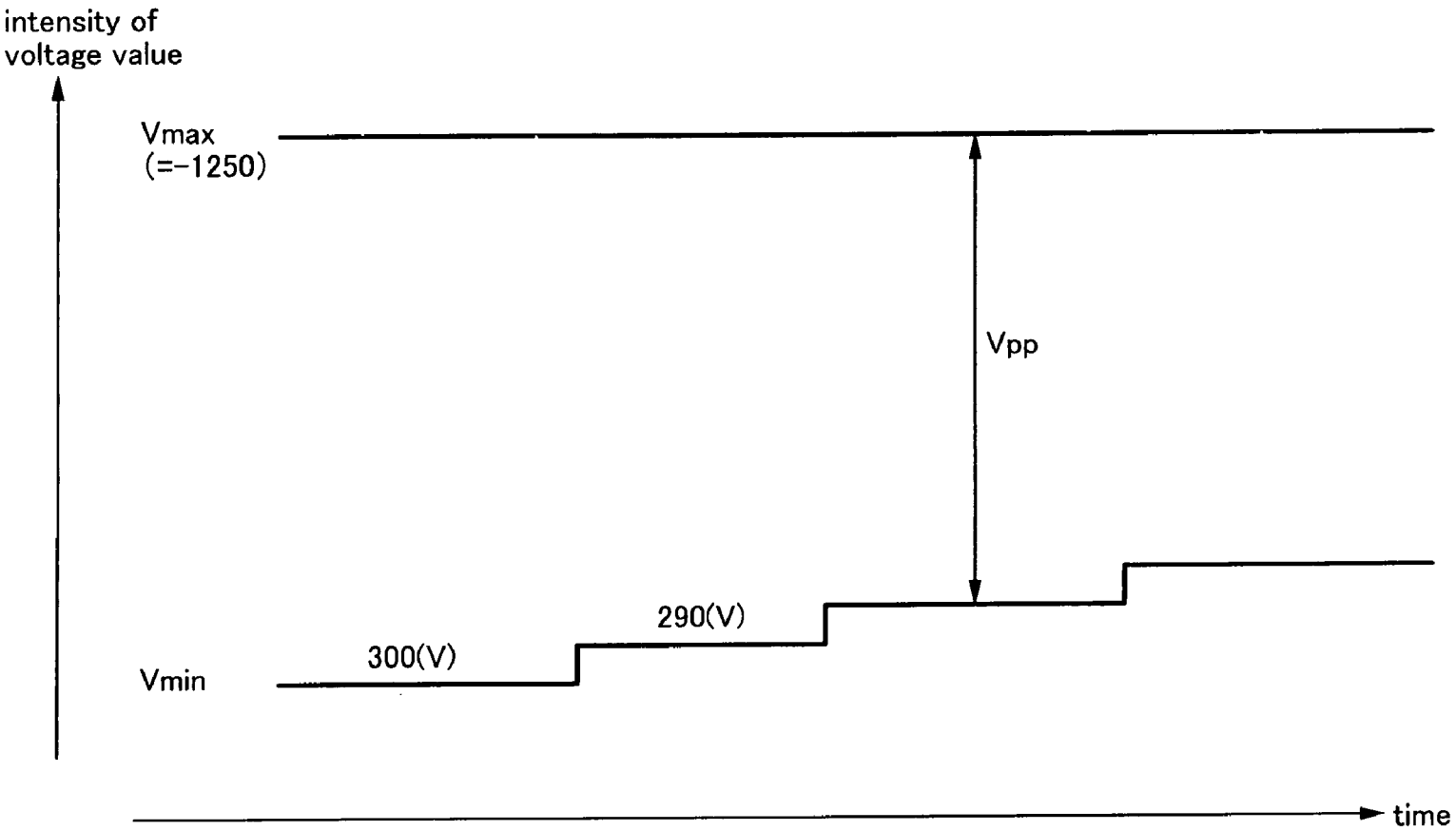
FIG. 57 is a schematic diagram showing the change in Vmax and Vmin.

This is explained in more detail. As shown in FIG. 57, the Vmin setting section 4125*b* maintains the Vmax at −1250 V, but changes the Vmin (for example, changes it from 300 V to 290 V) to adjust the image darkness. It should be noted that since only the Vmin is changed, the difference between the Vmax and the Vmin ("Vpp" in FIG. 57) is not constant. Note that FIG. 57 is a schematic diagram showing the change in Vmax and Vmin.

It should be noted that the method of setting the Vmin in accordance with the result of detecting the darkness of a patch image using the patch sensor PS will be described further below.

Next, when an image signal is input from a not-shown host computer to the controller section 4101 of the printer 4010 through the interface (I/F) 4112, the photoconductor 4020, the developing roller which is provided in each developing unit 4051, 4052, 4053, and 4054, and the intermediate transferring body 4070 rotate under the control of the unit controller 4102 based on the instructions from the controller section 4101. The unit controller 4102 controls the charging unit 4030 so as to charge the photoconductor 4020 (S4106). The charging unit 4030 successively charges the rotating photoconductor 4020 at a charging position.

Next, the unit controller 4102 controls the exposing unit 4040 so as to form a latent image on the charged photoconductor 4020 (S4108). With the rotation of the photoconductor 4020, the charged area of the photoconductor 4020 reaches an exposing position, and a latent image that corresponds to the image information about the first color, for example, yellow Y, is formed in that area by the exposing unit 4040. Further, the developing-unit holding unit 4050 positions the yellow developing unit 4054, which contains yellow (Y) toner, at the developing position opposing the photoconductor 4020.

Next, the development-bias generating device 4126 provided in the unit controller 4102 alternately applies, to the developing roller 4510, the Vmax set by the Vmax setting section 4125*a* at S4102 and the Vmin set by the Vmin setting section 4125*b* at S4104 (S4110). Here, the development-bias generating device 4126 alternately applies, to the developing roller 4510, a Vmax whose value is −1250 V and a Vmin whose value is 290 V. In this way, the latent image formed on the photoconductor 4020 reaches the developing position along with the rotation of the photoconductor 4020, and is developed with toner by the developing roller 4510. Thus, a toner image is formed on the photoconductor 4020.

Next, the unit controller 4102 controls the first transferring unit so as to transfer, onto the intermediate transferring body 4070, the toner image that has been formed on the photoconductor 4020 (S4112). With the rotation of the photoconductor 4020, the toner image formed on the photoconductor 4020 reaches a first transferring position, and is transferred onto the intermediate transferring body 4070 by the first transferring unit 4060. At this time, a first transferring voltage, which is in an opposite polarity from the polarity to which the toner is charged, is applied to the first transferring unit 4060. It should be noted that, during this process, the second transferring unit 4080 is kept separated from the intermediate transferring body 4070.

By successively performing the above-mentioned processes (S4102 to S4112) for the second, the third, and the fourth colors, toner images in four colors corresponding to the respective image signals are transferred onto the intermediate transferring body 4070 in a superimposed manner. As a result, a full-color toner image is formed on the intermediate transferring body 4070. Then, with the rotation of the intermediate transferring body 4070, the full-color toner image formed on the intermediate transferring body 4070 reaches a second transferring position, where it is transferred onto a recording medium by the second transferring unit 4080. In this way, an image is formed on a recording medium (S4114). It should be noted that the recording medium is carried from the paper supply tray 4092 to the second transferring unit 4080 via the paper-feed roller 4094 and resisting rollers 4096. During transferring operations, a second transferring voltage is applied to the second transferring unit 4080 and also the unit 4080 is pressed against the intermediate transferring body 4070.

The full-color toner image transferred onto the recording medium is heated and pressurized by the fusing unit 4090 and fused to the recording medium. On the other hand, after the photoconductor 4020 has passed the first transferring position, the toner adhering to the surface of the photoconductor 4020 is scraped off by the cleaning blade 4076 that is supported on the cleaning unit 4075, and the photoconductor 4020 is prepared for charging for formation of the next latent image. The scraped-off toner is collected into a remaining-toner collector of the cleaning unit 4075.

(4) Method of Setting Vmax in Accordance with Carry-amount Information

Figure 58:
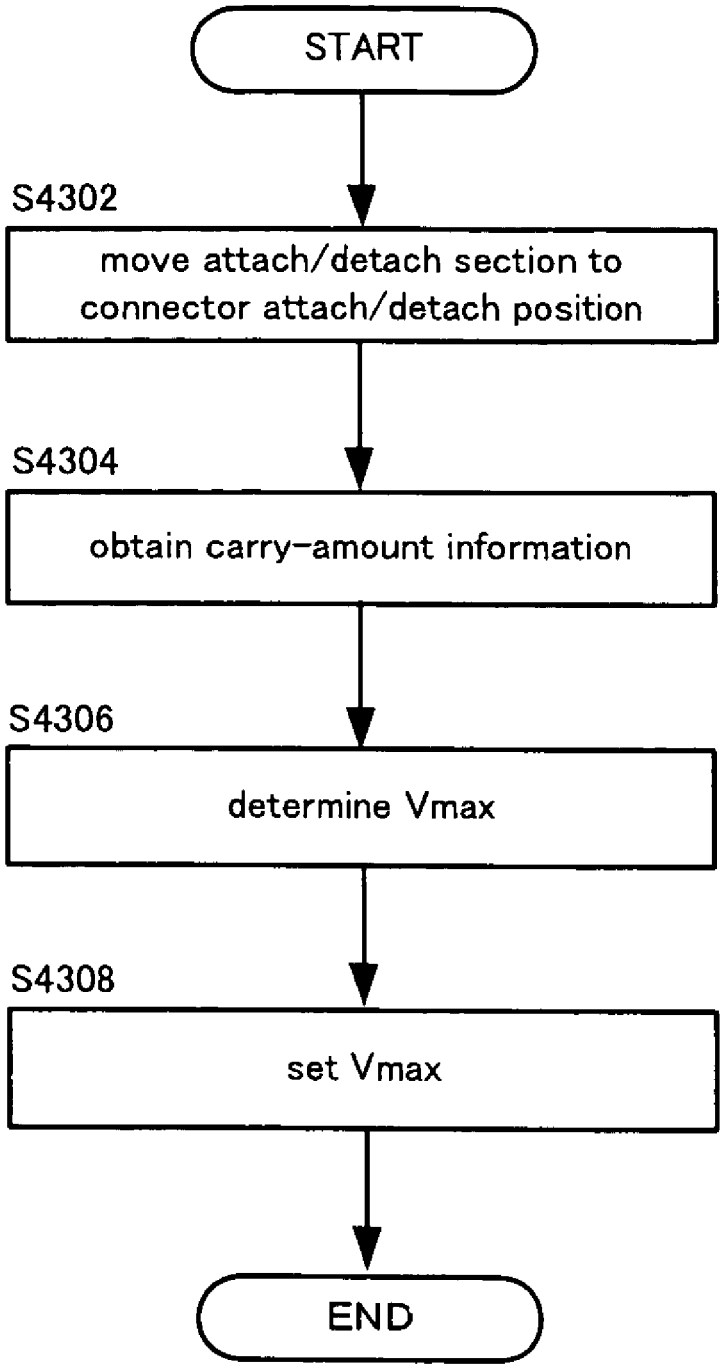
FIG. 58 is a flowchart showing a method of setting the Vmax based on carry-amount information.

The method of setting the Vmax according to the carry-amount information is described with reference to FIG. 58. FIG. 58 is a flowchart showing a method of setting the Vmax based on carry-amount information.

Setting of the Vmax is started in a state where the developing units have been attached to their respective attach/detach sections at their respective developing unit attach/detach positions (see FIG. 52C). The unit controller 4102 rotates the developing-unit holding unit 4050 to successively move the four attach/detach sections to the connector attach/detach position (see FIG. 52B) (S4302).

Next, the unit controller 4102 moves the apparatus-side connector 4034 to obtain information, such as the carry-amount information, stored in the developing-unit-side memory of a developing unit if there is a developing unit attached to the attach/detach section positioned at the connector attach/detach position (S4304). For example, if a yellow developing unit 4054 is attached to the attach/detach section 4050*d* positioned at the connector attach/detach position, then the apparatus-side connector 4034 is made to abut against the developing-unit-side connector 4054*b* and the unit controller 4102 obtains the information stored in the developing-unit-side memory 4054*a* of the yellow developing unit 4054. The unit controller 4102 reads out the carry-amount information (such as the information about the protruding amount L of the restriction blade 4560 and the surface-roughness information about the surface roughness Rz of the developing roller 4510), and then stores, for each developing unit, the information in a predetermined region of the apparatus-side memory 4122.

Next, the unit controller 4102 determines the Vmax (S4306) by referencing the carry-amount information read out from the developing-unit-side memory and stored in the apparatus-side memory 4122 and a Vmax setting table (see FIG. 59) stored, for example, in the unit-controller-side memory 4116. For example, if the carry-amount information indicates that the protruding amount L is 1.0 mm and the surface roughness Rz is 5.0 μm, then the unit controller 4102 determines the Vmax to be −1300 V. Then, the unit controller 4102 stores the Vmax determined for each developing unit in a predetermined region of the apparatus-side memory 4122. It should be noted that FIG. 59 is a diagram showing the Vmax setting table.

It should be noted that as shown in FIG. 59, in cases where the carry amount is large (that is, if the surface roughness Rz is large and/or the protruding amount L is large), the absolute value of the Vmax is small, whereas in cases where the carry amount is small (that is, if the surface roughness Rz is small and/or the protruding amount L is small), the absolute value of the Vmax is large. For example, when the surface roughness Rz is 5.5 μm and the protruding amount L is 1.1 mm, the Vmax is −1250 V, and when the surface roughness Rz is 4.5 μm and the protruding amount L is 0.9 mm, the Vmax is −1350 V.

Next, the Vmax setting section 4125*a* sets, for each developing unit, the Vmax (the DC voltage and the AC voltage) that has been determined (S4308). For example, the Vmax setting section 4125*a* sets the Vmax to −1250 V for a developing unit in which the surface roughness Rz is 5.0 μm and the protruding amount L is 1.0 mm.

(4) Method of Setting Vmin

Figure 60:
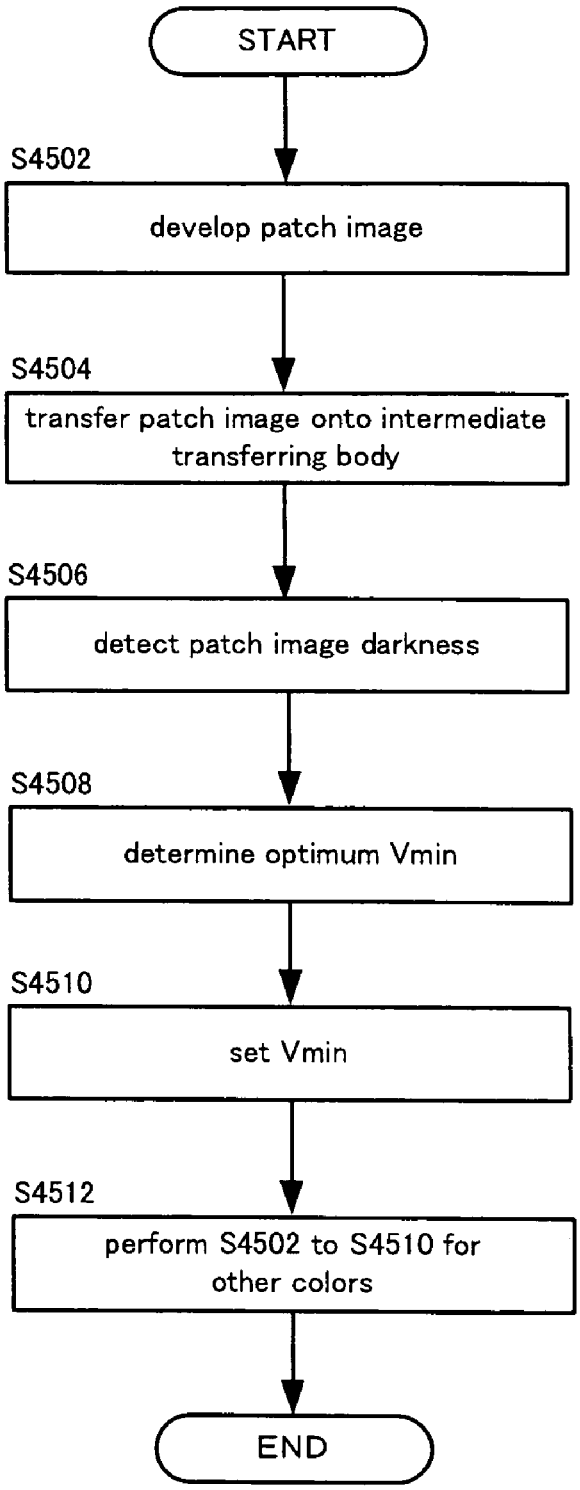
FIG. 60 is a flowchart showing a method of setting the Vmin.
Figure 61:
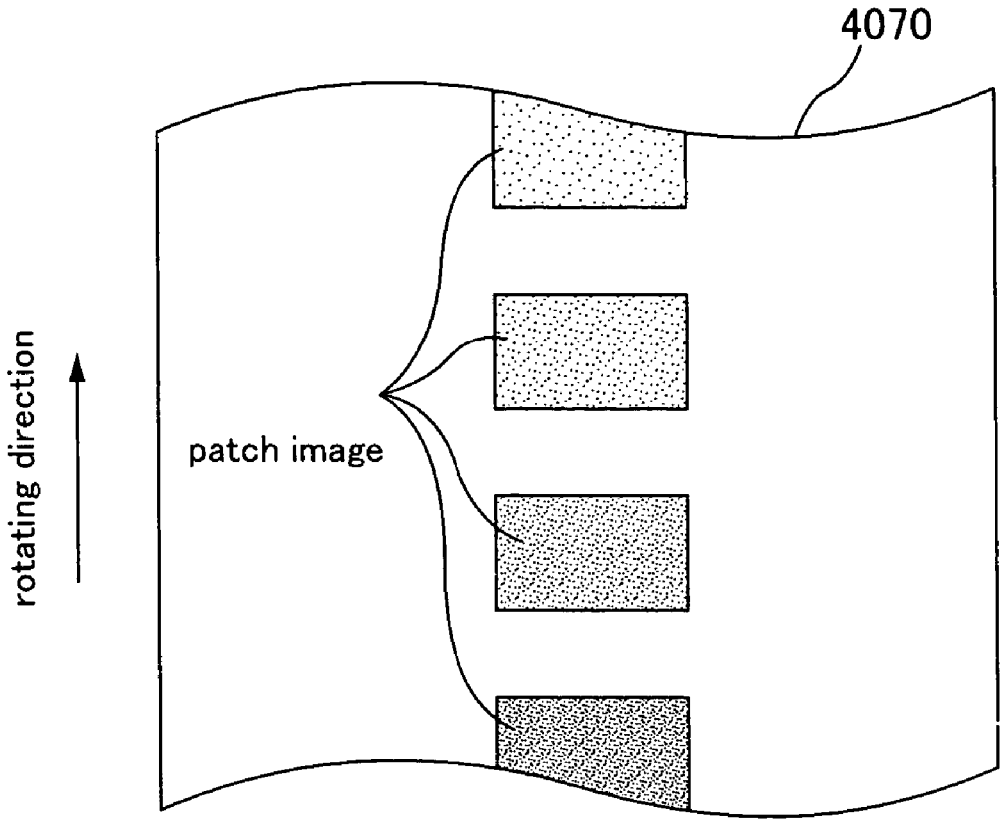
FIG. 61 is a schematic diagram showing how patch images are formed on an intermediate transferring body 4070.

As described above, the printer 4010 carries out, at a predetermined timing, a control operation for adjusting the darkness of an image (or, "Vmin setting operation"). Here, an example of the control operation is described with reference to FIG. 60 and FIG. 61. FIG. 60 is a flowchart showing a method of setting the Vmin. FIG. 61 is a schematic diagram showing how patch images are formed on the intermediate transferring body 4070. It should be noted that the various operations of the printer 4010 described below are mainly achieved by the controller section 4101 or the unit controller 4102 in the printer 4010. Particularly, in the present embodiment, they are achieved by the CPU processing a program stored in a program ROM. The program is made of codes for achieving the various operations described below.

First, the printer 4010 develops patch images (step S4502). While being rotated, the photoconductor 4020 is successively charged by the charging unit 4030 at the charging position. With the rotation of the photoconductor 4020, the charged area of the photoconductor 4020 reaches the exposing position, and patch latent images that correspond to information about patch images of the first color, for example, yellow Y, are formed in that area by the exposing unit 4040. With the rotation of the photoconductor 4020, the patch latent images formed on the photoconductor 4020 reach the developing position and are developed with yellow toner by the yellow developing unit 4054. Here, development of the patch latent images is performed while changing the Vmin of the development bias applied by the development-bias generating device 4126, that is, by changing the DC voltage and the AC voltage. In this way, patch images are formed on the photoconductor 4020.

With the rotation of the photoconductor 4020, the patch images formed on the photoconductor 4020 reach the first transferring position, and are transferred onto the intermediate transferring body 4070 by the first transferring unit 4060 (step S4504). In this way, a plurality of patch images, each having a different darkness, are formed in a line on the intermediate transferring body 4070, as shown in FIG. 61.

As each patch image on the intermediate transferring body 4070 reaches the position that is in opposition to the patch sensor PS with the rotation of the intermediate transferring body 4070, the darkness of that patch image is detected by the patch sensor PS (step S4506).

Then, when the darkness of all the patch images has been detected, the optimum Vmin, i.e., the optimum DC voltage and AC voltage, is determined based on the darkness-detection result, that is, by comparing the darkness detected for each patch image with the desired image darkness (step S4508). The Vmin that has been determined is then stored, for each developing unit, in a predetermined region of the apparatus-side memory 4122.

Next, the above-mentioned Vmin setting section 4125*b* sets the Vmin that has been determined, so that it is possible to carry out development at an optimum development bias after performing the above-mentioned control operation (step S4510).

It should be noted that the remaining toner T that forms the patch images for which darkness detection has finished is successively cleaned by a intermediate-transferring-body cleaning unit (not shown).

By successively performing, for each developing unit, the above-mentioned processes for the second, the third, and the fourth colors, the optimum Vmin is set for each color, and the control operation for adjusting the image darkness is completed (step S4512).

It should be noted that in the foregoing, a plurality of patch images each having a different darkness were formed. This, however, is not a limitation, and for example, it is also possible to form a single patch image whose darkness gradually changes.

(4) Selective Development

The reason why selective development occurs in the printer 4010 of the present fourth embodiment is the same as the reason why selective development occurs in the printer 10 described in the first embodiment using FIG. 15 and FIG. 16. Therefore, further explanation about the cause of selective development is omitted.

(4) Darkness Non-uniformities Appearing on Recording Media

Figure 62:
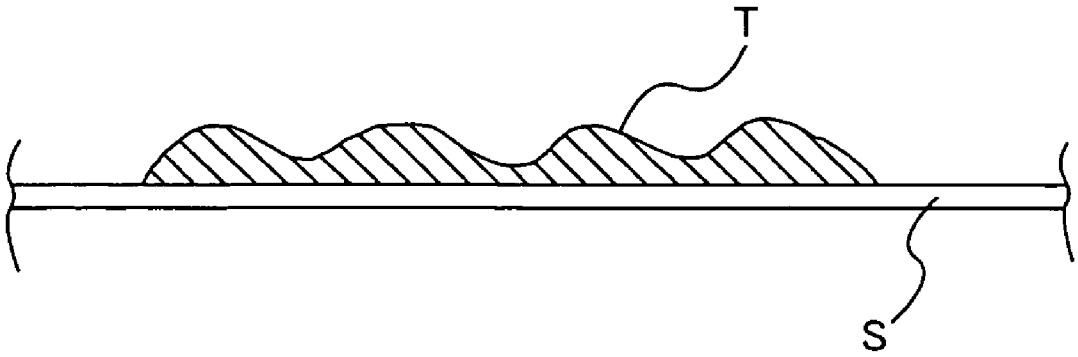
FIG. 62 is a diagram showing a state in which the toner T has adhered to a recording medium S in a non-uniform manner.
Figure 63:
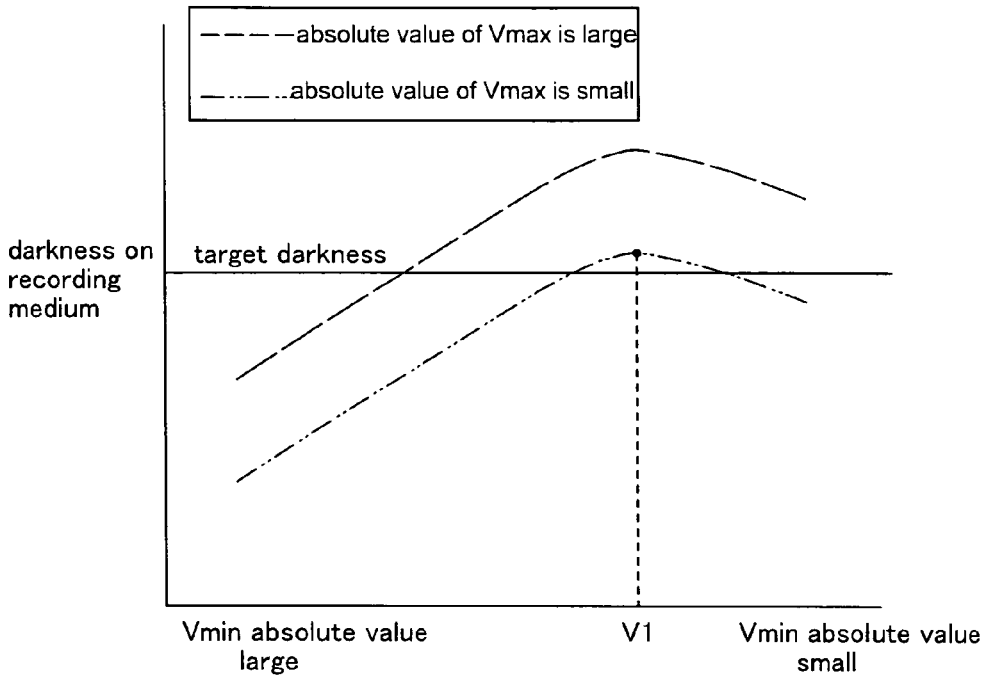
FIG. 63 is a graph showing a relationship between the intensity of the Vmin and the darkness of an image on a recording medium when the Vmax has been changed.
Figure 64:
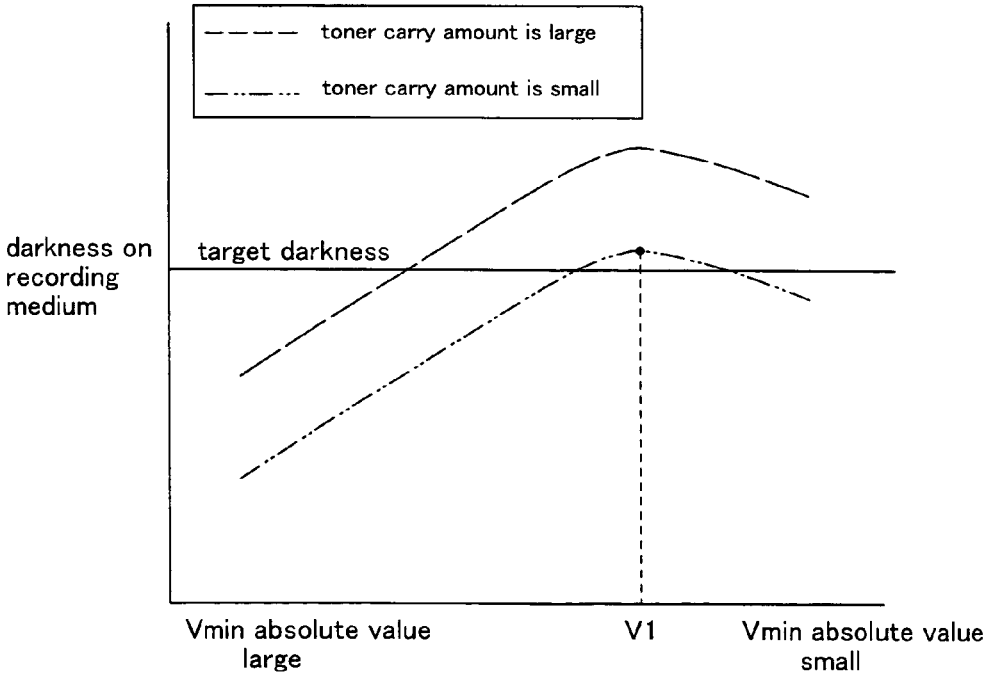
FIG. 64 is a graph showing a relationship between the intensity of the Vmin and the darkness of an image on a recording medium when the carry amount of toner T by the developing roller has been changed.

There are cases in which darkness non-uniformities appear in an image formed on a recording medium. The cause of such darkness non-uniformities in an image is described below with reference to FIG. 62 to FIG. 64. FIG. 62 is a diagram showing a state in which the toner T has adhered to the recording medium S in a non-uniform manner. FIG. 63 is a graph showing a relationship between the intensity of the Vmin and the darkness of an image on a recording medium when the Vmax has been changed. FIG. 64 is a graph showing a relationship between the intensity of the Vmin and the darkness of an image on a recording medium when the carry amount of toner T by the developing roller 4510 has been changed.

As described above, the larger the absolute value of the Vmin is, the amount of toner T that returns from the photoconductor 4020 to the developing roller 4510 increases. Therefore, when the absolute value of the Vmin is large, the amount of toner T adhering to the photoconductor 4020 is reduced, which results in a reduction in the amount of toner T making up the image to be formed on the recording medium, and thus making the image darkness low. On the other hand, when the absolute value of the Vmin is small, the image darkness tends to become high due to the reason described above. However, when the absolute value of the Vmin becomes smaller than a predetermined value (which is referred to as "darkness-reduction value"), the image darkness does not increase, but instead it gradually decreases. In cases where the Vmin is set to a value close to the darkness-reduction value ("V1" in FIG. 63) in order to achieve a desired darkness, or target darkness, darkness non-uniformities occur in the image.

The reason why darkness non-uniformities in an image occur when the Vmin is close to the darkness-reduction value is described below. As described above, since the Vmax and the Vmin are alternately applied to the developing roller 4510, the toner T oscillates between the developing roller 4510 and the photoconductor 4020. This oscillation of toner T allows the layer of toner T adhering to the photoconductor 4020 to become uniform. However, if the absolute value of the Vmin is small, it becomes difficult for the toner T to fly from the photoconductor 4020 to the developing roller 4510, and thus, the toner T will not oscillate properly, thereby resulting in the layer of toner T on the photoconductor 4020 becoming non-uniform. If an image is formed on a recording medium in such a state, the toner T will adhere to the recording medium S in a non-uniform manner as shown in FIG. 62, causing so-called darkness non-uniformities.

Incidentally, even when the intensity of the Vmin is the same, the darkness of an image on a recording medium becomes different in cases where the intensity of the Vmax is different or the carry amount of toner T by the developing roller 4510 is different. This is described in more detail.

As shown in FIG. 63, the image darkness becomes high when the absolute value of the Vmax is large. This is because, when the absolute value of the Vmax is large, the amount of toner T that flies from the developing roller 4510 toward the photoconductor 4020 increases. Therefore, in cases where the absolute value of the Vmax is large, the absolute value of the Vmin can be set to a larger value for achieving a desired darkness (target darkness), which allows darkness non-uniformities in an image to be prevented.

Further, as shown in FIG. 64, the image darkness becomes high when the carry amount of toner T by the developing roller 4510 is large. This is because, when the carry amount of toner T by the developing roller 4510 is large, the amount of toner T borne on the developing roller 4510 increases, and thus, the amount of toner T that flies from the developing roller 4510 toward the photoconductor 4020 increases. Therefore, in cases where the carry amount of toner T by the developing roller 4510 is large, the absolute value of the Vmin can be set to a larger value for achieving a desired darkness (target darkness), which allows darkness non-uniformities in an image to be prevented.

(4) Function of Development Bias According to the Present Embodiment

As described above, the Vmax setting section 4125*a* sets the Vmax based on the carry-amount information, and the Vmin setting section 4125*b* maintains the Vmax set by the Vmax setting section 4125*a* but changes the Vmin to adjust the darkness of an image to be formed on a recording medium. In this way, it becomes possible to prevent darkness non-uniformities in an image, as well as prevent an increase in fogging or scattering of toner T. This is described in detail below.

In consideration of preventing the so-called "selective development", it is effective to adjust the darkness of an image by fixing the absolute value of the Vmax at a large value and changing only the Vmin.

However, if the darkness of an image is to be adjusted simply by changing only the Vmin, then the Vmin could take a wide variety of values; therefore, the absolute value of the Vmin may be set to a small value in order to adjust the darkness to a desired darkness (target darkness). If the intensity of the Vmin is close to the darkness-reduction value ("V1" shown in FIG. 63), then darkness non-uniformities will appear in the image. Further, if the absolute value of the fixed Vmax is too large, then the amount of toner T that flies from the developing roller 4510 toward the photoconductor 4020 will become excessive, which may give rise to an increase in fogging in non-image sections of the photoconductor 4020 or scattering of toner T between the developing roller 4510 and the photoconductor 4020.

In view of the above, in the present embodiment, the Vmax setting section 4125*a* sets the Vmax in accordance with the carry amount of toner T by the developing roller 4510. This is described in more detail.

When the carry amount of toner T by the developing roller 4510 is large, the Vmax setting section 4125*a* sets the absolute value of the Vmax to a small value. It is preferable to set the absolute value of the Vmax to a small value because when the carry amount is large, fogging and scattering of toner T tend to increase. On the other hand, since the carry amount is large, darkness non-uniformities in the image is less likely to occur, even when the absolute value of the Vmax is made small. Therefore, by setting the absolute value of the Vmax to a small value when the carry amount of toner T by the developing roller 4510 is large, it becomes possible to prevent an increase in fogging and scattering of toner T while suppressing the occurrence of darkness non-uniformities in an image.

On the other hand, when the carry amount of toner T by the developing roller 4510 is small, the Vmax setting section 4125*a* sets the absolute value of the Vmax to a large value. It is preferable to set the absolute value of the Vmax to a large value because when the carry amount is small, darkness non-uniformities are likely to occur. On the other hand, since the carry amount is small, fogging and scattering of toner T are less likely to increase, even when the absolute value of the Vmax is made large. Therefore, by setting the absolute value of the Vmax to a large value when the carry amount of toner T by the developing roller 4510 is small, it becomes possible to prevent the occurrence of darkness non-uniformities in an image while preventing an increase in fogging and scattering of toner T.

As described above, by setting the Vmax with the Vmax setting section 4125*a* based on the carry-amount information about the carry amount of toner T by the developing roller 4510, it becomes possible to prevent darkness non-uniformities in an image, as well as prevent an increase in fogging or scattering of toner T, because an appropriate Vmax will be set in accordance with the carry amount when adjusting the darkness of an image.

(4) Other Considerations

An image forming apparatus according to the present fourth embodiment is a printer 4010 (image forming apparatus) comprising: a photoconductor 4020 (image bearing body); a developing roller 4510 (developer bearing body); a transferring section (first transferring unit 4060, intermediate transferring body 4070, and second transferring unit 4080); a development-bias generating device 4126 (voltage applying section); a Vmax setting section 4125*a* (first voltage setting section); and a Vmin setting section 4125*b* (image darkness adjusting section).

In the foregoing embodiment, as shown in FIG. 50, the printer 4010 had a restriction blade 4560 (layer-thickness restricting member) that abuts against the developing roller 4510 and that is for restricting a thickness of a layer of the toner T borne on the developing roller 4510. Further, a carry amount after the layer thickness has been restricted by the restriction blade 4560 was used as the carry amount of the toner T by the developing roller 4510.

This, however, is not a limitation. For example, the printer 4010 does not have to be provided with the restriction blade 4560.

However, in cases where the printer 4010 is provided with a restriction blade 4560, the toner T is used for development of the latent image after the thickness of the layer of toner T borne on the developing roller 4510 has been restricted to a predetermined level. Therefore, it would be effective to use a carry amount of toner T by the developing roller 4510 obtained after the layer thickness has been restricted by the restriction blade 4560 (referred to also as "post-restriction carry amount" below), as the carry amount of toner T by the developing roller 4510. By setting the Vmax with the Vmax setting section 4125*a* according to carry-amount information about the post-restriction carry amount, it becomes possible to effectively prevent darkness non-uniformities in an image and also effectively prevent an increase in fogging or scattering of toner T. The foregoing embodiment is therefore more preferable.

In the foregoing embodiment, as shown in FIG. 51, the restriction blade 4560 was arranged such that a tip end E of the restriction blade 4560 on a side where the restriction blade 4560 abuts against the developing roller 4510 faces toward an upstream side of a rotating direction of the developing roller 4510 with respect to an abutting position C where the restriction blade 4560 abuts against the developing roller 4510 (that is, the restriction blade 4560 abutted against the developing roller 4510 with its central section). Further, as shown in FIG. 59, distance information (information on protruding amount L) about the distance L (protruding amount L) from the tip end E to the abutting position C and surface-roughness information about the surface roughness Rz of the developing roller 4510, were used as the carry-amount information.

This, however, is not a limitation. For example, the carry-amount information may be either one of the information on the protruding amount L and the surface-roughness information. When protrusion amount L changes, the amount of toner T that can be borne on the developing roller 4510 also changes, and therefore, the carry amount of toner T by the developing roller 4510 also changes. By adopting the information on the protruding amount L as the carry-amount information, it becomes possible to get hold of the carry amount of toner T by the developing roller 4510 appropriately and in a simple manner. On the other hand, when the surface roughness Rz of the developing roller 4510 changes, the carry amount of toner T by the developing roller 4510 also changes. By adopting the surface-roughness information as the carry-amount information, it becomes possible to get hold of the carry amount of toner T by the developing roller 4510 appropriately and in a simple manner.

Further, an actual carry amount of toner T by the developing roller 4510 may be used as the carry-amount information. The actual carry amount can be calculated by: transferring the toner T borne on the developing roller 4510 onto an adhesive tape etc., and calculating the carry amount from the weight of the transferred toner T. Instead, the thickness of the layer of toner T borne on the developing roller 4510 may be measured using a laser measurement device etc., and the carry amount may be calculated from the thickness that has been measured.

Further, the restriction blade 4560 may abut against the developing roller 4510 at its edge.

In the foregoing embodiment, as shown in FIG. 48 and FIG. 50, the printer 4010 had a developing unit 4051, 4052, 4053, 4054 (developing device) that is attachable to and detachable from the body 4010*a* of the printer (body of image forming apparatus), that is provided with the developing roller 4510, and that is for containing the toner T to be borne by the developing roller 4510. Further, the developing unit 4051, 4052, 4053, 4054 was provided with a developing-unit-side memory 4051*a*, 4052*a*, 4053*a*, 4054*a* (developing-device storage section) in which the carry-amount information about the carry amount of toner T contained in the developing unit (information on the protrusion amount L and surface-roughness information) is stored. Further, the Vmax setting section 4125*a* set the Vmax based on the carry-amount information that has been read out from the developing-unit-side memory 4051*a*, 4052*a*, 4053*a*, 4054*a*.

This, however, is not a limitation. For example, the developing-unit-side memories 4051*a*, 4052*a*, 4053*a*, and 4054*a* do not have to be provided on the developing units 4051, 4052, 4053, and 4054, and a user etc. may input the carry-amount information to the printer 4010.

In the foregoing embodiment, as shown in FIG. 48, the transferring section included an intermediate transferring body 4070 (transferring medium member) through which the toner image (developer image) formed on the photoconductor 4020 is transferred onto the recording medium (medium). Further, the transferring section transferred the toner image formed on the photoconductor 4020 onto the intermediate transferring body 4070, and transferred the toner image transferred on the intermediate transferring body 4070 onto the recording medium, to form the image. Further, as shown in FIG. 48, the printer 4010 had a patch sensor PS (darkness detection member) that detects a darkness of a patch image (test pattern) formed on the intermediate transferring body 4070 for adjustment of the darkness of the image to be formed on the recording medium. Further, the Vmin setting section 4125*b* changed the Vmin based on a result of detection of the darkness of the patch image by the patch sensor PS.

This, however, is not a limitation. For example, the patch sensor PS may detect the darkness of patch images formed on the photoconductor 4020.

In the foregoing embodiment, the developing roller 4510 was made of metal. This, however, is not a limitation. For example, the developing roller 4510 may be non-metal.

However, in cases where the developing roller 4510 is made of metal, the image force between the toner T and the developing roller 4510 is stronger compared to when the developing roller 4510 is non-metal. Therefore, it is likely that the absolute value of the Vmax will be set to a large value from the viewpoint of preventing selective development. As a result, fogging and scattering of toner T tend to increase. Therefore, the effect that it is possible to prevent an increase in fogging and scattering of toner T, is attained more effectively in cases where the developing roller 4510 is made of metal. The foregoing embodiment is therefore more preferable.

In the foregoing embodiment, the toner T was manufactured using a grinding method. This, however, is not a limitation. For example, the toner may be manufactured according to a polymerizing method.

However, in cases where the toner is made through the grinding method, the charge distribution of the toner becomes wider compared to when the toner is manufactured through the polymerizing method. Therefore, it is likely that the Vmax will be set to a large value from the viewpoint of preventing selective development. As a result, fogging and scattering of toner T tend to increase. Therefore, the effect that it is possible to prevent an increase in fogging and scattering of toner T, is attained more effectively in cases where the toner T is made through the grinding method. The foregoing embodiment is therefore more preferable.

OTHER EMBODIMENTS

In the foregoing, an image forming apparatus etc. according to the present invention was described according to the above-described embodiments thereof. However, the foregoing embodiments of the invention are for the purpose of facilitating understanding of the present invention and are not to be interpreted as limiting the present invention. The present invention can be altered and improved without departing from the gist thereof, and needless to say, the present invention includes its equivalents.

In the foregoing embodiments, an intermediate-transferring-type full-color laser-beam printer was described as an example of an image forming apparatus. The present invention, however, is applicable to various types of image forming apparatuses such as full-color laser-beam printers of types other than the intermediate-transferring type, monochrome laser-beam printers, copying machines, and facsimile machines.

In the foregoing embodiments, an image forming apparatus provided with a rotary-type developing device (developing unit) was described as an example. This, however, is not a limitation, and the present invention is applicable to, for example, image forming apparatuses provided with tandem-type developing devices.

In the foregoing embodiments, the photoconductor, which is the image bearing body, was explained as having a structure in which a photoconductive layer is provided on the outer circumferential surface of a cylindrical, conductive base. This, however, is not a limitation, and the photoconductor can be, for example, a so-called photoconductive belt structured by providing a photoconductive layer on a surface of a belt-like conductive base.

CONFIGURATION OF THE IMAGE FORMING SYSTEM ETC.

Next, an embodiment of an image forming system, which serve as an example of an embodiment of the present invention, is described with reference to the drawings.

Figure 65:
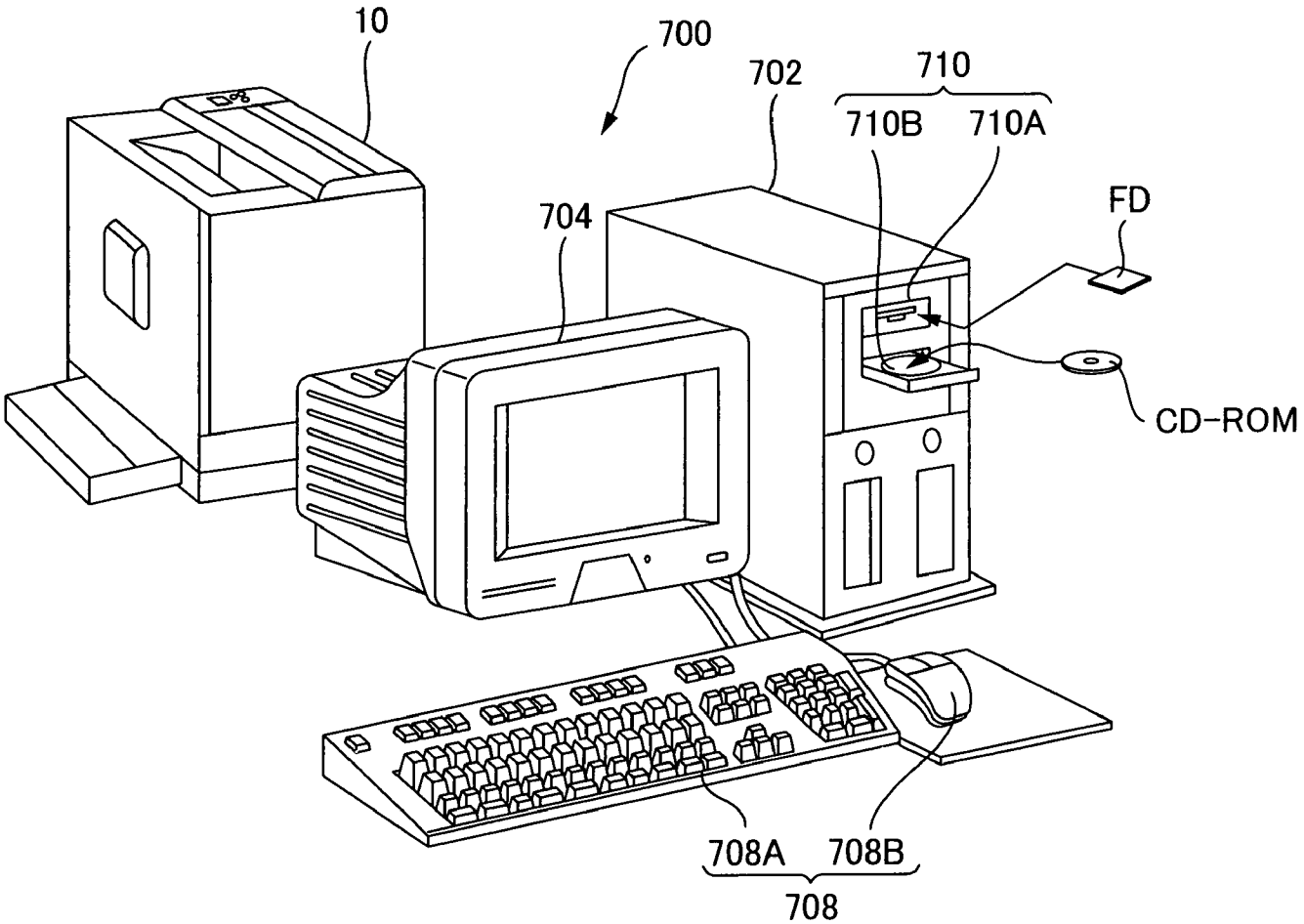
FIG. 65 is an explanatory drawing showing an external structure of an image forming system.

FIG. 65 is an explanatory drawing showing an external structure of an image forming system. The image forming system 1000 comprises a computer 702, a display device 704, a printer 10, an input device 708, and a reading device 710.

In this embodiment, the computer 702 is accommodated in a mini-tower type housing, but this is not a limitation. A CRT (cathode ray tube), a plasma display, or a liquid crystal display device, for example, is generally used as the display device 704, but this is not a limitation. The printer described above is used as the printer 10. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited to these, and it may also be other devices such as a MO (magneto optical) disk drive device and a DVD (digital versatile disk).

Figure 66:
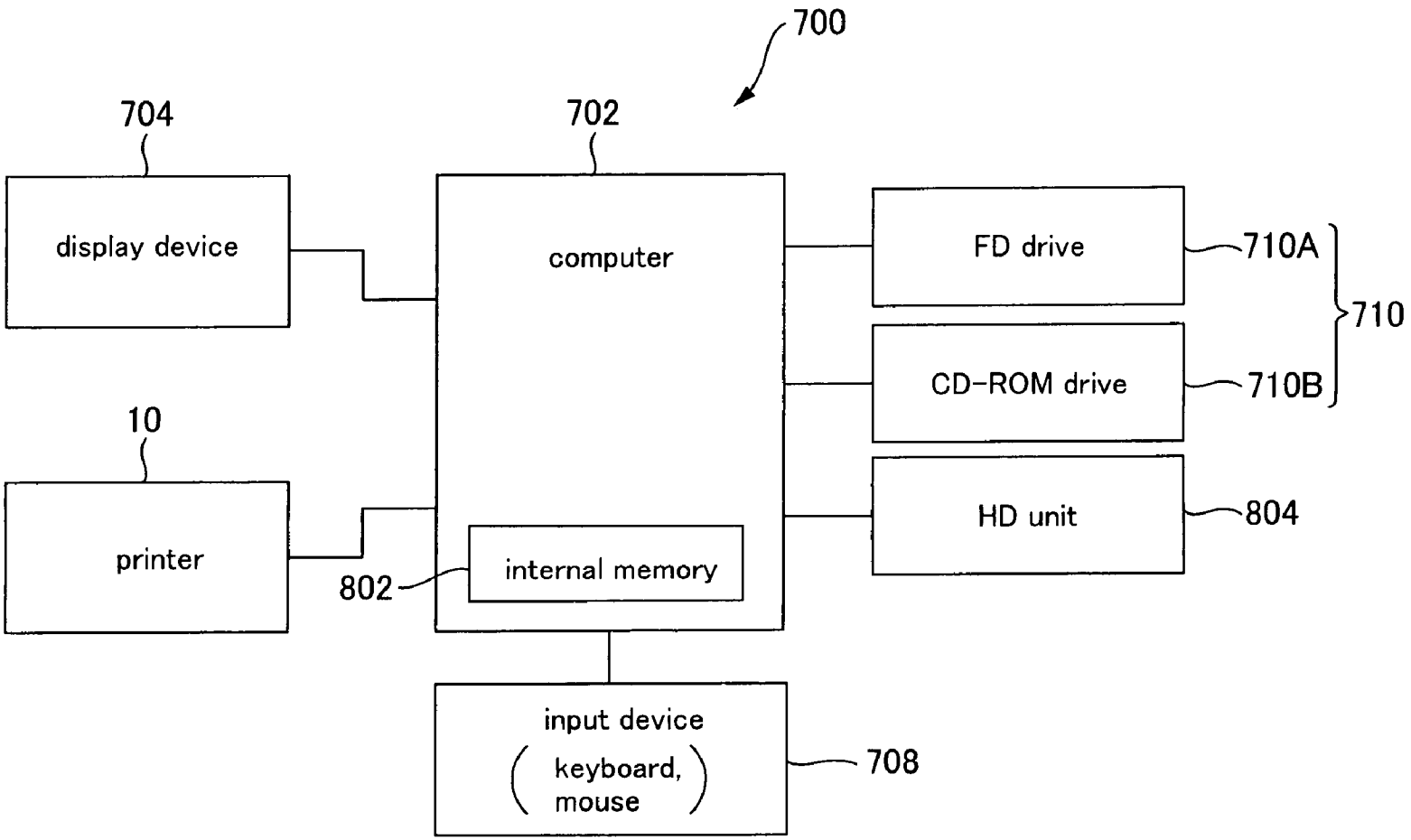
FIG. 66 is a block diagram showing a configuration of the image forming system shown in FIG. 65.

FIG. 66 is a block diagram showing a configuration of the image forming system shown in FIG. 65. Further provided are an internal memory 802, such as a RAM inside the housing accommodating the computer 702, and an external memory such as a hard disk drive unit 804.

It should be noted that in the above description, an example in which the image forming system is structured by connecting the printer 10 to the computer 702, the display device 704, the input device 708, and the reading device 710 was described, but this is not a limitation. For example, the image forming system can be made of the computer 702 and the printer 10, or the image forming system does not have to comprise any one of the display device 704, the input device 708, and the reading device 710.

Further, for example, the printer 10 can have some of the functions or mechanisms of the computer 702, the display device 704, the input device 708, and the reading device 710. As an example, the printer 10 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to conventional systems.

What is claimed is:

1. An image forming apparatus comprising:

an image bearing body for bearing a latent image;

a developer bearing body that bears a developer and that is for developing the latent image borne on said image bearing body with said developer a transferring section that transfers, onto a medium, a developer image formed on said image bearing body by the development of said latent image, to form an image;

a voltage applying section that alternately applies, to said developer bearing body, a first voltage for making the developer move from said developer bearing body toward said image bearing body in order to develop said latent image, and a second voltage for making the developer move from said image bearing body toward said developer bearing body;

an image darkness adjusting section for adjusting a darkness of the image to be formed on said medium by changing only said second voltage, among said first voltage and said second voltage;

a developing device that is provided with said developer bearing body and that is for containing the developer to be borne by said developer bearing body, and a first voltage setting section for setting said first voltage in accordance with an amount of usage of said developing device; and said image darkness adjusting section adjusts the darkness of the image to be formed on said medium by maintaining said first voltage that has been set by said first voltage setting section, and changing said second voltage.

2. An image forming apparatus according to claim 1, wherein:

said amount of usage of said developing device is a time for which said developer bearing body in said developing device has been driven.

3. An image forming apparatus according to claim 1, wherein:

said amount of usage of said developing device is a consumption amount of said developer contained in said developing device.

4. An image forming apparatus according to claim 1, wherein:

said transferring section includes a transferring medium member through which said developer image formed on said image bearing body is transferred onto said medium;

said transferring section transfers said developer image formed on said image bearing body onto said transferring medium member, and transfers said developer image transferred on said transferring medium member onto said medium, to form the image;

said image forming apparatus further comprises a darkness detection member that detects a darkness of a test pattern formed on said transferring medium member for adjustment of the darkness of the image to be formed on said medium; and said image darkness adjusting section changes said second voltage based on a result of detection of the darkness of said test pattern by said darkness detection member.

5. An image forming apparatus according to claim 1, wherein:

said developer bearing body is made of metal.

6. An image forming apparatus according to claim 1, wherein:

said developer is manufactured using a grinding method.

7. An image forming apparatus according to claim 1, wherein:

said developer borne by said developer bearing body is not in contact with said image bearing body before said voltage applying section applies said first voltage and said second voltage to said developer bearing body;

when said voltage applying section applies said first voltage to said developer bearing body, said developer borne on said developer bearing body flies toward said image bearing body and adheres thereto; and when said voltage applying section applies said second voltage to said developer bearing body, said developer adhering to said image bearing body flies toward said developer bearing body and returns thereto.

8. An image forming apparatus according to claim 1, wherein:

said developing device is provided with a developing-device storage section in which information about said amount of usage of said developing device is stored; and said first voltage setting section sets said first voltage based on said information about said amount of usage of said developing device that has been read out from said developing-device storage section.

9. An image forming apparatus comprising:

an image bearing body for bearing a latent image;

a developer bearing body that bears a developer and that is for developing the latent image borne on said image bearing body with said developer a transferring section that transfers, onto a medium, a developer image formed on said image bearing body by the development of said latent image, to form an image;

a voltage applying section that alternately applies, to said developer bearing body, a first voltage for making the developer move from said developer bearing body toward said image bearing body in order to develop said latent image, and a second voltage for making the developer move from said image bearing body toward said developer bearing body;

an image darkness adjusting section for adjusting a darkness of the image to be formed on said medium by changing only said second voltage, among said first voltage and said second voltage;

a developing device that is provided with said developer bearing body and that is for containing the developer to be borne by said developer bearing body; and a first voltage setting section for setting said first voltage in accordance with an amount of usage of said developing device;

wherein:

said image darkness adjusting section adjusts the darkness of the image to be formed on said medium by maintaining said first voltage that has been set by said first voltage setting section, and changing said second voltage;

said amount of usage of said developing device is a time for which said developer bearing body in said developing device has been driven;

said amount of usage of said developing device is a consumption amount of said developer contained in said developing device;

said transferring section includes a transferring medium member through which said developer image formed on said image bearing body is transferred onto said medium;

said transferring section transfers said developer image formed on said image bearing body onto said transferring medium member, and transfers said developer image transferred on said transferring medium member onto said medium, to form the image;

said image forming apparatus further comprises a darkness detection member that detects a darkness of a test pattern formed on said transferring medium member for adjustment of the darkness of the image to be formed on said medium;

said image darkness adjusting section changes said second voltage based on a result of detection of the darkness of said test pattern by said darkness detection member;

said developer bearing body is made of metal;

said developer is manufactured using a grinding method;

said developer borne by said developer bearing body is not in contact with said image bearing body before said voltage applying section applies said first voltage and said second voltage to said developer bearing body;

when said voltage applying section applies said first voltage to said developer bearing body, said developer borne on said developer bearing body flies toward said image bearing body and adheres thereto;

when said voltage applying section applies said second voltage to said developer bearing body, said developer adhering to said image bearing body flies toward said developer bearing body and returns thereto;

said developing device is provided with a developing-device storage section in which information about said amount of usage of said developing device is stored; and said first voltage setting section sets said first voltage based on said information about said amount of usage of said developing device that has been read out from said developing-device storage section.

10. An image forming system comprising:

a computer; and an image forming apparatus that is connectable to said computer and that includes:

an image bearing body for bearing a latent image;

a developer bearing body that bears a developer and that is for developing the latent image borne on said image bearing body with said developer;

a transferring section that transfers, onto a medium, a developer image formed on said image bearing body by the development of said latent image, to form an image;

a voltage applying section that alternately applies, to said developer bearing body, a first voltage for making the developer move from said developer bearing body toward said image bearing body in order to develop said latent image, and a second voltage for making the developer move from said image bearing body toward said developer bearing body;

an image darkness adjusting section for adjusting a darkness of the image to be formed on said medium by changing only said second voltage, among said first voltage and said second voltage;

a developing device that is provided with said developer bearing body and that is for containing the developer to be borne by said developer bearing body, and a first voltage setting section for setting said first voltage in accordance with an amount of usage of said developing device; and said image darkness adjusting section adjusts the darkness of the image to be formed on said medium by maintaining said first voltage that has been set by said first voltage setting section, and changing said second voltage.

11. An image forming method comprising the steps of:

providing a developer to be borne by a developer bearing body in a developing device;

setting a first voltage for making the developer move from the developer bearing body that bears the developer toward an image bearing body that bears a latent image in accordance with an amount of usage of the developing device;

among the first voltage for making the developer move from the developer bearing body that bears the developer toward the image bearing body that bears the latent image, and a second voltage for making the developer move from said image bearing body toward said developer bearing body, maintaining said first voltage and changing only said second voltage in order to adjust a darkness of an image to be formed on a medium;

developing said latent image by alternately applying, to said developer bearing body, said first voltage and said second voltage that has been changed; and forming an image by transferring, onto said medium, a developer image formed on said image bearing body by the development of said latent image.

* * * * *